US009842473B2

(12) United States Patent
Fujisawa

(10) Patent No.: US 9,842,473 B2
(45) Date of Patent: Dec. 12, 2017

(54) GAMING MACHINE

(71) Applicants: Universal Entertainment Corporation, Tokyo (JP); Aruze Gaming (Hong Kong) Limited, Kowloon (HK)

(72) Inventor: Masumi Fujisawa, Tokyo (JP)

(73) Assignees: UNIVERSAL ENTERTAINMENT CORPORATION, Tokyo (JP); ARUZE GAMING (HONG KONG) LIMITED, Kowloon (HK)

( * ) Notice: Subject to any disclaimer, the term of this patent is extended or adjusted under 35 U.S.C. 154(b) by 66 days.

(21) Appl. No.: 15/156,582

(22) Filed: May 17, 2016

(65) Prior Publication Data

US 2016/0343202 A1 Nov. 24, 2016

(30) Foreign Application Priority Data

May 18, 2015 (JP) ..... 2015-101231

(51) Int. Cl.
*G07F 17/34* (2006.01)
*G07F 17/32* (2006.01)

(52) U.S. Cl.
CPC ..... *G07F 17/34* (2013.01); *G07F 17/3244* (2013.01); *G07F 17/3269* (2013.01)

(58) Field of Classification Search
None
See application file for complete search history.

(56) References Cited

U.S. PATENT DOCUMENTS

2010/0304834 A1* 12/2010 Okada ..... G07F 17/32 463/20
2010/0304846 A1* 12/2010 Ogino ..... G07F 17/3223 463/25
2010/0331073 A1* 12/2010 Saito ..... G07F 17/3267 463/20
2014/0024437 A1* 1/2014 Vann ..... G07F 17/3279 463/25
2016/0275755 A1* 9/2016 Oh ..... G07F 17/3267

* cited by examiner

*Primary Examiner* — Ronald Laneau
(74) *Attorney, Agent, or Firm* — Lex IP Meister, PLLC

(57) ABSTRACT

After determining that a game state is a non-play state, it is determined whether or not a credit required for a play has been inputted within a predetermined time period. When the credit has not been inputted within the predetermined time period, a display mode in which a plurality of different bonus ranks are displayed on a middle image display panel in a first state in which a bonus or bonuses are likely to be obtained by a drawing and in a second state in which the bonus or bonuses are not obtained thereby is switched to a display mode in which all of the plurality of bonus ranks displayed in display areas are displayed in either of the first state or the second state.

4 Claims, 97 Drawing Sheets

FIG. 7

| | | SYMBOL | 1 | 2 | 3 | 4 | 5 |
|---|---|---|---|---|---|---|---|
| 501 | 505 505a | WILD | 0 | 0 | 0 | 0 | 0 |
| | 505 505b | 2xWILD | 0 | 0 | 0 | 0 | 0 |
| | 503 503a | DRAGON | 0 | 0 | 58 | 188 | 688 |
| | 503 503b | POT | 0 | 0 | 25 | 60 | 300 |
| | 503 503c | FISH | 0 | 0 | 20 | 45 | 125 |
| | 503 503d | GOURD | 0 | 0 | 15 | 30 | 100 |
| | 503 503e | BAT | 0 | 0 | 10 | 15 | 60 |
| | 502 | ACE | 0 | 0 | 5 | 10 | 25 |
| | 502 | KING | 0 | 0 | 5 | 10 | 25 |
| | 502 | QUEEN | 0 | 0 | 5 | 10 | 25 |
| | 502 | JACK | 0 | 0 | 5 | 10 | 25 |
| | 502 | TEN | 0 | 0 | 5 | 10 | 25 |
| | 502 | NINE | 0 | 0 | 5 | 10 | 25 |
| | 504 | TRIGGER | 0 | 0 | 3 | 8 | 58 |

FIG. 8

| No. | Reel 1 | Reel 2 | Reel 3 | Reel 4 | Reel 5 |
|---|---|---|---|---|---|
| 0 | ACE | TRIGGER | TRIGGER | TRIGGER | TRIGGER |
| 1 | ACE | BAT | BAT | BAT | JACK |
| 2 | ACE | BAT | QUEEN | BAT | TEN |
| 3 | TRIGGER | BAT | TRIGGER | NINE | TEN |
| 4 | BAT | TRIGGER | NINE | TRIGGER | QUEEN |
| 5 | BAT | KING | QUEEN | BAT | ACE |
| 6 | BAT | KING | QUEEN | KING | NINE |
| 7 | TRIGGER | BAT | NINE | NINE | ACE |
| 8 | ACE | KING | QUEEN | NINE | ACE |
| 9 | ACE | KING | KING | QUEEN | JACK |
| 10 | KING | TEN | NINE | NINE | ACE |
| 11 | ACE | WILD | QUEEN | NINE | ACE |
| 12 | ACE | KING | BAT | QUEEN | ACE |
| 13 | JACK | TEN | NINE | NINE | ACE |
| 14 | ACE | QUEEN | QUEEN | NINE | ACE |
| 15 | ACE | TEN | 2xWILD | QUEEN | ACE |
| 16 | ACE | KING | QUEEN | NINE | ACE |
| 17 | JACK | TRIGGER | QUEEN | NINE | ACE |
| 18 | ACE | KING | NINE | QUEEN | ACE |
| 19 | ACE | TEN | QUEEN | NINE | TEN |
| 20 | JACK | TEN | QUEEN | NINE | ACE |
| 21 | JACK | KING | NINE | QUEEN | ACE |
| 22 | ACE | TEN | QUEEN | NINE | TEN |
| 23 | ACE | TEN | QUEEN | NINE | ACE |
| 24 | JACK | KING | JACK | QUEEN | TEN |
| 25 | ACE | KING | TEN | NINE | TEN |
| 26 | ACE | TEN | QUEEN | QUEEN | JACK |
| 27 | JACK | TEN | QUEEN | NINE | ACE |
| 28 | ACE | KING | NINE | NINE | TEN |
| 29 | ACE | TEN | NINE | QUEEN | TEN |
| 30 | BAT | TEN | QUEEN | NINE | KING |
| 31 | JACK | NINE | NINE | QUEEN | ACE |
| 32 | JACK | TEN | NINE | NINE | ACE |
| 33 | ACE | KING | QUEEN | NINE | JACK |
| 34 | NINE | TEN | QUEEN | QUEEN | JACK |
| 35 | ACE | TEN | ACE | QUEEN | TEN |
| 36 | JACK | KING | NINE | WILD | JACK |
| 37 | JACK | TEN | NINE | QUEEN | JACK |
| 38 | ACE | KING | QUEEN | QUEEN | ACE |
| 39 | JACK | KING | NINE | NINE | BAT |

| No. | Reel 1 | Reel 2 | Reel 3 | Reel 4 | Reel 5 |
|---|---|---|---|---|---|
| 40 | JACK | TEN | NINE | QUEEN | JACK |
| 41 | ACE | KING | QUEEN | QUEEN | TEN |
| 42 | JACK | ACE | NINE | NINE | ACE |
| 43 | BAT | KING | NINE | JACK | TEN |
| 44 | ACE | TRIGGER | QUEEN | QUEEN | ACE |
| 45 | JACK | KING | TRIGGER | QUEEN | ACE |
| 46 | ACE | TEN | NINE | NINE | ACE |
| 47 | TRIGGER | TEN | NINE | QUEEN | TEN |
| 48 | JACK | KING | QUEEN | QUEEN | ACE |
| 49 | TEN | JACK | NINE | NINE | ACE |
| 50 | ACE | KING | NINE | QUEEN | ACE |
| 51 | ACE | KING | QUEEN | TRIGGER | BAT |
| 52 | JACK | TEN | NINE | QUEEN | ACE |
| 53 | ACE | TEN | NINE | QUEEN | ACE |
| 54 | ACE | KING | TRIGGER | NINE | BAT |
| 55 | ACE | TEN | NINE | QUEEN | TEN |
| 56 | JACK | KING | NINE | QUEEN | TEN |
| 57 | GOURD | TEN | TRIGGER | NINE | BAT |
| 58 | JACK | KING | NINE | ACE | BAT |
| 59 | ACE | TEN | NINE | TEN | BAT |
| 60 | QUEEN | GOURD | GOURD | GOURD | GOURD |
| 61 | JACK | FISH | FISH | FISH | FISH |
| 62 | ACE | POT | POT | POT | POT |
| 63 | ACE | DRAGON | DRAGON | DRAGON | DRAGON |
| 64 | FISH | KING | | | |
| 65 | POT | KING | | | |
| 66 | DRAGON | TEN | | | |
| 67 | ACE | TEN | | | |
| 68 | ACE | | | | |
| 69 | JACK | | | | |
| 70 | ACE | | | | |
| 71 | ACE | | | | |
| 72 | JACK | | | | |
| 73 | ACE | | | | |
| 74 | ACE | | | | |
| 75 | JACK | | | | |
| 76 | ACE | | | | |
| 77 | ACE | | | | |
| 78 | JACK | | | | |

FIG. 9

| No. | Reel 1 | Reel 2 | Reel 3 | Reel 4 | Reel 5 |
|---|---|---|---|---|---|
| 0 | TRIGGER | TRIGGER | TRIGGER | TRIGGER | TRIGGER |
| 1 | GOURD | GOURD | GOURD | GOURD | JACK |
| 2 | GOURD | GOURD | ACE | GOURD | GOURD |
| 3 | GOURD | GOURD | TRIGGER | ACE | TEN |
| 4 | TRIGGER | TRIGGER | NINE | TRIGGER | QUEEN |
| 5 | ACE | KING | ACE | GOURD | ACE |
| 6 | BAT | KING | GOURD | ACE | NINE |
| 7 | BAT | QUEEN | KING | JACK | ACE |
| 8 | ACE | KING | QUEEN | NINE | BAT |
| 9 | ACE | KING | KING | BAT | JACK |
| 10 | BAT | QUEEN | QUEEN | ACE | ACE |
| 11 | ACE | WILD | JACK | KING | KING |
| 12 | TEN | KING | BAT | ACE | TEN |
| 13 | BAT | JACK | KING | JACK | QUEEN |
| 14 | TEN | JACK | QUEEN | ACE | BAT |
| 15 | ACE | TEN | 2xWILD | BAT | KING |
| 16 | ACE | KING | KING | JACK | QUEEN |
| 17 | TEN | TRIGGER | TEN | NINE | BAT |
| 18 | TEN | GOURD | TEN | KING | ACE |
| 19 | BAT | JACK | NINE | QUEEN | NINE |
| 20 | TEN | KING | TEN | NINE | BAT |
| 21 | ACE | QUEEN | NINE | KING | TEN |
| 22 | BAT | QUEEN | ACE | QUEEN | QUEEN |
| 23 | ACE | BAT | QUEEN | JACK | BAT |
| 24 | NINE | BAT | JACK | QUEEN | KING |
| 25 | ACE | KING | TEN | TEN | QUEEN |
| 26 | ACE | JACK | JACK | KING | JACK |
| 27 | GOURD | JACK | BAT | JACK | TEN |
| 28 | TEN | KING | BAT | ACE | ACE |
| 29 | TEN | JACK | NINE | JACK | ACE |
| 30 | GOURD | NINE | ACE | BAT | KING |
| 31 | JACK | QUEEN | TEN | KING | QUEEN |

| No. | Reel 1 | Reel 2 | Reel 3 | Reel 4 | Reel 5 |
|---|---|---|---|---|---|
| 32 | ACE | TEN | ACE | TEN | ACE |
| 33 | TEN | KING | KING | TEN | NINE |
| 34 | TEN | NINE | KING | ACE | NINE |
| 35 | ACE | JACK | ACE | QUEEN | JACK |
| 36 | NINE | NINE | QUEEN | WILD | ACE |
| 37 | BAT | JACK | NINE | TEN | JACK |
| 38 | ACE | KING | KING | ACE | ACE |
| 39 | TEN | KING | BAT | NINE | GOURD |
| 40 | GOURD | QUEEN | ACE | KING | JACK |
| 41 | KING | KING | QUEEN | NINE | NINE |
| 42 | NINE | ACE | KING | QUEEN | NINE |
| 43 | ACE | KING | TEN | JACK | NINE |
| 44 | TEN | TRIGGER | QUEEN | TEN | JACK |
| 45 | TEN | KING | TRIGGER | NINE | QUEEN |
| 46 | BAT | KING | JACK | ACE | KING |
| 47 | BAT | KING | NINE | TEN | TEN |
| 48 | BAT | QUEEN | QUEEN | ACE | QUEEN |
| 49 | TEN | NINE | QUEEN | BAT | ACE |
| 50 | NINE | KING | BAT | NINE | JACK |
| 51 | ACE | QUEEN | BAT | TRIGGER | GOURD |
| 52 | TEN | NINE | QUEEN | KING | QUEEN |
| 53 | TEN | JACK | QUEEN | TEN | NINE |
| 54 | FISH | JACK | TRIGGER | NINE | GOURD |
| 55 | NINE | JACK | QUEEN | KING | TEN |
| 56 | ACE | QUEEN | TEN | BAT | NINE |
| 57 | QUEEN | JACK | TRIGGER | BAT | GOURD |
| 58 | JACK | JACK | JACK | BAT | GOURD |
| 59 | KING | JACK | QUEEN | NINE | GOURD |
| 60 | QUEEN | FISH | FISH | FISH | FISH |
| 61 | POT | POT | POT | POT | POT |
| 62 | DRAGON | DRAGON | DRAGON | DRAGON | DRAGON |

FIG. 10

| No. | Reel 1 | Reel 2 | Reel 3 | Reel 4 | Reel 5 |
|---|---|---|---|---|---|
| 0 | TRIGGER | TRIGGER | TRIGGER | TRIGGER | TRIGGER |
| 1 | FISH | FISH | FISH | FISH | JACK |
| 2 | FISH | FISH | ACE | FISH | FISH |
| 3 | FISH | FISH | TRIGGER | ACE | TEN |
| 4 | TRIGGER | TRIGGER | NINE | TRIGGER | QUEEN |
| 5 | ACE | BAT | ACE | FISH | ACE |
| 6 | FISH | BAT | BAT | BAT | NINE |
| 7 | GOURD | BAT | KING | JACK | ACE |
| 8 | ACE | ACE | QUEEN | NINE | GOURD |
| 9 | KING | KING | KING | GOURD | JACK |
| 10 | GOURD | QUEEN | QUEEN | ACE | ACE |
| 11 | KING | WILD | JACK | KING | KING |
| 12 | QUEEN | FISH | GOURD | ACE | TEN |
| 13 | GOURD | JACK | BAT | JACK | QUEEN |
| 14 | QUEEN | BAT | JACK | ACE | GOURD |
| 15 | ACE | BAT | 2xWILD | GOURD | KING |
| 16 | KING | ACE | KING | JACK | QUEEN |
| 17 | JACK | TRIGGER | TEN | NINE | GOURD |
| 18 | TEN | FISH | TEN | BAT | ACE |
| 19 | GOURD | JACK | NINE | QUEEN | NINE |
| 20 | TEN | KING | TEN | NINE | GOURD |
| 21 | ACE | QUEEN | NINE | KING | TEN |
| 22 | FISH | GOURD | ACE | QUEEN | QUEEN |
| 23 | QUEEN | GOURD | BAT | JACK | GOURD |
| 24 | NINE | GOURD | BAT | QUEEN | KING |
| 25 | ACE | KING | BAT | TEN | QUEEN |
| 26 | KING | JACK | JACK | KING | JACK |
| 27 | FISH | TEN | GOURD | JACK | TEN |
| 28 | JACK | ACE | GOURD | ACE | ACE |
| 29 | TEN | TEN | BAT | JACK | BAT |
| 30 | FISH | NINE | BAT | GOURD | BAT |

| No. | Reel 1 | Reel 2 | Reel 3 | Reel 4 | Reel 5 |
|---|---|---|---|---|---|
| 31 | JACK | QUEEN | TEN | KING | BAT |
| 32 | QUEEN | TEN | ACE | TEN | ACE |
| 33 | JACK | ACE | KING | TEN | NINE |
| 34 | TEN | NINE | KING | ACE | KING |
| 35 | ACE | TEN | ACE | QUEEN | BAT |
| 36 | NINE | BAT | QUEEN | WILD | ACE |
| 37 | GOURD | JACK | NINE | TEN | JACK |
| 38 | ACE | ACE | KING | ACE | ACE |
| 39 | JACK | KING | GOURD | NINE | FISH |
| 40 | FISH | QUEEN | ACE | KING | JACK |
| 41 | KING | FISH | QUEEN | NINE | NINE |
| 42 | NINE | ACE | BAT | BAT | KING |
| 43 | POT | KING | TEN | BAT | KING |
| 44 | TEN | WILD | QUEEN | BAT | JACK |
| 45 | QUEEN | BAT | 2xWILD | NINE | QUEEN |
| 46 | GOURD | BAT | JACK | ACE | KING |
| 47 | GOURD | KING | NINE | TEN | BAT |
| 48 | GOURD | QUEEN | BAT | ACE | QUEEN |
| 49 | TEN | NINE | BAT | GOURD | ACE |
| 50 | NINE | KING | GOURD | NINE | JACK |
| 51 | BAT | BAT | GOURD | WILD | FISH |
| 52 | JACK | NINE | FISH | KING | QUEEN |
| 53 | TEN | JACK | FISH | TEN | NINE |
| 54 | POT | ACE | TRIGGER | BAT | FISH |
| 55 | NINE | BAT | QUEEN | KING | TEN |
| 56 | BAT | QUEEN | BAT | GOURD | NINE |
| 57 | BAT | JACK | TRIGGER | GOURD | FISH |
| 58 | BAT | TEN | JACK | GOURD | FISH |
| 59 | KING | TEN | JACK | NINE | FISH |
| 60 | QUEEN | POT | POT | POT | POT |
| 61 | DRAGON | DRAGON | DRAGON | DRAGON | DRAGON |

FIG. 11

| No. | Reel 1 | Reel 2 | Reel 3 | Reel 4 | Reel 5 |
|---|---|---|---|---|---|
| 0 | TRIGGER | TRIGGER | TRIGGER | TRIGGER | TRIGGER |
| 1 | POT | POT | POT | POT | JACK |
| 2 | POT | POT | BAT | POT | POT |
| 3 | POT | POT | TRIGGER | ACE | TEN |
| 4 | TRIGGER | TRIGGER | NINE | TRIGGER | QUEEN |
| 5 | BAT | GOURD | ACE | POT | BAT |
| 6 | POT | GOURD | GOURD | GOURD | NINE |
| 7 | FISH | GOURD | KING | JACK | ACE |
| 8 | ACE | BAT | QUEEN | NINE | FISH |
| 9 | KING | BAT | BAT | FISH | JACK |
| 10 | FISH | BAT | BAT | ACE | ACE |
| 11 | BAT | WILD | BAT | KING | BAT |
| 12 | QUEEN | POT | FISH | BAT | TEN |
| 13 | FISH | JACK | GOURD | JACK | QUEEN |
| 14 | BAT | GOURD | JACK | ACE | FISH |
| 15 | ACE | GOURD | 2xWILD | FISH | KING |
| 16 | KING | ACE | KING | JACK | QUEEN |
| 17 | BAT | TRIGGER | TEN | NINE | FISH |
| 18 | TEN | POT | BAT | GOURD | ACE |
| 19 | FISH | BAT | NINE | QUEEN | NINE |
| 20 | BAT | KING | TEN | NINE | FISH |
| 21 | ACE | QUEEN | BAT | BAT | TEN |
| 22 | GOURD | FISH | BAT | QUEEN | QUEEN |
| 23 | QUEEN | FISH | GOURD | JACK | FISH |
| 24 | BAT | FISH | GOURD | BAT | KING |
| 25 | BAT | KING | GOURD | TEN | BAT |
| 26 | BAT | JACK | JACK | KING | BAT |
| 27 | GOURD | BAT | FISH | BAT | BAT |
| 28 | JACK | ACE | FISH | ACE | ACE |
| 29 | TEN | TEN | GOURD | JACK | GOURD |
| 30 | GOURD | BAT | GOURD | FISH | GOURD |

| No. | Reel 1 | Reel 2 | Reel 3 | Reel 4 | Reel 5 |
|---|---|---|---|---|---|
| 31 | JACK | QUEEN | TEN | KING | GOURD |
| 32 | BAT | TEN | ACE | TEN | ACE |
| 33 | BAT | BAT | BAT | BAT | BAT |
| 34 | BAT | NINE | KING | ACE | KING |
| 35 | ACE | TEN | ACE | QUEEN | GOURD |
| 36 | NINE | GOURD | BAT | WILD | ACE |
| 37 | FISH | JACK | NINE | TEN | JACK |
| 38 | ACE | ACE | KING | ACE | BAT |
| 39 | JACK | BAT | FISH | BAT | POT |
| 40 | GOURD | QUEEN | ACE | KING | JACK |
| 41 | KING | POT | QUEEN | NINE | NINE |
| 42 | NINE | ACE | GOURD | GOURD | BAT |
| 43 | GOURD | KING | TEN | GOURD | KING |
| 44 | TEN | WILD | QUEEN | GOURD | JACK |
| 45 | QUEEN | GOURD | 2xWILD | NINE | BAT |
| 46 | FISH | GOURD | JACK | BAT | KING |
| 47 | FISH | KING | NINE | TEN | GOURD |
| 48 | FISH | BAT | GOURD | ACE | QUEEN |
| 49 | TEN | NINE | GOURD | FISH | ACE |
| 50 | NINE | KING | FISH | NINE | BAT |
| 51 | GOURD | GOURD | FISH | WILD | POT |
| 52 | JACK | NINE | POT | KING | QUEEN |
| 53 | TEN | BAT | POT | TEN | NINE |
| 54 | DRAGON | ACE | TRIGGER | GOURD | POT |
| 55 | NINE | GOURD | QUEEN | KING | TEN |
| 56 | GOURD | QUEEN | POT | FISH | NINE |
| 57 | GOURD | JACK | TRIGGER | FISH | POT |
| 58 | GOURD | BAT | BAT | FISH | POT |
| 59 | KING | TEN | JACK | NINE | POT |
| 60 | QUEEN | DRAGON | DRAGON | DRAGON | DRAGON |

FIG. 12

| No. | Reel 1 | Reel 2 | Reel 3 | Reel 4 | Reel 5 |
|---|---|---|---|---|---|
| 0 | TRIGGER | TRIGGER | TRIGGER | TRIGGER | TRIGGER |
| 1 | DRAGON | DRAGON | DRAGON | DRAGON | JACK |
| 2 | DRAGON | DRAGON | GOURD | DRAGON | DRAGON |
| 3 | DRAGON | DRAGON | TRIGGER | ACE | TEN |
| 4 | TRIGGER | TRIGGER | NINE | TRIGGER | QUEEN |
| 5 | GOURD | FISH | FISH | DRAGON | GOURD |
| 6 | DRAGON | FISH | BAT | FISH | NINE |
| 7 | POT | FISH | BAT | JACK | ACE |
| 8 | ACE | GOURD | BAT | NINE | POT |
| 9 | BAT | GOURD | GOURD | POT | JACK |
| 10 | POT | GOURD | GOURD | ACE | ACE |
| 11 | GOURD | WILD | GOURD | KING | GOURD |
| 12 | QUEEN | DRAGON | POT | BAT | TEN |
| 13 | POT | JACK | FISH | JACK | QUEEN |
| 14 | GOURD | FISH | BAT | GOURD | BAT |
| 15 | KING | FISH | 2xWILD | NINE | BAT |
| 16 | BAT | BAT | KING | JACK | BAT |
| 17 | GOURD | TRIGGER | GOURD | POT | NINE |
| 18 | TEN | DRAGON | BAT | NINE | POT |
| 19 | POT | GOURD | BAT | QUEEN | POT |
| 20 | GOURD | KING | TEN | FISH | POT |
| 21 | ACE | POT | GOURD | BAT | TEN |
| 22 | FISH | POT | GOURD | BAT | QUEEN |
| 23 | BAT | POT | FISH | BAT | POT |
| 24 | GOURD | BAT | FISH | ACE | KING |
| 25 | GOURD | BAT | FISH | TEN | GOURD |
| 26 | GOURD | BAT | JACK | GOURD | GOURD |
| 27 | FISH | ACE | POT | GOURD | GOURD |
| 28 | BAT | GOURD | POT | GOURD | ACE |
| 29 | BAT | QUEEN | FISH | JACK | FISH |

| No. | Reel 1 | Reel 2 | Reel 3 | Reel 4 | Reel 5 |
|---|---|---|---|---|---|
| 30 | FISH | BAT | FISH | POT | FISH |
| 31 | JACK | TEN | TEN | KING | FISH |
| 32 | GOURD | GOURD | GOURD | BAT | ACE |
| 33 | GOURD | QUEEN | KING | BAT | GOURD |
| 34 | GOURD | BAT | BAT | BAT | KING |
| 35 | QUEEN | TEN | ACE | ACE | FISH |
| 36 | POT | GOURD | GOURD | WILD | ACE |
| 37 | BAT | JACK | NINE | TEN | JACK |
| 38 | BAT | FISH | BAT | QUEEN | GOURD |
| 39 | FISH | KING | ACE | GOURD | DRAGON |
| 40 | JACK | BAT | POT | KING | JACK |
| 41 | BAT | GOURD | BAT | FISH | NINE |
| 42 | NINE | ACE | BAT | FISH | GOURD |
| 43 | GOURD | DRAGON | BAT | FISH | KING |
| 44 | TEN | WILD | QUEEN | NINE | JACK |
| 45 | BAT | FISH | FISH | GOURD | GOURD |
| 46 | POT | FISH | 2xWILD | GOURD | KING |
| 47 | POT | KING | BAT | TEN | FISH |
| 48 | POT | GOURD | JACK | ACE | QUEEN |
| 49 | TEN | NINE | FISH | POT | ACE |
| 50 | FISH | BAT | FISH | NINE | GOURD |
| 51 | NINE | FISH | POT | WILD | DRAGON |
| 52 | BAT | NINE | TRIGGER | BAT | QUEEN |
| 53 | BAT | GOURD | DRAGON | KING | NINE |
| 54 | BAT | ACE | DRAGON | FISH | DRAGON |
| 55 | QUEEN | FISH | TRIGGER | TEN | TEN |
| 56 | FISH | BAT | QUEEN | POT | NINE |
| 57 | FISH | BAT | DRAGON | POT | DRAGON |
| 58 | FISH | BAT | ACE | POT | DRAGON |
| 59 | KING | GOURD | GOURD | NINE | DRAGON |

FIG. 13

| No. | Reel 1 | Reel 2 | Reel 3 | Reel 4 | Reel 5 |
|---|---|---|---|---|---|
| 0 | DRAGON | DRAGON | DRAGON | DRAGON | DRAGON |
| 1 | POT | POT | POT | POT | POT |
| 2 | FISH | FISH | FISH | FISH | FISH |
| 3 | GOURD | BAT | GOURD | WILD | TRIGGER |
| 4 | TRIGGER | GOURD | BAT | TRIGGER | GOURD |
| 5 | BAT | WILD | FISH | BAT | BAT |
| 6 | BAT | GOURD | FISH | GOURD | DRAGON |
| 7 | BAT | GOURD | FISH | TRIGGER | DRAGON |
| 8 | BAT | GOURD | FISH | POT | DRAGON |
| 9 | BAT | GOURD | FISH | POT | DRAGON |
| 10 | BAT | TRIGGER | TRIGGER | POT | DRAGON |
| 11 | BAT | GOURD | FISH | POT | DRAGON |
| 12 | BAT | GOURD | FISH | POT | DRAGON |
| 13 | BAT | GOURD | FISH | POT | DRAGON |
| 14 | BAT | GOURD | FISH | POT | DRAGON |
| 15 | BAT | GOURD | 2xWILD | POT | DRAGON |
| 16 | BAT | GOURD | FISH | POT | DRAGON |
| 17 | BAT | GOURD | FISH | POT | DRAGON |
| 18 | BAT | GOURD | FISH | POT | DRAGON |
| 19 | BAT | GOURD | FISH | POT | DRAGON |
| 20 | BAT | GOURD | FISH | POT | DRAGON |
| 21 | BAT | GOURD | FISH | POT | DRAGON |

| No. | Reel 1 | Reel 2 | Reel 3 | Reel 4 | Reel 5 |
|---|---|---|---|---|---|
| 22 | BAT | GOURD | FISH | POT | DRAGON |
| 23 | BAT | GOURD | FISH | POT | DRAGON |
| 24 | BAT | GOURD | FISH | POT | DRAGON |
| 25 | BAT | GOURD | FISH | POT | DRAGON |
| 26 | BAT | GOURD | FISH | POT | DRAGON |
| 27 | BAT | GOURD | FISH | POT | DRAGON |
| 28 | BAT | GOURD | FISH | POT | DRAGON |
| 29 | BAT | GOURD | FISH | POT | DRAGON |
| 30 | BAT | GOURD | FISH | POT | DRAGON |
| 31 | BAT | GOURD | FISH | POT | DRAGON |
| 32 | BAT | GOURD | FISH | POT | DRAGON |
| 33 | BAT | GOURD | FISH | POT | DRAGON |
| 34 | BAT | GOURD | FISH | POT | DRAGON |
| 35 | BAT | GOURD | FISH | POT | DRAGON |
| 36 | BAT | GOURD | FISH | POT | DRAGON |
| 37 | BAT | GOURD | FISH | POT | DRAGON |
| 38 | BAT | GOURD | FISH | POT | DRAGON |
| 39 | BAT | GOURD | FISH | POT | DRAGON |
| 40 | BAT | GOURD | FISH | POT | DRAGON |
| 41 | BAT | GOURD | FISH | POT | DRAGON |
| 42 | BAT | GOURD | FISH | POT | DRAGON |
| 43 | BAT | GOURD | FISH | | |

FIG. 14

| No. | Reel 1 | Reel 2 | Reel 3 | Reel 4 | Reel 5 |
|---|---|---|---|---|---|
| 0 | DRAGON | DRAGON | DRAGON | DRAGON | DRAGON |
| 1 | POT | POT | POT | POT | POT |
| 2 | FISH | FISH | FISH | FISH | FISH |
| 3 | GOURD | BAT | GOURD | WILD | TRIGGER |
| 4 | TRIGGER | GOURD | BAT | TRIGGER | GOURD |
| 5 | GOURD | BAT | BAT | BAT | BAT |
| 6 | GOURD | BAT | BAT | GOURD | BAT |
| 7 | GOURD | BAT | BAT | TRIGGER | |
| 8 | TRIGGER | BAT | TRIGGER | GOURD | |
| 9 | BAT | BAT | BAT | GOURD | |
| 10 | GOURD | BAT | BAT | GOURD | |
| 11 | GOURD | BAT | BAT | TRIGGER | |
| 12 | GOURD | WILD | BAT | GOURD | |
| 13 | GOURD | BAT | TRIGGER | GOURD | |
| 14 | GOURD | BAT | BAT | GOURD | |
| 15 | GOURD | BAT | BAT | | |
| 16 | GOURD | BAT | BAT | | |
| 17 | GOURD | TRIGGER | BAT | | |
| 18 | GOURD | BAT | 2xWILD | | |
| 19 | GOURD | BAT | BAT | | |
| 20 | GOURD | BAT | BAT | | |
| 21 | GOURD | TRIGGER | BAT | | |
| 22 | GOURD | BAT | BAT | | |
| 23 | GOURD | BAT | TRIGGER | | |
| 24 | GOURD | BAT | BAT | | |

| No. | Reel 1 | Reel 2 | Reel 3 | Reel 4 | Reel 5 |
|---|---|---|---|---|---|
| 25 | GOURD | BAT | BAT | | |
| 26 | GOURD | BAT | BAT | | |
| 27 | GOURD | BAT | BAT | | |
| 28 | GOURD | BAT | BAT | | |
| 29 | GOURD | BAT | BAT | | |
| 30 | GOURD | FISH | BAT | | |
| 31 | GOURD | BAT | BAT | | |
| 32 | GOURD | BAT | BAT | | |
| 33 | GOURD | BAT | BAT | | |
| 34 | GOURD | BAT | BAT | | |
| 35 | GOURD | BAT | BAT | | |
| 36 | GOURD | BAT | BAT | | |
| 37 | GOURD | BAT | BAT | | |
| 38 | GOURD | BAT | BAT | | |
| 39 | GOURD | BAT | BAT | | |
| 40 | GOURD | BAT | BAT | | |
| 41 | GOURD | BAT | BAT | | |
| 42 | GOURD | BAT | BAT | | |
| 43 | GOURD | BAT | BAT | | |
| 44 | GOURD | BAT | BAT | | |
| 45 | GOURD | BAT | BAT | | |
| 46 | GOURD | BAT | BAT | | |
| 47 | GOURD | BAT | BAT | | |
| 48 | GOURD | BAT | BAT | | |
| 49 | GOURD | BAT | | | |

FIG. 15

| No. | Reel 1 | Reel 2 | Reel 3 | Reel 4 | Reel 5 |
|---|---|---|---|---|---|
| 0 | DRAGON | DRAGON | DRAGON | DRAGON | DRAGON |
| 1 | POT | POT | POT | POT | POT |
| 2 | FISH | GOURD | FISH | GOURD | BAT |
| 3 | BAT | BAT | FISH | FISH | GOURD |
| 4 | BAT | FISH | GOURD | BAT | BAT |
| 5 | TRIGGER | GOURD | FISH | GOURD | BAT |
| 6 | BAT | GOURD | GOURD | GOURD | GOURD |
| 7 | BAT | GOURD | FISH | BAT | FISH |
| 8 | BAT | GOURD | GOURD | BAT | FISH |
| 9 | BAT | GOURD | BAT | BAT | FISH |
| 10 | BAT | GOURD | FISH | FISH | GOURD |
| 11 | BAT | BAT | TRIGGER | GOURD | GOURD |
| 12 | BAT | GOURD | BAT | GOURD | FISH |
| 13 | BAT | WILD | BAT | FISH | GOURD |
| 14 | BAT | GOURD | BAT | BAT | GOURD |
| 15 | BAT | GOURD | FISH | POT | BAT |
| 16 | BAT | GOURD | TRIGGER | FISH | BAT |
| 17 | BAT | GOURD | BAT | BAT | FISH |
| 18 | BAT | TRIGGER | BAT | FISH | BAT |
| 19 | FISH | FISH | 2xWILD | FISH | GOURD |
| 20 | FISH | FISH | BAT | FISH | FISH |
| 21 | FISH | FISH | GOURD | BAT | FISH |
| 22 | BAT | TRIGGER | GOURD | BAT | GOURD |
| 23 | BAT | GOURD | GOURD | WILD | BAT |
| 24 | BAT | GOURD | GOURD | BAT | BAT |
| 25 | BAT | GOURD | GOURD | TRIGGER | GOURD |

| No. | Reel 1 | Reel 2 | Reel 3 | Reel 4 | Reel 5 |
|---|---|---|---|---|---|
| 26 | BAT | GOURD | GOURD | POT | FISH |
| 27 | BAT | GOURD | FISH | FISH | FISH |
| 28 | TRIGGER | GOURD | FISH | TRIGGER | GOURD |
| 29 | BAT | GOURD | TRIGGER | BAT | BAT |
| 30 | BAT | GOURD | FISH | FISH | FISH |
| 31 | BAT | POT | FISH | FISH | FISH |
| 32 | POT | GOURD | FISH | FISH | TRIGGER |
| 33 | BAT | GOURD | FISH | BAT | BAT |
| 34 | BAT | GOURD | FISH | TRIGGER | BAT |
| 35 | GOURD | BAT | POT | GOURD | BAT |
| 36 | GOURD | GOURD | FISH | GOURD | GOURD |
| 37 | GOURD | GOURD | FISH | GOURD | BAT |
| 38 | BAT | GOURD | FISH | FISH | GOURD |
| 39 | BAT | GOURD | FISH | FISH | FISH |
| 40 | BAT | GOURD | FISH | FISH | BAT |
| 41 | BAT | GOURD | FISH | BAT | GOURD |
| 42 | BAT | GOURD | FISH | BAT | BAT |
| 43 | BAT | GOURD | FISH | BAT | |
| 44 | BAT | GOURD | FISH | BAT | |
| 45 | BAT | GOURD | FISH | BAT | |
| 46 | BAT | GOURD | FISH | BAT | |
| 47 | BAT | GOURD | FISH | BAT | |
| 48 | BAT | GOURD | FISH | BAT | |
| 49 | BAT | GOURD | FISH | BAT | |
| 50 | BAT | GOURD | FISH | BAT | |

FIG. 16

| No. | Reel 1 | Reel 2 | Reel 3 | Reel 4 | Reel 5 |
|---|---|---|---|---|---|
| 0 | DRAGON | DRAGON | DRAGON | DRAGON | DRAGON |
| 1 | BAT | BAT | BAT | FISH | BAT |
| 2 | FISH | FISH | GOURD | POT | GOURD |
| 3 | BAT | GOURD | GOURD | GOURD | FISH |
| 4 | POT | BAT | FISH | FISH | BAT |
| 5 | GOURD | POT | BAT | FISH | GOURD |
| 6 | TRIGGER | GOURD | BAT | GOURD | BAT |
| 7 | POT | BAT | GOURD | GOURD | GOURD |
| 8 | BAT | FISH | FISH | GOURD | FISH |
| 9 | BAT | POT | BAT | BAT | POT |
| 10 | FISH | GOURD | POT | POT | POT |
| 11 | GOURD | BAT | FISH | FISH | POT |
| 12 | GOURD | GOURD | GOURD | FISH | FISH |
| 13 | GOURD | FISH | BAT | POT | BAT |
| 14 | GOURD | BAT | BAT | GOURD | BAT |
| 15 | GOURD | GOURD | POT | DRAGON | BAT |
| 16 | GOURD | POT | TRIGGER | BAT | FISH |
| 17 | GOURD | BAT | GOURD | POT | POT |
| 18 | GOURD | WILD | GOURD | BAT | BAT |
| 19 | GOURD | BAT | GOURD | GOURD | FISH |
| 20 | BAT | GOURD | BAT | POT | FISH |
| 21 | BAT | GOURD | POT | POT | GOURD |
| 22 | FISH | GOURD | TRIGGER | POT | GOURD |
| 23 | GOURD | GOURD | BAT | GOURD | POT |
| 24 | BAT | GOURD | GOURD | BAT | GOURD |
| 25 | POT | GOURD | GOURD | GOURD | FISH |
| 26 | POT | GOURD | BAT | WILD | POT |
| 27 | POT | GOURD | 2xWILD | GOURD | BAT |
| 28 | FISH | GOURD | GOURD | BAT | POT |
| 29 | BAT | TRIGGER | BAT | BAT | FISH |
| 30 | GOURD | POT | FISH | TRIGGER | BAT |
| 31 | FISH | POT | FISH | DRAGON | GOURD |
| 32 | BAT | POT | FISH | POT | GOURD |
| 33 | BAT | TRIGGER | FISH | BAT | FISH |
| 34 | FISH | FISH | FISH | BAT | POT |
| 35 | BAT | GOURD | FISH | BAT | BAT |
| 36 | POT | BAT | POT | TRIGGER | POT |
| 37 | GOURD | POT | BAT | GOURD | FISH |
| 38 | TRIGGER | BAT | BAT | POT | BAT |
| 39 | POT | FISH | POT | POT | GOURD |
| 40 | GOURD | BAT | TRIGGER | POT | POT |
| 41 | BAT | FISH | FISH | GOURD | BAT |
| 42 | BAT | GOURD | POT | BAT | POT |
| 43 | BAT | BAT | POT | TRIGGER | TRIGGER |
| 44 | POT | FISH | BAT | FISH | GOURD |
| 45 | BAT | TRIGGER | TRIGGER | FISH | GOURD |
| 46 | DRAGON | BAT | FISH | FISH | GOURD |
| 47 | GOURD | DRAGON | DRAGON | POT | FISH |
| 48 | BAT | BAT | BAT | POT | BAT |
| 49 | BAT | BAT | BAT | POT | GOURD |
| 50 | POT | GOURD | BAT | | FISH |
| 51 | BAT | FISH | POT | | POT |
| 52 | FISH | BAT | BAT | | BAT |
| 53 | FISH | BAT | BAT | | GOURD |
| 54 | FISH | BAT | TRIGGER | | FISH |
| 55 | BAT | TRIGGER | FISH | | GOURD |
| 56 | GOURD | FISH | BAT | | |
| 57 | POT | FISH | FISH | | |
| 58 | BAT | FISH | FISH | | |
| 59 | | FISH | BAT | | |
| 60 | | FISH | FISH | | |
| 61 | | | FISH | | |
| 62 | | | BAT | | |
| 63 | | | FISH | | |
| 64 | | | FISH | | |
| 65 | | | BAT | | |
| 66 | | | FISH | | |

FIG. 17

| No. | Reel 1 | Reel 2 | Reel 3 | Reel 4 | Reel 5 |
|---|---|---|---|---|---|
| 0 | GOURD | GOURD | BAT | POT | BAT |
| 1 | BAT | POT | BAT | BAT | GOURD |
| 2 | POT | FISH | GOURD | DRAGON | FISH |
| 3 | GOURD | GOURD | FISH | FISH | POT |
| 4 | DRAGON | DRAGON | FISH | BAT | GOURD |
| 5 | FISH | FISH | POT | POT | FISH |
| 6 | TRIGGER | GOURD | GOURD | POT | BAT |
| 7 | DRAGON | POT | GOURD | BAT | GOURD |
| 8 | GOURD | DRAGON | FISH | FISH | DRAGON |
| 9 | GOURD | FISH | POT | FISH | FISH |
| 10 | POT | BAT | GOURD | FISH | POT |
| 11 | FISH | GOURD | DRAGON | GOURD | DRAGON |
| 12 | FISH | FISH | POT | DRAGON | DRAGON |
| 13 | FISH | POT | FISH | POT | BAT |
| 14 | GOURD | GOURD | GOURD | POT | POT |
| 15 | GOURD | FISH | GOURD | DRAGON | GOURD |
| 16 | POT | DRAGON | DRAGON | FISH | GOURD |
| 17 | FISH | GOURD | TRIGGER | BAT | GOURD |
| 18 | GOURD | BAT | FISH | BAT | POT |
| 19 | DRAGON | WILD | FISH | BAT | DRAGON |
| 20 | DRAGON | FISH | FISH | POT | GOURD |
| 21 | DRAGON | FISH | GOURD | GOURD | BAT |
| 22 | POT | FISH | DRAGON | DRAGON | POT |
| 23 | GOURD | GOURD | TRIGGER | GOURD | POT |
| 24 | FISH | TRIGGER | BAT | FISH | BAT |
| 25 | POT | DRAGON | GOURD | DRAGON | BAT |
| 26 | GOURD | DRAGON | FISH | BAT | BAT |
| 27 | GOURD | DRAGON | FISH | BAT | FISH |
| 28 | BAT | TRIGGER | GOURD | BAT | FISH |
| 29 | POT | POT | BAT | DRAGON | DRAGON |
| 30 | GOURD | FISH | 2xWILD | DRAGON | FISH |
| 31 | DRAGON | GOURD | FISH | FISH | POT |
| 32 | FISH | DRAGON | GOURD | GOURD | DRAGON |
| 33 | TRIGGER | BAT | POT | FISH | BAT |
| 34 | DRAGON | GOURD | POT | WILD | GOURD |

| No. | Reel 1 | Reel 2 | Reel 3 | Reel 4 | Reel 5 |
|---|---|---|---|---|---|
| 35 | FISH | POT | DRAGON | GOURD | DRAGON |
| 36 | GOURD | BAT | GOURD | GOURD | POT |
| 37 | GOURD | BAT | BAT | FISH | GOURD |
| 38 | GOURD | BAT | GOURD | TRIGGER | FISH |
| 39 | DRAGON | GOURD | DRAGON | POT | FISH |
| 40 | BAT | POT | TRIGGER | DRAGON | POT |
| 41 | GOURD | FISH | POT | BAT | DRAGON |
| 42 | DRAGON | GOURD | DRAGON | GOURD | BAT |
| 43 | FISH | POT | DRAGON | GOURD | GOURD |
| 44 | GOURD | TRIGGER | GOURD | GOURD | DRAGON |
| 45 | GOURD | GOURD | TRIGGER | DRAGON | POT |
| 46 | DRAGON | DRAGON | POT | TRIGGER | GOURD |
| 47 | BAT | WILD | DRAGON | FISH | FISH |
| 48 | BAT | GOURD | GOURD | DRAGON | DRAGON |
| 49 | BAT | GOURD | GOURD | DRAGON | BAT |
| 50 | GOURD | FISH | GOURD | FISH | GOURD |
| 51 | POT | POT | BAT | GOURD | DRAGON |
| 52 | POT | GOURD | BAT | WILD | TRIGGER |
| 53 | POT | GOURD | DRAGON | POT | FISH |
| 54 | GOURD | GOURD | 2xWILD | POT | FISH |
| 55 | FISH | DRAGON | DRAGON | POT | FISH |
| 56 | POT | POT | GOURD | GOURD | BAT |
| 57 | GOURD | POT | BAT | DRAGON | POT |
| 58 | | POT | DRAGON | BAT | GOURD |
| 59 | | DRAGON | GOURD | GOURD | FISH |
| 60 | | | | | POT |
| 61 | | | | | DRAGON |
| 62 | | | | | GOURD |
| 63 | | | | | FISH |
| 64 | | | | | POT |
| 65 | | | | | BAT |
| 66 | | | | | FISH |
| 67 | | | | | GOURD |
| 68 | | | | | DRAGON |

FIG. 18

| | SYMBOL | Reel 1 | Reel 2 | Reel 3 | Reel 4 | Reel 5 | TOTAL | PERCENTAGE |
|---|---|---|---|---|---|---|---|---|
| SBB1 | DRAGON | 1 | 1 | 1 | 1 | 1 | 5 | 1.5% |
| | POT | 1 | 1 | 1 | 1 | 1 | 5 | 1.5% |
| | FISH | 1 | 1 | 1 | 1 | 1 | 5 | 1.5% |
| | GOURD | 1 | 1 | 1 | 1 | 1 | 5 | 1.5% |
| | BAT | 5 | 4 | 2 | 3 | 6 | 20 | 5.9% |
| | TOTAL NUMBER OF SYMBOLS | 79 | 68 | 64 | 64 | 64 | 339 | |
| SBB5 | DRAGON | 1 | 1 | 1 | 1 | 1 | 5 | 1.6% |
| | POT | 1 | 1 | 1 | 1 | 1 | 5 | 1.6% |
| | FISH | 1 | 1 | 1 | 1 | 1 | 5 | 1.6% |
| | GOURD | 6 | 4 | 2 | 3 | 7 | 22 | 7.0% |
| | BAT | 10 | 2 | 6 | 7 | 5 | 30 | 9.5% |
| | TOTAL NUMBER OF SYMBOLS | 63 | 63 | 63 | 63 | 63 | 315 | |
| SBB15 | DRAGON | 1 | 1 | 1 | 1 | 1 | 5 | 1.6% |
| | POT | 2 | 1 | 1 | 1 | 1 | 6 | 1.9% |
| | FISH | 8 | 6 | 3 | 3 | 7 | 27 | 8.7% |
| | GOURD | 8 | 3 | 6 | 7 | 5 | 29 | 9.4% |
| | BAT | 4 | 10 | 11 | 6 | 5 | 36 | 11.6% |
| | TOTAL NUMBER OF SYMBOLS | 62 | 62 | 62 | 62 | 62 | 310 | |
| SBB30 | DRAGON | 1 | 1 | 1 | 1 | 1 | 5 | 1.6% |
| | POT | 4 | 6 | 4 | 3 | 7 | 24 | 7.9% |
| | FISH | 8 | 3 | 6 | 7 | 5 | 29 | 9.5% |
| | GOURD | 9 | 10 | 10 | 6 | 5 | 40 | 13.1% |
| | BAT | 11 | 11 | 10 | 7 | 10 | 49 | 16.1% |
| | TOTAL NUMBER OF SYMBOLS | 61 | 61 | 61 | 61 | 61 | 305 | |
| SBB60 | DRAGON | 4 | 6 | 4 | 3 | 7 | 24 | 8.0% |
| | POT | 8 | 3 | 5 | 7 | 5 | 28 | 9.3% |
| | FISH | 8 | 10 | 10 | 6 | 5 | 39 | 13.0% |
| | GOURD | 12 | 11 | 10 | 7 | 10 | 50 | 16.7% |
| | BAT | 12 | 11 | 12 | 8 | 3 | 46 | 15.3% |
| | TOTAL NUMBER OF SYMBOLS | 60 | 60 | 60 | 60 | 60 | 300 | |

FIG. 19

| | SYMBOL | Reel 1 | Reel 2 | Reel 3 | Reel 4 | Reel 5 | TOTAL | PERCEN-TAGE |
|---|---|---|---|---|---|---|---|---|
| SBB1 | DRAGON | 1 | 1 | 1 | 1 | 38 | 42 | 19.3% |
| | POT | 1 | 1 | 1 | 36 | 1 | 40 | 18.3% |
| | FISH | 1 | 1 | 38 | 1 | 1 | 42 | 19.3% |
| | GOURD | 1 | 38 | 1 | 1 | 1 | 42 | 19.3% |
| | BAT | 39 | 1 | 1 | 1 | 1 | 43 | 19.7% |
| | TOTAL NUMBER OF SYMBOLS | 44 | 44 | 44 | 43 | 43 | 218 | |
| SBB5 | DRAGON | 1 | 1 | 1 | 1 | 1 | 5 | 3.0% |
| | POT | 1 | 1 | 1 | 1 | 1 | 5 | 3.0% |
| | FISH | 1 | 2 | 1 | 1 | 1 | 6 | 3.6% |
| | GOURD | 44 | 1 | 1 | 7 | 1 | 54 | 32.1% |
| | BAT | 1 | 42 | 41 | 1 | 2 | 87 | 51.8% |
| | TOTAL NUMBER OF SYMBOLS | 49 | 49 | 48 | 15 | 7 | 168 | |
| SBB15 | DRAGON | 1 | 1 | 1 | 1 | 1 | 5 | 2.0% |
| | POT | 2 | 2 | 2 | 3 | 1 | 10 | 4.0% |
| | FISH | 4 | 4 | 28 | 14 | 12 | 62 | 25.1% |
| | GOURD | 3 | 38 | 9 | 8 | 13 | 71 | 28.7% |
| | BAT | 39 | 3 | 7 | 21 | 15 | 85 | 34.4% |
| | TOTAL NUMBER OF SYMBOLS | 51 | 51 | 51 | 51 | 43 | 247 | |
| SBB30 | DRAGON | 2 | 2 | 2 | 3 | 1 | 10 | 3.4% |
| | POT | 10 | 7 | 8 | 14 | 12 | 51 | 17.4% |
| | FISH | 9 | 13 | 19 | 8 | 13 | 62 | 21.2% |
| | GOURD | 16 | 17 | 10 | 11 | 15 | 69 | 23.5% |
| | BAT | 20 | 17 | 22 | 10 | 14 | 83 | 28.3% |
| | TOTAL NUMBER OF SYMBOLS | 59 | 61 | 67 | 50 | 56 | 293 | |
| SBB60 | DRAGON | 2 | 2 | 2 | 3 | 1 | 10 | 3.3% |
| | POT | 10 | 7 | 8 | 14 | 12 | 51 | 16.6% |
| | FISH | 9 | 13 | 19 | 8 | 13 | 62 | 20.2% |
| | GOURD | 16 | 17 | 10 | 11 | 15 | 69 | 22.5% |
| | BAT | 20 | 17 | 22 | 10 | 14 | 83 | 27.0% |
| | TOTAL NUMBER OF SYMBOLS | 58 | 60 | 60 | 60 | 69 | 307 | |

FIG. 33

| SCENARIO | WEIGHT | FIRST PICK | SECOND PICK | THIRD PICK | FOURTH PICK | FIFTH PICK AND SUBSEQUENT PICKS |
|---|---|---|---|---|---|---|
| 1 | 1 | GRAND × 2 | GRAND | MAJOR × 2 | MAJOR | RANDOM |
| 2 | 1 | GRAND × 2 | GRAND | MAJOR | MAJOR × 2 | |
| 3 | 1 | GRAND × 2 | MAJOR × 2 | GRAND | MAJOR | |
| 4 | 1 | GRAND × 2 | MAJOR | GRAND | MAJOR × 2 | |
| 5 | 1 | GRAND × 2 | MAJOR × 2 | MAJOR | GRAND | |
| 6 | 1 | GRAND × 2 | MAJOR | MAJOR × 2 | GRAND | |
| 7 | 1 | GRAND | GRAND × 2 | MAJOR × 2 | MAJOR | |
| 8 | 1 | GRAND | GRAND × 2 | MAJOR | MAJOR × 2 | |
| 9 | 1 | GRAND | MAJOR × 2 | GRAND × 2 | MAJOR | |
| 10 | 1 | GRAND | MAJOR | GRAND × 2 | MAJOR × 2 | |
| 11 | 1 | GRAND | MAJOR × 2 | MAJOR | GRAND × 2 | |
| 12 | 1 | GRAND | MAJOR | MAJOR × 2 | GRAND × 2 | |
| 13 | 1 | MAJOR × 2 | GRAND | GRAND × 2 | MAJOR | |
| 14 | 1 | MAJOR × 2 | GRAND | MAJOR | GRAND × 2 | |
| 15 | 1 | MAJOR × 2 | GRAND × 2 | GRAND | MAJOR | |
| 16 | 1 | MAJOR × 2 | MAJOR | GRAND | GRAND × 2 | |
| 17 | 1 | MAJOR × 2 | GRAND × 2 | MAJOR | GRAND | |
| 18 | 1 | MAJOR × 2 | MAJOR | GRAND × 2 | GRAND | |
| 19 | 1 | MAJOR | MAJOR × 2 | GRAND × 2 | GRAND | |
| 20 | 1 | MAJOR | MAJOR × 2 | GRAND | GRAND × 2 | |
| 21 | 1 | MAJOR | GRAND × 2 | MAJOR × 2 | GRAND | |
| 22 | 1 | MAJOR | GRAND | MAJOR × 2 | GRAND × 2 | |
| 23 | 1 | MAJOR | GRAND × 2 | GRAND | MAJOR × 2 | |
| 24 | 1 | MAJOR | GRAND | GRAND × 2 | MAJOR × 2 | |

FIG. 39

| | V1 | V2 | V3 | V4 | V5 | V6 | V7 |
|---|---|---|---|---|---|---|---|
| SBB1 | 8257.416901 | 8257.416901 | 8257.416901 | 8257.416901 | 8213.316125 | 8191.265737 | 8169.215350 |
| SBB2 | 1752.022190 | 1752.022190 | 1752.022190 | 1752.022190 | 1740.190269 | 1734.274309 | 1728.358348 |
| SBB3 | 1087.915233 | 1087.915233 | 1087.915233 | 1087.915233 | 1085.396645 | 1084.137351 | 1082.878057 |
| SBB4 | 550.312679 | 550.312679 | 550.312679 | 550.312679 | 549.175090 | 548.606295 | 548.037500 |
| SBB5 | 291.232399 | 291.232399 | 291.232399 | 291.232399 | 290.015784 | 289.407477 | 288.799169 |

FIG. 40

| No | Level | Weight |
|---|---|---|
| 0 | GRAND BONUS | 150 |
| 1 | MAJOR BONUS | 500 |
| 2 | MINOR BONUS | 83200 |
| 3 | MINI BONUS | 999900 |
| | Total | 1083750 |

FIG. 47

| | N TIMES OF TOTAL BET | | |
|---|---|---|---|
| WIN RANK | OR MORE | LESS THAN | NUMBER OF SECONDS |
| WIN1 | | 0.1 | 0.50 |
| WIN2 | 0.1 | 0.2 | 0.60 |
| WIN3 | 0.2 | 0.3 | 0.70 |
| WIN4 | 0.3 | 0.4 | 0.90 |
| WIN5 | 0.4 | 0.5 | 0.90 |
| WIN6 | 0.5 | 0.75 | 0.50 |
| WIN7 | 0.75 | 1 | 2.00 |
| WIN8 | 1 | 1.25 | 2.50 |
| WIN9 | 1.25 | 1.5 | 2.70 |
| WIN10 | 1.5 | 2 | 3.90 |
| WIN11 | 2 | 3 | 5.60 |
| WIN12 | 3 | 4 | 6.10 |
| WIN13 | 4 | 5 | 9.90 |
| WIN14 | 5 | 6 | 9.90 |
| WIN15 | 6 | 7 | 9.90 |
| WIN16 | 7 | 8 | 11.90 |
| WIN17 | 8 | 10 | 19.60 |
| WIN18 | 10 | 12 | 19.70 |
| WIN19 | 12 | 15 | 23.80 |
| WIN20 | 15 | 20 | 30.30 |
| WIN21 | 20 | 30 | 34.60 |
| WIN22 | 30 | 40 | 43.00 |
| WIN23 | 40 | 50 | 50.00 |
| WIN24 | 50 | | 72.00 |

FIG. 58

| | Reel 1 | Reel 2 | Reel 3 | Reel 4 | Reel 5 |
|---|---|---|---|---|---|
| 0 | TRIGGER | TRIGGER | TRIGGER | TRIGGER | TRIGGER |
| 1 | PHOENIX | PHOENIX | PHOENIX | PHOENIX | PHOENIX |
| 2 | ACE | KING | QUEEN | ACE | ACE |
| 3 | ACE | KING | QUEEN | ACE | ACE |
| 4 | ACE | KING | QUEEN | ACE | ACE |
| 5 | ACE | KING | QUEEN | ACE | ACE |
| 6 | ACE | KING | QUEEN | ACE | ACE |
| 7 | ACE | KING | QUEEN | ACE | ACE |
| 8 | ACE | KING | QUEEN | ACE | ACE |
| 9 | PHOENIX | PHOENIX | PHOENIX | ACE | ACE |
| 10 | ACE | KING | QUEEN | ACE | ACE |
| 11 | ACE | KING | QUEEN | PHOENIX | PHOENIX |
| 12 | ACE | KING | QUEEN | KING | KING |
| 13 | ACE | KING | QUEEN | KING | KING |
| 14 | ACE | KING | QUEEN | KING | KING |
| 15 | ACE | KING | QUEEN | KING | KING |
| 16 | ACE | KING | QUEEN | KING | KING |
| 17 | TRIGGER | WILD | 2xWILD | KING | KING |
| 18 | ACE | KING | QUEEN | KING | KING |
| 19 | ACE | KING | QUEEN | PHOENIX | PHOENIX |
| 20 | ACE | KING | QUEEN | QUEEN | QUEEN |
| 21 | ACE | KING | QUEEN | QUEEN | QUEEN |
| 22 | ACE | KING | QUEEN | QUEEN | QUEEN |
| 23 | ACE | KING | QUEEN | QUEEN | QUEEN |
| 24 | ACE | KING | QUEEN | QUEEN | QUEEN |
| 25 | ACE | KING | QUEEN | QUEEN | QUEEN |
| 26 | PHOENIX | PHOENIX | PHOENIX | QUEEN | QUEEN |
| 27 | JACK | TEN | NINE | WILD | PHOENIX |
| 28 | JACK | TEN | NINE | JACK | JACK |
| 29 | JACK | TEN | NINE | JACK | JACK |
| 30 | JACK | TEN | NINE | JACK | JACK |
| 31 | JACK | TEN | NINE | JACK | JACK |
| 32 | JACK | TEN | NINE | JACK | JACK |
| 33 | JACK | TEN | NINE | JACK | JACK |
| 34 | JACK | TEN | NINE | JACK | JACK |
| 35 | PHOENIX | PHOENIX | PHOENIX | PHOENIX | PHOENIX |
| 36 | JACK | TEN | NINE | TEN | TEN |
| 37 | JACK | TEN | NINE | TEN | TEN |
| 38 | JACK | TEN | NINE | TEN | TEN |
| 39 | JACK | TEN | NINE | TEN | TEN |

| | Reel 1 | Reel 2 | Reel 3 | Reel 4 | Reel 5 |
|---|---|---|---|---|---|
| 40 | JACK | TEN | NINE | TEN | TEN |
| 41 | JACK | TEN | NINE | TEN | TEN |
| 42 | JACK | TEN | NINE | TEN | TEN |
| 43 | TRIGGER | TRIGGER | TRIGGER | PHOENIX | PHOENIX |
| 44 | JACK | TEN | NINE | NINE | NINE |
| 45 | JACK | TEN | NINE | NINE | NINE |
| 46 | JACK | TEN | NINE | NINE | NINE |
| 47 | JACK | TEN | NINE | NINE | NINE |
| 48 | JACK | TEN | NINE | NINE | NINE |
| 49 | JACK | TEN | NINE | NINE | NINE |
| 50 | JACK | TEN | NINE | NINE | NINE |
| 51 | JACK | TEN | NINE | | |
| 52 | TRIGGER | TRIGGER | TRIGGER | | |
| 53 | ACE | ACE | ACE | | |
| 54 | ACE | ACE | ACE | | |
| 55 | ACE | ACE | ACE | | |
| 56 | ACE | ACE | ACE | | |
| 57 | PHOENIX | PHOENIX | PHOENIX | | |
| 58 | KING | KING | KING | | |
| 59 | KING | KING | KING | | |
| 60 | KING | KING | KING | | |
| 61 | KING | KING | KING | | |
| 62 | TRIGGER | TRIGGER | TRIGGER | | |
| 63 | QUEEN | QUEEN | QUEEN | | |
| 64 | QUEEN | QUEEN | QUEEN | | |
| 65 | QUEEN | QUEEN | QUEEN | | |
| 66 | QUEEN | JACK | JACK | | |
| 67 | JACK | JACK | JACK | | |
| 68 | JACK | JACK | JACK | | |
| 69 | JACK | JACK | JACK | | |
| 70 | JACK | JACK | JACK | | |
| 71 | TEN | TEN | TEN | | |
| 72 | TEN | TEN | TEN | | |
| 73 | TEN | TEN | TEN | | |
| 74 | TEN | TEN | TEN | | |
| 75 | NINE | NINE | NINE | | |
| 76 | NINE | NINE | NINE | | |
| 77 | NINE | NINE | NINE | | |
| 78 | NINE | NINE | NINE | | |

FIG. 59

| | Reel 1 | Reel 2 | Reel 3 | Reel 4 | Reel 5 |
|---|---|---|---|---|---|
| 0 | TRIGGER | TRIGGER | TRIGGER | TRIGGER | TRIGGER |
| 1 | PHOENIX | PHOENIX | PHOENIX | PHOENIX | PHOENIX |
| 2 | PHOENIX | PHOENIX | ACE | PHOENIX | PHOENIX |
| 3 | PHOENIX | PHOENIX | ACE | TRIGGER | TRIGGER |
| 4 | TRIGGER | ACE | ACE | ACE | ACE |
| 5 | ACE | ACE | ACE | ACE | ACE |
| 6 | ACE | ACE | PHOENIX | ACE | ACE |
| 7 | ACE | ACE | KING | PHOENIX | PHOENIX |
| 8 | ACE | PHOENIX | KING | KING | KING |
| 9 | PHOENIX | KING | KING | KING | KING |
| 10 | KING | KING | KING | KING | KING |
| 11 | KING | KING | PHOENIX | PHOENIX | PHOENIX |
| 12 | KING | KING | 2xWILD | QUEEN | QUEEN |
| 13 | KING | WILD | PHOENIX | QUEEN | QUEEN |
| 14 | PHOENIX | QUEEN | QUEEN | WILD | PHOENIX |
| 15 | QUEEN | QUEEN | QUEEN | JACK | JACK |
| 16 | QUEEN | QUEEN | QUEEN | JACK | JACK |
| 17 | QUEEN | QUEEN | QUEEN | JACK | JACK |
| 18 | QUEEN | PHOENIX | PHOENIX | JACK | JACK |
| 19 | PHOENIX | PHOENIX | PHOENIX | PHOENIX | PHOENIX |
| 20 | JACK | JACK | JACK | PHOENIX | PHOENIX |
| 21 | JACK | JACK | JACK | TEN | TEN |
| 22 | JACK | JACK | JACK | TEN | TEN |
| 23 | JACK | JACK | JACK | TEN | TEN |
| 24 | PHOENIX | PHOENIX | PHOENIX | TEN | TEN |
| 25 | TEN | PHOENIX | PHOENIX | PHOENIX | PHOENIX |
| 26 | TEN | TEN | TEN | NINE | NINE |
| 27 | TEN | TEN | TEN | NINE | NINE |
| 28 | TEN | TEN | TEN | NINE | NINE |
| 29 | PHOENIX | TRIGGER | PHOENIX | | |
| 30 | PHOENIX | NINE | NINE | | |
| 31 | NINE | NINE | NINE | | |
| 32 | NINE | NINE | NINE | | |
| 33 | NINE | NINE | NINE | | |

FIG. 60

| No. | Reel 1 | Reel 2 | Reel 3 | Reel 4 | Reel 5 |
|---|---|---|---|---|---|
| 0 | TRIGGER | TRIGGER | TRIGGER | TRIGGER | TRIGGER |
| 1 | SWALLOW | SWALLOW | SWALLOW | SWALLOW | SWALLOW |
| 2 | ACE | KING | QUEEN | ACE | ACE |
| 3 | ACE | KING | QUEEN | ACE | ACE |
| 4 | ACE | KING | QUEEN | ACE | ACE |
| 5 | SWALLOW | SWALLOW | SWALLOW | ACE | ACE |
| 6 | ACE | KING | QUEEN | ACE | ACE |
| 7 | ACE | KING | QUEEN | ACE | ACE |
| 8 | ACE | KING | QUEEN | ACE | ACE |
| 9 | SWALLOW | SWALLOW | SWALLOW | ACE | ACE |
| 10 | ACE | KING | QUEEN | ACE | ACE |
| 11 | ACE | KING | QUEEN | SWALLOW | SWALLOW |
| 12 | ACE | KING | QUEEN | KING | KING |
| 13 | SWALLOW | SWALLOW | SWALLOW | KING | KING |
| 14 | ACE | KING | QUEEN | KING | KING |
| 15 | ACE | KING | QUEEN | KING | KING |
| 16 | ACE | KING | QUEEN | KING | KING |
| 17 | TRIGGER | WILD | 2xWILD | KING | KING |
| 18 | ACE | KING | QUEEN | KING | KING |
| 19 | ACE | KING | QUEEN | SWALLOW | SWALLOW |
| 20 | ACE | KING | QUEEN | QUEEN | QUEEN |
| 21 | SWALLOW | SWALLOW | SWALLOW | QUEEN | QUEEN |
| 22 | ACE | KING | QUEEN | QUEEN | QUEEN |
| 23 | ACE | KING | QUEEN | QUEEN | QUEEN |
| 24 | ACE | KING | QUEEN | QUEEN | QUEEN |
| 25 | ACE | KING | QUEEN | QUEEN | QUEEN |
| 26 | SWALLOW | SWALLOW | SWALLOW | QUEEN | QUEEN |
| 27 | JACK | TEN | NINE | WILD | SWALLOW |
| 28 | JACK | TEN | NINE | JACK | JACK |
| 29 | JACK | TEN | NINE | JACK | JACK |
| 30 | JACK | TEN | NINE | JACK | JACK |
| 31 | SWALLOW | SWALLOW | SWALLOW | JACK | JACK |
| 32 | JACK | TEN | NINE | JACK | JACK |
| 33 | JACK | TEN | NINE | JACK | JACK |
| 34 | JACK | TEN | NINE | JACK | JACK |
| 35 | SWALLOW | SWALLOW | SWALLOW | SWALLOW | SWALLOW |
| 36 | JACK | TEN | NINE | TEN | TEN |
| 37 | JACK | TEN | NINE | TEN | TEN |
| 38 | JACK | TEN | NINE | TEN | TEN |
| 39 | SWALLOW | SWALLOW | SWALLOW | TEN | TEN |

| | Reel 1 | Reel 2 | Reel 3 | Reel 4 | Reel 5 |
|---|---|---|---|---|---|
| 40 | JACK | TEN | NINE | TEN | TEN |
| 41 | JACK | TEN | NINE | TEN | TEN |
| 42 | JACK | TEN | NINE | TEN | TEN |
| 43 | TRIGGER | TRIGGER | TRIGGER | SWALLOW | SWALLOW |
| 44 | JACK | TEN | NINE | NINE | NINE |
| 45 | JACK | TEN | NINE | NINE | NINE |
| 46 | JACK | TEN | NINE | NINE | NINE |
| 47 | SWALLOW | SWALLOW | SWALLOW | NINE | NINE |
| 48 | JACK | TEN | NINE | NINE | NINE |
| 49 | JACK | TEN | NINE | NINE | NINE |
| 50 | JACK | TEN | NINE | NINE | NINE |
| 51 | JACK | TEN | NINE | | |
| 52 | TRIGGER | TRIGGER | TRIGGER | | |
| 53 | ACE | ACE | ACE | | |
| 54 | ACE | ACE | ACE | | |
| 55 | ACE | ACE | ACE | | |
| 56 | ACE | ACE | ACE | | |
| 57 | SWALLOW | SWALLOW | SWALLOW | | |
| 58 | KING | KING | KING | | |
| 59 | KING | KING | KING | | |
| 60 | KING | KING | KING | | |
| 61 | KING | KING | KING | | |
| 62 | TRIGGER | TRIGGER | TRIGGER | | |
| 63 | QUEEN | QUEEN | QUEEN | | |
| 64 | QUEEN | QUEEN | QUEEN | | |
| 65 | QUEEN | QUEEN | JACK | | |
| 66 | QUEEN | JACK | JACK | | |
| 67 | JACK | JACK | JACK | | |
| 68 | JACK | JACK | JACK | | |
| 69 | JACK | JACK | JACK | | |
| 70 | SWALLOW | SWALLOW | SWALLOW | | |
| 71 | TEN | TEN | TEN | | |
| 72 | TEN | TEN | TEN | | |
| 73 | TEN | TEN | TEN | | |
| 74 | SWALLOW | SWALLOW | SWALLOW | | |
| 75 | NINE | NINE | NINE | | |
| 76 | NINE | NINE | NINE | | |
| 77 | NINE | NINE | NINE | | |
| 78 | NINE | NINE | NINE | | |

FIG. 61

| | Reel 1 | Reel 2 | Reel 3 | Reel 4 | Reel 5 |
|---|---|---|---|---|---|
| 0 | TRIGGER | TRIGGER | TRIGGER | TRIGGER | TRIGGER |
| 1 | SWALLOW | SWALLOW | SWALLOW | SWALLOW | SWALLOW |
| 2 | SWALLOW | SWALLOW | ACE | SWALLOW | SWALLOW |
| 3 | SWALLOW | SWALLOW | ACE | TRIGGER | TRIGGER |
| 4 | TRIGGER | ACE | ACE | ACE | ACE |
| 5 | ACE | ACE | SWALLOW | ACE | ACE |
| 6 | ACE | ACE | SWALLOW | ACE | ACE |
| 7 | SWALLOW | SWALLOW | KING | SWALLOW | SWALLOW |
| 8 | SWALLOW | SWALLOW | KING | KING | KING |
| 9 | SWALLOW | SWALLOW | KING | KING | KING |
| 10 | SWALLOW | SWALLOW | SWALLOW | SWALLOW | KING |
| 11 | KING | KING | SWALLOW | SWALLOW | SWALLOW |
| 12 | KING | KING | 2xWILD | QUEEN | QUEEN |
| 13 | SWALLOW | WILD | SWALLOW | QUEEN | QUEEN |
| 14 | SWALLOW | QUEEN | QUEEN | WILD | SWALLOW |
| 15 | SWALLOW | QUEEN | QUEEN | JACK | JACK |
| 16 | QUEEN | QUEEN | QUEEN | JACK | JACK |
| 17 | QUEEN | SWALLOW | SWALLOW | JACK | JACK |
| 18 | SWALLOW | SWALLOW | SWALLOW | JACK | JACK |
| 19 | SWALLOW | SWALLOW | SWALLOW | SWALLOW | SWALLOW |
| 20 | SWALLOW | SWALLOW | SWALLOW | SWALLOW | SWALLOW |
| 21 | JACK | JACK | JACK | TEN | SWALLOW |
| 22 | JACK | JACK | JACK | TEN | TEN |
| 23 | SWALLOW | SWALLOW | SWALLOW | TEN | TEN |
| 24 | SWALLOW | SWALLOW | SWALLOW | SWALLOW | SWALLOW |
| 25 | SWALLOW | SWALLOW | SWALLOW | SWALLOW | SWALLOW |
| 26 | TEN | TEN | TEN | SWALLOW | SWALLOW |
| 27 | TEN | TEN | TEN | NINE | NINE |
| 28 | TEN | TEN | TEN | NINE | NINE |
| 29 | SWALLOW | TRIGGER | SWALLOW | | |
| 30 | SWALLOW | NINE | SWALLOW | | |
| 31 | SWALLOW | NINE | SWALLOW | | |
| 32 | NINE | SWALLOW | NINE | | |
| 33 | NINE | SWALLOW | NINE | | |

WILD symbol drawing table

FIG. 65

| | SC01-SC10 | | | | | | |
|---|---|---|---|---|---|---|---|
| | V01 | V02 | V03 | V04 | V05 | V06 | V07 |
| SBB1 | 656284216902710 | 656284216902710 | 663702725092832 0 | 663702725092832 0 | 663702725092832 0 | 663702725092832 0 | 663702725092832 0 |
| SBB2 | 2254810797608730 | 2254810797608730 | 2277614665212410 | 2277614665212410 | 2277614665212410 | 2277614665212410 | 2277614665212410 |
| SBB3 | 2015899962240720 | 2015899962240720 | 2023789309016420 | 2023789309016420 | 2023789309016420 | 2023789309016420 | 2023789309016420 |
| SBB4 | 1176484197926940 | 1176484197926940 | 1183827118164530 | 1183827118164530 | 1183827118164530 | 1183827118164530 | 1183827118164530 |
| SBB5 | 906072534705548 | 906072534705548 | 911471487528664 | 911471487528664 | 911471487528664 | 911471487528664 | 911471487528664 |

| | SC11-SC20, SC41 | | | | | | |
|---|---|---|---|---|---|---|---|
| | V01 | V02 | V03 | V04 | V05 | V06 | V07 |
| SBB1 | 9188037903663790 | 9188037903663790 | 9291538151299650 | 9291538151299650 | 9291538151299650 | 9291538151299650 | 9291538151299650 |
| SBB2 | 3156735116652220 | 3156735116652220 | 3188660531297380 | 3188660531297380 | 3188660531297380 | 3188660531297380 | 3188660531297380 |
| SBB3 | 2822259947137000 | 2822259947137000 | 2833305032622990 | 2833305032622990 | 2833305032622990 | 2833305032622990 | 2833305032622990 |
| SBB4 | 1647077877097720 | 1647077877097720 | 1657358385430350 | 1657358385430350 | 1657358385430350 | 1657358385430350 | 1657358385430350 |
| SBB5 | 1268501548587770 | 1268501548587770 | 1276060082540130 | 1276060082540130 | 1276060082540130 | 1276060082540130 | 1276060082540130 |

| | SC21-SC30, SC46 | | | | | | |
|---|---|---|---|---|---|---|---|
| | V01 | V02 | V03 | V04 | V05 | V06 | V07 |
| SBB1 | 1181319159042490 0 | 1181319159042490 0 | 1194664905167100 0 | 1194664905167100 0 | 1194664905167100 0 | 1194664905167100 0 | 1194664905167100 0 |
| SBB2 | 4058659435695720 | 4058659435695720 | 4099706397382340 | 4099706397382340 | 4099706397382340 | 4099706397382340 | 4099706397382340 |
| SBB3 | 3628619932033290 | 3628619932033290 | 3642820756229560 | 3642820756229560 | 3642820756229560 | 3642820756229560 | 3642820756229560 |
| SBB4 | 2117671556268490 | 2117671556268490 | 2130889352696160 | 2130889352696160 | 2130889352696160 | 2130889352696160 | 2130889352696160 |
| SBB5 | 1630930562469990 | 1630930562469990 | 1640648677551600 | 1640648677551600 | 1640648677551600 | 1640648677551600 | 1640648677551600 |

| | SC31-SC40, SC47, SC48 | | | | | | |
|---|---|---|---|---|---|---|---|
| | V01 | V02 | V03 | V04 | V05 | V06 | V07 |
| SBB1 | 1443834527718600 0 | 1443834527718600 0 | 1460145995204230 0 | 1460145995204230 0 | 1460145995204230 0 | 1460145995204230 0 | 1460145995204230 0 |
| SBB2 | 4960588754739210 | 4960588754739210 | 5010752263467300 | 5010752263467300 | 5010752263467300 | 5010752263467300 | 5010752263467300 |
| SBB3 | 4434979916929580 | 4434979916929580 | 4452336479836120 | 4452336479836120 | 4452336479836120 | 4452336479836120 | 4452336479836120 |
| SBB4 | 2588265235439270 | 2588265235439270 | 2604420319961980 | 2604420319961980 | 2604420319961980 | 2604420319961980 | 2604420319961980 |
| SBB5 | 1993359576352210 | 1993359576352210 | 2005237272563060 | 2005237272563060 | 2005237272563060 | 2005237272563060 | 2005237272563060 |

| | SC42-SC45 | | | | | | |
|---|---|---|---|---|---|---|---|
| | V01 | V02 | V03 | V04 | V05 | V06 | V07 |
| SBB1 | 1050061474704430 0 | 1050061474704430 0 | 1061924360148530 0 | 1061924360148530 0 | 1061924360148530 0 | 1061924360148530 0 | 1061924360148530 0 |
| SBB2 | 3607697276173970 | 3607697276173970 | 3641183464339860 | 3641183464339860 | 3641183464339860 | 3641183464339860 | 3641183464339860 |
| SBB3 | 3225439939585150 | 3225439939585150 | 3238062894426270 | 3238062894426270 | 3238062894426270 | 3238062894426270 | 3238062894426270 |
| SBB4 | 1882374716683100 | 1882374716683100 | 1894123869063260 | 1894123869063260 | 1894123869063260 | 1894123869063260 | 1894123869063260 |
| SBB5 | 1449716055528880 | 1449716055528880 | 1458354380045860 | 1458354380045860 | 1458354380045860 | 1458354380045860 | 1458354380045860 |

FIG. 66 top symbol drawing table

| | SC01-SC10 | | | | | | |
|---|---|---|---|---|---|---|---|
| | V01 | V02 | V03 | V04 | V05 | V06 | V07 |
| SBB1 | 3283232039143540 | 3283232039143540 | 3283232039143540 | 3283232039143540 | 3283232039143540 | 3283232039143540 | 3283232039143540 |
| SBB2 | 605886093414439 | 605886093414439 | 605886093414439 | 605886093414439 | 605886093414439 | 605886093414439 | 605886093414439 |
| SBB3 | 677499518575903 | 677499518575903 | 677499518575903 | 677499518575903 | 677499518575903 | 677499518575903 | 677499518575903 |
| SBB4 | 397529386367401 | 397529386367401 | 397529386367401 | 397529386367401 | 397529386367401 | 397529386367401 | 397529386367401 |
| SBB5 | 2265307749026650 | 2265307749026650 | 2265307749026650 | 2265307749026650 | 2265307749026650 | 2265307749026650 | 2265307749026650 |

| | SC11-SC20, SC41 | | | | | | |
|---|---|---|---|---|---|---|---|
| | V01 | V02 | V03 | V04 | V05 | V06 | V07 |
| SBB1 | 4596524854800950 | 4596524854800950 | 4596524854800950 | 4596524854800950 | 4596524854800950 | 4596524854800950 | 4596524854800950 |
| SBB2 | 848240530780214 | 848240530780214 | 848240530780214 | 848240530780214 | 848240530780214 | 848240530780214 | 848240530780214 |
| SBB3 | 948499326006264 | 948499326006264 | 948499326006264 | 948499326006264 | 948499326006264 | 948499326006264 | 948499326006264 |
| SBB4 | 556511140914361 | 556511140914361 | 556511140914361 | 556511140914361 | 556511140914361 | 556511140914361 | 556511140914361 |
| SBB5 | 3171430848637310 | 3171430848637310 | 3171430848637310 | 3171430848637310 | 3171430848637310 | 3171430848637310 | 3171430848637310 |

| | SC21-SC30, SC46 | | | | | | |
|---|---|---|---|---|---|---|---|
| | V01 | V02 | V03 | V04 | V05 | V06 | V07 |
| SBB1 | 5909817670458370 | 5909817670458370 | 5909817670458370 | 5909817670458370 | 5909817670458370 | 5909817670458370 | 5909817670458370 |
| SBB2 | 1090594968145990 | 1090594968145990 | 1090594968145990 | 1090594968145990 | 1090594968145990 | 1090594968145990 | 1090594968145990 |
| SBB3 | 1219499133436620 | 1219499133436620 | 1219499133436620 | 1219499133436620 | 1219499133436620 | 1219499133436620 | 1219499133436620 |
| SBB4 | 715552895461321 | 715552895461321 | 715552895461321 | 715552895461321 | 715552895461321 | 715552895461321 | 715552895461321 |
| SBB5 | 4077553948247970 | 4077553948247970 | 4077553948247970 | 4077553948247970 | 4077553948247970 | 4077553948247970 | 4077553948247970 |

| | SC31-SC40, SC47, SC48 | | | | | | |
|---|---|---|---|---|---|---|---|
| | V01 | V02 | V03 | V04 | V05 | V06 | V07 |
| SBB1 | 7223110486115790 | 7223110486115790 | 7223110486115790 | 7223110486115790 | 7223110486115790 | 7223110486115790 | 7223110486115790 |
| SBB2 | 1332949405511760 | 1332949405511760 | 1332949405511760 | 1332949405511760 | 1332949405511760 | 1332949405511760 | 1332949405511760 |
| SBB3 | 1490498940866990 | 1490498940866990 | 1490498940866990 | 1490498940866990 | 1490498940866990 | 1490498940866990 | 1490498940866990 |
| SBB4 | 874564650008281 | 874564650008281 | 874564650008281 | 874564650008281 | 874564650008281 | 874564650008281 | 874564650008281 |
| SBB5 | 4983677047858630 | 4983677047858630 | 4983677047858630 | 4983677047858630 | 4983677047858630 | 4983677047858630 | 4983677047858630 |

| | SC42-SC45 | | | | | | |
|---|---|---|---|---|---|---|---|
| | V01 | V02 | V03 | V04 | V05 | V06 | V07 |
| SBB1 | 5253171262629660 | 5253171262629660 | 5253171262629660 | 5253171262629660 | 5253171262629660 | 5253171262629660 | 5253171262629660 |
| SBB2 | 969417749463102 | 969417749463102 | 969417749463102 | 969417749463102 | 969417749463102 | 969417749463102 | 969417749463102 |
| SBB3 | 1083999229721440 | 1083999229721440 | 1083999229721440 | 1083999229721440 | 1083999229721440 | 1083999229721440 | 1083999229721440 |
| SBB4 | 636047018187841 | 636047018187841 | 636047018187841 | 636047018187841 | 636047018187841 | 636047018187841 | 636047018187841 |
| SBB5 | 3624192398442640 | 3624192398442640 | 3624192398442640 | 3624192398442640 | 3624192398442640 | 3624192398442640 | 3624192398442640 |

FIG. 70

PROGRESSIVE INITIAL VALUE TABLE

| | SC01 | SC02 | SC03 | SC04 | SC05 | SC06 | SC07 |
|---|---|---|---|---|---|---|---|
| GRAND JACKPOT Reset Value (Credits) | 5000000 | 3500000 | 3000000 | 2500000 | 2500000 | 5000000 | 3000000 |
| MAJOR JACKPOT Reset Value (Credits) | 80000 | 80000 | 75000 | 80000 | 80000 | 50000 | 30000 |
| MINOR JACKPOT Reset Value (Credits) | 1500 | 1500 | 1800 | 1500 | 1500 | 1500 | 1800 |
| MINI JACKPOT Reset Value (Credits) | 1200 | 1100 | 1100 | 1000 | 1000 | 1000 | 1250 |

| | SC08 | SC09 | SC10 | SC11 | SC12 | SC13 | SC14 |
|---|---|---|---|---|---|---|---|
| GRAND JACKPOT Reset Value (Credits) | 3000000 | 2500000 | 2000000 | 15000000 | 10000000 | 10000000 | 8000000 |
| MAJOR JACKPOT Reset Value (Credits) | 75000 | 80000 | 80000 | 100000 | 100000 | 100000 | 100000 |
| MINOR JACKPOT Reset Value (Credits) | 1800 | 2000 | 2000 | 2200 | 2500 | 2200 | 2000 |
| MINI JACKPOT Reset Value (Credits) | 900 | 1000 | 800 | 1250 | 1000 | 1300 | 1250 |

| | SC15 | SC16 | SC17 | SC18 | SC19 | SC20 | SC21 |
|---|---|---|---|---|---|---|---|
| GRAND JACKPOT Reset Value (Credits) | 7500000 | 10000000 | 12500000 | 10000000 | 9000000 | 8000000 | 20000000 |
| MAJOR JACKPOT Reset Value (Credits) | 100000 | 100000 | 75000 | 100000 | 100000 | 100000 | 100000 |
| MINOR JACKPOT Reset Value (Credits) | 2250 | 2250 | 2000 | 2500 | 2500 | 2500 | 2500 |
| MINI JACKPOT Reset Value (Credits) | 1500 | 1350 | 1250 | 1000 | 1250 | 1000 | 1600 |

| | SC22 | SC23 | SC24 | SC25 | SC26 | SC27 | SC28 |
|---|---|---|---|---|---|---|---|
| GRAND JACKPOT Reset Value (Credits) | 15000000 | 12500000 | 10000000 | 9000000 | 15000000 | 12500000 | 10000000 |
| MAJOR JACKPOT Reset Value (Credits) | 75000 | 125000 | 80000 | 100000 | 75000 | 150000 | 100000 |
| MINOR JACKPOT Reset Value (Credits) | 2250 | 2500 | 2500 | 3000 | 2500 | 2800 | 2500 |
| MINI JACKPOT Reset Value (Credits) | 1800 | 1800 | 1750 | 1750 | 1800 | 1800 | 1750 |

| | SC29 | SC30 | SC31 | SC32 | SC33 | SC34 | SC35 |
|---|---|---|---|---|---|---|---|
| GRAND JACKPOT Reset Value (Credits) | 9000000 | 8000000 | 50000000 | 35000000 | 25000000 | 15000000 | 10000000 |
| MAJOR JACKPOT Reset Value (Credits) | 100000 | 100000 | 75000 | 100000 | 300000 | 250000 | 250000 |
| MINOR JACKPOT Reset Value (Credits) | 2500 | 2500 | 2000 | 2250 | 2500 | 3000 | 3600 |
| MINI JACKPOT Reset Value (Credits) | 1800 | 1500 | 1000 | 1500 | 1500 | 1500 | 1800 |

| | SC36 | SC37 | SC38 | SC39 | SC40 | SC41 | SC42 |
|---|---|---|---|---|---|---|---|
| GRAND JACKPOT Reset Value (Credits) | 20000000 | 18000000 | 15000000 | 12500000 | 10000000 | 100000 | 200000 |
| MAJOR JACKPOT Reset Value (Credits) | 100000 | 250000 | 150000 | 150000 | 150000 | 25000 | 50000 |
| MINOR JACKPOT Reset Value (Credits) | 3000 | 2800 | 3000 | 3000 | 2500 | 4000 | 4000 |
| MINI JACKPOT Reset Value (Credits) | 2000 | 1500 | 1800 | 2000 | 1800 | 1000 | 2000 |

| | SC43 | SC44 | SC45 | SC46 | SC47 | SC48 |
|---|---|---|---|---|---|---|
| GRAND JACKPOT Reset Value (Credits) | 500000 | 1000000 | 888888 | 8888888 | 18888888 | 38888888 |
| MAJOR JACKPOT Reset Value (Credits) | 50000 | 100000 | 188888 | 188888 | 188888 | 88888 |
| MINOR JACKPOT Reset Value (Credits) | 4000 | 3000 | 3888 | 3888 | 3888 | 2888 |
| MINI JACKPOT Reset Value (Credits) | 2000 | 1500 | 1888 | 1888 | 1888 | 1088 |

FIG. 71

PROGRESSIVE DEFAULT INCREMENT RATE TABLE

| | SC01 | SC02 | SC03 | SC04 | SC05 | SC06 | SC07 |
|---|---|---|---|---|---|---|---|
| GRAND JACKPOT Set Increment Percentage | 0.250000% | 0.250000% | 0.250000% | 0.500000% | 0.500000% | 0.500000% | 0.250000% |
| MAJOR JACKPOT Set Increment Percentage | 0.250000% | 0.250000% | 0.250000% | 0.500000% | 0.300000% | 0.500000% | 0.250000% |
| MINOR JACKPOT Set Increment Percentage | 0.500000% | 0.750000% | 0.750000% | 0.750000% | 0.750000% | 0.750000% | 0.500000% |
| MINI JACKPOT Set Increment Percentage | 1.500000% | 1.500000% | 1.500000% | 1.500000% | 1.500000% | 1.500000% | 1.500000% |

| | SC08 | SC09 | SC10 | SC11 | SC12 | SC13 | SC14 |
|---|---|---|---|---|---|---|---|
| GRAND JACKPOT Set Increment Percentage | 0.500000% | 0.250000% | 0.500000% | 0.250000% | 0.250000% | 0.250000% | 0.500000% |
| MAJOR JACKPOT Set Increment Percentage | 0.300000% | 0.250000% | 0.500000% | 0.250000% | 0.250000% | 0.250000% | 0.300000% |
| MINOR JACKPOT Set Increment Percentage | 0.750000% | 0.750000% | 0.750000% | 0.750000% | 0.750000% | 0.750000% | 0.750000% |
| MINI JACKPOT Set Increment Percentage | 1.500000% | 1.500000% | 1.500000% | 1.500000% | 1.500000% | 1.500000% | 1.500000% |

| | SC15 | SC16 | SC17 | SC18 | SC19 | SC20 | SC21 |
|---|---|---|---|---|---|---|---|
| GRAND JACKPOT Set Increment Percentage | 0.250000% | 0.250000% | 0.250000% | 0.500000% | 0.250000% | 0.250000% | 0.250000% |
| MAJOR JACKPOT Set Increment Percentage | 0.250000% | 0.250000% | 0.250000% | 0.300000% | 0.250000% | 0.250000% | 0.250000% |
| MINOR JACKPOT Set Increment Percentage | 0.750000% | 0.500000% | 0.750000% | 0.750000% | 0.750000% | 1.000000% | 0.500000% |
| MINI JACKPOT Set Increment Percentage | 1.500000% | 1.500000% | 1.500000% | 1.500000% | 1.500000% | 1.500000% | 1.500000% |

| | SC22 | SC23 | SC24 | SC25 | SC26 | SC27 | SC28 |
|---|---|---|---|---|---|---|---|
| GRAND JACKPOT Set Increment Percentage | 0.250000% | 0.250000% | 0.250000% | 0.250000% | 0.250000% | 0.250000% | 0.250000% |
| MAJOR JACKPOT Set Increment Percentage | 0.250000% | 0.250000% | 0.250000% | 0.250000% | 0.250000% | 0.250000% | 0.250000% |
| MINOR JACKPOT Set Increment Percentage | 0.500000% | 0.500000% | 0.500000% | 0.500000% | 0.500000% | 0.500000% | 0.500000% |
| MINI JACKPOT Set Increment Percentage | 1.500000% | 1.500000% | 1.500000% | 1.500000% | 1.500000% | 1.500000% | 1.500000% |

| | SC29 | SC30 | SC31 | SC32 | SC33 | SC34 | SC35 |
|---|---|---|---|---|---|---|---|
| GRAND JACKPOT Set Increment Percentage | 0.250000% | 0.250000% | 0.100000% | 0.100000% | 0.250000% | 0.250000% | 0.250000% |
| MAJOR JACKPOT Set Increment Percentage | 0.250000% | 0.250000% | 0.100000% | 0.100000% | 0.250000% | 0.250000% | 0.250000% |
| MINOR JACKPOT Set Increment Percentage | 0.500000% | 0.750000% | 0.200000% | 0.250000% | 0.500000% | 1.000000% | 0.750000% |
| MINI JACKPOT Set Increment Percentage | 1.500000% | 2.000000% | 0.500000% | 1.000000% | 1.500000% | 1.500000% | 1.500000% |

| | SC36 | SC37 | SC38 | SC39 | SC40 | SC41 | SC42 |
|---|---|---|---|---|---|---|---|
| GRAND JACKPOT Set Increment Percentage | 0.250000% | 0.250000% | 0.250000% | 0.250000% | 0.250000% | 0.250000% | 0.250000% |
| MAJOR JACKPOT Set Increment Percentage | 0.250000% | 0.250000% | 0.250000% | 0.250000% | 0.250000% | 0.250000% | 0.250000% |
| MINOR JACKPOT Set Increment Percentage | 0.500000% | 0.500000% | 0.500000% | 1.000000% | 1.000000% | 0.500000% | 0.500000% |
| MINI JACKPOT Set Increment Percentage | 1.500000% | 1.500000% | 1.500000% | 1.500000% | 2.000000% | 1.000000% | 1.000000% |

| | SC43 | SC44 | SC45 | SC46 | SC47 | SC48 |
|---|---|---|---|---|---|---|
| GRAND JACKPOT Set Increment Percentage | 0.250000% | 0.250000% | 0.250000% | 0.250000% | 0.250000% | 0.100000% |
| MAJOR JACKPOT Set Increment Percentage | 0.250000% | 0.250000% | 0.250000% | 0.250000% | 0.250000% | 0.100000% |
| MINOR JACKPOT Set Increment Percentage | 0.500000% | 0.500000% | 0.500000% | 0.500000% | 0.500000% | 0.200000% |
| MINI JACKPOT Set Increment Percentage | 1.000000% | 1.500000% | 1.000000% | 1.000000% | 1.000000% | 0.500000% |

FIG. 72

FIRST BONUS GAME DRAWING TABLE

| | SC01 | SC02 | SC03 | SC04 | SC05 | SC06 | SC07 |
|---|---|---|---|---|---|---|---|
| GRAND JACKPOT Hit Weight | 42517597 | 42517597 | 42517597 | 42517597 | 42517597 | 44260002 | 44260002 |
| MAJOR JACKPOT Hit Weight | 2125018272 | 2125018272 | 2125018272 | 2125018272 | 2125018272 | 2433241342 | 2433241342 |
| MINOR JACKPOT Hit Weight | 350451808086 | 350451808086 | 350451808086 | 350451808086 | 350451808086 | 257479048654 | 257479048654 |
| MINI JACKPOT Hit Weight | 788848764603 | 634644407486 | 793026359003 | 674475107320 | 569132086680 | 812555678752 | 658160373572 |

| | SC08 | SC09 | SC10 | SC11 | SC12 | SC13 | SC14 |
|---|---|---|---|---|---|---|---|
| GRAND JACKPOT Hit Weight | 44260002 | 44260002 | 44260002 | 90517602 | 44517602 | 60517602 | 46517602 |
| MAJOR JACKPOT Hit Weight | 2433241342 | 2433241342 | 2433241342 | 2125018264 | 2125018264 | 2125018264 | 2125018264 |
| MINOR JACKPOT Hit Weight | 257479048654 | 257479048654 | 257479048654 | 350451808080 | 350451808080 | 350451808080 | 350451808080 |
| MINI JACKPOT Hit Weight | 667319193572 | 736151644972 | 665803714582 | 1674453353885 | 642061622500 | 920876207655 | 662111885635 |

| | SC15 | SC16 | SC17 | SC18 | SC19 | SC20 | SC21 |
|---|---|---|---|---|---|---|---|
| GRAND JACKPOT Hit Weight | 60517602 | 50517602 | 50517602 | 50517602 | 53517602 | 44517602 | 160517602 |
| MAJOR JACKPOT Hit Weight | 2125018264 | 2125018264 | 2125018264 | 2125018264 | 2125018264 | 2125018264 | 2125018264 |
| MINOR JACKPOT Hit Weight | 350451808080 | 350451808080 | 350451808080 | 350451808080 | 350451808080 | 350451808080 | 350451808080 |
| MINI JACKPOT Hit Weight | 994190865015 | 761045629300 | 768402875818 | 793959282062 | 852171613032 | 640243036650 | 2465831438158 |

| | SC22 | SC23 | SC24 | SC25 | SC26 | SC27 | SC28 |
|---|---|---|---|---|---|---|---|
| GRAND JACKPOT Hit Weight | 63517602 | 70517602 | 66517602 | 65517602 | 80517602 | 89517602 | 50517602 |
| MAJOR JACKPOT Hit Weight | 2125018264 | 2125018264 | 2125018264 | 2125018264 | 2125018264 | 2125018264 | 2125018264 |
| MINOR JACKPOT Hit Weight | 350451808080 | 350451808080 | 350451808080 | 350451808080 | 350451808080 | 350451808080 | 350451808080 |
| MINI JACKPOT Hit Weight | 772607966165 | 881510753030 | 578574655555 | 699605797954 | 1077108612105 | 1233278907715 | 4786147962218 |

| | SC29 | SC30 | SC31 | SC32 | SC33 | SC34 | SC35 |
|---|---|---|---|---|---|---|---|
| GRAND JACKPOT Hit Weight | 50517602 | 50517602 | 69000000 | 202517602 | 201260002 | 82517602 | 92517602 |
| MAJOR JACKPOT Hit Weight | 2125018264 | 2125018264 | 70000000 | 2125018288 | 2433241341 | 2125018288 | 2125018288 |
| MINOR JACKPOT Hit Weight | 350451808080 | 350451808080 | 12000000000 | 500451808073 | 210479048652 | 250451808073 | 250451808073 |
| MINI JACKPOT Hit Weight | 454982029830 | 533654170245 | 991366354558 | 2389761825130 | 2663030907321 | 936998995079 | 909622125918 |

| | SC36 | SC37 | SC38 | SC39 | SC40 | SC41 | SC42 |
|---|---|---|---|---|---|---|---|
| GRAND JACKPOT Hit Weight | 170517602 | 82517602 | 82517602 | 92517602 | 92517602 | 1231370000 | 1200517602 |
| MAJOR JACKPOT Hit Weight | 2125018288 | 2125018288 | 2125018288 | 2125018288 | 2125018288 | 6166500000 | 2525018288 |
| MINOR JACKPOT Hit Weight | 250451808073 | 250451808073 | 250451808073 | 250451808073 | 250451808073 | 157977880000 | 310001808073 |
| MINI JACKPOT Hit Weight | 2203579389426 | 874496055873 | 791332418450 | 1071361044110 | 902639606445 | 346680987931 | 909906379995 |

| | SC43 | SC44 | SC45 | SC46 | SC47 | SC48 |
|---|---|---|---|---|---|---|
| GRAND JACKPOT Hit Weight | 502517602 | 142517602 | 142517602 | 66260002 | 91260002 | 80000000 |
| MAJOR JACKPOT Hit Weight | 2525018288 | 2525018288 | 2525018288 | 2433241341 | 2433241341 | 100000000 |
| MINOR JACKPOT Hit Weight | 300451808073 | 350451808073 | 450451808073 | 210479048652 | 210479048652 | 100000000000 |
| MINI JACKPOT Hit Weight | 911968480745 | 480240508746 | 1191063933420 | 947740044175 | 1111971926990 | 879862768042 |

FIG. 73

SECOND BONUS GAME DRAWING TABLE

| | SC01 | SC02 | SC03 | SC04 | SC05 | SC06 | SC07 |
|---|---|---|---|---|---|---|---|
| MAJOR JACKPOT Hit Weight | 5125018272 | 5125018272 | 5125018272 | 5125018272 | 5125018272 | 6433241342 | 7433241342 |
| MINOR JACKPOT Hit Weight | 350451808086 | 350451808086 | 350451808086 | 350451808086 | 350451808086 | 257479048654 | 257479048654 |
| MINI JACKPOT Hit Weight | 688499034703 | 532365392488 | 833099584980 | 675716235918 | 591529047163 | 525364776812 | 547245802214 |

| | SC08 | SC09 | SC10 | SC11 | SC12 | SC13 | SC14 |
|---|---|---|---|---|---|---|---|
| MAJOR JACKPOT Hit Weight | 5125018272 | 5125018272 | 5125018272 | 12125018264 | 12125018264 | 12125018264 | 12125018264 |
| MINOR JACKPOT Hit Weight | 350451808086 | 350451808086 | 350451808086 | 350451808080 | 350451808080 | 350451808080 | 350451808080 |
| MINI JACKPOT Hit Weight | 629101042039 | 852948376158 | 728283654750 | 113037417000 5 | 991191424836 | 1188342076145 | 1086737724155 |

| | SC15 | SC16 | SC17 | SC18 | SC19 | SC20 | SC21 |
|---|---|---|---|---|---|---|---|
| MAJOR JACKPOT Hit Weight | 10125018264 | 10125018264 | 10125018264 | 12125018264 | 10125018264 | 10125018264 | 10125018264 |
| MINOR JACKPOT Hit Weight | 350451808080 | 350451808080 | 350451808080 | 350451808080 | 350451808080 | 350451808080 | 350451808080 |
| MINI JACKPOT Hit Weight | 1265427244703 | 937437671448 | 624358737587 | 1010031142050 | 1042262504064 | 926205927555 | 551915990663 |

| | SC22 | SC23 | SC24 | SC25 | SC26 | SC27 | SC28 |
|---|---|---|---|---|---|---|---|
| MAJOR JACKPOT Hit Weight | 10125018264 | 10125018264 | 10125018264 | 10125018264 | 10125018264 | 10125018264 | 10125018264 |
| MINOR JACKPOT Hit Weight | 350451808080 | 350451808080 | 350451808080 | 350451808080 | 350451808080 | 350451808080 | 350451808080 |
| MINI JACKPOT Hit Weight | 365770366029 | 845660358125 | 458935045671 | 752314672325 | 436568711095 | 1135164195718 | 616216882780 |

| | SC29 | SC30 | SC31 | SC32 | SC33 | SC34 | SC35 |
|---|---|---|---|---|---|---|---|
| MAJOR JACKPOT Hit Weight | 10125018264 | 10125018264 | 40125018264 | 30125018264 | 8125018264 | 7125018288 | 5125018288 |
| MINOR JACKPOT Hit Weight | 350451808080 | 350451808080 | 350451808080 | 350451808080 | 350451808080 | 250451808073 | 200451808073 |
| MINI JACKPOT Hit Weight | 641114534610 | 762561596225 | 555207549615 | 812462196763 | 896608375865 | 850162402892 | 714334606660 |

| | SC36 | SC37 | SC38 | SC39 | SC40 | SC41 | SC42 |
|---|---|---|---|---|---|---|---|
| MAJOR JACKPOT Hit Weight | 12125018264 | 5125018288 | 7125018288 | 7125018288 | 7125018288 | 6106500000 | 2525018288 |
| MINOR JACKPOT Hit Weight | 350451808080 | 200451808073 | 250451808073 | 250451808073 | 250451808073 | 157977880000 | 310001808073 |
| MINI JACKPOT Hit Weight | 535936223555 | 487826290051 | 451688170353 | 650217618645 | 646088477075 | 239486117561 | 511033722493 |

| | SC43 | SC44 | SC45 | SC46 | SC47 | SC48 |
|---|---|---|---|---|---|---|
| MAJOR JACKPOT Hit Weight | 2525018288 | 3525018288 | 2525018288 | 2525018288 | 5525018288 | 100000000000 |
| MINOR JACKPOT Hit Weight | 300451808073 | 350451808073 | 450451808073 | 450451808073 | 450451808073 | 1000000000000 |
| MINI JACKPOT Hit Weight | 499361500272 | 373433184870 | 903823604470 | 545991551959 | 465233955255 | 1991769205143 |

FIG. 75

| | Reel 1 | Reel 2 | Reel 3 | Reel 4 | Reel 5 |
|---|---|---|---|---|---|
| 0 | ACE | FEATURE | FEATURE | FEATURE | FEATURE |
| 1 | ACE | COIN | COIN | COIN | JACK |
| 2 | ACE | COIN | QUEEN | COIN | TEN |
| 3 | FEATURE | COIN | FEATURE | NINE | TEN |
| 4 | COIN | FEATURE | NINE | FEATURE | QUEEN |
| 5 | COIN | KING | QUEEN | COIN | ACE |
| 6 | COIN | KING | QUEEN | KING | NINE |
| 7 | FEATURE | COIN | NINE | NINE | NINE |
| 8 | ACE | KING | QUEEN | NINE | ACE |
| 9 | ACE | KING | KING | QUEEN | JACK |
| 10 | KING | TEN | NINE | NINE | ACE |
| 11 | ACE | WILD | QUEEN | NINE | ACE |
| 12 | ACE | KING | COIN | QUEEN | ACE |
| 13 | JACK | TEN | NINE | TEN | ACE |
| 14 | ACE | QUEEN | QUEEN | NINE | ACE |
| 15 | ACE | TEN | WILD | QUEEN | ACE |
| 16 | ACE | KING | QUEEN | NINE | ACE |
| 17 | JACK | FEATURE | QUEEN | NINE | ACE |
| 18 | ACE | KING | NINE | QUEEN | ACE |
| 19 | ACE | TEN | QUEEN | NINE | TEN |
| 20 | JACK | TEN | QUEEN | NINE | TEN |
| 21 | JACK | KING | NINE | QUEEN | ACE |
| 22 | ACE | TEN | QUEEN | NINE | TEN |
| 23 | ACE | TEN | QUEEN | TEN | ACE |
| 24 | JACK | KING | JACK | QUEEN | TEN |
| 25 | ACE | KING | TEN | NINE | TEN |
| 26 | ACE | TEN | QUEEN | QUEEN | JACK |
| 27 | JACK | TEN | QUEEN | NINE | ACE |
| 28 | ACE | KING | NINE | NINE | TEN |
| 29 | ACE | TEN | NINE | QUEEN | TEN |
| 30 | COIN | TEN | QUEEN | NINE | KING |
| 31 | JACK | NINE | NINE | QUEEN | ACE |
| 32 | JACK | TEN | NINE | NINE | ACE |
| 33 | ACE | KING | QUEEN | NINE | JACK |
| 34 | NINE | TEN | QUEEN | QUEEN | JACK |
| 35 | ACE | TEN | ACE | QUEEN | TEN |
| 36 | JACK | KING | NINE | WILD | JACK |
| 37 | JACK | TEN | NINE | QUEEN | JACK |
| 38 | ACE | KING | QUEEN | QUEEN | ACE |
| 39 | JACK | KING | NINE | NINE | COIN |

| | Reel 1 | Reel 2 | Reel 3 | Reel 4 | Reel 5 |
|---|---|---|---|---|---|
| 40 | JACK | TEN | NINE | QUEEN | JACK |
| 41 | ACE | KING | QUEEN | QUEEN | TEN |
| 42 | JACK | ACE | NINE | NINE | ACE |
| 43 | COIN | KING | NINE | JACK | TEN |
| 44 | ACE | TEN | QUEEN | QUEEN | ACE |
| 45 | JACK | KING | WILD | QUEEN | ACE |
| 46 | ACE | TEN | NINE | NINE | ACE |
| 47 | JACK | TEN | NINE | QUEEN | TEN |
| 48 | JACK | KING | QUEEN | QUEEN | ACE |
| 49 | TEN | JACK | NINE | NINE | ACE |
| 50 | ACE | KING | NINE | QUEEN | ACE |
| 51 | ACE | KING | QUEEN | FEATURE | COIN |
| 52 | JACK | TEN | NINE | QUEEN | ACE |
| 53 | ACE | TEN | NINE | QUEEN | ACE |
| 54 | ACE | KING | FEATURE | NINE | COIN |
| 55 | ACE | TEN | NINE | QUEEN | TEN |
| 56 | JACK | KING | NINE | QUEEN | TEN |
| 57 | GOURD | TEN | FEATURE | NINE | COIN |
| 58 | JACK | KING | NINE | ACE | COIN |
| 59 | ACE | TEN | NINE | TEN | COIN |
| 60 | QUEEN | GOURD | GOURD | GOURD | GOURD |
| 61 | JACK | PIG | PIG | PIG | PIG |
| 62 | ACE | INGOT | INGOT | INGOT | INGOT |
| 63 | ACE | TORTOISE | TORTOISE | TORTOISE | TORTOISE |
| 64 | PIG | KING | | | |
| 65 | INGOT | KING | | | |
| 66 | TORTOISE | TEN | | | |
| 67 | ACE | TEN | | | |
| 68 | ACE | | | | |
| 69 | JACK | | | | |
| 70 | ACE | | | | |
| 71 | ACE | | | | |
| 72 | JACK | | | | |
| 73 | ACE | | | | |
| 74 | ACE | | | | |
| 75 | JACK | | | | |
| 76 | ACE | | | | |
| 77 | ACE | | | | |
| 78 | JACK | | | | |

FIG. 76

| | Reel 1 | Reel 2 | Reel 3 | Reel 4 | Reel 5 |
|---|---|---|---|---|---|
| 0 | NINE | COIN | WILD | COIN | JACK |
| 1 | NINE | COIN | WILD | COIN | TEN |
| 2 | ACE | TEN | WILD | ACE | TEN |
| 3 | COIN | KING | | KING | QUEEN |
| 4 | COIN | KING | | NINE | ACE |
| 5 | COIN | TEN | | ACE | NINE |
| 6 | QUEEN | KING | | ACE | ACE |
| 7 | NINE | KING | | QUEEN | ACE |
| 8 | KING | TEN | | ACE | JACK |
| 9 | NINE | WILD | | ACE | ACE |
| 10 | NINE | KING | | QUEEN | ACE |
| 11 | JACK | TEN | | ACE | ACE |
| 12 | NINE | QUEEN | | ACE | ACE |
| 13 | NINE | TEN | | QUEEN | ACE |
| 14 | NINE | KING | | ACE | ACE |
| 15 | JACK | KING | | ACE | ACE |
| 16 | NINE | TEN | | QUEEN | ACE |
| 17 | NINE | TEN | | ACE | ACE |
| 18 | JACK | KING | | ACE | TEN |
| 19 | JACK | TEN | | QUEEN | ACE |
| 20 | NINE | TEN | | ACE | ACE |
| 21 | NINE | KING | | ACE | TEN |
| 22 | JACK | KING | | QUEEN | ACE |
| 23 | NINE | TEN | | ACE | TEN |
| 24 | NINE | TEN | | QUEEN | TEN |
| 25 | JACK | KING | | ACE | JACK |
| 26 | NINE | TEN | | ACE | ACE |
| 27 | NINE | TEN | | QUEEN | TEN |
| 28 | COIN | NINE | | ACE | TEN |
| 29 | JACK | TEN | | QUEEN | KING |
| 30 | JACK | KING | | ACE | ACE |
| 31 | NINE | TEN | | ACE | ACE |
| 32 | NINE | TEN | | QUEEN | JACK |
| 33 | NINE | KING | | QUEEN | JACK |
| 34 | JACK | TEN | | WILD | TEN |
| 35 | JACK | KING | | QUEEN | JACK |
| 36 | NINE | KING | | QUEEN | JACK |
| 37 | JACK | TEN | | ACE | ACE |
| 38 | JACK | KING | | QUEEN | COIN |
| 39 | NINE | ACE | | QUEEN | JACK |

| | Reel 1 | Reel 2 | Reel 3 | Reel 4 | Reel 5 |
|---|---|---|---|---|---|
| 40 | JACK | KING | | ACE | TEN |
| 41 | COIN | KING | | JACK | ACE |
| 42 | NINE | TEN | | QUEEN | TEN |
| 43 | JACK | TEN | | QUEEN | ACE |
| 44 | NINE | KING | | ACE | ACE |
| 45 | JACK | JACK | | QUEEN | ACE |
| 46 | TEN | KING | | QUEEN | TEN |
| 47 | NINE | KING | | ACE | ACE |
| 48 | NINE | TEN | | QUEEN | ACE |
| 49 | JACK | TEN | | QUEEN | ACE |
| 50 | NINE | KING | | QUEEN | COIN |
| 51 | NINE | TEN | | ACE | ACE |
| 52 | NINE | KING | | QUEEN | ACE |
| 53 | JACK | TEN | | QUEEN | COIN |
| 54 | GOURD | KING | | ACE | TEN |
| 55 | JACK | TEN | | ACE | TEN |
| 56 | NINE | GOURD | | TEN | COIN |
| 57 | NINE | PIG | | GOURD | COIN |
| 58 | JACK | INGOT | | PIG | COIN |
| 59 | NINE | TORTOISE | | INGOT | GOURD |
| 60 | NINE | KING | | TORTOISE | PIG |
| 61 | PIG | KING | | | INGOT |
| 62 | INGOT | TEN | | | TORTOISE |
| 63 | TORTOISE | TEN | | | |
| 64 | NINE | KING | | | |
| 65 | NINE | KING | | | |
| 66 | JACK | TEN | | | |
| 67 | NINE | TEN | | | |
| 68 | NINE | KING | | | |
| 69 | JACK | KING | | | |
| 70 | NINE | TEN | | | |
| 71 | NINE | TEN | | | |
| 72 | JACK | KING | | | |
| 73 | NINE | KING | | | |
| 74 | NINE | TEN | | | |
| 75 | JACK | TEN | | | |
| 76 | JACK | KING | | | |
| 77 | NINE | KING | | | |
| 78 | NINE | TEN | | | |
| 79 | JACK | TEN | | | |

FIG. 77

| | Reel 1 | Reel 2 | Reel 3 | Reel 4 | Reel 5 |
|---|---|---|---|---|---|
| 80 | JACK | KING | | | |
| 81 | NINE | KING | | | |
| 82 | NINE | TEN | | | |
| 83 | JACK | TEN | | | |
| 84 | JACK | KING | | | |
| 85 | NINE | KING | | | |
| 86 | NINE | TEN | | | |
| 87 | JACK | KING | | | |
| 88 | JACK | KING | | | |
| 89 | NINE | KING | | | |
| 90 | NINE | TEN | | | |
| 91 | JACK | TEN | | | |
| 92 | JACK | KING | | | |
| 93 | NINE | KING | | | |
| 94 | NINE | TEN | | | |
| 95 | JACK | TEN | | | |
| 96 | JACK | | | | |

FIG. 78

| | Reel 1 | Reel 2 | Reel 3 | Reel 4 | Reel 5 |
|---|---|---|---|---|---|
| 0 | PIG | FEATURE | FEATURE | FEATURE | FEATURE |
| 1 | PIG | TORTOISE | TORTOISE | TORTOISE | JACK |
| 2 | KING | TORTOISE | TORTOISE | TORTOISE | TORTOISE |
| 3 | FEATURE | TORTOISE | WILD | ACE | TEN |
| 4 | TORTOISE | FEATURE | NINE | FEATURE | QUEEN |
| 5 | TORTOISE | PIG | PIG | TORTOISE | GOURD |
| 6 | TORTOISE | PIG | COIN | PIG | NINE |
| 7 | FEATURE | PIG | COIN | JACK | ACE |
| 8 | GOURD | GOURD | COIN | NINE | INGOT |
| 9 | TORTOISE | GOURD | GOURD | INGOT | JACK |
| 10 | INGOT | GOURD | GOURD | ACE | ACE |
| 11 | ACE | WILD | GOURD | KING | GOURD |
| 12 | COIN | TORTOISE | INGOT | COIN | TEN |
| 13 | INGOT | JACK | PIG | JACK | QUEEN |
| 14 | GOURD | PIG | COIN | GOURD | COIN |
| 15 | ACE | PIG | WILD | NINE | COIN |
| 16 | INGOT | COIN | KING | JACK | COIN |
| 17 | GOURD | WILD | GOURD | INGOT | NINE |
| 18 | KING | TORTOISE | COIN | NINE | INGOT |
| 19 | COIN | GOURD | COIN | QUEEN | INGOT |
| 20 | GOURD | KING | TEN | PIG | INGOT |
| 21 | TEN | INGOT | GOURD | COIN | TEN |
| 22 | INGOT | INGOT | GOURD | COIN | QUEEN |
| 23 | GOURD | INGOT | PIG | COIN | INGOT |
| 24 | ACE | COIN | PIG | ACE | KING |
| 25 | PIG | COIN | PIG | TEN | GOURD |
| 26 | COIN | COIN | JACK | GOURD | GOURD |
| 27 | GOURD | ACE | INGOT | GOURD | GOURD |
| 28 | GOURD | GOURD | INGOT | GOURD | ACE |
| 29 | GOURD | QUEEN | PIG | JACK | PIG |
| 30 | PIG | COIN | PIG | INGOT | PIG |
| 31 | COIN | TEN | TEN | KING | PIG |
| 32 | COIN | GOURD | GOURD | COIN | ACE |
| 33 | PIG | QUEEN | KING | COIN | GOURD |
| 34 | JACK | COIN | COIN | COIN | KING |
| 35 | GOURD | TEN | ACE | ACE | PIG |
| 36 | GOURD | GOURD | GOURD | WILD | ACE |
| 37 | GOURD | JACK | NINE | TEN | JACK |
| 38 | QUEEN | PIG | COIN | QUEEN | GOURD |
| 39 | INGOT | KING | ACE | GOURD | TORTOISE |

| | Reel 1 | Reel 2 | Reel 3 | Reel 4 | Reel 5 |
|---|---|---|---|---|---|
| 40 | COIN | COIN | INGOT | KING | JACK |
| 41 | COIN | GOURD | COIN | PIG | GOURD |
| 42 | PIG | ACE | COIN | PIG | GOURD |
| 43 | JACK | TORTOISE | COIN | PIG | KING |
| 44 | COIN | WILD | QUEEN | NINE | JACK |
| 45 | NINE | PIG | PIG | GOURD | GOURD |
| 46 | GOURD | PIG | WILD | GOURD | KING |
| 47 | ACE | KING | COIN | TEN | PIG |
| 48 | COIN | GOURD | JACK | ACE | QUEEN |
| 49 | INGOT | NINE | PIG | INGOT | ACE |
| 50 | INGOT | COIN | PIG | NINE | TORTOISE |
| 51 | INGOT | PIG | INGOT | WILD | TORTOISE |
| 52 | TEN | NINE | FEATURE | COIN | QUEEN |
| 53 | PIG | GOURD | TORTOISE | KING | NINE |
| 54 | NINE | ACE | TORTOISE | GOURD | TORTOISE |
| 55 | COIN | PIG | FEATURE | TEN | TEN |
| 56 | COIN | COIN | QUEEN | INGOT | NINE |
| 57 | COIN | COIN | TORTOISE | INGOT | TORTOISE |
| 58 | QUEEN | COIN | ACE | INGOT | TORTOISE |
| 59 | PIG | GOURD | GOURD | NINE | GOURD |

FIG. 79

| | Reel 1 | Reel 2 | Reel 3 | Reel 4 | Reel 5 |
|---|---|---|---|---|---|
| 0 | PIG | WILD | WILD | WILD | JACK |
| 1 | PIG | TORTOISE | WILD | GOURD | TORTOISE |
| 2 | KING | TORTOISE | WILD | GOURD | TEN |
| 3 | TORTOISE | TORTOISE | | ACE | QUEEN |
| 4 | TORTOISE | PIG | | TORTOISE | GOURD |
| 5 | TORTOISE | PIG | | PIG | NINE |
| 6 | GOURD | PIG | | JACK | ACE |
| 7 | TORTOISE | GOURD | | NINE | INGOT |
| 8 | INGOT | GOURD | | INGOT | JACK |
| 9 | ACE | GOURD | | ACE | ACE |
| 10 | COIN | WILD | | KING | GOURD |
| 11 | INGOT | TORTOISE | | COIN | TEN |
| 12 | GOURD | JACK | | JACK | QUEEN |
| 13 | ACE | PIG | | GOURD | COIN |
| 14 | INGOT | PIG | | NINE | COIN |
| 15 | GOURD | COIN | | JACK | COIN |
| 16 | KING | WILD | | INGOT | NINE |
| 17 | COIN | TORTOISE | | NINE | INGOT |
| 18 | GOURD | GOURD | | QUEEN | INGOT |
| 19 | TEN | KING | | PIG | INGOT |
| 20 | INGOT | INGOT | | COIN | TEN |
| 21 | GOURD | INGOT | | COIN | QUEEN |
| 22 | ACE | INGOT | | COIN | INGOT |
| 23 | PIG | COIN | | ACE | KING |
| 24 | COIN | COIN | | TEN | GOURD |
| 25 | GOURD | COIN | | GOURD | GOURD |
| 26 | GOURD | ACE | | GOURD | GOURD |
| 27 | GOURD | GOURD | | GOURD | ACE |
| 28 | PIG | QUEEN | | JACK | PIG |
| 29 | COIN | COIN | | INGOT | PIG |
| 30 | COIN | TEN | | KING | PIG |
| 31 | PIG | GOURD | | COIN | ACE |
| 32 | JACK | QUEEN | | COIN | GOURD |
| 33 | GOURD | COIN | | COIN | KING |
| 34 | GOURD | TEN | | ACE | PIG |
| 35 | GOURD | GOURD | | WILD | ACE |
| 36 | QUEEN | JACK | | TEN | JACK |
| 37 | INGOT | PIG | | QUEEN | GOURD |
| 38 | COIN | KING | | GOURD | TORTOISE |
| 39 | COIN | COIN | | KING | JACK |

| | Reel 1 | Reel 2 | Reel 3 | Reel 4 | Reel 5 |
|---|---|---|---|---|---|
| 40 | PIG | GOURD | | PIG | NINE |
| 41 | JACK | ACE | | PIG | GOURD |
| 42 | COIN | TORTOISE | | PIG | KING |
| 43 | NINE | WILD | | NINE | JACK |
| 44 | GOURD | PIG | | TORTOISE | GOURD |
| 45 | ACE | PIG | | TORTOISE | KING |
| 46 | COIN | KING | | TEN | PIG |
| 47 | INGOT | GOURD | | ACE | QUEEN |
| 48 | INGOT | NINE | | INGOT | ACE |
| 49 | INGOT | COIN | | NINE | TORTOISE |
| 50 | TEN | PIG | | WILD | TORTOISE |
| 51 | PIG | NINE | | COIN | QUEEN |
| 52 | NINE | GOURD | | KING | NINE |
| 53 | COIN | ACE | | PIG | TORTOISE |
| 54 | COIN | PIG | | TEN | TEN |
| 55 | COIN | COIN | | INGOT | NINE |
| 56 | QUEEN | COIN | | INGOT | NINE |
| 57 | PIG | COIN | | INGOT | TORTOISE |
| 58 | | GOURD | | NINE | GOURD |

FIG. 80

| | Reel 1 | Reel 2 | Reel 3 | Reel 4 | Reel 5 |
|---|---|---|---|---|---|
| 0 | ACE | FEATURE | FEATURE | FEATURE | FEATURE |
| 1 | ACE | PEACH | PEACH | PEACH | JACK |
| 2 | ACE | PEACH | QUEEN | PEACH | TEN |
| 3 | FEATURE | PEACH | FEATURE | NINE | TEN |
| 4 | PEACH | FEATURE | NINE | FEATURE | QUEEN |
| 5 | PEACH | KING | QUEEN | PEACH | ACE |
| 6 | PEACH | KING | QUEEN | KING | NINE |
| 7 | FEATURE | PEACH | NINE | NINE | ACE |
| 8 | ACE | KING | QUEEN | NINE | ACE |
| 9 | ACE | KING | KING | QUEEN | JACK |
| 10 | KING | TEN | NINE | NINE | ACE |
| 11 | ACE | WILD | QUEEN | NINE | ACE |
| 12 | ACE | KING | PEACH | QUEEN | ACE |
| 13 | JACK | TEN | NINE | TEN | ACE |
| 14 | ACE | QUEEN | QUEEN | NINE | ACE |
| 15 | ACE | TEN | WILD | QUEEN | ACE |
| 16 | ACE | KING | QUEEN | NINE | ACE |
| 17 | JACK | FEATURE | QUEEN | NINE | ACE |
| 18 | ACE | KING | NINE | QUEEN | ACE |
| 19 | ACE | TEN | QUEEN | NINE | TEN |
| 20 | JACK | TEN | QUEEN | NINE | ACE |
| 21 | JACK | KING | NINE | QUEEN | ACE |
| 22 | ACE | TEN | QUEEN | NINE | TEN |
| 23 | ACE | TEN | QUEEN | TEN | ACE |
| 24 | JACK | KING | JACK | QUEEN | TEN |
| 25 | ACE | KING | TEN | NINE | TEN |
| 26 | ACE | TEN | QUEEN | QUEEN | JACK |
| 27 | JACK | TEN | QUEEN | NINE | ACE |
| 28 | ACE | KING | NINE | NINE | TEN |
| 29 | ACE | TEN | NINE | QUEEN | TEN |
| 30 | PEACH | TEN | QUEEN | NINE | KING |
| 31 | JACK | NINE | NINE | QUEEN | ACE |
| 32 | JACK | TEN | NINE | NINE | ACE |
| 33 | ACE | KING | QUEEN | NINE | JACK |
| 34 | NINE | TEN | QUEEN | QUEEN | JACK |
| 35 | ACE | TEN | ACE | QUEEN | TEN |
| 36 | JACK | KING | NINE | WILD | JACK |
| 37 | JACK | TEN | NINE | QUEEN | JACK |
| 38 | ACE | KING | QUEEN | QUEEN | ACE |
| 39 | JACK | KING | NINE | NINE | PEACH |

| | Reel 1 | Reel 2 | Reel 3 | Reel 4 | Reel 5 |
|---|---|---|---|---|---|
| 40 | JACK | TEN | NINE | QUEEN | JACK |
| 41 | ACE | KING | QUEEN | QUEEN | TEN |
| 42 | JACK | ACE | NINE | NINE | ACE |
| 43 | PEACH | KING | NINE | JACK | TEN |
| 44 | ACE | TEN | QUEEN | QUEEN | ACE |
| 45 | JACK | KING | WILD | QUEEN | ACE |
| 46 | ACE | TEN | NINE | NINE | ACE |
| 47 | JACK | TEN | NINE | QUEEN | TEN |
| 48 | JACK | KING | QUEEN | QUEEN | ACE |
| 49 | TEN | JACK | NINE | NINE | ACE |
| 50 | ACE | KING | NINE | QUEEN | ACE |
| 51 | ACE | KING | QUEEN | FEATURE | PEACH |
| 52 | JACK | TEN | NINE | QUEEN | ACE |
| 53 | ACE | TEN | NINE | QUEEN | ACE |
| 54 | ACE | KING | FEATURE | NINE | PEACH |
| 55 | ACE | TEN | NINE | QUEEN | TEN |
| 56 | JACK | KING | NINE | QUEEN | TEN |
| 57 | BUTTERFLY | TEN | FEATURE | NINE | PEACH |
| 58 | JACK | KING | NINE | ACE | PEACH |
| 59 | ACE | TEN | NINE | TEN | PEACH |
| 60 | QUEEN | BUTTERFLY | BUTTERFLY | BUTTERFLY | BUTTERFLY |
| 61 | JACK | TURTLE | TURTLE | TURTLE | TURTLE |
| 62 | ACE | DEER | DEER | DEER | DEER |
| 63 | ACE | KYLIN | KYLIN | KYLIN | KYLIN |
| 64 | TURTLE | KING | | | |
| 65 | DEER | KING | | | |
| 66 | KYLIN | TEN | | | |
| 67 | ACE | TEN | | | |
| 68 | ACE | | | | |
| 69 | JACK | | | | |
| 70 | ACE | | | | |
| 71 | ACE | | | | |
| 72 | JACK | | | | |
| 73 | ACE | | | | |
| 74 | ACE | | | | |
| 75 | JACK | | | | |
| 76 | ACE | | | | |
| 77 | ACE | | | | |
| 78 | JACK | | | | |

FIG. 81

| | Reel 1 | Reel 2 | Reel 3 | Reel 4 | Reel 5 |
|---|---|---|---|---|---|
| 0 | KILIN | KILIN | KILIN | KILIN | KILIN |
| 1 | DEER | DEER | DEER | DEER | DEER |
| 2 | TURTLE | TURTLE | TURTLE | TURTLE | TURTLE |
| 3 | BUTTERFLY | PEACH | BUTTERFLY | WILD | BUTTERFLY |
| 4 | PEACH | BUTTERFLY | PEACH | WILD | PEACH |
| 5 | PEACH | WILD | TURTLE | WILD | KILIN |
| 6 | PEACH | WILD | TURTLE | DEER | KILIN |
| 7 | PEACH | WILD | TURTLE | DEER | KILIN |
| 8 | PEACH | BUTTERFLY | TURTLE | PEACH | KILIN |
| 9 | PEACH | BUTTERFLY | TURTLE | BUTTERFLY | KILIN |
| 10 | PEACH | BUTTERFLY | TURTLE | DEER | KILIN |
| 11 | PEACH | BUTTERFLY | TURTLE | DEER | KILIN |
| 12 | PEACH | BUTTERFLY | TURTLE | DEER | KILIN |
| 13 | PEACH | BUTTERFLY | TURTLE | DEER | KILIN |
| 14 | PEACH | BUTTERFLY | WILD | DEER | KILIN |
| 15 | PEACH | BUTTERFLY | WILD | DEER | KILIN |
| 16 | PEACH | BUTTERFLY | WILD | DEER | KILIN |
| 17 | PEACH | BUTTERFLY | TURTLE | DEER | KILIN |
| 18 | PEACH | BUTTERFLY | TURTLE | DEER | KILIN |
| 19 | PEACH | BUTTERFLY | TURTLE | DEER | KILIN |
| 20 | PEACH | BUTTERFLY | TURTLE | DEER | KILIN |
| 21 | PEACH | BUTTERFLY | TURTLE | DEER | KILIN |
| 22 | PEACH | BUTTERFLY | TURTLE | DEER | KILIN |
| 23 | PEACH | BUTTERFLY | TURTLE | DEER | KILIN |
| 24 | PEACH | BUTTERFLY | TURTLE | DEER | KILIN |
| 25 | PEACH | BUTTERFLY | TURTLE | DEER | KILIN |
| 26 | PEACH | BUTTERFLY | TURTLE | DEER | KILIN |
| 27 | PEACH | BUTTERFLY | TURTLE | DEER | KILIN |
| 28 | PEACH | BUTTERFLY | TURTLE | DEER | KILIN |
| 29 | PEACH | BUTTERFLY | TURTLE | DEER | KILIN |
| 30 | PEACH | BUTTERFLY | TURTLE | DEER | KILIN |
| 31 | PEACH | BUTTERFLY | TURTLE | DEER | KILIN |
| 32 | PEACH | BUTTERFLY | TURTLE | DEER | KILIN |
| 33 | PEACH | BUTTERFLY | TURTLE | DEER | KILIN |
| 34 | PEACH | BUTTERFLY | TURTLE | DEER | KILIN |
| 35 | PEACH | BUTTERFLY | TURTLE | DEER | KILIN |
| 36 | PEACH | BUTTERFLY | TURTLE | DEER | KILIN |
| 37 | PEACH | BUTTERFLY | TURTLE | DEER | KILIN |
| 38 | PEACH | BUTTERFLY | TURTLE | DEER | KILIN |
| 39 | PEACH | BUTTERFLY | TURTLE | DEER | KILIN |

| | Reel 1 | Reel 2 | Reel 3 | Reel 4 | Reel 5 |
|---|---|---|---|---|---|
| 40 | PEACH | BUTTERFLY | TURTLE | DEER | KILIN |
| 41 | PEACH | BUTTERFLY | TURTLE | DEER | KILIN |
| 42 | PEACH | BUTTERFLY | TURTLE | | |
| 43 | | BUTTERFLY | | | |
| 44 | | BUTTERFLY | | | |
| 45 | | BUTTERFLY | | | |
| 46 | | BUTTERFLY | | | |
| 47 | | BUTTERFLY | | | |
| 48 | | BUTTERFLY | | | |
| 49 | | | | | |
| 50 | | | | | |
| 51 | | | | | |
| 52 | | | | | |
| 53 | | | | | |
| 54 | | | | | |
| 55 | | | | | |
| 56 | | | | | |
| 57 | | | | | |
| 58 | | | | | |
| 59 | | | | | |
| 60 | | | | | |
| 61 | | | | | |
| 62 | | | | | |
| 63 | | | | | |
| 64 | | | | | |
| 65 | | | | | |
| 66 | | | | | |
| 67 | | | | | |
| 68 | | | | | |
| 69 | | | | | |
| 70 | | | | | |
| 71 | | | | | |
| 72 | | | | | |
| 73 | | | | | |
| 74 | | | | | |
| 75 | | | | | |
| 76 | | | | | |
| 77 | | | | | |
| 78 | | | | | |

FIG. 82

| | Reel 1 | Reel 2 | Reel 3 | Reel 4 | Reel 5 |
|---|---|---|---|---|---|
| 0 | TURTLE | FEATURE | FEATURE | FEATURE | FEATURE |
| 1 | TURTLE | KYLIN | KYLIN | KYLIN | JACK |
| 2 | KING | KYLIN | BUTTERFLY | KYLIN | KYLIN |
| 3 | FEATURE | KYLIN | WILD | ACE | TEN |
| 4 | KYLIN | FEATURE | NINE | FEATURE | QUEEN |
| 5 | KYLIN | TURTLE | TURTLE | KYLIN | BUTTERFLY |
| 6 | KYLIN | TURTLE | PEACH | TURTLE | NINE |
| 7 | FEATURE | TURTLE | PEACH | JACK | ACE |
| 8 | BUTTERFLY | BUTTERFLY | PEACH | NINE | DEER |
| 9 | KYLIN | BUTTERFLY | BUTTERFLY | DEER | JACK |
| 10 | DEER | BUTTERFLY | BUTTERFLY | ACE | ACE |
| 11 | ACE | WILD | BUTTERFLY | KING | BUTTERFLY |
| 12 | PEACH | KYLIN | DEER | PEACH | TEN |
| 13 | DEER | JACK | TURTLE | JACK | QUEEN |
| 14 | BUTTERFLY | TURTLE | PEACH | BUTTERFLY | PEACH |
| 15 | QUEEN | TURTLE | WILD | NINE | PEACH |
| 16 | DEER | PEACH | KING | JACK | PEACH |
| 17 | BUTTERFLY | WILD | BUTTERFLY | DEER | NINE |
| 18 | KING | KYLIN | PEACH | NINE | DEER |
| 19 | PEACH | BUTTERFLY | PEACH | QUEEN | DEER |
| 20 | BUTTERFLY | KING | TEN | TURTLE | DEER |
| 21 | TEN | DEER | BUTTERFLY | PEACH | TEN |
| 22 | DEER | DEER | BUTTERFLY | PEACH | QUEEN |
| 23 | BUTTERFLY | DEER | TURTLE | PEACH | DEER |
| 24 | ACE | PEACH | TURTLE | ACE | KING |
| 25 | TURTLE | PEACH | TURTLE | TEN | BUTTERFLY |
| 26 | PEACH | PEACH | JACK | BUTTERFLY | BUTTERFLY |
| 27 | BUTTERFLY | ACE | DEER | BUTTERFLY | BUTTERFLY |
| 28 | BUTTERFLY | BUTTERFLY | DEER | BUTTERFLY | ACE |
| 29 | BUTTERFLY | QUEEN | TURTLE | JACK | TURTLE |
| 30 | TURTLE | PEACH | TURTLE | DEER | TURTLE |
| 31 | PEACH | TEN | TEN | KING | TURTLE |
| 32 | PEACH | BUTTERFLY | BUTTERFLY | PEACH | ACE |
| 33 | TURTLE | QUEEN | KING | PEACH | BUTTERFLY |
| 34 | JACK | PEACH | PEACH | PEACH | KING |
| 35 | BUTTERFLY | TEN | ACE | ACE | TURTLE |
| 36 | BUTTERFLY | BUTTERFLY | BUTTERFLY | WILD | ACE |
| 37 | BUTTERFLY | JACK | NINE | TEN | JACK |
| 38 | QUEEN | TURTLE | PEACH | QUEEN | BUTTERFLY |
| 39 | DEER | KING | ACE | BUTTERFLY | KYLIN |

| | Reel 1 | Reel 2 | Reel 3 | Reel 4 | Reel 5 |
|---|---|---|---|---|---|
| 40 | PEACH | PEACH | DEER | KING | JACK |
| 41 | PEACH | BUTTERFLY | PEACH | TURTLE | NINE |
| 42 | TURTLE | ACE | PEACH | TURTLE | BUTTERFLY |
| 43 | JACK | KYLIN | PEACH | TURTLE | KING |
| 44 | PEACH | WILD | QUEEN | NINE | JACK |
| 45 | NINE | TURTLE | TURTLE | BUTTERFLY | BUTTERFLY |
| 46 | BUTTERFLY | TURTLE | WILD | BUTTERFLY | KING |
| 47 | TEN | KING | PEACH | TEN | TURTLE |
| 48 | PEACH | BUTTERFLY | JACK | ACE | QUEEN |
| 49 | DEER | NINE | TURTLE | DEER | ACE |
| 50 | DEER | PEACH | TURTLE | NINE | BUTTERFLY |
| 51 | DEER | TURTLE | DEER | WILD | KYLIN |
| 52 | TEN | NINE | FEATURE | PEACH | QUEEN |
| 53 | TURTLE | BUTTERFLY | KYLIN | KING | NINE |
| 54 | NINE | ACE | KYLIN | TURTLE | KYLIN |
| 55 | PEACH | TURTLE | FEATURE | TEN | TEN |
| 56 | PEACH | PEACH | QUEEN | DEER | NINE |
| 57 | PEACH | PEACH | KYLIN | DEER | KYLIN |
| 58 | QUEEN | PEACH | ACE | DEER | KYLIN |
| 59 | TURTLE | BUTTERFLY | BUTTERFLY | NINE | KYLIN |

FIG. 83

| | Reel 1 | Reel 2 | Reel 3 | Reel 4 | Reel 5 |
|---|---|---|---|---|---|
| 0 | BUTTERFLY | BUTTERFLY | PEACH | DEER | PEACH |
| 1 | PEACH | DEER | PEACH | PEACH | BUTTERFLY |
| 2 | DEER | TURTLE | BUTTERFLY | KYLIN | TURTLE |
| 3 | BUTTERFLY | BUTTERFLY | WILD | TURTLE | DEER |
| 4 | BUTTERFLY | WILD | WILD | PEACH | BUTTERFLY |
| 5 | BUTTERFLY | WILD | DEER | DEER | TURTLE |
| 6 | KYLIN | BUTTERFLY | BUTTERFLY | DEER | PEACH |
| 7 | KYLIN | DEER | BUTTERFLY | PEACH | BUTTERFLY |
| 8 | BUTTERFLY | KYLIN | TURTLE | TURTLE | KYLIN |
| 9 | BUTTERFLY | TURTLE | DEER | TURTLE | TURTLE |
| 10 | DEER | PEACH | BUTTERFLY | TURTLE | DEER |
| 11 | TURTLE | BUTTERFLY | KYLIN | BUTTERFLY | KYLIN |
| 12 | TURTLE | TURTLE | DEER | KYLIN | KYLIN |
| 13 | TURTLE | DEER | TURTLE | DEER | PEACH |
| 14 | BUTTERFLY | BUTTERFLY | BUTTERFLY | DEER | DEER |
| 15 | BUTTERFLY | TURTLE | BUTTERFLY | KYLIN | BUTTERFLY |
| 16 | DEER | KYLIN | KYLIN | TURTLE | BUTTERFLY |
| 17 | TURTLE | WILD | KYLIN | PEACH | BUTTERFLY |
| 18 | BUTTERFLY | WILD | TURTLE | PEACH | DEER |
| 19 | KYLIN | WILD | TURTLE | DEER | BUTTERFLY |
| 20 | KYLIN | TURTLE | TURTLE | DEER | BUTTERFLY |
| 21 | KYLIN | TURTLE | BUTTERFLY | BUTTERFLY | PEACH |
| 22 | DEER | TURTLE | KYLIN | KYLIN | DEER |
| 23 | BUTTERFLY | BUTTERFLY | DEER | BUTTERFLY | DEER |
| 24 | TURTLE | BUTTERFLY | PEACH | TURTLE | PEACH |
| 25 | DEER | KYLIN | BUTTERFLY | KYLIN | PEACH |
| 26 | BUTTERFLY | KYLIN | TURTLE | PEACH | PEACH |
| 27 | BUTTERFLY | KYLIN | TURTLE | PEACH | TURTLE |
| 28 | PEACH | DEER | WILD | PEACH | TURTLE |
| 29 | DEER | DEER | WILD | KYLIN | KYLIN |
| 30 | BUTTERFLY | TURTLE | WILD | KYLIN | TURTLE |
| 31 | PEACH | BUTTERFLY | TURTLE | TURTLE | DEER |
| 32 | TURTLE | KYLIN | BUTTERFLY | WILD | KYLIN |
| 33 | KYLIN | PEACH | DEER | WILD | BUTTERFLY |
| 34 | KYLIN | BUTTERFLY | DEER | WILD | BUTTERFLY |
| 35 | TURTLE | DEER | KYLIN | BUTTERFLY | KYLIN |
| 36 | BUTTERFLY | PEACH | BUTTERFLY | BUTTERFLY | DEER |
| 37 | BUTTERFLY | PEACH | PEACH | TURTLE | BUTTERFLY |
| 38 | BUTTERFLY | PEACH | KYLIN | DEER | TURTLE |
| 39 | KYLIN | BUTTERFLY | KYLIN | DEER | TURTLE |

| | Reel 1 | Reel 2 | Reel 3 | Reel 4 | Reel 5 |
|---|---|---|---|---|---|
| 40 | PEACH | DEER | TURTLE | KYLIN | DEER |
| 41 | BUTTERFLY | TURTLE | DEER | PEACH | KYLIN |
| 42 | KYLIN | BUTTERFLY | KYLIN | BUTTERFLY | PEACH |
| 43 | TURTLE | DEER | KYLIN | BUTTERFLY | BUTTERFLY |
| 44 | BUTTERFLY | DEER | BUTTERFLY | BUTTERFLY | KYLIN |
| 45 | BUTTERFLY | BUTTERFLY | BUTTERFLY | KYLIN | DEER |
| 46 | KYLIN | WILD | DEER | PEACH | BUTTERFLY |
| 47 | PEACH | WILD | KYLIN | TURTLE | TURTLE |
| 48 | PEACH | BUTTERFLY | BUTTERFLY | KYLIN | KYLIN |
| 49 | PEACH | BUTTERFLY | BUTTERFLY | KYLIN | PEACH |
| 50 | BUTTERFLY | TURTLE | BUTTERFLY | TURTLE | BUTTERFLY |
| 51 | DEER | DEER | PEACH | WILD | KYLIN |
| 52 | DEER | BUTTERFLY | PEACH | WILD | DEER |
| 53 | DEER | BUTTERFLY | WILD | DEER | TURTLE |
| 54 | BUTTERFLY | BUTTERFLY | WILD | DEER | TURTLE |
| 55 | TURTLE | KYLIN | KYLIN | DEER | TURTLE |
| 56 | DEER | DEER | BUTTERFLY | BUTTERFLY | PEACH |
| 57 | BUTTERFLY | DEER | PEACH | KYLIN | DEER |
| 58 | | DEER | KYLIN | PEACH | BUTTERFLY |
| 59 | | KYLIN | BUTTERFLY | BUTTERFLY | TURTLE |
| 60 | | | | | DEER |
| 61 | | | | | KYLIN |
| 62 | | | | | BUTTERFLY |
| 63 | | | | | TURTLE |
| 64 | | | | | DEER |
| 65 | | | | | PEACH |
| 66 | | | | | TURTLE |
| 67 | | | | | BUTTERFLY |
| 68 | | | | | KYLIN |

FIG. 85

COIN PRESENTATION ASSIGNMENT TABLE

| | (A) | | (B) | | (C) | |
|---|---|---|---|---|---|---|
| | X | Y | X | Y | X | Y |
| 1→2 STAGE CHANGE, | 25 | 4.00 | 10 | 10.00 | 1 | 100.00 |
| 2→3 STAGE CHANGE | 25 | 4.00 | 20 | 5.00 | 5 | 20.00 |
| 3→4 STAGE CHANGE, | 25 | 4.00 | 30 | 3.33 | 44 | 2.27 |
| 4→5 STAGE CHANGE, | 25 | 4.00 | 40 | 2.50 | 50 | 2.00 |

GAMING MACHINE

CROSS-REFERENCE TO RELATED APPLICATION

This application claims the benefit of Japanese Patent Application No. 2015-101231, filed on May 18, 2015, which application is incorporated herein by reference in its entirety.

FIELD OF THE INVENTION

The present invention relates to a gaming machine.

BACKGROUND OF THE INVENTION

As the conventional gaming machine, one type of a gaming machine has been known in which a part of a bet amount placed in a base game is accumulated at a predetermined percentage for each of a plurality of progressive bonus ranks whose payouts are different from one another each time a unit game is played, and the accumulated amounts of any of the progressive bonus ranks are paid out randomly by a drawing. For example, the conventional gaming machine has a plurality of bonus kinds as the progressive bonuses whose payouts being likely to be paid out are different from one another in amount, and probabilities with which the plurality of respective bonuses are won are set so as to be different from one another (refer to the specification of U.S. patent application Ser. No. 13/291,915 (U.S. Pat. No. 8,795,056)).

In addition, the above-mentioned gaming machine includes, for example, two displays. On one of the displays, presentation is performed such that in symbol display areas in which paylines are set, a plurality of symbol arrays are displayed in a rotating manner and a plurality of symbols are rearranged, and on the other of the displays, a kind or kinds of a bonus or bonuses among the plurality of bonus kinds, which is or are likely to be obtained, and a condition (a bet number and the like) required to play a bonus game are displayed.

In addition, there also has been known another type of a gaming machine in which in games such as a social networking service game using general game software and a general game apparatus, a payout of each of the above-mentioned plurality of ranks is replaced with points and items to be provided for a player as a profit (that is, a award). In other words, in the case of said one type of the gaming machine, when a bonus rank among the bonus ranks, whose payout is large, is won, the large payout can be obtained, and in the case of said another type of the gaming machine, when a bonus rank among the bonus ranks, whose rank is high, is won, a large number of points or a high score can be obtained, a large amount of virtual money can be obtained, or rare items can be obtained. Degrees of a profit to be provided for a player upon winning the respective plurality of bonus ranks are different from one another.

However, on the conventional gaming machine, states of the final game in which the previous player has played are displayed on the respective displays. Therefore, it is likely to cause the next player to erroneously recognize that winning probabilities of said gaming machine are low. As a result, it is likely that operation rates of specific gaming machines are reduced.

The above-mentioned problem is not limited to the gaming machines, but is likely to occur in game apparatuses for general social networking service games, arcade games, consumer games, and the like.

Therefore, an object of the present invention is to provide a gaming machine, a game apparatus, and a gaming system which are capable of avoiding the above-described problem.

BRIEF SUMMARY OF THE INVENTION

A gaming machine according to the present invention includes: a display part for displaying a plurality of awards in a first state (including a highlighted display state or a lighting-up display state) and a second state (including a darkened display state), payouts of the plurality of awards being different from one another; a storage part for storing a deposited bet amount, the deposited bet amount being allowed to be bet in accordance with a previously inputted game value; and a controller for subtracting a bet amount placed for a unit game from the deposited bet amount stored in the storage part and for displaying the awards having the different payouts in the first state and in the second state in accordance with the placed bet amount, the first state indicating activation that makes any of the awards obtainable, the second state indicating deactivation that makes the awards unobtainable, the controller determining that a game state is a non-play state when with reference to the storage part, the deposited bet amount stored in the storage part has reached an amount being less than a unit bet amount being required for a play, the controller comparing display states of all the awards and causing all the awards to be displayed in either of the first state or the second state.

In this configuration, when in the course of playing of a game by a player, when the deposited bet amount has reached the amount which is less than the unit bet (which is equivalent to "0 (zero)" in the below-described embodiment, and this state is a state in which a player has stopped the game), the controller determines that the game state is the non-play state. Thereafter, the controller controls the display part to switch the display mode, in which any one or any ones of the awards are displayed in the first state and the other award or awards are displayed in the second state, to the display mode in which all of the awards are displayed in either of the first state or the second state.

In other words, all of the awards are displayed in either of the first state or the second state, whereby a player looking at said display state is likely to recognize that the awards which are likely to be obtained are not limited in a biased manner.

That is to say, the situation where when a part of the awards is or are left in the state in which the part of the awards is or are not obtained, a player may erroneously recognize that on that gaming machine, there are some awards which are not obtained can be avoided.

More specifically, a player finishing the game or another player, who can be the next player thereon, looking at the gaming machine on which the game state is the non-play state expects that a profit of large payouts is likely to be obtained from said gaming machine in the initialized state (which is the display state in which all of the awards are likely to be obtained although it is unnecessary that all of the awards are internally activated) and thus, continues the game or newly plays a game. As a result, as compared with the conventional gaming machine in which upon finishing a game in association with a deposited bet amount becoming less than a unit bet, awards are displayed in a second state in which the awards are deactivated, indicating that the awards are not obtained, in the present invention, the awards are displayed in the display mode in which the display modes of all of the awards are unified in either of the first state or the second state. Hence, the situation where an operation rate of said gaming machine may be reduced due to the difference in the display mode can be avoided, and consequently, a profit of a gaming machine administrator is likely to be enhanced.

In the above-described configuration, the controller may control the display part when the game state is determined to be the non-play state as described below.

For example, when the controller determines that the game state is the non-play state, the controller may control the display part to display the awards displayed on the display part in the first state.

In this configuration, all of the awards displayed on the display part are activated, indicating that all of the awards are likely to be obtained. Accordingly, a player playing a game or other player deems that awards of large payouts are likely to be obtained from said gaming machine and continues a play of the game or newly starts a play of a game. Thus, an operation rate of said gaming machine is enhanced.

In a different embodiment, when the controller determines that the game state is the non-play state, the controller may control the display part to display the awards displayed on the display part in the second state.

In this configuration, all of the awards displayed on the display part are deactivated, indicating that all of the awards are not obtained. In other words, likelihood that a player may erroneously recognize that the gaming machine is in a state soon after the initialization (refreshing) of the gaming machine and becoming usable is raised. In other words, a player erroneously recognizes that on the initialized gaming machine, no awards of large payouts have not yet been obtained. Accordingly, a player playing a game or other player deems that awards of large payouts are likely to be obtained from said gaming machine and continues a play of the game or newly starts a play of a game. Thus, an operation rate of said gaming machine is enhanced.

In addition, the gaming machine according to the present invention includes a game value acceptance part for accepting the game value, wherein when the game value acceptance part has accepted the game value, the controller may return the display part to be in a display mode at a point in time when the game state is determined to be the non-play state.

In the above-described configuration, when the game value acceptance part has accepted the game value (a credit, coins, a token, a virtual currency, or the like), the controller returns the display part from the first state in which all of the awards including the awards of large payouts are likely to be obtained to the display state, which includes the second state, immediately before determining that the game state is the non-play state. A player looking at said display state deems that the state upon finishing a game is retained and in order to activate the awards of large payouts in the second state, continues a play on said gaming machine. In other words, a bet amount is increased, an operation rate of the gaming machine is enhanced.

In addition, in the gaming machine according to the present invention, after an elapse of a predetermined time period from the point in time when the game state is determined to be the non-play state, the controller may switch the display part to be in a display mode in which display modes of all of the awards are unified.

In the above-described configuration, despite the determination that the game state is the non-play state in association with the deposited bet amount becoming less than the unit bet (including a state in which a credit is 0 and is insufficient), after the elapse of the predetermined time period, the display modes of all of the awards are unified to be in the first state or the second state. In other words, a player erroneously recognizes that upon finishing a game, probabilities with which the awards are likely to be obtained are initialized. As a result, a player expects that the awards of large payouts are obtained and continues the game on said gaming machine to resume a play, thereby enhancing an operation rate of said gaming machine.

In addition, in order to achieve the above-described object, the present invention also discloses the below-described configurations.

A game apparatus includes:

a display part operable to display a plurality of awards in a first state and a second state, each of the plurality of awards being likely to be obtained depending on a result of a game executed, payouts of the plurality of awards being different from one another;

a first storage part for previously electronically storing a quantity of a game value (a credit, points, or a virtual currency), the game value being bet to trigger the execution of the game, an input part for accepting a predetermined quantity of a consumption unit associated with the game value being bet to trigger the execution of the game, with an upper limit being the quantity of the game value inputted to the storage part, the consumption unit being accepted from among a plurality of patterns of consumption units (M bets or N bets: M>N, the input part operable to accept a quantity, with an upper limit being a deposited quantity);

a second storage part for temporarily storing the consumption unit inputted to the input part, the consumption unit having a predetermined number; and a controller for executing a first control process, a second control process, a third control process, and a fourth control process, wherein in the first control process, any one or any ones is or are selected from the plurality of awards in accordance with the consumption unit inputted from the input part, the selected award or awards is or are previously set to be in a state in which the selected award or awards is or are likely to be obtained depending on the result of the game, and the award or awards which is or are not selected is or are set to be in a state in which the award or awards which is or are not selected is or are not obtained, in the second control process, the display part is controlled to display a display mode or display modes of the award or awards being set in the state in which the award or awards is or are likely to be obtained depending on the result of the game in the first state, and a display mode or display modes of the award or awards being set in the state in which the award or awards is or are not obtained in the second state, in the third control process, it is determined whether or not the game value stored in the storage part has become less than the consumption unit, and in the fourth control process, when in the third control process, it is determined that the game value stored in the storage part has become less than the consumption unit, the display mode or display modes in the first state and the display mode or display modes in the second state are compared, and the display mode or display modes in the first state and the display mode or display modes in the second state are unified in either of the first state or the second state (a normal lighting-up display state or a darkened display state by shading effects).

In this configuration, when the game value has become less than the consumption unit in association with the insufficient game value, from said point in time, the display state on the display part is switched to the first state in which the award or awards is or are likely to be obtained or to the second state in which the award or awards is or are not obtained. Accordingly, a player looking at the change on said display part erroneously recognizes that the game apparatus is initialized (refreshed) and awards whose payouts are large are likely to be obtained newly. Accordingly, a player continues to play a game, thereby enhancing an operation rate of the game apparatus.

It is to be noted that in this configuration, when after the game value has become less than the consumption unit, an additional game value is inputted to the first storage part, the controller may return the display state on the display part to the display state at the point in time when the game value has become less than the consumption unit.

In this configuration, when the game value (the virtual currency, for example, such as points and electronic money) has been accepted, the controller returns the display state on the display part in which the display modes are unified in the first state or the second state to the display state at the point in time when the game value has become less than the consumption unit. A player looking at said change in the display state deems that while the condition upon finishing the game is being retained, a player can continue to play the game, and therefore, continues the game in order to activate the award or awards which has or have not been obtained. Accordingly, an operation rate of the game apparatus is enhanced.

A gaming system includes:

a server apparatus; and a communication terminal, the server apparatus including:

a communication part for enabling interactive communication of information between the server apparatus and the communication terminal;

a first storage part having a game program stored therein, the game program being delivered to the communication terminal, a second storage part for storing identification information of the communication terminal (a password, an ID, a mail address, and the like) previously registered via the communication part;

a identifying part for identifying the identification information from the communication terminal; and a control part for transmitting an entitlement to enable a profit to be likely to be obtained by a drawing (entitlement to continue a play by a credit) in response to information and a request related to a game which are transmitted from the communication terminal in accordance with an identifying result by the identifying part, the communication terminal including:

a communication part for enabling interactive communication of information between the server apparatus and the communication terminal;

an input part for inputting predetermined information;

a first terminal storage part for storing a game downloaded from the server apparatus;

a second terminal storage part for storing the information inputted from the input part; and a display part for displaying the game to be executed and a variety of pieces of information, wherein the communication terminal further includes a controller for executing steps (A) to (F):

at step (A), a game value inputted to play a game is stored in the second terminal storage part;

at step (B), a predetermined quantity of a consumption unit (virtual electronic money such as credits and points, and the like) associated with the game value being bet to trigger the execution of the game is accepted, with an upper limit being the quantity of the game value inputted in the second storage part, the consumption unit being accepted from among a plurality of patterns of consumption units;

at step (C), in accordance with the information inputted from the input part of the communication terminal, any one or any ones is or are selected from the plurality of awards, the selected award or awards is or are previously set to be in a first state in which the selected award or awards is or are likely to be obtained depending on a result of the game, and the award or awards which is or are not selected is or are previously set to be in a second state in which the award or awards which is or are not selected is or are not obtained;

at step (D), the display part is controlled to display a display mode or display modes of the award or awards being set in the state in which the award or awards is or are likely to be obtained depending on the result of the game in the first state, and a display mode or display modes of the award or awards being set in the state in which the award or awards is or are not obtained in the second state;

at step (E), it is determined whether or not the game value stored in the second storage part of the communication terminal has become less than the consumption unit; and at step (F), when it is determined that the game value stored in the storage part has become less than the consumption unit, display states in the first state and the second state are compared, the display states of the display on the communication terminal are unified.

In this configuration, when it becomes impossible to continue a play in association with a shortage of the game value, the display mode or display modes of the plurality of different awards displayed on the display part are unified in either of the first state or the second state. Therefore, a player deems that the game state upon finishing the game is initialized and awards whose payouts are large are likely to be obtained newly and continues to play a game on the communication terminal. As a result, an operation rate of a game played by using the communication terminal is enhanced.

The gaming system may be configured as described below:

after the game value has become less than the consumption unit, the communication terminal transmits to the server apparatus a request including the identification information to additionally input a game value;

the server apparatus identifies the communication terminal previously registered, from the identification information included in the request received by the identifying part from the communication terminal; and when the communication terminal has been registered in the server apparatus, the game value in accordance with the request is provided for said communication terminal, and the display mode on the display part is returned to the display mode including the first state and the second state upon finishing the game.

In this configuration, a game downloaded onto the communication terminal can be played free of charge, and moreover, when it becomes impossible to continue a play in association with the shortage of the game value, the request (charging) is transmitted to the server apparatus to supply the shortage of the game value, thereby allowing the display state on the display part to be returned to the state upon finishing the game in which the award or awards or the like are likely to be obtained and enabling a play to be continued. Accordingly, an operation rate of the game apparatus is enhanced.

The present invention is capable of allowing a game to proceed advantageously through the betting of a high bet number and further, changes the display modes of the awards displayed on the display part, thereby allowing a bet amount to be increased and thus, enhancing an operation rate of a gaming machine.

BRIEF DESCRIPTION OF THE DRAWINGS

FIG. 7 is an explanatory diagram showing one example of the payout tables;

FIG. 8 is a table showing one example of symbol arrays in the base game;

FIG. 9 is a table showing one example of symbol arrays in the base game;

FIG. 10 is a table showing one example of symbol arrays in the base game;

FIG. 11 is a table showing one example of symbol arrays in the base game;

FIG. 12 is a table showing one example of symbol arrays in the base game;

FIG. 13 is a table showing one example of symbol arrays in free games;

FIG. 14 is a table showing one example of symbol arrays in the free games;

FIG. 15 is a table showing one example of symbol arrays in the free games;

FIG. 16 is a table showing one example of symbol arrays in the free games;

FIG. 17 is a table showing one example of symbol arrays in the free games;

FIG. 18 is a table showing numbers and percentages of special symbols in the base game;

FIG. 19 is a table showing numbers and percentages of special symbols in the free games;

FIG. 33 is an explanatory diagram of a scenario table;

FIG. 39 is an explanatory diagram of a progressive challenge table;

FIG. 40 is an explanatory diagram of a progressive drawing table;

FIG. 47 is an explanatory diagram of a win rank table;

FIG. 58 is a table showing one example of symbol arrays in the free games;

FIG. 59 is a table showing one example of symbol arrays in the free games;

FIG. 60 is a table showing one example of symbol arrays in the free games;

FIG. 61 is a table showing one example of symbol arrays in the free games;

FIG. 65 is an explanatory diagram of a WILD symbol drawing table in the modification example;

FIG. 66 is an explanatory diagram of a top symbol drawing table in the modification example;

FIG. 70 is an explanatory diagram of a progressive initial value table in the modification example;

FIG. 71 is an explanatory diagram of a progressive default increment rate table in the modification example;

FIG. 72 is an explanatory diagram of a first bonus game drawing table in the modification example;

FIG. 73 is an explanatory diagram of a second bonus game drawing table in the modification example;

FIG. 75 is a table showing one example of symbol arrays in a base game in the modification example;

FIG. 76 is a table showing one example of symbol arrays in free games in the modification example;

FIG. 77 is a table showing one example of symbol arrays in the free games in the modification example;

FIG. 78 is a table showing one example of symbol arrays in the base game in the modification example;

FIG. 79 is a table showing one example of symbol arrays in the free games in the modification example;

FIG. 80 is a table showing one example of symbol arrays in the base game in the modification example;

FIG. 81 is a table showing one example of symbol arrays in the free games in the modification example;

FIG. 82 is a table showing one example of symbol arrays in the base game in the modification example;

FIG. 83 is a table showing one example of symbol arrays in the free games in the modification example;

FIG. 85 is an explanatory diagram of a coin presentation assignment table in the modification example;

DETAILED DESCRIPTION OF THE PREFERRED EMBODIMENT

Figure 1:
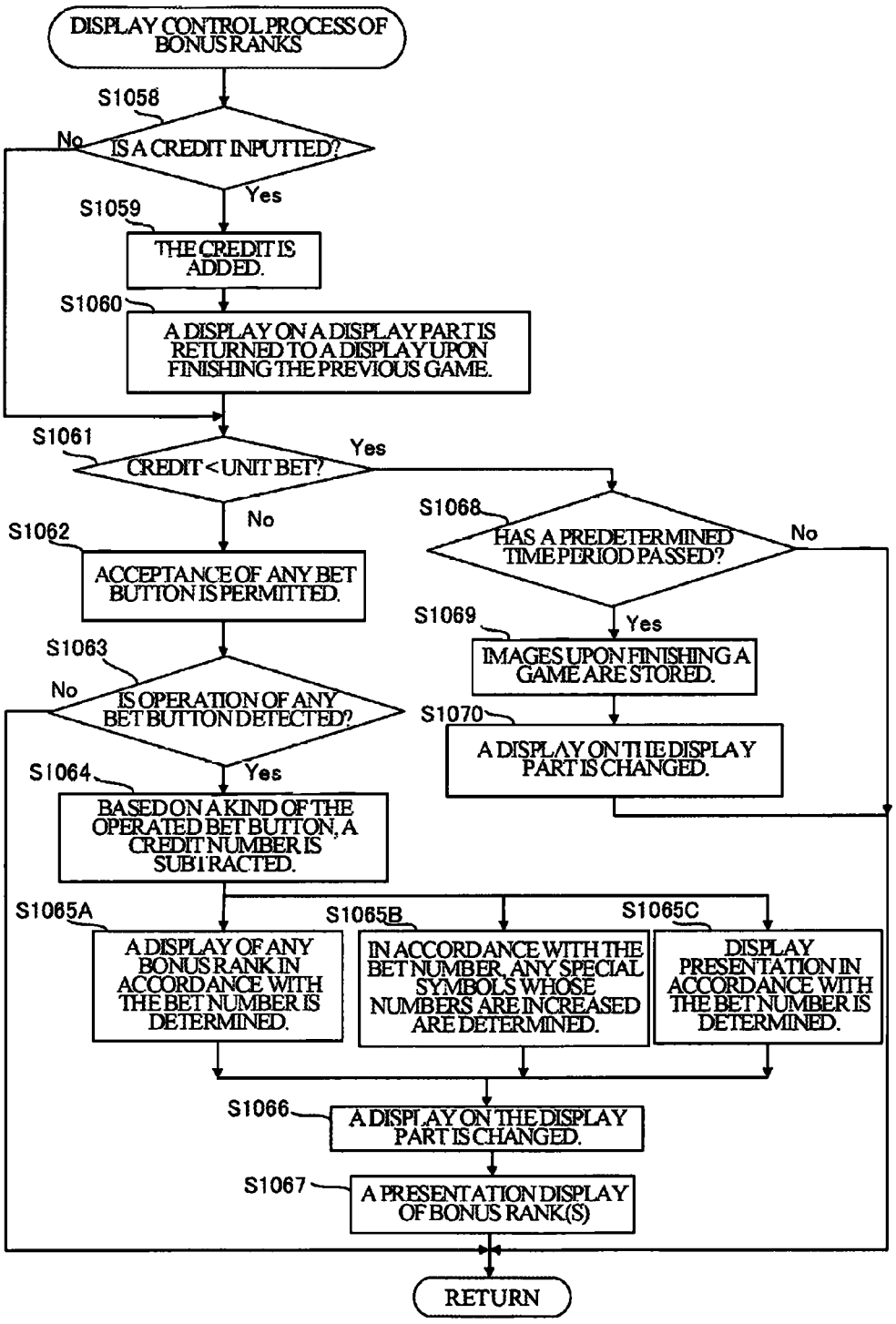
FIG. 1 is a flowchart of a display control process in a bonus game.

Outline of Gaming Machine According to One Embodiment of The Present Invention A gaming machine according to the present invention will be described with reference to the accompanying drawings. A slot machine as the gaming machine according to an embodiment of the present invention has a plurality of kinds of progressive payouts which are different from one another as awards (bonuses). With reference to FIG. 1, a configuration of the present invention is characterized in that a credit is accepted during a base game (S1058); any of a plurality of kinds of bonus ranks in accordance with the accepted credit amount, which awards or award the plurality of kinds of progressive payouts is or are activated; and a main CPU 71 as a controller in the present invention executes display modification on a display part (S1066). In other words, in the slot machine according to one embodiment of the present invention, when a bet amount in the base game is large, all of the bonus ranks are in a state in which the progressive payouts of all of the bonus ranks are likely to be obtained, and the state in which all of the bonus ranks are likely to be obtained is displayed on the display part so as to allow a player to visually recognize the state. In addition, when a bet amount is smaller than the bet amount which allows all of the bonus ranks to be likely to be obtained, all of the bonus ranks are not activated and a part of the bonus ranks which allows a large amount of a payout to be likely to be obtained is or are deactivated.

In order to notify a player of the above-mentioned state, under the control of the main CPU 71, the display modification for the bonus rank or bonus ranks which is or are not activated is executed such that a gray layer is superimposed on an image or images of the above-mentioned bonus rank or bonus ranks to be displayed on the display part, thereby making it difficult to visually recognize the image or images, as compared with an image or images of the activated bonus rank or bonus ranks (S1066). As described above, presentation display for the bonus ranks is executed in order to notify a player that the bonus ranks which are internally deactivated are not obtained and to notify a player of the bonus ranks which are likely to be obtained (S1067). Of course, in order to more clearly display the deactivated bonus ranks, the image or images of the deactivated bonus ranks may be caused to disappear (non-display state).

Figure 2:
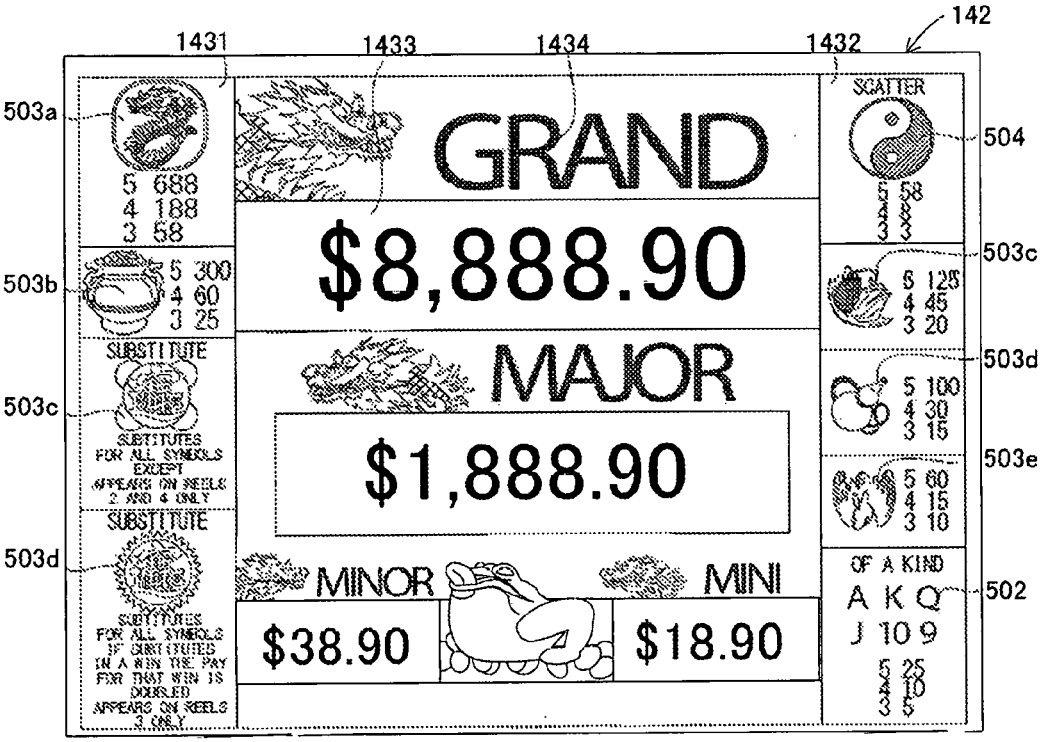
FIG. 2 is a diagram illustrating a screen showing payout tables displayed on a middle image display panel.

In the present embodiment, there are four kinds of bonus ranks. Specifically, as shown in FIG. 2, as the bonus kinds (ranks), there are GRAND, MAJOR, MINOR, and MINI in the order of large payouts. These bonus ranks are displayed together with jackpot amounts (payout amounts), respectively on the later-described middle image display panel 142.

The bonus ranks and the jackpot amounts displayed on the middle image display panel 142 are arranged such that a display mode is changed in association with the course of the base game, the interruption (non-playing state), and the resumption of a game after the interruption (S1059). In other words, display areas of the bonus ranks and the jackpot amounts are arranged such that a first state of displaying in which the bonus rank or bonus ranks is or are activated so as to allow the jackpot amount or jackpot amounts to be likely to be obtained in accordance with a bet number (which is synonymous with the above-mentioned bet amount) and a second state of displaying (the image or images with the gray layer being superimposed to be displayed) in which the bonus rank or bonus ranks is or are deactivate so as not to allow the jackpot amount or jackpot amounts to be obtained are switched at appropriate timing.

Figure 3:
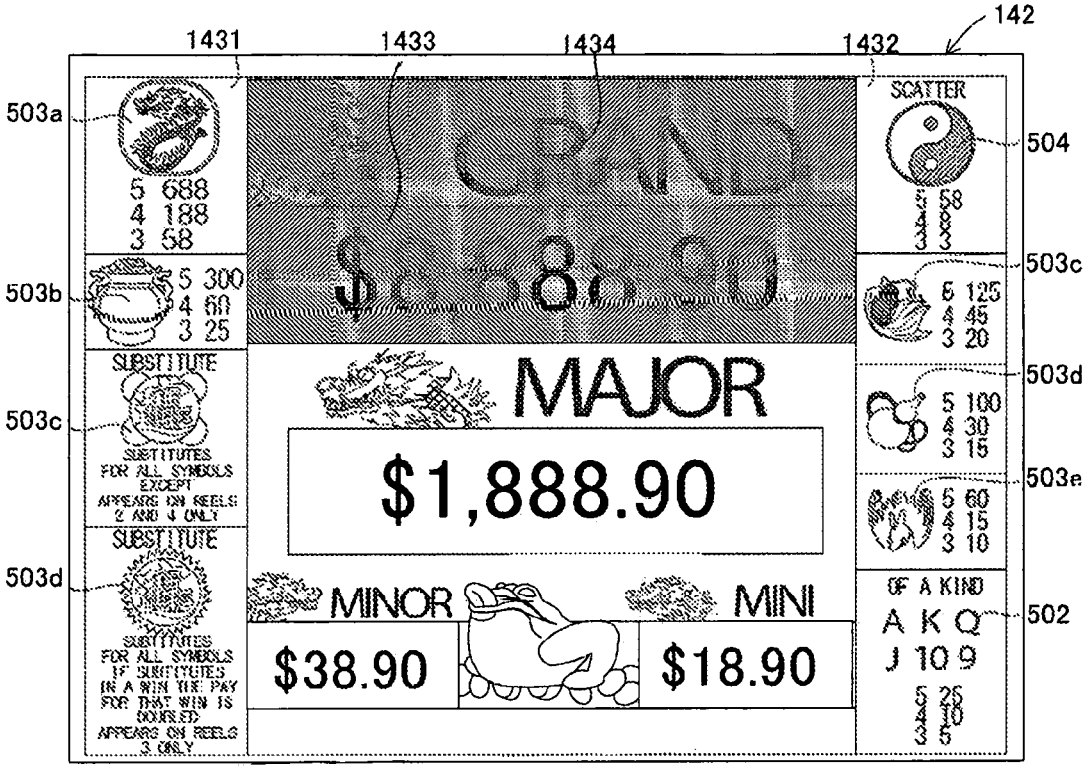
FIG. 3 is an explanatory diagram illustrating one example of a display screen displayed on the middle image display panel.

The first state and the second state are displayed, for example, as shown in FIG. 3, on the display part of the middle image display panel 142 as described below. Here, in the first state, the bonus ranks of MAJOR, MINOR, and MINI are activated among the bonus ranks. In order to clearly indicate that said bonus ranks are activated, normal lighting-up displaying is conducted so as to allow a player to recognize the ranks and the payout amounts (in a state in which the gray layer is not superimposed on the images to be displayed and the visual recognition is not difficult).

In the second state, the bonus rank of GRAND is deactivated. Accordingly, in order to suggest a player that said bonus rank is deactivated so as not to be obtained, the gray layer is superimposed on the image to be displayed so as to hardly visually recognize characters of the rank and the payout amount. The display control process in a bonus game in which the display mode is switched between the first state and the second state on the display part of the middle image display panel 142 will be described below in detail. There is a reason for causing GRAND as the bonus rank, which allows a high amount of a payment to be likely to be obtained, not to disappear so as not to completely visually recognize GRAND. Specifically, by displaying the image of GRAND in the state in which it is difficult to visually recognize the image of GRAND and displaying the progressively changed payout amount ($8,888,90) as a numerical value, advantages are obtained in that a player is psychologically prompted so as to add a bet number in order to activate GRAND and in that a player is psychologically prompted so as to bet a bet number which allows GRAND of the bonus rank to be activated in the subsequent base games.

(Display Control Process of Bonus Ranks)

With reference to a flowchart in FIG. 1, a display control process of the bonus ranks will be described. A credit number which a player has previously deposited and is to be consumed for betting during a base game is stored in a credit number storage region of a storage part.

First, upon staring a new game, since a credit number in the storage part is "0", it is detected whether or not any credit (bill(s) or the like) is inputted from a bill entry 22 (S1058). When no credit is inputted (S1058: NO), the process shifts to S1061 (a gaming state comes to be a standby state in which a display state is maintained as it is without returning the display on the display part to the original display as at S1060). When a credit is inputted (S1058: YES), a number of the credit is temporarily stored in the credit number storage region of the storage part. When any credit number has already remained in the credit number storage region, the inputted credit number is added to said remaining number of the credit (S1059).

Figure 4:
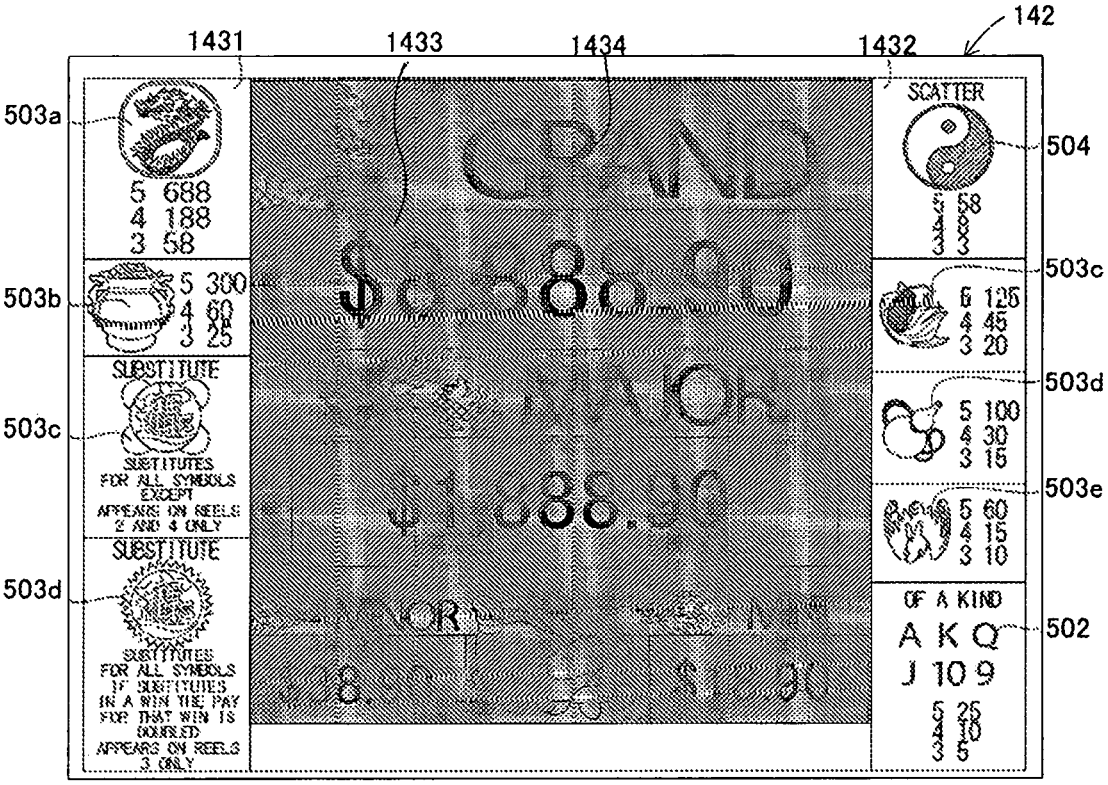
FIG. 4 is an explanatory diagram illustrating one example of a display screen displayed on the middle image display panel.

In association with the addition of the credit number, the display on the display part of the middle image display panel 142 is changed (S1060). In other words, the display state on the display part is returned to the display state upon finishing the game prior to inputting the credit. Specifically, based on a program transmitted from the CPU 71, a display state on a graphic board 130 (refer to FIG. 27) comes to be in a state in which one part of the plurality of bonus ranks are activated and the other thereof is deactivated as shown in FIG. 3 or comes to be in a state in which all of the bonus ranks are deactivated as shown in FIG. 4, changed from the normal lighting-up display state in which all of the bonus ranks displayed on the display part of the middle image display panel 142 are activated as shown in FIG. 2. It is to be noted that at S1060, the bonus ranks which are displayed on the display part of the middle image display panel 142 in the activated modes retain conditions upon finishing the previous game, and the activated bonus ranks displayed thereon are set as the bonus ranks which are also internally likely to be obtained.

Figure 27:
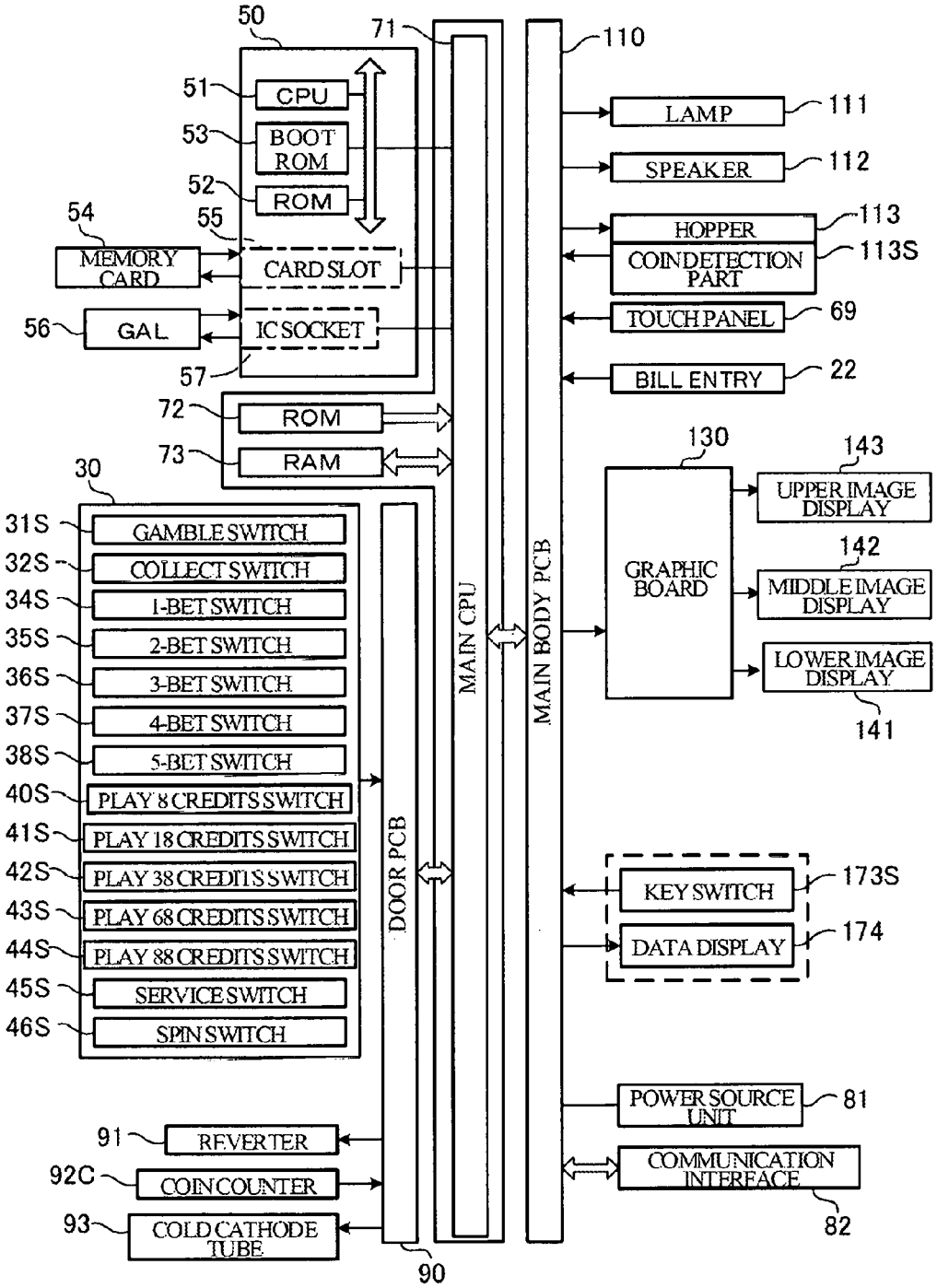
FIG. 27 is an electrical block diagram of the gaming machine.

Next, the CPU 71 being equivalent to the controller in the present invention shown in FIG. 27 determines whether or not the credit number stored in the credit number storage region of a RAM 73 which is the storage part is less than a unit bet including "0" (S1061).

First, a case where in said determination result, the CPU 71 has determined that a value stored in the credit number storage region is not less than the unit bet (S1061: NO) will be described.

Figure 49:
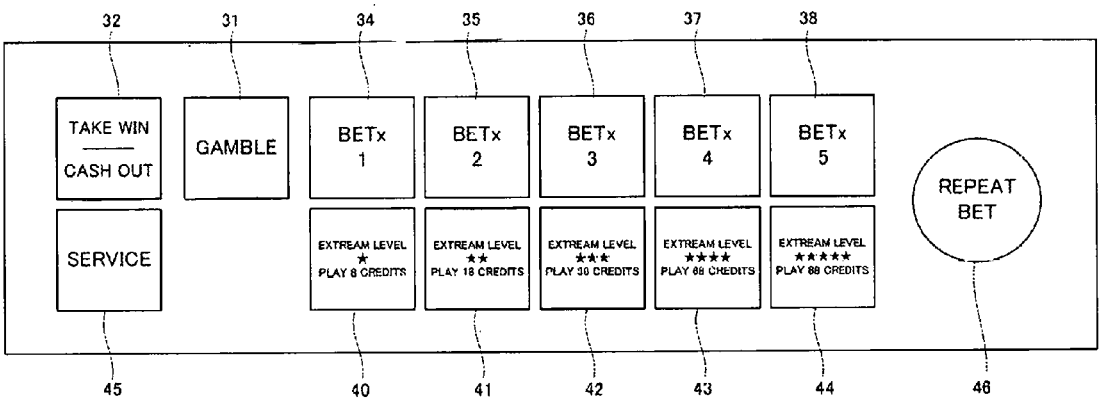
FIG. 49 is an explanatory diagram illustrating a control panel.

The CPU 71 permits the acceptance of operation of BET buttons (a 1-BET button 34, a 2-BET button 35, a 3-BET button 36, a 4-BET button 37, and a 5-BET button 38; and credit buttons 40 to 44) shown in FIG. 49 (S1062).

Next, the CPU 71 determines whether or not the operation of any of the BET buttons has been detected (S1063). When it is detected by a BET switch (any of a 1-BET switch 34S, a 2-BET switch 35S, a 3-BET switch 36S, a 4-BET switch 37S, and a 5-BET switch 38S) that any of the BET buttons has been pressed down by a player, based on a signal of that kind of the BET button, the CPU 71 subtracts the consumed credit number from the deposited credit (being equivalent to a deposited bet amount in the present invention) stored in the credit number storage region of the RAM 73 (S1064). When the CPU 71 has determined that the operation of any of the BET buttons is not detected (S1063: NO), the CPU 71 returns to the process at S1058.

Upon receiving a signal of any of the BET switches 34S to 38S, the CPU 71 executes processes of determination of the display of the bonus ranks in accordance with the bet number (51065A), of determination of special symbols whose numbers are increased in accordance with the bet number (S1065B), and of determination of display presentation in accordance with the bet number (S1065C). The details of definition of the special symbols and the process for determining the special symbols whose numbers are increased in accordance with the bet number will be described later.

In the determination of the display of the bonus ranks (S1065A), the bonus ranks of GRAND, MAJOR, MINOR, and MINT are associated with the bet numbers, respectively.

In other words, the CPU 71 selects any of the bonus rank whose payout is higher in accordance with an increase in a bet number. For example, when any of bet numbers of an uppermost limit and a second upper limit is detected, the CPU 71 selects the display of the bonus rank of said GRAND whose payout is the largest.

In the determination of the special symbols whose numbers are increased in accordance with the bet number (S1065B), in accordance with an increase in a bet number placed, a percentage of a number of special symbols 503 to a number of all of symbols 501 in a plurality of symbol arrays 170 is increased. In other words, the CPU 71 modifies the symbols to the symbols 501 arrayed in said plurality of symbol arrays 170 based on WILD symbol increased number determination table data indicating a WILD symbol increased number determination table.

In the determination of the presentation display in association with the bet number (S1065C), based on a game program stored in the RAM 73, the graphic board 130 executes an execution instruction for a bonus of the rank selected by the CPU 71.

As described above, upon completing preprocessing of the presentation display at S1065A to S1065C, the graphic board 130 executes the displays of a still image and a moving image generated on the lower image display panel 141 and the middle image display panel 142 (S1066). For example, at this point in time, on the display part of the middle image display panel 142, as shown in FIG. 3, the bonus ranks (MINI, MINOR, and MAJOR) which are activated in accordance with the bet number are displayed in the normal lighting-up manner and the bonus rank (GRAND) which is deactivated and whose image is made gray is displayed. In other words, in order to suggest a player that the GRAND rank whose payout amount is large is deactivated so as not to allow a payout of the GRAND rank to be likely to be obtained, the gray layer is superimposed on the image so as to hardly visually recognize the characters of GRAND and the payout amount.

As described above, while the inputted credit number is not less than the unit bet required to execute the game, the CPU 71 permits the execution of the base game with the credit being consumed from the deposited credit number (being equivalent to the deposited bet amount in the present invention) stored in the credit number storage region of the RAM 73.

When the credit number has become less than the unit bet at S1061 (S1061: YES), the CPU 71 counts a predetermined time period (for example, 120 ms) up to the acceptance of a credit such as bills or the like by the bill entry 22 by using a timer (S1068). For example, without providing the predetermined time period, immediately when the credit number has become less than the unit bet, it also can be determined that the game state is the later-described non-play state.

When the predetermined time period has not passed at S1068 (S1068: NO), the CPU 71 determines that a play state is continuing and retains the display state as it is.

When no credit is added within the predetermined time period at S1068 (S1068: YES), that is, when any credit is not added during the predetermined time period and the stored credit number does not come to be the unit bet number or more, the CPU 71 determines that the game state is the non-play state in which the game has been finished. At this time, the display states displayed on the lower image display panel 141 and the middle image display panel 142 are temporarily stored in a storage region of the RAM 73 (S1069). In the present embodiment, the credit number which is less than the unit bet is set to "0 (zero)". However, in a case where the credit number is converted to a bet number, when the bet number is equivalent to a credit number being less than the lowest bet amount which allows the base game to be executed, it also can be determined that the game state is the non-play state. By arranging the configuration as described above, it is made possible to avoid the situation where although a player has left the slot machine after finishing the game without settling the accounting and the game has been actually finished, the display is not modified to the display in the non-play state.

When the display states on the lower image display panel 141 and the middle image display panel 142 are retained at S1069, based on the program transmitted from the CPU 71, the graphic board 130 modifies the display areas of all of the bonus ranks and the payout amounts displayed on the display part of the middle image display panel 142 in the normal lighting-up display state as shown in FIG. 2 (S1070). The diagram in FIG. 3 shows the display screen on the middle image display panel 142, illustrating the state in which the part of the plurality of bonus ranks are activated and the other part thereof is deactivated. The diagram in FIG. 4 shows the display screen on the middle image display panel 142, illustrating the state in which all of the bonus ranks are deactivated and the gray image of the bonus ranks is displayed.

In other words, executed is the display modification from the state in which it is difficult to visually recognize the image of the bonus ranks which is stored upon finishing the game, the image having the gray layer superimposed thereon, to the state in which it is easy to visually recognize the image in the normal lighting-up state. Here, the control for the display modification on the display part at the above-described step S1066 and the control for the display modification on the display part at step S1070 are different from each other in that at S1066, the bonus ranks displayed in the activated display mode on the display part (middle image display panel 142) are also internally set as the bonus ranks which are likely to be obtained, whereas at S1070, in the display modification on the display part, although one part of the bonus ranks internally remains as the bonus ranks which are not obtained, all of the bonus ranks are displayed on the display part as bonus ranks which are activated in a pseudo manner.

At step S1060, the above-described image upon finishing the game at S1069 is displayed on the middle image display panel 142, and the internally activated bonus ranks and the bonus ranks displayed in the activated manner indicating the activation are displayed so as to match each other.

As described above, at S1070, all of the bonus ranks including the bonus ranks which are internally not activated are displayed on the display part of the middle image display panel 142 as the bonus ranks which are activated in the pseudo manner. Thus, the likelihood with which in the standby state time in which a player is waiting for the next game after finishing a game, the effect for inducing a player is enhanced is boosted, as compared with a case where one part of the bonus ranks is not displayed in an activated manner.

Outline of Gaming Machine Definition

The above-described "slot machine 10" is one kind of a game terminal of a gaming machine 300. It is to be noted that in the present embodiment, although the slot machine 10 will be described as one example of the game terminal, the present invention is not limited thereto, and a model including a terminal controller capable of independently executing some sort of a base game is applicable as a game terminal.

A base game in the present embodiment is executed by the slot machine 10. The base game is a slot game in which a plurality of symbols 501 are rearranged. The base game is not limited to the slot game, and it is only required for the base game to be a game which can be independently executed on a game terminal such as the slot machine 10. In other words, the base game is a game whose concept is opposed to the concept of a common game. For example, a base game and a bonus game are classified as the base game.

The rearrangement of symbols in the slot game is conducted on a lower image display panel 141. The slot game may have the base game, the bonus game, a rescue process, and the like. In the base game, a process in which with betting of a game value as a condition, the symbols are rearranged on the lower image display panel 141 and a normal payout associated with the rearranged symbols is awarded is executed. The bonus game is executed when the symbols are rearranged under a predetermined condition in the base game.

A "bonus game" is synonymous with a feature game. It is only required for the bonus game to be a game whose play state is more advantageous than that of the base game, and the bonus game may be any kind of a game. In addition, when it can be arranged that the play state of a game is advantageous for a player, that is, the play state thereof is more advantageous than that of the base game, the bonus game may be combined with other kind of a bonus game to be adopted. For example, the bonus game may be realized by combining a state in which a game value larger than that obtained in the base game can be obtained, a state in which with a probability higher than that in the base game, a game value can be obtained, a state in which a number of the consumed game value is smaller than in the base game, and other state, or singly setting each of the above-mentioned states.

For example, the bonus game may be a fixed-payout game, and the bonus game may be a free game which is executed with betting of a game value whose amount is smaller than that in the base game (also including 0) as a condition. In addition, the bonus game may be a game in which a symbol drawing table whose payout rate is higher than that in the base game is used. In addition, the bonus game may be a pick-out bonus game in which a plurality of choices are presented to a player in a selectable manner. In the case of the pick-out bonus game, the choices may include the fixed payout game, the free game, and the like. In addition, in the choices of the pick-out bonus game, triggering of the pick-out bonus game as a choice to be selected by a player may be further included. It is preferable that the choices of the pick-out bonus game are randomly arranged. In addition, it is preferable that in a stage prior to the selection of any of the choices by a player in the pick-out bonus game, the contents of the choices are non-displayed. The details of the bonus game in the present embodiment will be described later. The rescue process is executed when a rescue start condition is established.

The "gaming value" is coins, bills, or electronic valuable information corresponding to these. It is to be noted that the gaming value in the present invention is not particularly limited, and for example, may be gaming media such as medals, a token, electronic money, and a ticket. The ticket is not particularly limited, and for example, may be the later-described ticket with a barcode and the like. In addition, as described above, the "game value" may be electronic game points being equivalent to the gaming media.

The "free game" is a game which can be executed with the smaller amount of a game value than that in the base game. The case where the free game can be executed with the smaller amount of the game value includes a case where the bet amount is "0". Accordingly, the "free game" may be a game which is executed without setting the betting of the game value as the condition, and a game value whose amount is associated with the rearranged symbols 501. In other words, the "free game" may be a game which is started without presupposing the consumption of the game value is paid out. In contrast to this, the "base game" is the game which is executed with the betting of the game value as the condition, and in which the game value whose amount is associated with the rearranged symbols 501 is paid out. In other words, the "base game" is a game which is started with the consumption of the game value as a precondition.

A state of the "rearrangement" means a state in which after the arrangement of symbols has been released, the symbols 501 are again arranged. A state of the "arrangement" means a state in which a player can visually confirm the symbols 501 externally.

The "normal payout associated with the rearranged symbols 501" means a normal payout corresponding to a winning combination of the rearranged symbols 501. In addition, the "bonus payout associated with the rearranged symbols 501" means a bonus payout corresponding to a winning combination of the rearranged symbols 501. The "winning combination" means that an award is established. The details of the winning combination will be described later.

(Functional Flow of Gaming Machine 300: Slot Machine)

Figure 21:
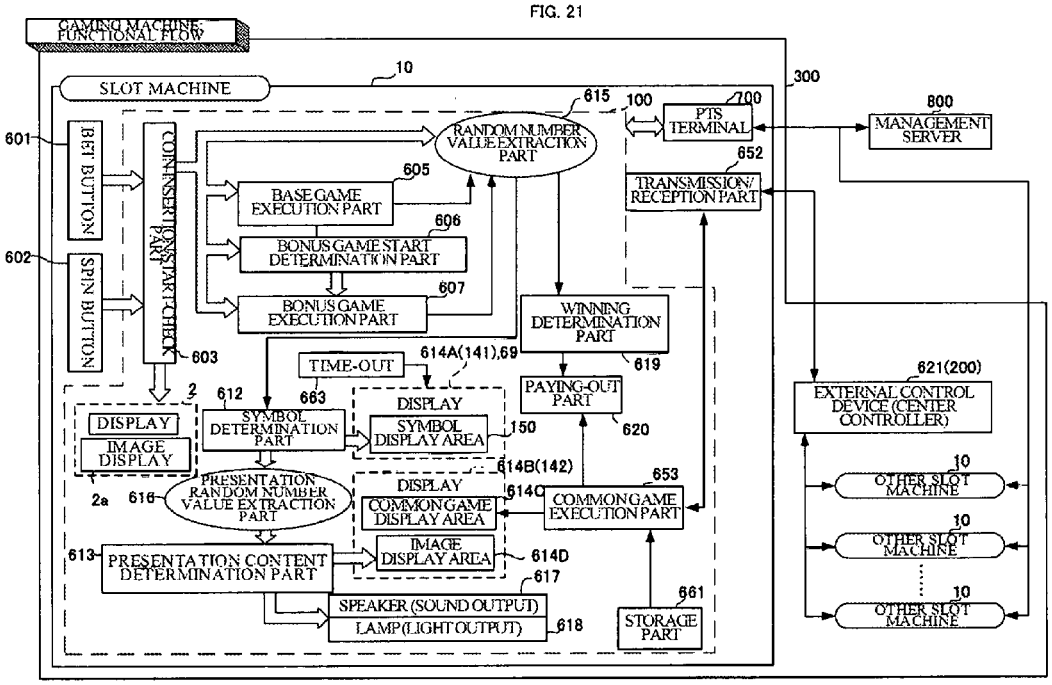
FIG. 21 is an explanatory diagram showing a functional flow of the gaming machine.

As shown in FIG. 21, a gaming machine 300 configured as described above has slot machines 10 and an external control device 621 (center controller 200) which is connected to the slot machines 10 so as to allow data communication therewith. The external control device 621 is connected to a plurality of slot machines 10 installed in a hall so as to allow data communication therewith.

The slot machines 10 has a BET button 601, a SPIN button 602, a display 614A (a lower image display panel 141 or the like in FIG. 5), a display 614B (a middle image display panel 142 in FIG. 5), and a game controller 100 for controlling the above-mentioned parts. Each of the BET button 601 and the SPIN button 602 is a kind of an input device. Further, the slot machine 10 has a transmission/reception part 652 which allows data communication with the external control device 621.

The above-mentioned BET button 601 has a function to accept a bet amount through the operation by a player. The SPIN button 602 has a function to accept the start of a game such as a base game through the operation by a player, that is, a start operation.

Figure 5:
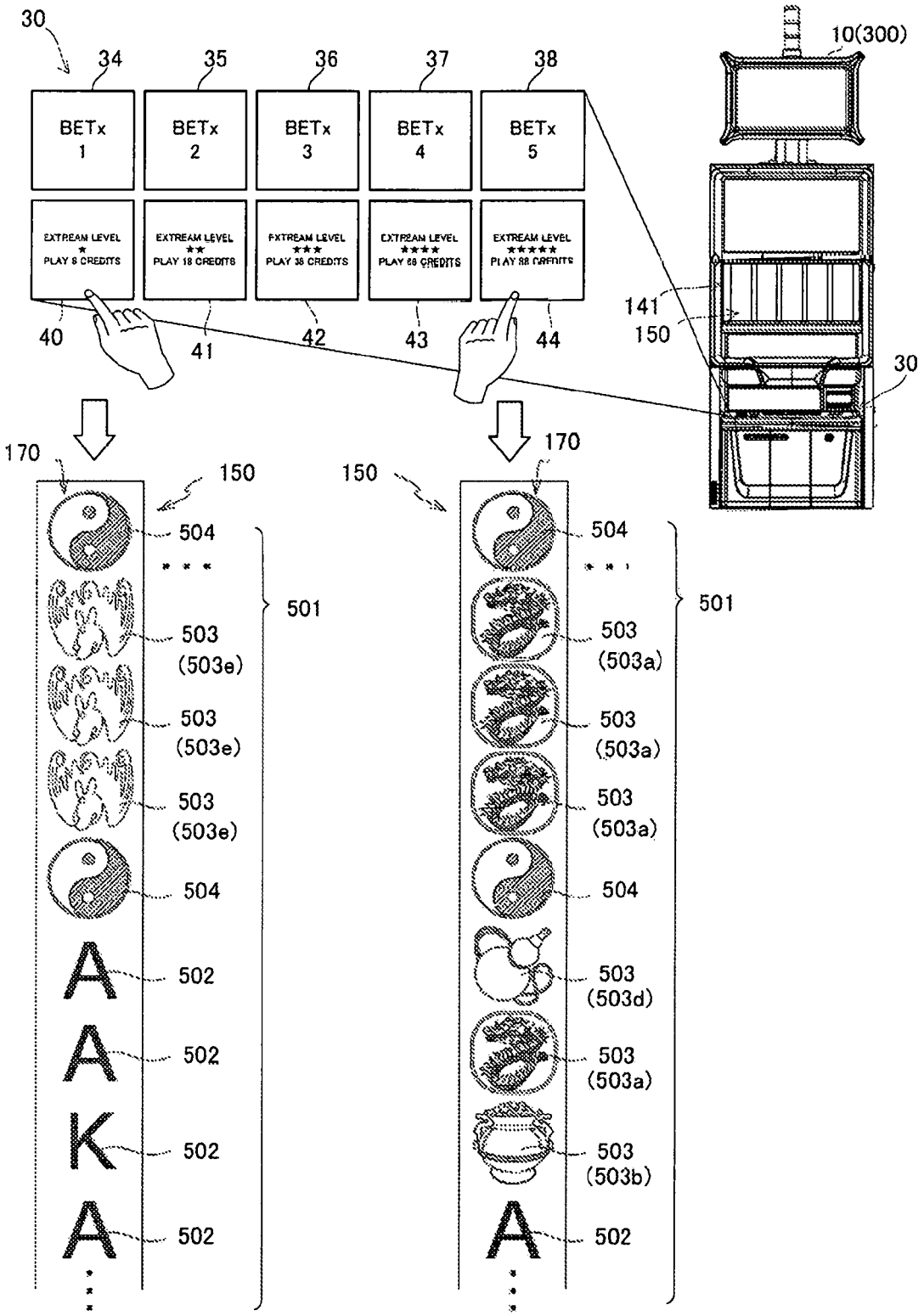
FIG. 5 is an explanatory diagram illustrating operation states of a gaming machine.

The display 614A s has a function to display still image information such as a variety of symbols 501, numerical values, and characters and moving image information such as presentation images. Further, the display 614A has a touch panel 69 as an input device and has a function which allows a variety of instructions to be accepted through the pressing-down operation by a player. The display 614A has a symbol display area 150, an image display area 614B, and a common game display area 614C. In the symbol display area 150, a reel screen including the symbols 501 shown in FIG. 5 is displayed. In the image display area 614B, a variety of pieces of information of images of presentation to be executed during the progress of a game are displayed by moving images and still images. In the common game display area 614C, a common game is displayed.

For example, in the image display area 614B, presentation display related to the bonus game as described above is conducted.

In the present embodiment, the symbol display area 150 and an area for displaying choice images 1421 in the bonus game are set on the same one screen of the lower image display panel 141. However, the present invention is not limited thereto. In addition, the common game display area 614C may be formed together with the symbol display area 150 and the image display area 614B and may be caused to appear through the replacement only when the common game is executed.

As shown in FIG. 21, the display 614B has an image display area 614D and has a function to display the still image information such as the numerical values and the characters and the moving image information such as the presentation images on said image display area 614D. For example, the bonus ranks, the money amounts, and payout tables shown in FIG. 2 are displayed thereon. In addition, on said display area, each of the moving images is displayed also so as to be superimposed on each of the still images.

The game controller 100 has a coin-insertion/start-check part 603, a base game execution part 605, a bonus game start determination part 606, a bonus game execution part 607, a random number value extraction part 615, a symbol determination part 612, a presentation random number value extraction part 616, a presentation content determination part 613, a speaker part 617, a lamp part 618, a winning determination part 619, a paying-out part 620, and a predictive presentation part 651.

The base game execution part 605 has a function to execute the base game, with the operation of the BET button 601 as a condition. Based on a combination of the rearranged symbols 501 in the base game, the bonus game start determination part 606 determines whether or not the bonus game is executed. In other words, when TRIGGER symbols 504 or the like are rearranged on a predetermined condition, the bonus game start determination part 606 determines that a bonus game is won and has a function to shift the processing to the bonus game execution part 607 so as to execute the bonus game from the next unit game.

Here, the "unit game" is a game in which a series of operations from the start of the acceptance of betting to the establishment of winning are conducted. For example, the unit game of the base game includes one time of betting time in which the betting is accepted; one time of game time in which stopped symbols 501 are rearranged; and one time of paying-out time in which a paying-out process for awarding a payout is conducted, respectively. It is to be noted that the unit game in the base game is referral to as a unit base game. Although in the present embodiment, a time period from when a player operates the SPIN button and displaying the symbols in a varying manner is started to when the symbols are rearranged is set to approximately three seconds, the present invention is not limited thereto.

The bonus game execution part 607 has a function to repeatedly execute a free game at a plurality of times only through the operation of the SPIN button 602 and has a function to choose one from a plurality of the choice images 1421 in the bonus game.

The symbol determination part 612 has a function to determine symbols 501 to be rearranged by using random number values from the random number value extraction part 615; a function to rearrange the determined symbols 501 in the symbol display area 150 of the display 614; a function to output rearrangement information of the symbols 501 to the winning determination part 619 and the predictive presentation part 651, respectively; and a function to output a presentation designation signal to the presentation random number value extraction part 616 based on a state of the rearranged symbols 501.

When the winning determination part 619 can obtain the rearrangement information of the symbols 501 which are rearranged on the display 614, the winning determination part 619 has a function to determine whether or not winning has occurred; a function to calculate a total amount of a payout based on a winning combination when it is determined that the winning has occurred; and a function to output a paying-out signal based on the amount of the payout to the paying-out part 620. The paying-out part 620 has a function to pay out a game value in the form of coins, medals, a credit, and the like. In addition, the paying-out part 620 has a function to add credit data corresponding to the paid-out credit to credit data stored in an IC card which is inserted into the later-described PTS terminal 700.

Further, the game controller 100 has a storage part 661 for storing a variety of pieces of bet amount data. The storage part 661 is a device such as a hard disk device and a memory for storing data in a rewritable manner. Said storage part 661 is equivalent to the storage part in the present invention.

Further, the game controller 100 has a common game execution part 653. The common game execution part 653 has a function to output bet amount information based on a bet amount placed in the base game to the external control device 621 for each unit base game; a function to execute the common game based on a game start instruction from the external control device 621; and a function to accept a bet input by the BET button 601, which is stored in the storage part 661, with respect to a bet amount corresponding to common game bet amount data indicating bet amounts which can be bet for a common game.

In addition, the game controller 100 is connected to the PTS terminal 700. The PTS terminal 700 is a unit into which an LCD, a microphone, a human body detection camera, and the like are integrated and has, for example, a function to present a game through the mutual communication with the game controller 100. In particular, the PTS terminal 700 is provided with a card insertion slot, thereby allowing an IC card to be inserted thereinto. Thus, a player inserts the IC card into the card insertion slot and can use a credit stored in the IC card on the slot machine 10.

In addition, upon receiving the credit data from the PTS terminal 700, the game controller 100 updates a credit display in a display frame provided in a lower portion of the display 614B. Further, when the settlement for the game has been made, the game controller 100 outputs the settled credit data to the PTS terminal 700.

In addition, the PTS terminal 700 which each of the plurality of slot machines 10 constituting the gaming machine 300 has is connected to a management server 800 which collectively manages downloading of images, an IC card, and a credit.

(Functional Flow of Gaming Machine 300: External Control Device)

Figure 22:
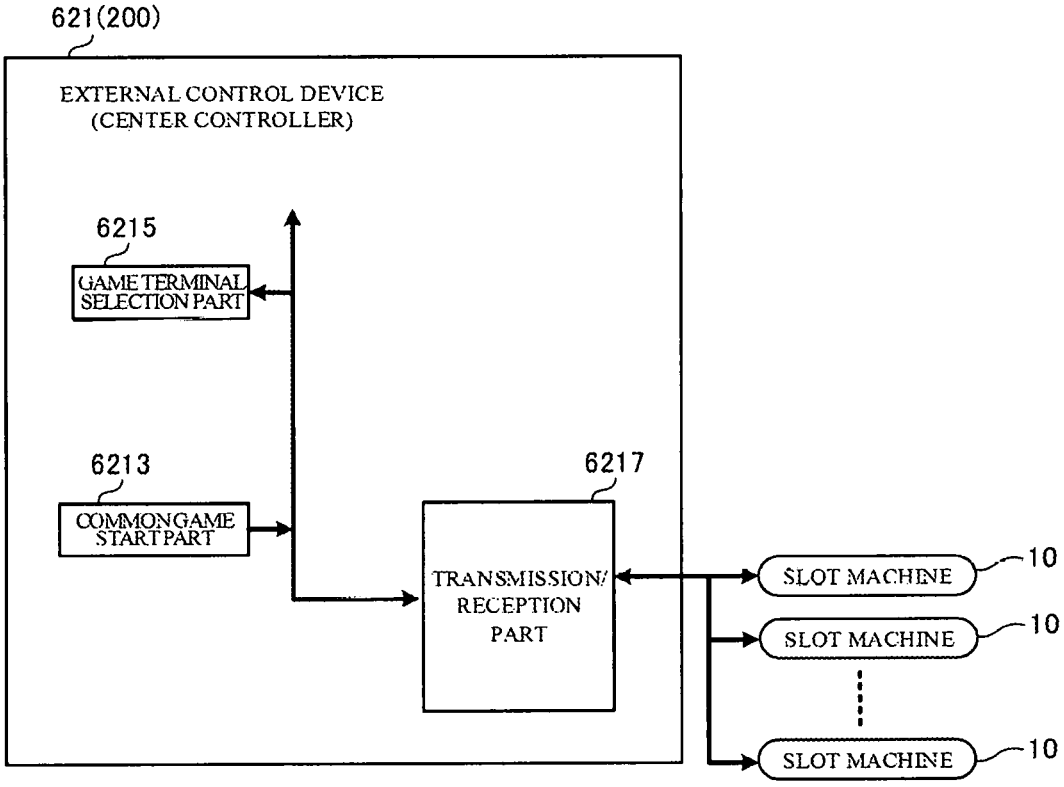
FIG. 22 is an explanatory diagram showing a functional flow of the gaming machine.

As shown in FIG. 22, the slot machine 10 configured as described above is connected to the external control device 621. The external control device 621 has a function to perform remote operation and remote monitoring of processes such as the modification of operating states and a variety of game setting values of a plurality of slot machines 10. Further, the external control device 621 has a function to determine a common game start condition for each of game terminals which are the slot machines 10; and when the external control device 621 has obtained a determination result which satisfies the common game start condition on any of the game terminals, to execute the common game or the like on the plurality of slot machines 10.

In more detail, the external control device 621 has a common game start part 6213, a game terminal selection part 6215, and a transmission/reception part 6217. The common game start determination part 6213 has a function to determine whether or not the common game start condition is established based on accumulated values of the bet amount information, each of which is transmitted in each unit base game from each of the slot machines 10; a function to output the game start instruction to each of the plurality of slot machines 10; and a function to display a state until the establishment of the common game start condition on the PTS terminal 700.

The determination of whether or not the common game start condition is established is conducted based on the accumulated values of the bet amount information and in addition thereto, can be conducted based on all of accumulated values whose number is increased by repeating the unit base game. For example, a number of times at which the base game is repeated and periods of time during which the base game is repeated may be the accumulated values.

Further, the common game start part 6213 has a function to output a game start instruction to each of the slot machines 10, on which the accumulated values whose number is increased by repeating the base game satisfies a game execution condition. Thus, the common game start part 6213 does not qualify a slot machine 10, on which the total of the accumulated values is less than the lowest set value, to participate in the common game, and therefore, it is made possible to motivate a player to actively repeat the base game.

Further, the common game start part 6213 has a function to monitor a non-inputting time during which the start operation is not conducted and to output the game start instruction to each of the slot machines 10 except each of the slot machines 10, on which the non-inputting time is a time-out time or more. Thus, it is made possible for the common game start part 6213 to determine that a player is not present on each of the slot machines 10, on which the base game is not executed over the time-out time or more, thereby allowing the execution of the common game on such a slot machine 10 to be avoided.

The game terminal selection part 6215 has a function to select specific slot machines 10 from among the plurality of slot machines 10 and to output a common game start instruction signal to each of said slot machines 10. The common game start instruction signal is to authorize each of the specific slot machines 10 to start the common game. The transmission/reception part 6217 has a function to allow the data to be transmitted and received to and from the slot machines 10.

(Operation of Gaming Machine 300)

The operation of the gaming machine 300 including the above-mentioned functional blocks will be described. Although in the present embodiment, the "game terminal" in the diagrams means a slot machine 10 for executing a slot game, the present invention is not limited thereto.

(Operations of Slot Machine 10)

The slot machine 10 which is the game terminal executes a terminal side process. Specifically, first, a base game process (for a base game or the like) is executed. The below-described series of operations are executed.

(Credit Input/Start-Check)

First, after inputting a credit, the slot machine 10 checks whether or not a BET button part 601 has been pressed by a player, and subsequently checks whether or not a SPIN button part 602 has been pressed by a player.

(Symbol Determination)

Next, when the SPIN button part 602 has been pressed by a player, the slot machine 10 extracts symbol determination random number values and determines symbols 501 to be displayed to a player at the time of stopping scrolling of symbol arrays 170, for a plurality of respective video reels displayed on a display 614A.

(Symbol Display)

Next, the slot machine 10 starts the scrolling of the symbol arrays 170 of the video reels and then stops the scrolling such that the determined symbols 501 are displayed to a player.

(Winning Determination)

Next, when the scrolling of the symbol arrays 170 of the video reels has been stopped, the slot machine 10 determines whether or not a combination of symbols displayed to a player is a combination associated with winning.

(Paying-Out)

Next, when the combination of symbols 501 displayed to a player is a combination associated with winning, the slot machine 10 awards benefits associated with a kind of the combination of the symbols to a player.

For example, when a combination of symbols 501 associated with a payout of coins has been displayed, the slot machine 10 pays out coins whose number corresponds to the combination of the symbols 501 to a player.

Next, it is determined whether or not winning of a bonus combination has occurred. When the winning of the bonus combination has occurred, a bonus game process is executed. Specifically, when TRIGGER symbols 504 whose number is a predetermined number or more have been rearranged in a symbol display area 150, the execution of free games is determined, and a drawing to determine whether or not a bonus game is executed is conducted. On the other hand, when the winning of the bonus combination has not occurred, the base game is executed again. In a period of time in which the base game including these base game and bonus game is executed, pieces of execution state information indicting the start and finishing of a unit game such as the base game and a bet amount in the unit game are transmitted to an external control device 621. Thus, the pieces of the execution state information of each of the slot machines 10 are collectively managed on the external control device 621.

(Operations of External Control Device 621)

When the slot machines 10 are operating as described above, the external control device 621 is executing a center side process described below while synchronizing with each of the slot machines 10.

First, the external control device 621 receives the execution state information from each of the slot machines 10 and acquires an execution state of the base game. Thereafter, based on a number of times at which the base game is repeated, accumulated bet amounts, and the like, the external control device 621 determines whether or not a common game start condition has been established on any of the slot machines 10. When the common game start condition has not been established, the external control device 621 continues the acquisition of the execution state of the base game on each of the slot machines 10.

On the other hand, when the common game start condition has been established, the game start instructions are concurrently outputted to the slot machines 10, each of which satisfies the game execution condition. Thereafter, specific slot machines 10 from among the slot machines 10 satisfying the game execution condition are selected, and a common game start authorization instruction is outputted to each of the specific slot machines 10.

Next, the external control device 621 waits until the common game start instruction transmitted from each of the specific slot machines 10 is received. When the common game start instruction has been received, with this reception as a trigger, winning or losing in the common game is determined as a game result. For example, any of winning, losing, and a draw is determined. When it is determined that the game result is not the draw, at least one part of the game result of the draw is skipped from a series of game results temporarily stored, and the remaining game results are sequentially outputted to each of the slot machines 10 as the game result information.

Thereafter, based on the game results, in each of which winning or losing has been determined, it is determined whether or not winning in the common game has occurred. When the losing has occurred, an execution state of the base game is newly acquired on each of the slot machines 10. On the other hand, when the winning has occurred, based on the bet amount placed in the common game on each of the slot machines 10, a money amount to be paid out is calculated, and the calculated money amount is transmitted to each of the slot machines 10 as paying-out information.

(Overall Configuration of Game System)

A gaming system 350 which includes gaming machines 300 having the above-described functions will be described.

Figure 23:
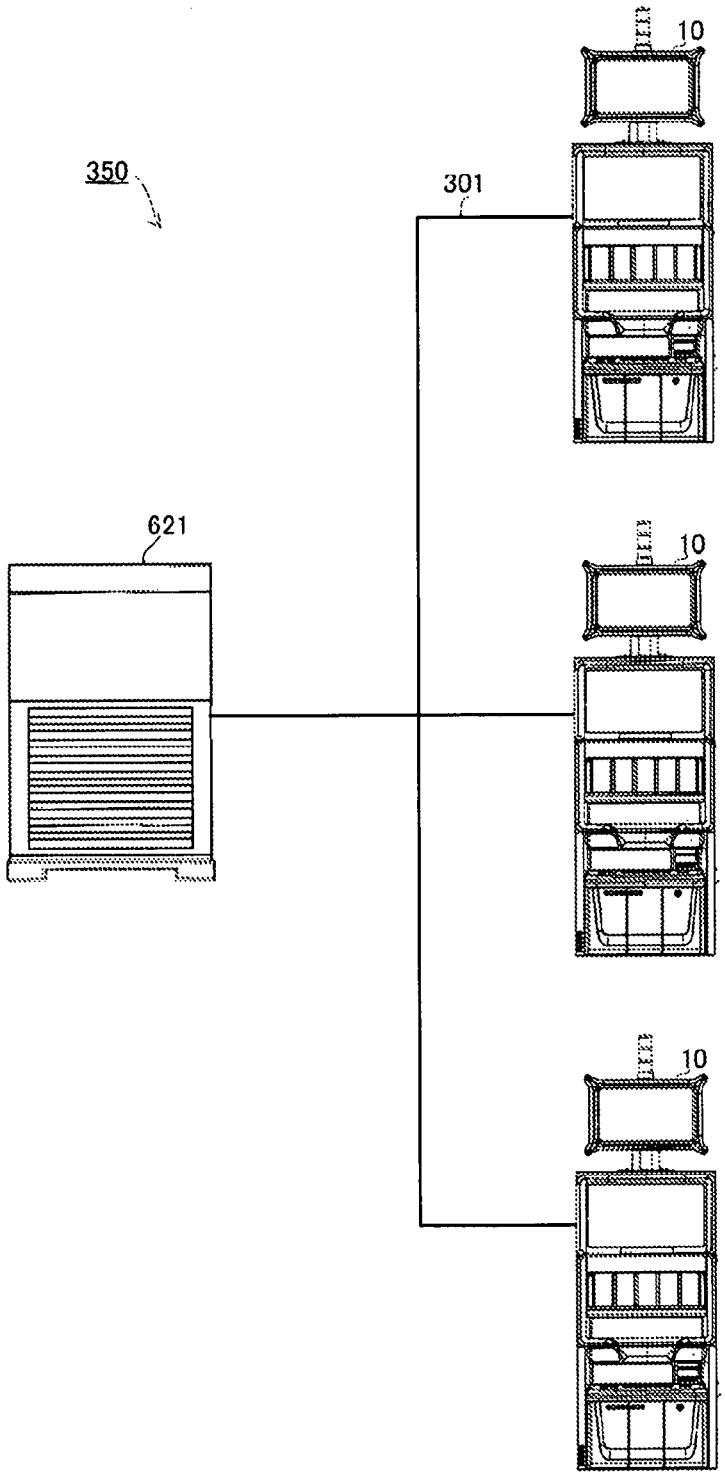
FIG. 23 is an explanatory diagram illustrating a connection configuration of a gaming system.

As shown in FIG. 23, the gaming system 350 includes a plurality of slot machines 10 and an external control device 621 which is connected to each of the slot machines 10 via a communication line 301.

The external control device 621 is to control the plurality of slot machines 10. In the present embodiment, the external control device 621 is the so-called hall server which is installed in a game facility having the plurality of slot machines 10. Each of the slot machines 10 is provided with a unique identification number, and the external control device 621 identifies transmission sources of data transmitted from the respective slot machines 10. In addition, in a case where data is transmitted from the external control device 621 to the slot machines 10, the identification numbers are used for specifying the transmission destination.

It is to be noted that the gaming system 350 may be constructed within a single game facility where various games can be conducted, such as a casino, or may be constructed among a plurality of game facilities. In addition, when the gaming system 350 is constructed in a single game facility, the gaming system 350 may be constructed in each floor or section of the game facility. The communication line 301 may be a wired or wireless line, and a dedicated line, an exchange line, or the like can be adopted.

Figure 24:
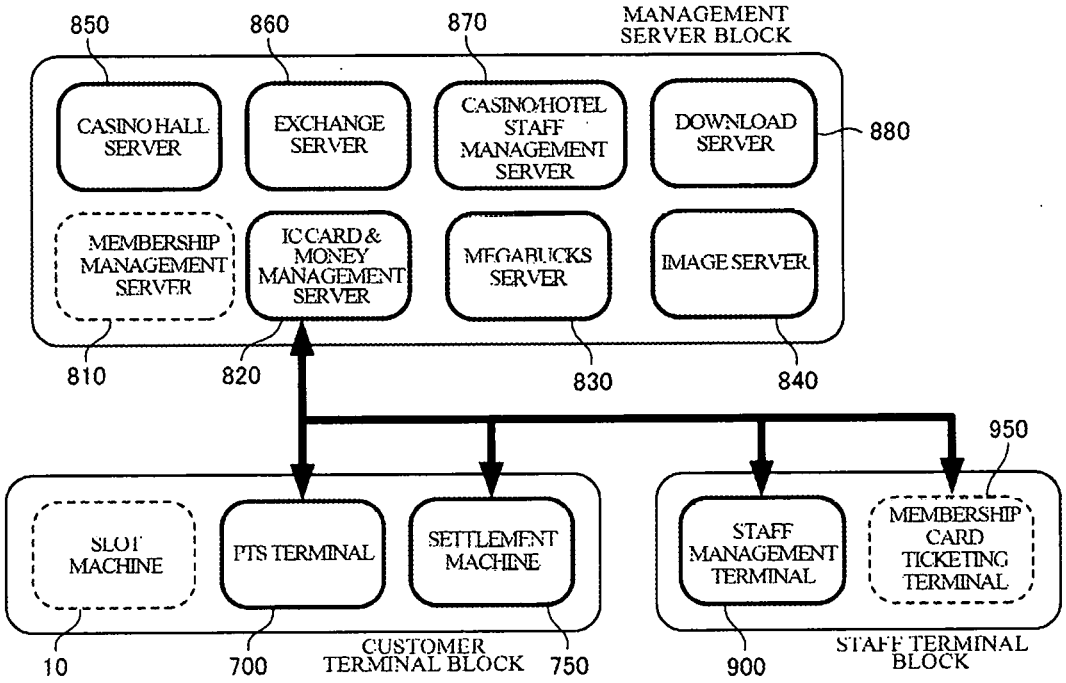
FIG. 24 is a block diagram of the gaming system.

As shown in FIG. 24, the gaming system includes three blocks which are a management server block, a customer terminal block, and a staff terminal block. The management server block has a casino hall server 850, an exchange server 860, a casino/hotel staff management server 870, and a download server 880.

The casino hall server 850 is a server for managing the whole casino hall in which slot machines 10 are installed. The exchange server 860 is a server for preparing exchange rate data based on exchange information or the like. The casino/hotel staff management server 870 is a server for managing staff of a casino hall or a hotel related to the casino hall. The download server 880 is a server for downloading, for example, the latest information such as information related to games and news and for notifying a player of such information through a PTS terminal 700 of each of the slot machines 10.

In addition, the management server block has a membership management server 810, an IC card & money management server 820, a megabucks server 830, and an image server 840.

The membership management server 810 is a server for managing membership information or the like of a player playing each of the slot machines 10. The IC card & money management server 820 is a server for managing an IC card used on each of the slot machines 10. Specifically, the IC card & money management server 820 is a server for storing fractional cash data so as to be associated with an identification code and for outputting the fractional cash data to the PTS terminal 700. The IC card & money management server 820 also prepares and manages denomination rate data or the like. The megabucks server 830 is a server for managing, for example, a game of megabucks in which the total sum of wagers placed on a plurality of slot machines 10 installed in a plurality of casino halls or the like is to be a payout. The image server 840 is a server for downloading, for example, the latest images such as images related to a game and news and for notifying a player of the latest images through the PTS terminal 700 of each of the slot machines 10.

The customer terminal block has a slot machine 10, a PTS terminal 700, and a settlement machine 750. The PTS terminal 700 can be attached to the slot machine 10 so as to allow mutual communication with the management server 800. The settlement machine 750 is a machine for exchanging cash data stored in an IC card, which a player has, for money for settlement and for storing cash data of coins, bills, or the like in the IC card.

The staff terminal block has a staff management terminal 900 and a membership card ticketing terminal 950. The staff management terminal 900 is a terminal with which staff of a casino hall manages the slot machines 10. In particular, in the case of the present embodiment, the staff of a casino hall manages whether a number of IC cards which are stocked in the PTS terminal 700 is in excess or in shortage. The membership card ticketing terminal 950 is a terminal used when a player playing a game in a casino hall issues a membership card.

(PTS Terminal 700)

Figure 25:
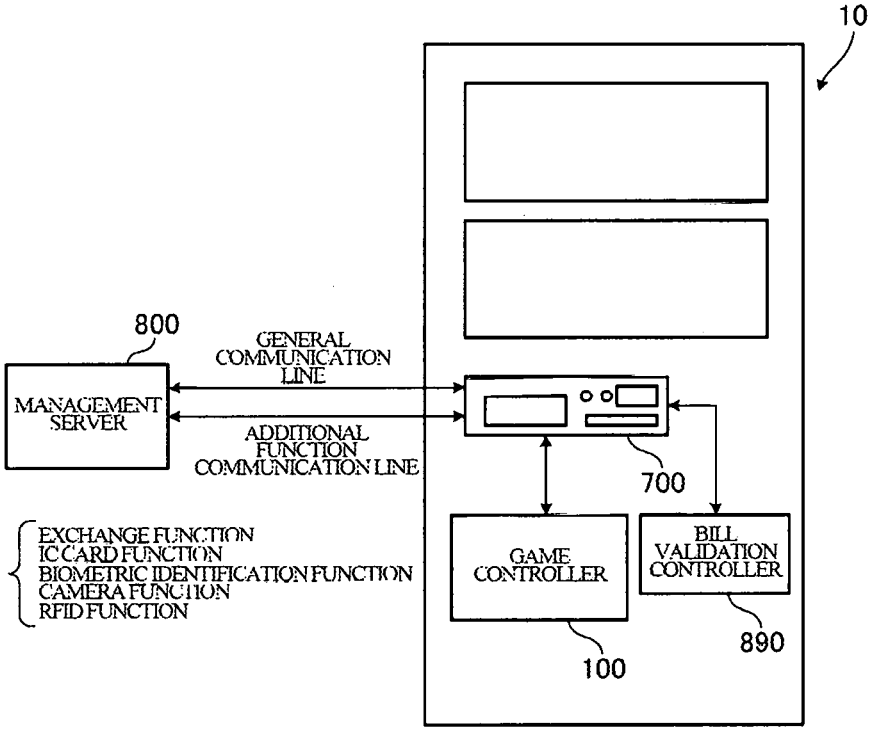
FIG. 25 is a block diagram of a PTS system.

As shown in FIG. 25, the PTS terminal 700 is incorporated into a PTS system. The PTS terminal 700 attached to a slot machine 10 is connected to a game controller 100 and a bill validation controller 890 of the slot machine 10 so as to be capable of communicating therewith.

The PTS terminal 700, for example, updates presentation of a game by sounds, images, and the like and credit data in the communication with the game controller 100. In addition, the PTS terminal 700 transmits credit data required for the settlement in the communication with the bill validation controller 890.

In addition, the PTS terminal 700 is connected to the management server 800 so as to be capable of communicating therewith. The PTS terminal 700 communicates with the management server 800, using two lines which are a general communication line and an additional function communication line.

On the general communication line, the PTS terminal 700 communicates, for example, data such as cash data, identification code data, membership information of a player, and the like. On the other hand, on the additional function communication line, the PTS terminal 700 performs communications related to newly added functions. In the case of the present embodiment, on the additional function communication line, the PTS terminal 700 performs communications related to an exchange function, an IC card function, a biometric identification function, a camera function, and an RFID (Radio Frequency IDentification) function which is a function to perform solid identification using radio waves.

(Mechanical Configuration of Slot Machine)

Figure 26:
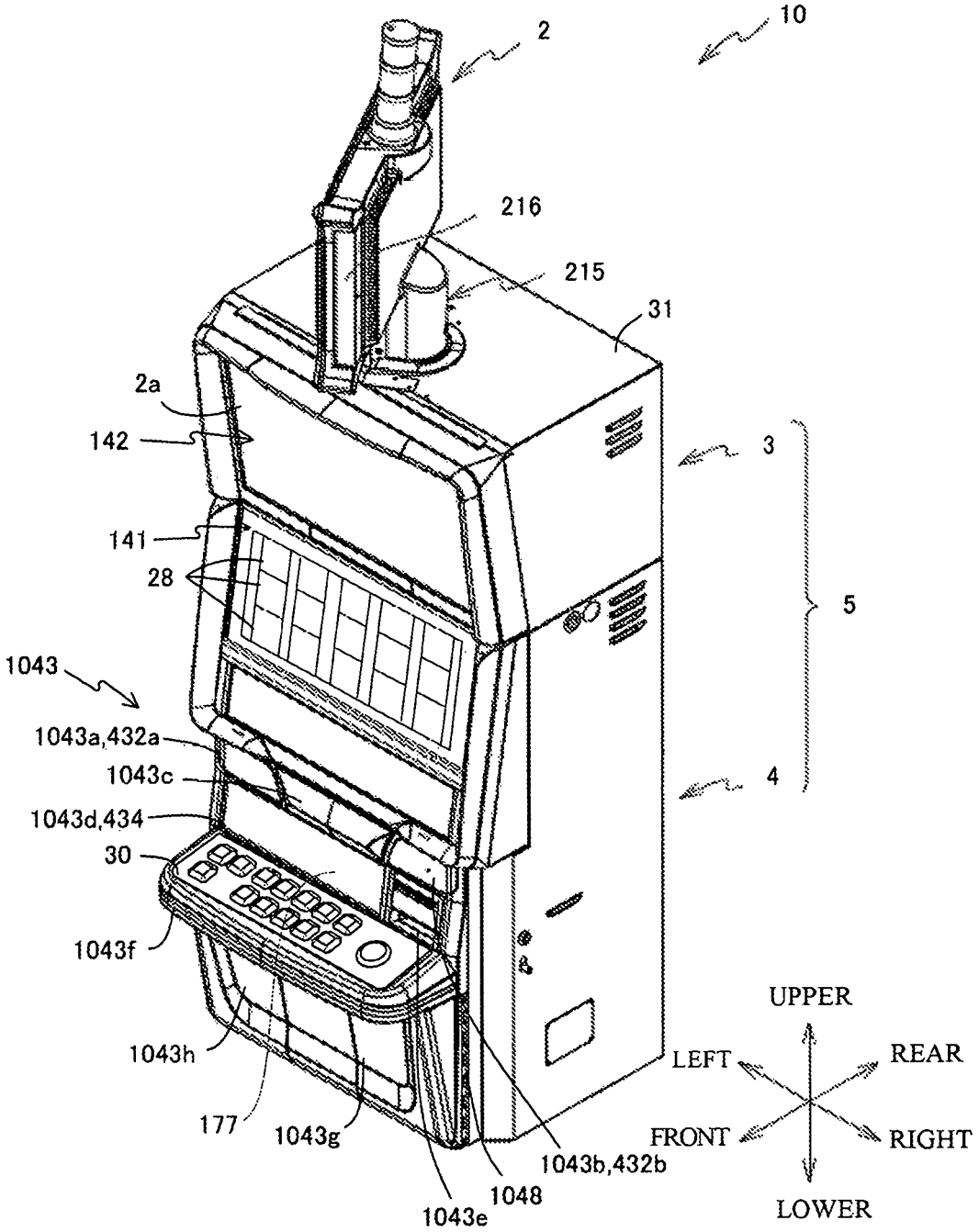
FIG. 26 is a perspective view illustrating a slot machine as the gaming machine.
Figure 36:
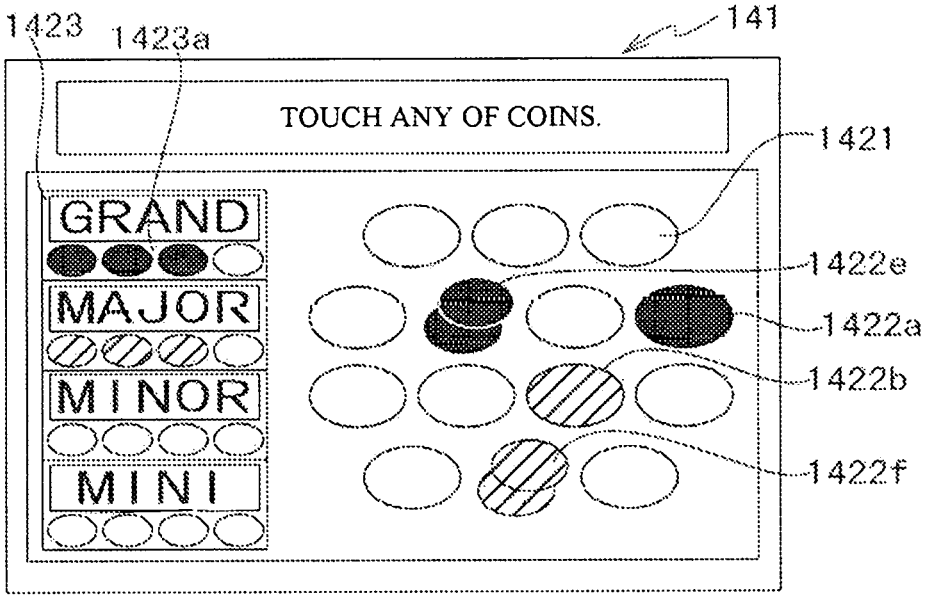
FIG. 36 is an explanatory diagram illustrating one example of a display screen in the bonus game.

With reference to FIG. 26, FIG. 27, and FIG. 36, an overall configuration of a slot machine 10 will be described.

In the slot machine 10, used as gaming media are coins, bills, or electronic valuable information being equivalent to these. In particular, in the present embodiment, credit-related data such as cash data stored in an IC card is used.

The slot machine 10 has a topper device 2 and a gaming machine main body 5 with the topper device 2 provided on its upper surface wall. The gaming machine main body 5 has a top device 3 which includes two image display panels 141 and 142 (displays 614A and 614B shown in FIG. 21) and an apparatus main body 4 with the top device 3 provided on its upper surface wall.

The topper device 2 has a function to make the slot machine 10 conspicuous even from a remote location and has a function to allow the contents of a game on the slot machine 10 to be visually recognized even from the remote location.

The top device 3 has a function to display game related information such as specific contents of a game, bonus ranks, payout amounts, payout tables, and rules. The apparatus main body 4 has a function to execute a game.

The topper device 2 is provided on the upper surface wall of the top device 3 so as to be located on the highest position of the slot machine 10. The topper device 2 has a rotation axis which coincides with a vertical direction of the slot machine 10 and is configured to be rotatable within a predetermined angle in a normal direction and a reverse direction, with this rotation axis as the center. Thus, the topper device 2 is operable to switch between a front posture in which a display face 2A of a liquid crystal display device for displaying the game contents faces forward and a slanting posture in which the display face 2A face slantingly forward. The front posture is a posture which is adopted in a normal state such as when a game is executed and when the game is in a standby state so as to allow people being far away from the slot machine 10 (players, persons related to a game arcade, and the like) to visually recognize game contents. On the other hand, the slanting posture is a special posture which is adopted when the display in the topper device 2 is modified. The slanting posture allows the work of modifying the display in the topper device 2 from a front side of the slot machine 10 by positioning a side plate cover 216 (replacement mechanism) located in an edge portion of a right side of the topper device 2 on a front side.

In addition, the top device 3 has a top box 31 and a middle image display panel 142 (liquid crystal display device), which is provided on a front face of the top box 31, for displaying bonus ranks, payout amounts, payout tables, and the like.

A front face and a lower face of the apparatus main body 4 are opened. A screen displayed on the lower image display panel 141 has a symbol display area 150 in its central portion. The symbol display area 150 is constituted of 15 display blocks 28, that is, 5 columns×3 rows. Three display blocks 28 of each of the respective columns form each of pseudo reels 151 to 155. The three display blocks 28 are displayed in a downward moving manner while a speed is wholly being changed, whereby each of the pseudo reels 151 to 155 is operable to move symbols 501 displayed in the display blocks 28 in a vertical direction in a rotating manner (displayed in a varying manner) and thereafter, to stop the display blocks 28 for the rearrangement. The details of the display screen of the lower image display panel 141 will be described later.

It is to be noted that although in the present embodiment, the case where the slot machine 10 is the so-called video slot machine is described, in the slot machine 10 according to the present invention, the so-called mechanical reels may be substituted for a part or all of the pseudo reels 151 to 155.

On a front face of the lower image display panel 141 (liquid crystal display device), a touch panel 69 is provided. The touch panel 69 allows a player to touch and operate a display screen of the lower image display panel 141 and to thereby input a variety of instructions. An input signal is transmitted from the touch panel 69 to a main CPU 71 (refer to FIG. 27).

Below the lower image display panel 141, a control panel 30 is arranged. As shown in FIG. 49, the control panel 30 includes a variety of buttons, a coin entry for accepting coins into a cabinet 11, a bill entry, and the like. On the control panel 30, a TAKE WIN/COLLECT button 32 and a SERVICE button 45 are arranged in positions in an anteroposterior direction from a player's side toward the depth. Onto the right side of the TAKE WIN/COLLECT button 32, a GAMBLE button 31 is arranged. On the central rear side thereof, a 1-BET button 34, a 2-BET button 35, a 3-BET button 36, a 4-BET button 37, and a 5-BET button 38 are arranged. Further, on the control panel 30, a PLAY 8 CREDITS button 40, a PLAY 18 CREDITS button 41, a PLAY 38 CREDITS button 42, a PLAY 68 CREDITS button 43, and a PLAY 88 CREDITS button 44 are arranged on the central front side. The control panel 30 includes a SPIN button 46 in a lower portion of an area on the right side. In addition, although not shown, LEDs are incorporated into the buttons 31 to 38 and the buttons 40 to 46 so as to be operable to be turned ON/OFF. The details of the control panel 30 will be described later.

A lower door device 1043 onto which a controller 30 is attached has a front mask part 1043*c* which is arranged in the central portion of an upper part thereof; speaker parts 1043*a* and 1043*b* which are arranged so as to be bilaterally symmetric with the front mask part 1043*c* as the center; a PTS part 1043*d*; and a bill part 1043*e* which is arranged on the right side of the PTS part 1043*d*. Further, the lower door device 1043 has a control panel part 1043*f* which is arranged below the PTS part 1043*d* and the bill part 1043*e*; a bill cover part 1043*g* which is arranged below the right side of the control panel part 1043*f*; and a lower front cover part 1043*h* which is arranged on the left side of the bill cover part 1043*g*. These parts 1043*a* to 1043*h* are formed by incorporating a variety of members into a lower door base member 1438.

The front mask part 1043*c* has a front mask cover 431 having a top part on the front side, on the frontmost face. The speaker parts 1043*a* and 1043*b* have speaker covers 432*a* and 432*b*, which have a multitude of holes, on the frontmost face and speakers which are arranged on the rear sides of the speaker covers 432*a* and 432*b*. The PTS part 1043*d* has a PTS cover 434 on the frontmost face and the PTS cover 434 is replaced with a FTS terminal 700 to be attached, not shown, as necessary.

The PTS terminal 700 has integrated thereinto a variety of devices having a microphone function, a camera function, a speaker function, a display function, and the like, thereby forming one unit. Specifically, the PTS terminal 700 has an LCD, a human body detection camera, a microphone, bass reflex type speakers, and the like. The human body detection camera is operable to detect, with the camera function, whether or not a player is present. The microphone is used to allow a player to participate in a game with his or her voice and to authenticate a player with voice recognition. The speakers perform presentation of a game with audio and output sounds for notifying that an IC card is left unremoved. Further, the speakers output notification sounds also in a case when the authentication of an inserted IC card fails.

In the PTS terminal 700, LEDs and a card insertion slot are provided. The LEDs notify a player of the remaining number of IC cards accumulated in a card stacker through lighting-up in a plurality of colors. The card insertion slot has a mechanism with which IC cards are inserted or removed. An IC card has a display part. Although while a player is playing a game, the IC card is completely inserted thereinto, upon the settlement, the IC card is ejected such that the display part thereof is exposed. Thus, a player can confirm credit-related data such as updated cash data. Further, the IC card may be retained without being completely inserted thereinto even while a player is playing a game such that the display part thereof is exposed. Thus, a player can confirm a view in which a credit is updated during a play of a game.

Upon the settlement of a credit, in a case when it is detected by using the human body detection camera that a player is not present, the IC card is drawn there inside and is kept in the card stacker. Thus, for example, even in a case when a player has confirmed with the display part that an amount of the remaining credit is small and has left his or her seat intentionally with the IC card being left, it does not occur that the IC card is left inserted for a long period of time.

In addition, as described above, in the PTS terminal 700, a VFD 177 is provided. As shown in FIG. 26, in the central portion of the VFD 177, a game status area 1620 is provided to be operable to display a status of a game. In the game status area 1620, a bonus state 1621, a winning content 1622, an obtained credit 1623, and the like are displayed. In addition thereto, a CREDIT meter, a total bet number meter, a denomination meter, a line meter, a BET meter, and a win meter are displayed.

(Electrical Configuration of Slot Machine)

Next, with reference to FIG. 27, a configuration of circuitry which a slot machine 10 includes will be described.

A gaming board 50 is provided with: a CPU 51, a ROM 52, and a boot ROM 53, which are mutually connected by an internal bus; a card slot 55 corresponding to a memory card 54; and an IC socket 57 corresponding to a GAL (Generic Array Logic) 56.

The memory card 54 is constituted of a non-volatile memory and stores a game program and a gaming system program. The game program includes a program related to game progression and a program for executing presentation by images and sounds. In addition, the above-mentioned game program includes a symbol determination program. The symbol determination program is a program for determining symbols to be rearranged in display blocks 28.

In addition, the game program includes: base game symbol table data showing a base game symbol table which indicates a correspondence relationship of each symbol of each symbol array of each display block, each code No., and each random number value; bonus game symbol table data showing a bonus game symbol table which indicates a correspondence relationship of each symbol of each symbol array of each display block, each code No., and each random number value; symbol No. determination table data showing a symbol No. determination table; code No. determination table data showing a code No. determination table; WILD symbol increased number determination table data showing a WILD symbol increased number determination table; a TRIGGER symbol increased number determination table data showing a TRIGGER symbol increased number determination table; odds data which indicates a correspondence relationship of each kind and each number of symbols rearranged on each activated line and each payout amount, and the like.

In addition, the card slot 55 is configured such that the memory card 54 can be inserted thereinto and removed therefrom and is connected to a motherboard 70 by an IDE bus. Accordingly, a kind and the contents of a game to be played on the slot machine 10 can be changed by pulling out the memory card 54 from the card slot 55, writing another game program into the memory card 54, and inserting the memory card 54 into the card slot 55.

The GAL 56 is a kind of PLD (Programmable Logic Device) having a fixed OR array structure. The GAL 56 is provided with a plurality of input ports and output ports, and predetermined input into the input port causes output of the corresponding data from the output port.

In addition, the IC socket 57 is configured such that the GAL 56 can be inserted thereinto and removed therefrom and is connected to the motherboard 70 by a PCI bus. The contents of the game to be played on the slot machine 10 can be changed by replacing the memory card 54 with another memory card 54 having another program written therein or by rewriting the program written into the memory card 54 as another program.

The CPU 51, the ROM 52 and the boot ROM 53 mutually connected by the internal bus are connected to the motherboard 70 by a PCI bus. The PCI bus enables a signal transmission between the motherboard 70 and the gaming board 50, and power supply from the motherboard 70 to the gaming board 50.

The ROM 52 stores an authentication program. The boot ROM 53 stores a pre-authentication program, a program (boot code) to be used by the CPU 51 for activating the pre-authentication program, and the like.

The authentication program is a program (tamper check program) for authenticating the game program and the gaming system program. The pre-authentication program is a program for authenticating the aforementioned authentication program. The authentication program and the pre-authentication program are written along a procedure (authentication procedure) for proving that the program to be the subject has not been tampered.

The motherboard 70 is configured by using a commercially available general-purpose motherboard (a printed circuit board on which basic components of a personal computer are mounted) and includes a main CPU 71, a ROM (Read Only Memory) 72, a RAM (Random Access Memory) 73, and a communication interface 82. It is to be noted that the motherboard 70 is equivalent to a game controller 100 in the present embodiment.

The ROM 72 is constituted of a memory device such as a flash memory and stores a program such as a BIOS (Basic Input/Output System) to be executed by the main CPU 71 and permanent data. When the BIOS is executed by the main CPU 71, processing for initializing predetermined peripheral devices is conducted; further, through the gaming board 50, processing of loading the game program and the gaming system program stored in the memory card 54 is started. It is to be noted that in the present invention, the ROM 72 may be a memory whose contents are rewritable or are not rewritable.

The RAM 73 stores data and programs such as a symbol determination program which are used in operation of the main CPU 71. For example, when the processing of loading the above-mentioned game program, gaming system program, or authentication program is conducted, the RAM 73 can store the program. The RAM 73 is provided with working areas used for operations in the execution of these programs. Examples of the areas include: an area that stores counters for managing the number of plays, the number of BETs, the number of payouts, the number of credits and the like; and an area that stores symbols (code numbers) determined by a drawing.

The communication interface 82 is to communicate with the external control device 621 such as a server, through the communication line 301. Further, the motherboard 70 is connected with the later-described door PCB (Printed Circuit Board) 90 and a main body PCB 110 by respective USBs. The motherboard 70 is also connected with a power supply unit 81. Further, connected to the motherboard 70 is a PTS terminal 700 by a USB.

When the power is supplied from the power supply unit 81 to the motherboard 70, the main CPU 71 of the motherboard 70 is activated, and then the power is supplied to the gaming board 50 via the PCI bus so as to activate a CPU 51.

The door PCB 90 and the main body PCB 110 are connected with input devices such as switches and a sensor, and peripheral devices, the operations of which are controlled by the main CPU 71.

The door PCB 90 is connected with a control panel 30, a reverter 91, a coin counter 92C and a cold cathode tube 93.

The control panel 30 is provided with a COLLECT switch 32S, a 1-BET switch 34S, a 2-BET switch 35S, a 3-BET switch 36S, a 4-BET switch 37S, a 5-BET switch 38S, a PLAY 8 CREDITS switch 40S, a PLAY 18 CREDITS switch 41S, a PLAY 38 CREDITS switch 42S, a PLAY 68 CREDITS switch 43S, a PLAY 88 CREDITS switch 44S, a service switch 45S, and a spin switch 46S which correspond to the above-mentioned respective buttons. Each of the switches outputs a signal to the main CPU 71 upon detection of press of the button corresponding thereto by a player.

Inside of a coin entry 39, the reverter 91 and the coin counter 92C are provided. The reverter 91 identifies whether or not coins inputted into the coin entry 39 are legitimate and revers coins other than legitimate coins are discharged from a coin payout exit. In addition, the coin counter 92C detects the accepted legitimate coins and counts the number thereof.

The reverter 91 operates based on a control signal outputted from the main CPU 71 and distributes legitimate coins validated by the coin counter 92C into a hopper 113 or a cash box. That is, coins are distributed into the hopper 113 when the hopper 113 is not filled with coins, while coins are distributed into the cash box when the hopper 113 is filled with coins, respectively.

The cold cathode tube 93 functions as a backlight installed on the rear face sides of a presentation mechanism 131 and a lower image display panel 141 and lights up based on a control signal outputted from the main CPU 71.

The main body PCB 110 is connected with the presentation mechanism 131, speakers 112, the hopper 113, a coin detection part 113S, a touch panel 69, a bill entry 22, a graphic board 130, a key switch 173S, and a data display 174. The speakers 112 output sounds such as BGM, based on a control signal outputted from the main CPU 71.

The hopper 113 operates based on a control signal outputted from the main CPU 71 and pays out coins of the specified number of payouts from the coin payout exit to a coin tray not shown. The coin detection part 113S outputs a signal to the main CPU 71 upon detection of coins paid out by the hopper 113.

The touch panel 69 detects a position on the lower image display panel 141 touched by a player's finger or the like and outputs to the main CPU 71 a signal corresponding to the detected position.

The bill entry 22 identifies whether or not bills are legitimate and accepts legitimate bills into the cabinet 11. An amount of the bills inputted in the cabinet 11 is converted to a number of coins and a credit which is equivalent to the converted number of coins is added as a credit which a player has.

The graphic board 130 controls display of images conducted by the respective lower image display panel 141, middle image display panel 142, and upper image display panel 143 based on a control signal outputted from the main CPU 71. The graphic board 130 is provided with a VDP (Video Display Processor) generating image data, a video RAM temporarily storing the image data generated by the VDP, and the like. It is to be noted that the image data used in generation of image data by the VDP is included in the game program that has been read from the memory card 54 and stored into the RAM 73.

The key switch 173S is provided in a keypad 173 and outputs a predetermined signal to the main CPU 71 when the keypad 173 has been operated by a player. The data display 174 displays data read by a card reader 172 and data inputted by a player via the keypad 173, based on a control signal outputted from the main CPU 71.

(Symbols, Combinations, and Others)

Symbols 501 to be displayed on pseudo reels 151 to 155 of the above-described slot machine 10 form symbol arrays 170 in which base game symbols 502, special symbols 503, TRIGGER symbols 504, and WILD symbols 505 are arrayed. Specifically, on the pseudo reels 151 to 155, symbol arrays 170A, 170B, 170C, 170D, and 170E shown in any of FIG. 8 to FIG. 17 are displayed in a scrolling manner. Since all of probabilities with which the respective symbols 501 are rearranged are the same as one another, rearrangement probabilities are set based on numbers of kinds of symbols in the symbol arrays 170.

The rearrangement probabilities for the symbols 501 are not limited thereto, and a rearrangement probability for each of the symbols may be set. For example, upon determining symbols 501 to be rearranged, which are used in a base game, a symbol drawing table may be used. The symbol drawing table makes each of the respective symbols 501 in display blocks 28 in each of the respective symbol arrays and each code No. correspond to each other and makes each value range of numerical values and makes a range of random numbers for selecting symbols to be arranged from the respective symbol arrays as a range of numerical values corresponding to the numbers of symbols of the respective symbol arrays and each code No. correspond to each other. A way of setting the range may be even or uneven. For example, when the way is setting the range is uneven, each probability with which winning occurs depending on a range of random number values can be adjusted by a kind of the symbols 501. A plurality of symbol drawing tables may be used in accordance with game states. For example, symbol drawing tables for the base game and free games, which are different from each other, may be used.

As the base game symbols 502, there are six kinds of symbols: "9", "10", "JACK", "QUEEN", "KING", and "ACE". In addition, as the special symbols 503, as described above, there are BAT symbols 503*e*, GOURD symbols 503*d*, FISH symbols 503*c*, POT symbols 503*b*, and DRAGON symbols 503*a*. In addition, as the WILD symbols 505, there are two kinds of symbols: normal WILD symbols 505*a* and 2×WILD symbols 505*b*. Each of the WILD symbols 505 is a symbol which triggers the execution of a drawing for a bonus game and is replaced with each of the base game symbols 502, special symbols 503, and TRIGGER symbols 504. It is to be noted that when the 2× WILD symbol 505*b* is rearranged, a payout and a drawing probability of the bonus game are doubled. In addition, the normal WILD symbols 505*a* are present only in a symbol array 170*b* and a symbol array 170*d* on the pseudo reels 152 and the pseudo reels 154. In addition, the 2× WILD symbol 505*b* is present only in a symbol array 170*c* on the pseudo reel 153. In addition, each of the TRIGGER symbols 504 is a symbol which triggers the execution of the free games.

Figure 28:
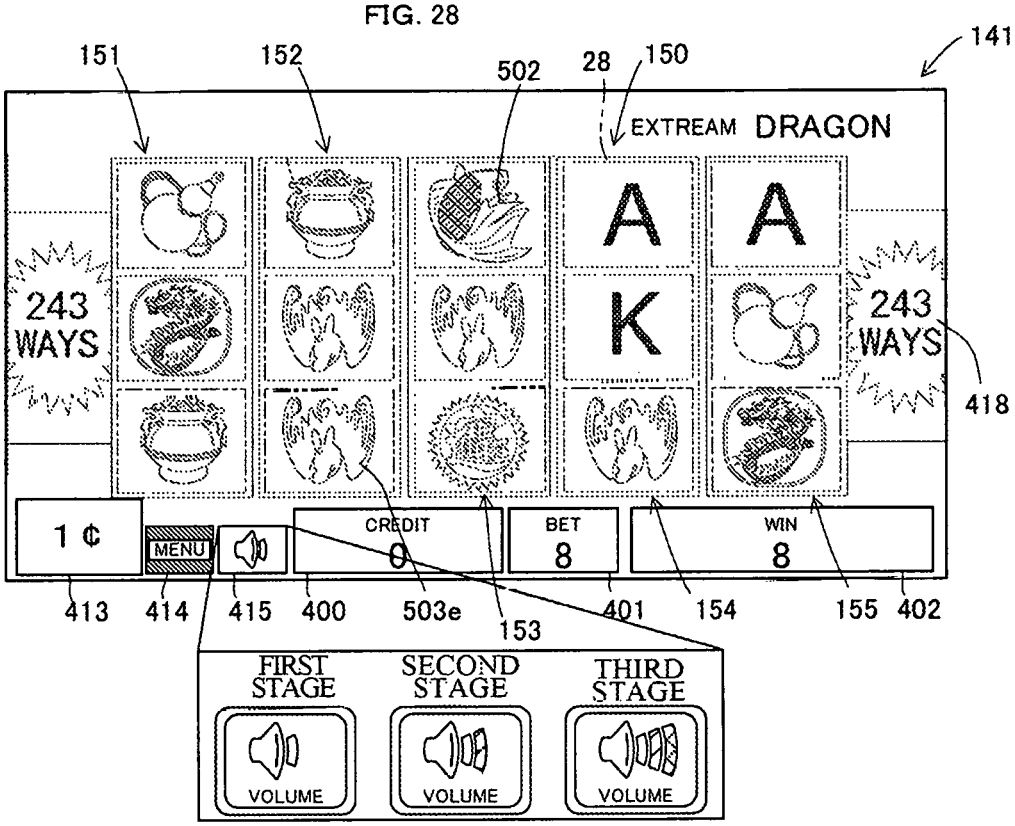
FIG. 28 is an explanatory diagram illustrating one example of a base game screen on a lower image display panel.

Three successive symbols 501 in the symbol arrays, as shown in FIG. 28, are displayed (arranged) in an upper row, a middle row, and a lower row in display areas of each of the pseudo reels 151 to 155, thereby configuring a symbol matrix of 5 columns×3 rows in a symbol display area 150. At least when a SPIN button 46 is pressed and a game is started, scrolling of the symbols 501 configuring the symbol matrix is started. When a predetermined time period has passed from the start of scrolling, scrolling of the respective symbols 501 is stopped (the respective symbols are rearranged).

In addition, with respect to the respective symbols 501, a variety of winning combinations are previously set. It is to be noted that each of the winning combinations means the establishment of winning Each of the winning combinations is a combination of symbols 501 stopped on an activated line, which is advantageous for a player. The advantageous state is a state in which coins corresponding to a winning combination are paid out, a state in which a number of coins to be paid out is added to a credit, a state in which a bonus game is started, and the like.

As the winning combinations in the present embodiment, there are winning combinations, each of which generates a scatter win, and winning combinations, each of which generates a line win. Specifically, the scatter win is generated by the TRIGGER symbol(s) 504 which triggers the execution of the free game and triggers of the execution of a drawing of the bonus game. When the TRIGGER symbol (s) 504 is/are rearranged in the symbol display area 150, a payout associated with a number of the rearranged TRIGGER symbol(s) is awarded.

In addition, the line win is generated by the base game symbols 502, the special symbols 503, and WILD symbols 505. In the present embodiment, paylines are not limited, all of patterns (243 patterns) which are present over the pseudo reel 151 to pseudo reel 155 are paylines. In other words, when on the respective pseudo reels 151 to 155 in the symbol display area 150, symbols 501 whose kind is the same are rearranged in any of the upper row, the middle row, and the lower row, the line win is established. In an example shown in FIG. 28, since the BAT symbols 503*e* are rearranged on the pseudo reels 152 to 154, 3 of a Kind of the BAT symbols 503*e* is established. It is to be noted that paylines for establishing line wins may be set.

It is to be noted that a drawing for the symbols 501 to be rearranged in the base game is conducted when the SPIN button 46 is pressed down. In addition, a drawing for the symbols 501 to be rearranged in each of the free games is conducted immediately before displaying the respective pseudo reels 151 to 155 in a varying manner is started. In addition, a drawing to determine whether or not the bonus game is executed is conducted when WILD symbol(s) 505 is(are) rearranged in the symbol display area 150. In addition, a drawing to determine a bonus in the bonus game is conducted when the WILD symbol(s) 505 is(are) rearranged in the symbol display area 150 and a screen with a presentation image is thereby switched to a bonus game screen.

(Display Screen: Payout Table)

As shown in FIG. 2, on a middle image display panel 142, payout tables in the respective wins shown in FIG. 7 are displayed. Specifically, on the middle image display panel 142, a first payout table 1431 is displayed in the left end portion thereof, a second payout table 1432 is displayed in the right end portion thereof, and jackpot amounts 1433 (payout amounts) and jackpot names 1434 (bonus ranks) are displayed in the central portion thereof. In the first payout table 1431 and the second payout table 1432, credit numbers, each of which can be obtained by each of the variety of winning combinations, are displayed, with a payout multiplier for each of the displayed credit numbers being one time. In the first payout table 1431, payouts to be obtained by the DRAGON symbols 503*a* and the POT symbols 503*b* are displayed. With respect to the winning combinations of the DRAGON symbols 503*a*, a payout is a 58-credit in a case of 3 of a Kind; a payout is a 188-credit in a case of 4 of a Kind; and a payout is a 688-credit in a case of 5 of a Kind. In addition, with respect to the winning combinations of the POT symbols 503*b*, a payout is a 25-credit in a case of 3 of a Kind; a payout is a 60-credit in a case of 4 of a Kind; and a payout is a 300-credit in a case of 5 of a Kind.

In addition, in the first payout table 1431, explanations regarding the WILD symbols 505 are displayed. Specifically, displayed in the first payout table 1431 are the explanations regarding the 2× WILD symbol 505*b* that the 2× WILD symbol 505*b* substitutes for all symbols except the WILD symbols 505; that when the 2× WILD symbol 505*b* is included in a winning combination, a payout is doubled; and that the 2× WILD symbol 505*b* appears only on a third reel (pseudo reel 153). In addition, displayed in the first payout table 1431 are the explanations regarding the normal WILD symbols 505*a* that each of the normal WILD symbols 505*a* substitutes for all symbols except the WILD symbols 505; and that the normal WILD symbols 505*a* appear only on a second reel and on a fourth reel (pseudo reels 152 and 154).

In the second payout table 1432, payouts of the TRIGGER symbols 504, the FISH symbols 503*c*, the GOURD symbols 503*d*, and the BAT symbols 503*e* are displayed. As the payouts of the scatter-type TRIGGER symbols 504, a payout is a 3-credit in a case of 3 of a Kind; a payout is a 8-credit in a case of 4 of a Kind; and a payout is a 58-credit in a case of 5 of a Kind. As the payouts of the winning combinations of the FISH symbols 503*c*, a payout is a 20-credit in a case of 3 of a Kind; a payout is a 45-credit in a case of 4 of a Kind; and a payout is a 125-credit in a case of 5 of a Kind. As the payouts of the winning combinations of the GOURD symbols 503*d*, a payout is a 15-credit in a case of 3 of a Kind; a payout is a 30-credit in a case of 4 of a Kind; and a payout is a 100-credit in a case of 5 of a Kind. As the payouts of the winning combinations of the BAT symbols 503*e*, a payout is a 10-credit in a case of 3 of a Kind; a payout is a 15-credit in a case of 4 of a Kind; and a payout is a 60-credit in a case of 5 of a Kind.

As the jackpot amounts 1433, payout amounts of four kinds of bonuses are displayed, and the jackpot names 1434 indicating names of the bonuses (GRAND, MAJOR, MINOR, and MINI) are given thereto. The pieces of information to be displayed as the jackpot amounts 1433 are changed in accordance with the states. It is to be noted that on the lower image display panel 141 and the middle image display panel 142, number fonts whose widths are different from one another are used properly in accordance respective numbers of digits displayed as respective numerical values.

(Free Games)

Figure 29:
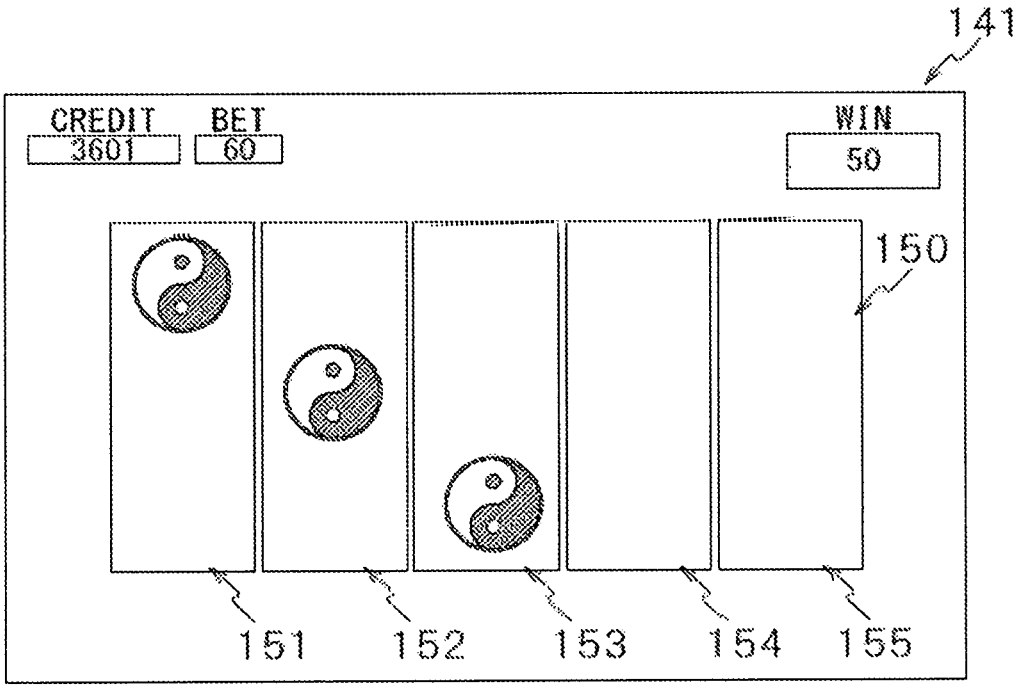
FIG. 29 is an explanatory diagram illustrating one example of a state in which the free games are triggered.

Next, free games will be described. An initial number of free games is 10. As shown in FIG. 29, when TRIGGER symbols 504 whose number is a predetermined number (for example, three TRIGGER symbols 504) or more are rearranged, the free games are executed. In the free games, symbol arrays 170 (refer to FIG. 13 to FIG. 17) which are different from those used in the base game are used. In each of the free games, when the TRIGGER symbols 504 whose number is a predetermined number (for example, three TRIGGER symbols 504) are rearranged, a retrigger with which 10 is added to a number of the remaining free games occurs. In the present embodiment, although a number of times at which the retrigger occurs is not limited, the present invention is not limited thereto.

Figure 30:
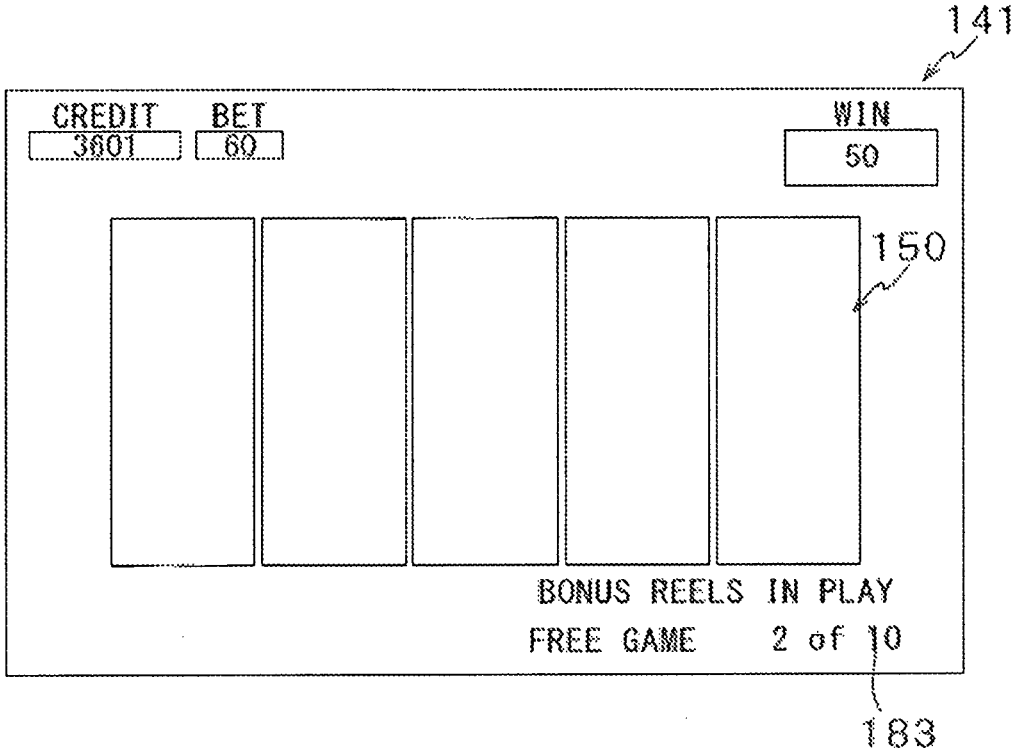
FIG. 30 is an explanatory diagram illustrating one example of a display screen in the free games.

The TRIGGER symbols 504 whose number is the predetermined number or more are rearranged and "10 FREE GAMES" is displayed on a lower image display panel 141. After darkening, on pseudo reels 151 to 155, changing to symbol arrays 170 for the free games, which correspond to a bet number placed in the immediately previous base game, is conducted. In addition, as shown in FIG. 30, in a right lower portion of the lower image display panel 141, a free game counter 183 is displayed. In the free game counter 183, the total number of free games and a number of the counted free games are displayed. For example, in a case where "2 OF 10" is displayed in the free game counter 183, it is indicated that 10 free games are set to be executable and at present, two free games have been counted. In other words, a player is notified that each one of the free games proceeds. It is to be noted that a count value before starting each of the free games is "0", and upon starting of displaying pseudo reels 151 to 155 in a varying manner, one is concurrently added to the count value, and image presentation, in which the count value is displayed in an expanded manner, is conducted concurrently with audio presentation. In addition, the free game counter 183 displays that a game is being played with bonus reels and a current game is a free game. Displaying the symbol arrays 170 in the varying manner in the symbol display area 150 is automatically started. When a win has occurred in each of the free games, the later-described win screen is displayed.

When the remaining number of free games have been consumed and the free games have been finished, the total credit obtained is displayed on the lower image display panel 141 and thereafter, the game returns to a base game. In addition, during each of the free games, when the TRIGGER symbols 504 whose number is the predetermined number or more are rearranged, as mentioned above, the presentation is conducted by audio of "ringing" sound and thereafter, 10 is added to a value in the free game counter 183. For example, the display in the free game counter 183 is changed from "3 of 10" to "3 of 20". In addition, the later-described win presentation is conducted through the establishment of the scatter by the TRIGGER symbols 504.

In addition, when no win has occurred in one free game, two seconds of a standby time is provided from when the rearrangement on the pseudo reels 151 to 155 is completed to when displaying in the varying manner in the next free game is started. It is to be noted that the standby time may be skipped by a SPIN button 46 or the like. It is to be noted that in the present embodiment, a reel spin by the SPIN button 46 or the like is made impossible.

Figure 31:
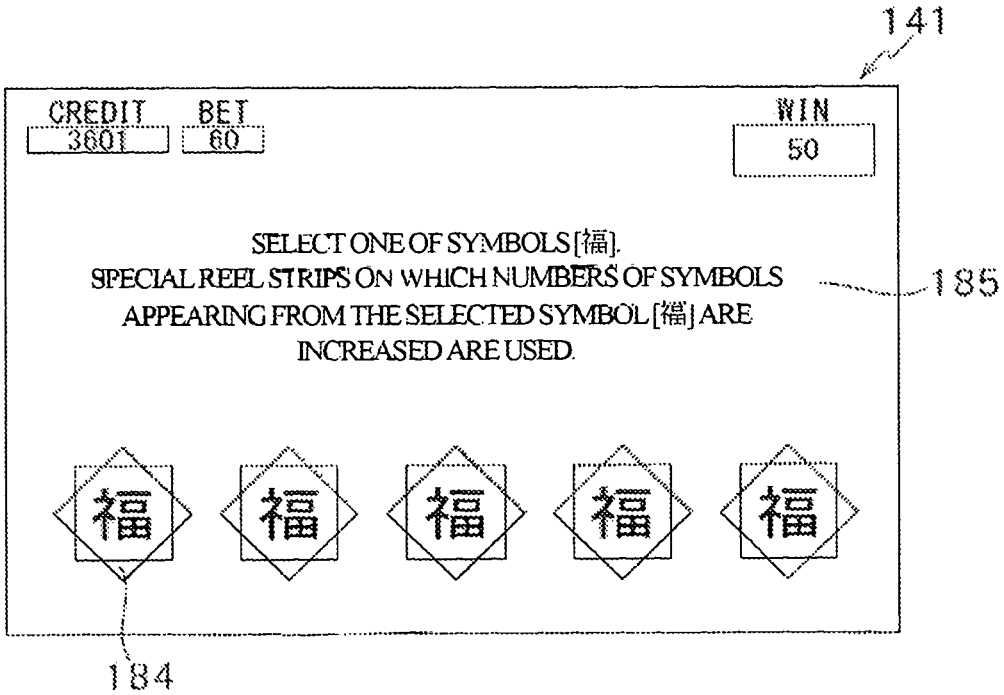
FIG. 31 is an explanatory diagram illustrating one example of a display screen in a selection game.
Figure 32:
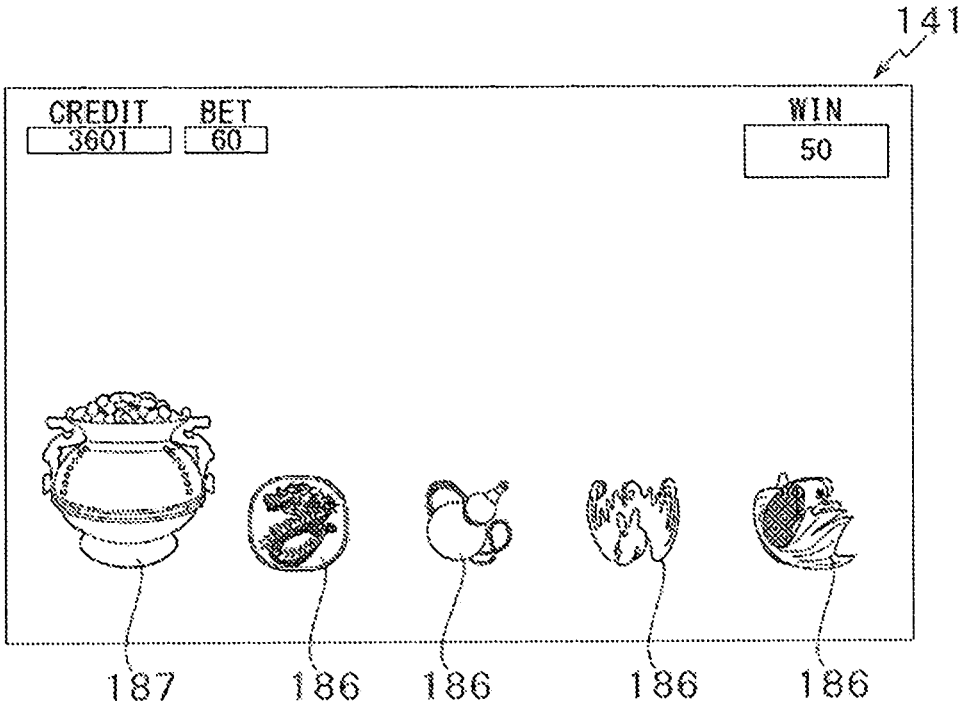
FIG. 32 is an explanatory diagram illustrating one example of a display screen in the selection game.

For each of the free games, a selection game for increasing the special symbols 503 may be conducted. As shown in FIG. 31, upon starting each of the free games, on the lower image display panel 141, a selection game screen is first displayed. On the selection game screen, five choice images 184 are arranged in a lower portion of the lower image display panel 141. In addition, in the central portion of the lower image display panel 141, a message 185 for prompting a player to select one of the choice images 184 is displayed. In a case where a control panel 30 is used to select one of the choice images 184, an image display in which the selected choice image 184 is changed to a selection symbol image 187 is conducted. The selection symbol image 187 is any of five kinds of the special symbols 503. In addition, an image display in which the four choice images 184 not selected are changed to non-selection selection symbol images 186 is conducted. The four non-selection selection symbol images 186 are four kinds of images except the selection symbol image 187, among the five kinds of the special symbols 503.

Only the special symbols 503, each of which is indicated by the selection symbol image 187 selected on the selection game screen as described above, are displayed on the symbol arrays 170 in each of the free games. In other words, in the symbol arrays 170 in each of the free games, the special symbols 503 whose kind is selected by the selection game, base game symbols 502, TRIGGER symbols 504, and WILD symbols 505 are displayed. Accordingly, the four kinds of the special symbols 503 not selected by the selection game are not displayed in each of the free games. In addition, the numbers of the special symbols 503 whose kind is selected by the selection game and which are displayed in each of the free games and arranged in the symbol arrays 170 vary, depending on an amount of a symbol bet placed in the base game in which the free games are triggered. In other words, a percentage at which special symbols are arranged in the symbol arrays is increased in accordance with an increase in the amount of the symbol bet.

One example of the symbol arrays in each of the free games in the case where the above-described selection game is conducted is shown in FIG. 58 to FIG. 61. In FIG. 58 and FIG. 59, one example of a case where a special symbol "PHOENIX" is selected in the selection game is shown. In FIG. 58, symbol arrays in a case where a symbol bet in the base game in which the free games are triggered is one are shown. In FIG. 59, symbol arrays in a case where a symbol bet in the base game in which the free games are triggered is 60 are shown. In FIG. 60 and FIG. 61, one example of a case where a special symbol "SWALLOW" is selected in the selection game is shown. In FIG. 60, symbol arrays in a case where a symbol bet in the base game in which the free games are triggered is one are shown. In FIG. 61, symbol arrays in a case where a symbol bet in the base game in which the free games are triggered is 60 are shown.

As shown in FIG. 58 to FIG. 59, only the symbols "PHOENIX" selected in the selection game are displayed as the special symbols 503. In addition, in accordance with the increase in the amount of the symbol bet, the number of specific symbols "PHOENIX" included in the symbol arrays is increased. In addition, a number of symbols included in the symbol arrays is decreased, and further, the percentage at which the specific symbols "PHOENIX" are included therein is increased. In addition, as shown in FIG. 60 to FIG. 61, only the symbols "SWALLOW" selected in the selection game are displayed as the special symbols 503. In addition, in accordance with the increase in the amount of the symbol bet, the number of specific symbols "SWALLOW" included in the symbol arrays is increased. In addition, a number of symbols included in the symbol arrays is decreased, and further, the percentage at which the specific symbols "SWALLOW" are included therein is increased. As described above, only the special symbols selected in the selection game are displayed in the symbol arrays in each of the free games. Further, in accordance with the increase in the symbol bet in the base game in which the free games are triggered, the percentage at which the special symbols are included therein is increased. Accordingly, with respect to the five kinds of specific symbols, symbol arrays (the total of 25 kinds) related to five kinds of symbol bets are previously prepared.

(Bonus Game)

Figure 6:
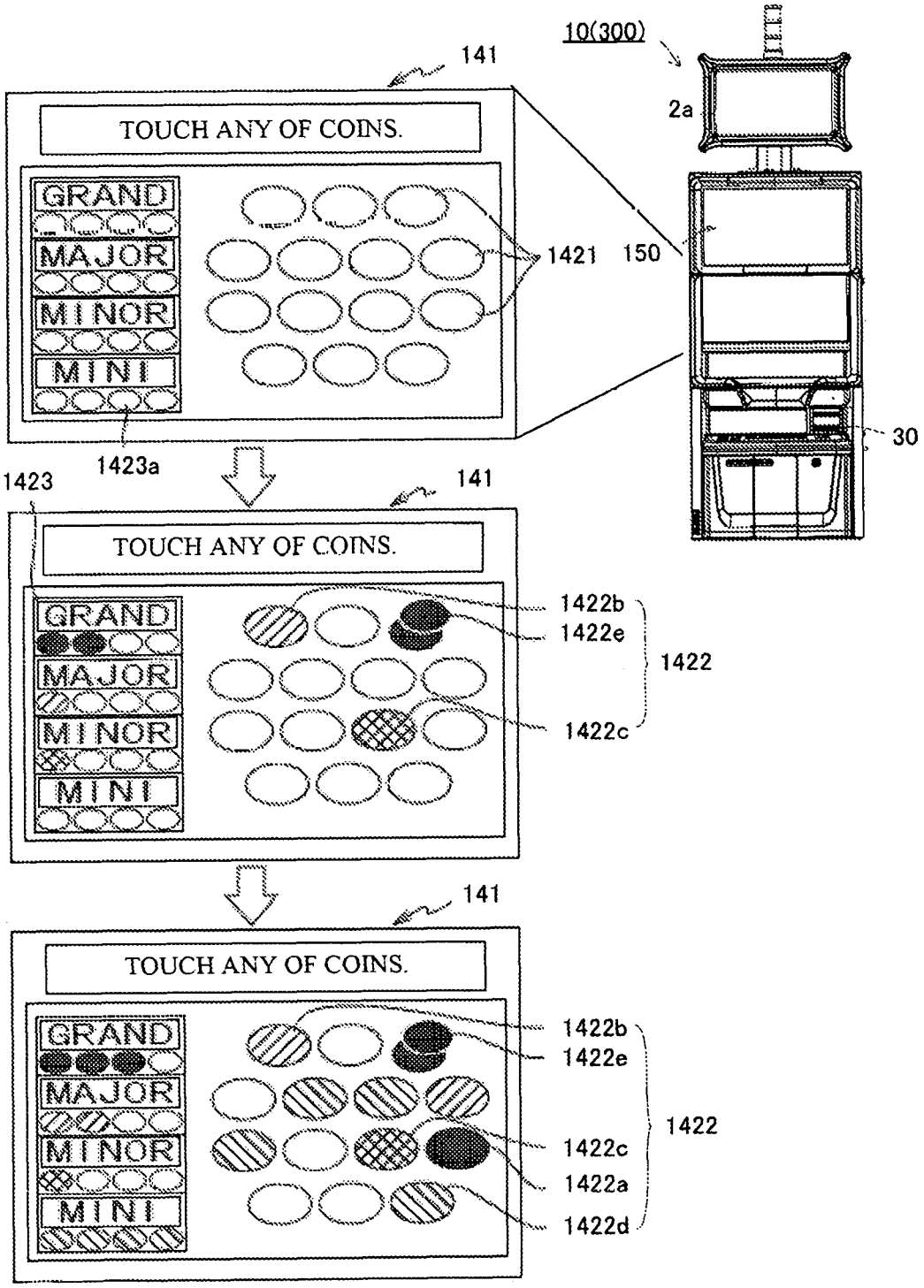
FIG. 6 is an explanatory diagram illustrating operation states of the gaming machine.

In a base game and each free game, when a WILD symbol 505 or WILD symbols is or are rearranged on any of pseudo reels 151 to 155, a drawing (first drawing) to determine whether or not a bonus game is executed is conducted. When during each of the free games, the bonus game is executed, each of the free games is interrupted and the bonus game as shown in FIG. 6 is started. In addition, a drawing (second drawing) for a mystery bonus in each base game is conducted, and when winning in this drawing has occurred, the bonus game is executed. In other words, in the base game, when winning has occurred in both of the first drawing and the second drawing, the bonus game is execute twice. The first drawing and the second drawing will be described later.

As shown in FIG. 6, in the bonus game, 14 choice images 1421 are made selectable. As the choice images 1421, two double bonus rank images 1422*e* are included. When the double bonus rank images 1422*e* are displayed, below the double bonus rank images 1422*e*, a message "Lucky! Two counts obtained!" is displayed and a corresponding count in any corresponding area of rank count areas 1423 is increased by two.

When the execution of the bonus game is established, a drawing to determine whether a presentation method in a first mode (scenario mode) or a presentation method in a second mode (random mode) is employed is executed. In the present embodiment, although the determination for either is made with a weight of one and a probability of 1/2, the present invention is not limited thereto, and the weight may be provided with bias. In the scenario mode, there are previously determined patterns, in each of which the bonus rank images 1422 are displayed, until a plurality of selections are made. Up to the middle of the selections, in accordance with each of these patterns, the bonus rank images 1422 are displayed. Thereafter, based on a previously determined bonus, bonus rank images 1422 to be displayed and a displaying order are determined. In the random mode, based on a previously determined bonus, bonus rank images 1422 to be displayed and a displaying order are determined. Only four bonus rank images 1422 corresponding to the previously determined bonus are displayed, and further, these bonus rank images 1422 are finally displayed. Thus, a presentation display in which a count of the bonus rank images of the previously determined bonus reaches four can be conducted. In the second mode, the selection of the choice images 1421 can be executed at three times as a minimum up to 10 times as a maximum.

Figure 34:
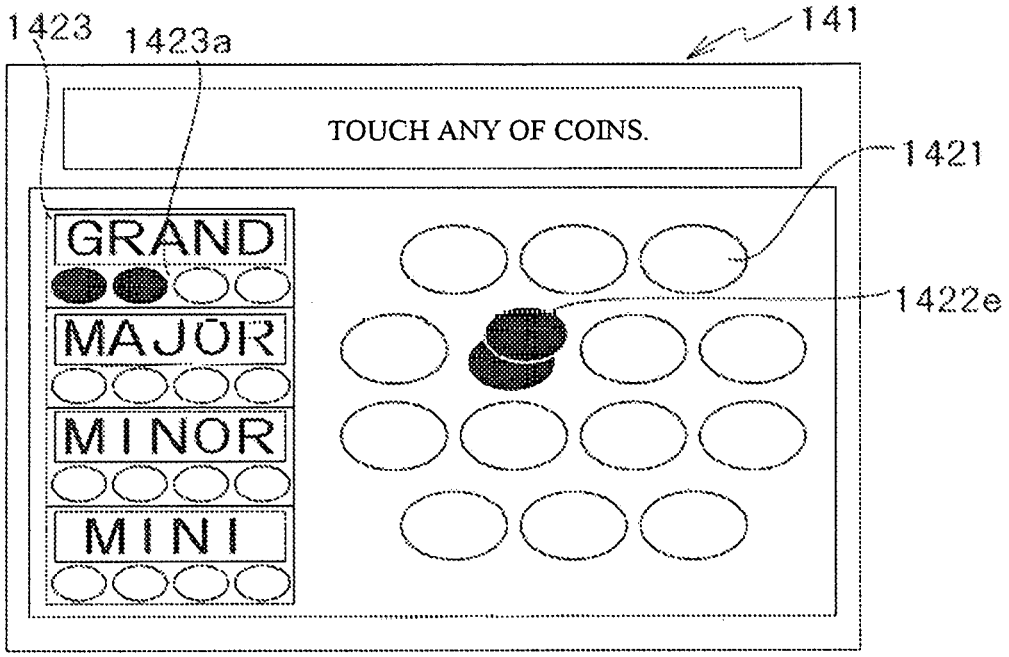
FIG. 34 is an explanatory diagram illustrating one example of a display screen in the bonus game.
Figure 35:
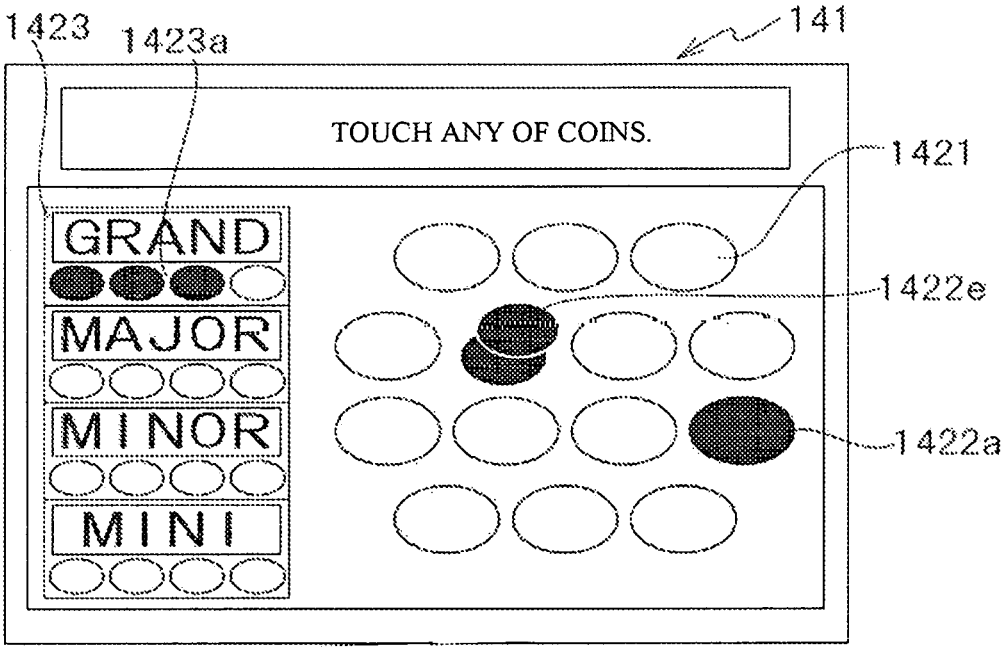
FIG. 35 is an explanatory diagram illustrating one example of a display screen in the bonus game.

Specifically, the scenario mode will be described. As shown in a scenario table in FIG. 33, in the scenario mode, one of scenarios, in each of which the bonus rank images 1422 in the first to the fourth selections to be displayed by selecting the choice images 1421 are previously determined, is selected. There are 24 kinds of scenarios, and a weight for each of the scenarios is set to one. However, weights for the scenarios may be set so as to be different from one another. In all of the scenarios, only the bonus rank images 1422 which are higher in bonus ranks are set. Accordingly, in the scenario mode, in the first to the fourth sections, the bonus rank images 1422 which are higher in the bonus ranks are invariably displayed. In one bonus game, one of the scenario is determined by a drawing. For example, in the bonus game, in a case where a scenario 1 is determined, as shown in FIG. 34, even when a player selects any of the choice images 1421, the double bonus rank image 1422*e* of the GRAND rank is displayed in the first selection. In a count image 1423*a* of a GRAND rank in any corresponding area of the rank count areas 1423, two is counted. As shown in FIG. 35, even when a player selects any of the choice images 1421, a GRAND rank image 1422*a* is displayed in the second selection. In the count image 1423*a* of the GRAND rank in the rank count area 1423, the count is increased further by one and the total of three is counted.

As shown in FIG. 36, a double bonus rank image 1422*f* of a MAJOR rank is displayed in the third selection and in a count image of the MAJOR rank in the rank count area 1423, two is counted. A MAJOR rank image 1422*b* is displayed in the fourth selection, and in the count image of the MAJOR rank in the rank count area 1423, and the count is increased further by one and the total of three is counted. In the fifth and subsequent selections, bonus rank images 1422 randomly determined by drawings are displayed. Since bonuses to be won are previously determined, the bonus rank images 1422 displayed in the fifth and subsequent selections are determined such that the number of the bonus rank images 1422 corresponding to bonuses other than the won bonuses does not reach four. In accordance with the operation onto the control panel 30 by a player, the determined bonus rank images 1422 in the fifth and subsequent selection are displayed.

Figure 37:
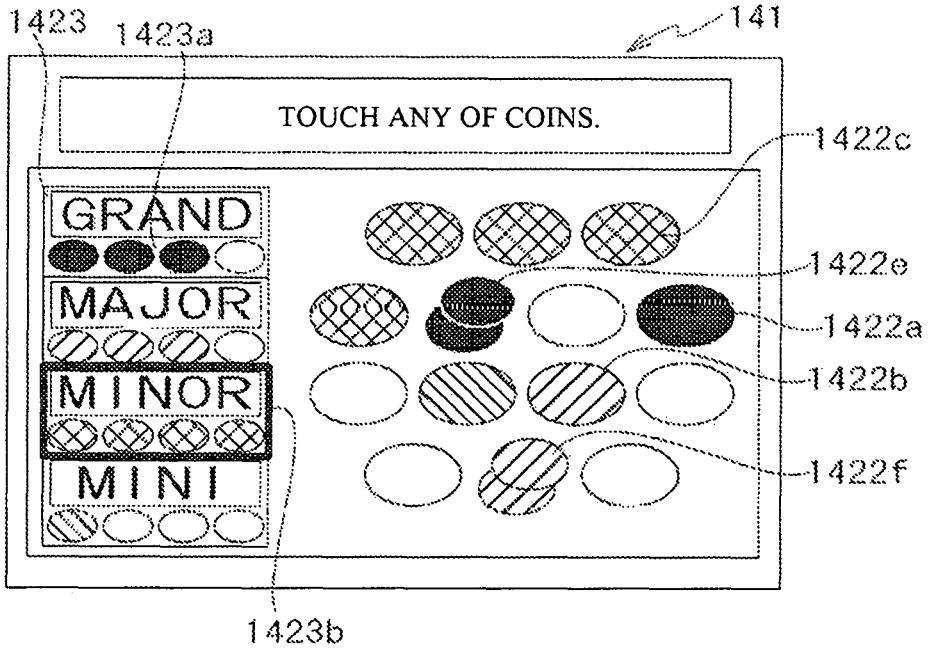
FIG. 37 is an explanatory diagram illustrating one example of a display screen in the bonus game.
Figure 38:
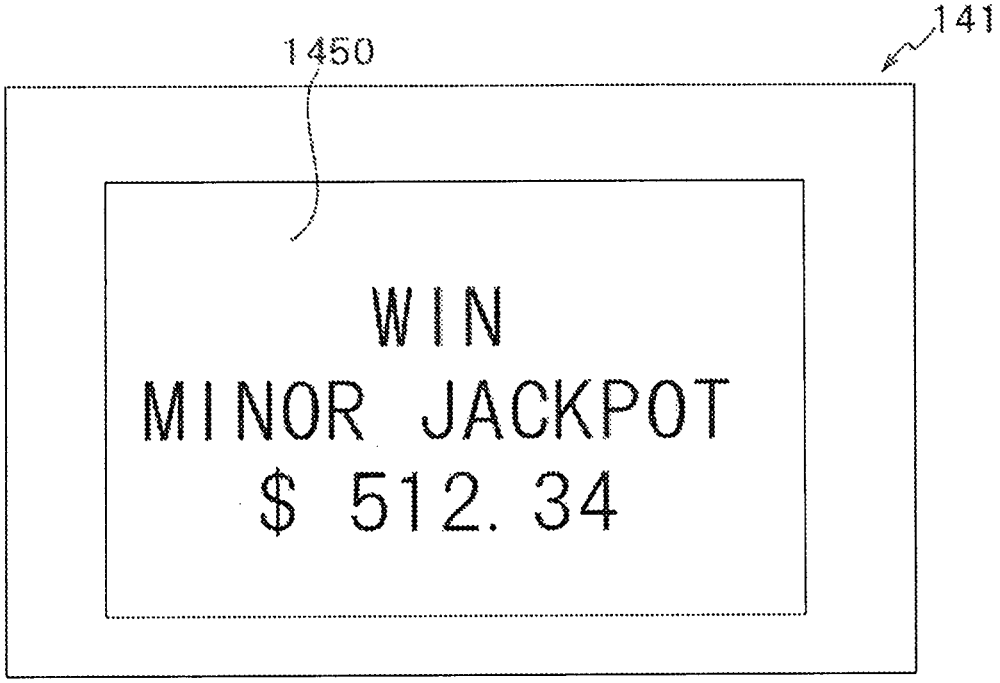
FIG. 38 is an explanatory diagram illustrating one example of a display screen in the bonus game.

When any of the counts in the rank count areas 1423 has reached four, as shown in FIG. 37, a frame image 1423*b* which encloses the rank count area 1423 corresponding to the determined bonus is displayed. Thus, a kind of the won bonus can be displayed in an easily recognizable manner. As shown in FIG. 38, on the lower image display panel 141, a result display screen is displayed. In the result display screen, a bonus result 1450 in which a kind of the established bonus and the obtained credit are shown is displayed. Thereafter, the game returns to a state in which the bonus game is triggered.

(Re: Drawing Related to Bonus Game)

The drawing related to the bonus game will be described below. As described above, in the bonus game, one bonus is determined from among the four kinds of bonuses (the GRAND bonus, the MAJOR bonus, the MINOR bonus, and the MINI bonus). An initial value of the GRAND bonus is a 500,000-credit; an initial value of the MAJOR bonus is a 40,000-credit; an initial value of the MINOR bonus is a 4,000-credit; and an initial value of the MINI bonus is a 2,000-credit. A value obtained by multiplying each of these initial values by a value of a set denomination is a bonus value. In addition, default increment percentages of the bonuses are as follows: the default increment percentage of the GRAND bonus is 0.1%; the default increment percentage of the MAJOR bonus is 0.1%; the default increment percentage of the MINOR bonus is 0.5%; and the default increment percentage of the MINI bonus is 1%.

First, a drawing (also referral to as a first drawing or a progressive challenge) to determine whether or not a bonus game is executed in a case where in the base game and each of the free games, a WILD symbol or WILD symbols 505 is or are rearranged will be described. A winning probability of the bonus game in the progressive challenge is increased in accordance with a kind of a symbol bet and a number of the rearranged WILD symbols 505. Specifically, as shown in FIG. 39, in a progressive challenge table, a numerical value is previously associated with each kind of the symbol bet for each game variation, respectively. This progressive challenge table is prepared for each setting combination. In order to increase a precision, a value obtained by multiplying this numerical value by 1,000,000 is used as a denominator of the winning probability. In addition, in the base game or each of the free games in which the progressive challenge has been triggered, a value obtained by multiplying a number of the rearranged normal WILD symbols by 1,000,000 is used as a numerator of the winning probability. The 2× WILD symbol 505*b* is counted as two.

When the execution of the bonus game is determined by the progressive challenge drawing, a drawing (also referral to as a progressive drawing) to determine which one of the four kinds of bonuses is awarded is conducted. Specifically, as shown in FIG. 40, in a progressive drawing table, weights of the respective bonuses are previously determined. In other words, a numerical value whose denominator is the total of the weights and whose numerator is the weight of each of the respective bonuses is the winning probability of each of the respective bonuses. In case of the occurrence of abnormality, a value of the MINOR bonus is set to be a default.

(Processing Operation of Slot Machine 10: Base Game Execution Process)

Figure 41:
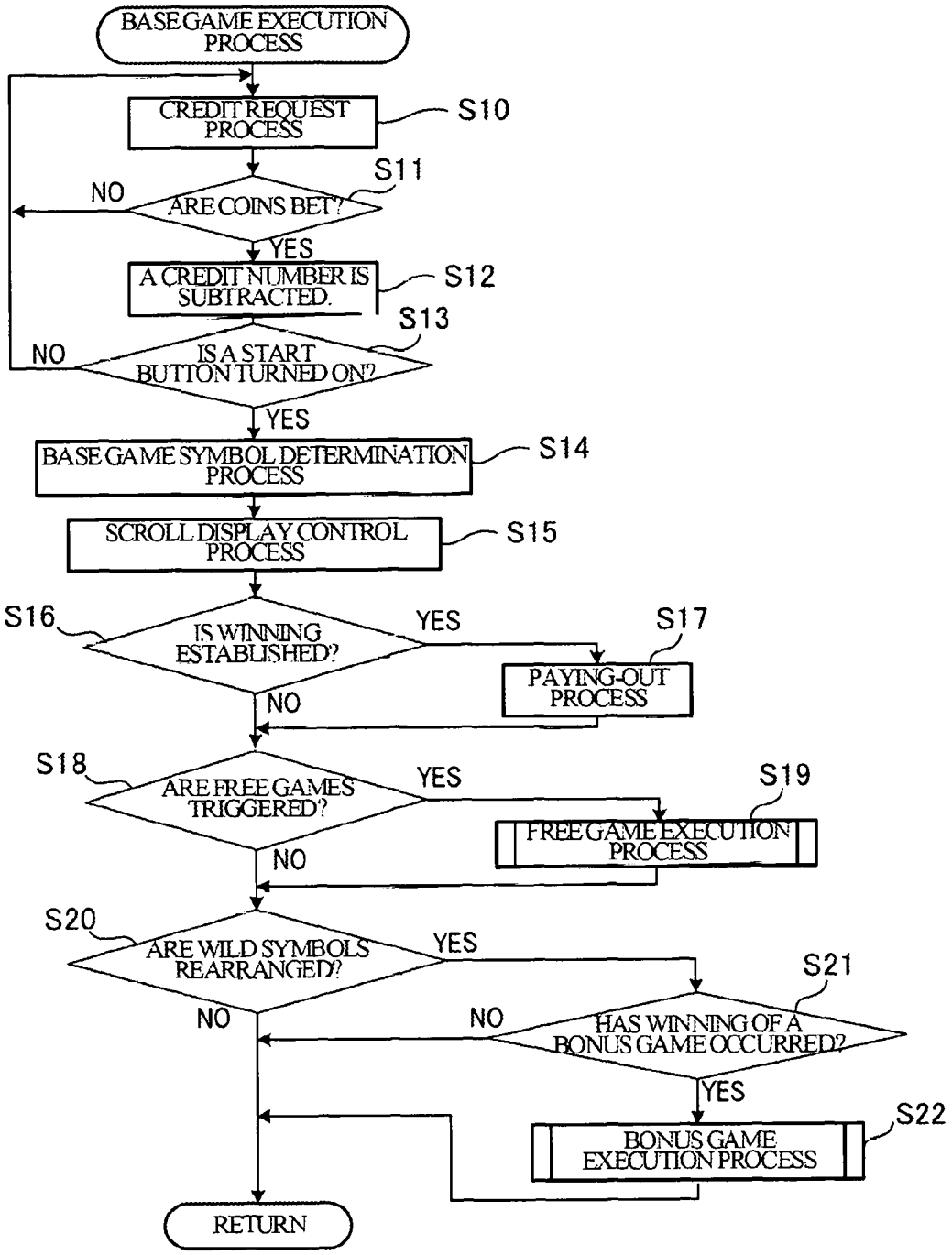
FIG. 41 is a flowchart of a base game execution process.

The operation of a slot machine 10 having the above-described configuration will be described. A base game execution process in FIG. 41 is executed by a main CPU 71 of the slot machine 10. It is to be noted that the slot machine 10 is previously booted.

First, the main CPU 71 executes a credit request process (S10). In this process, a player determines whether or not some credit is used from a credit stored in an IC card.

It is determined whether or not coins are bet (S11). In this process, the main CPU 71 determines whether or not an input signal outputted from a 1-BET switch 34S when a 1-BET button 34 is operated or an input signal outputted from a 5-BET switch 39S when a 5-BET button 38 is operated has been received. When it is determined that no coins have been bet, the main CPU 71 returns the processing to S10.

On the other hand, when it is determined at S11 that the coins have been bet, the main CPU 71 conducts a process of the subtraction of a credit number stored in a RAM 73 in accordance with a number of the bet coins (S12). When the number of the bet coins is larger than the credit number store in the RAM 73, the main CPU 71 returns the processing to S11 without conducting the process of the subtraction of the credit number stored in the RAM 73. In addition, when the number of the bet coins exceeds an upper limit (5 BETs×88 CREDITs=440 coins in the present embodiment) which can be bet for one play, the main CPU 71 causes the processing to proceed to S13 without conducting the process of the subtraction of the credit number stored in the RAM 73.

Next, the main CPU 71 determines whether or not a SPIN button 46 has been turned ON (S13). In this process, the main CPU 71 determines whether or not an input signal outputted from a spin switch 46S when the SPIN button 46 has been pressed has been received. When it is determined that the SPIN button 46 has not been turned ON, the main CPU 71 returns the processing to S11. When the SPIN button 46 has not been turned ON (for example, when an instruction that the SPIN button 46 is not turned ON and a play is finished is inputted), the main CPU 71 cancels a result of the subtraction at S12.

On the other hand, when it is determined at S13 that the SPIN button 46 has been turned ON, the main CPU 71 executes a base game symbol determination process (S14). In the base game symbol determination process, a code No. of symbols upon stopping of the symbols is determined Specifically, based on an acquired random number value, the code No. of the symbols in display blocks 28 of respective symbol arrays upon stopping of the symbols is determined.

Next, the main CPU 71 conducts a scroll display control process (S15). In this process, the display is controlled such that after starting scrolling of symbols 501, the symbols 501 determined at S15 are rearranged.

Next, the main CPU 71 determines whether or not winning has been established by the rearranged symbols determined at S14 (S16).

When it is determined at S16 that the winning has been established, the main CPU 71 conducts a process related to paying-out of coins (S17). In this process, with reference to odds data stored in the RAM 73, the main CPU 71 determines a payout multiplier based on a number of the symbols 501 rearranged on an activated line. The odds data is data indicating a correspondence relationship between each number of symbols 501 rearranged on the activated line and each payout multiplier. When a 2× WILD symbol 505*b* has been rearranged and a win related to the 2× WILD symbol 505*b* has been established, a payout is doubled.

When it is determined at S16 that no winning has been established or after the process at S17 has been executed, the main CPU 71 determines whether or not free games have been triggered (S18). When the free games have been triggered, each of the free games is started (S19). When the free game has not been triggered or after the free games have been executed, the main CPU 71 determines whether or not a WILD symbol or WILD symbols has/have been rearranged (S20). When the WILD symbol or WILD symbols has/have been rearranged, a bonus game drawing is conducted in accordance with a number of the WILD symbol or WILD symbols, and the main CPU 71 determines whether or not winning of a bonus game has occurred (S21). Thereafter, when the winning of the bonus game has occurred, the bonus game is executed (S22). When the WILD symbol or WILD symbols has/have not been rearranged or after the bonus game triggered by the rearrangement of the WILD symbol or WILD symbols has been executed, this routine is finished.

As described above, whether or not the bonus game is triggered is determined by the progressive challenge executed by the rearrangement of the WILD symbol or WILD symbols. Accordingly, in order to modify a probability of the progressive challenge, which depends on symbol arrays, it is required to modify the symbol arrays.

(Processing Operation of Slot Machine 10: Free Game Execution Process)

Figure 42:
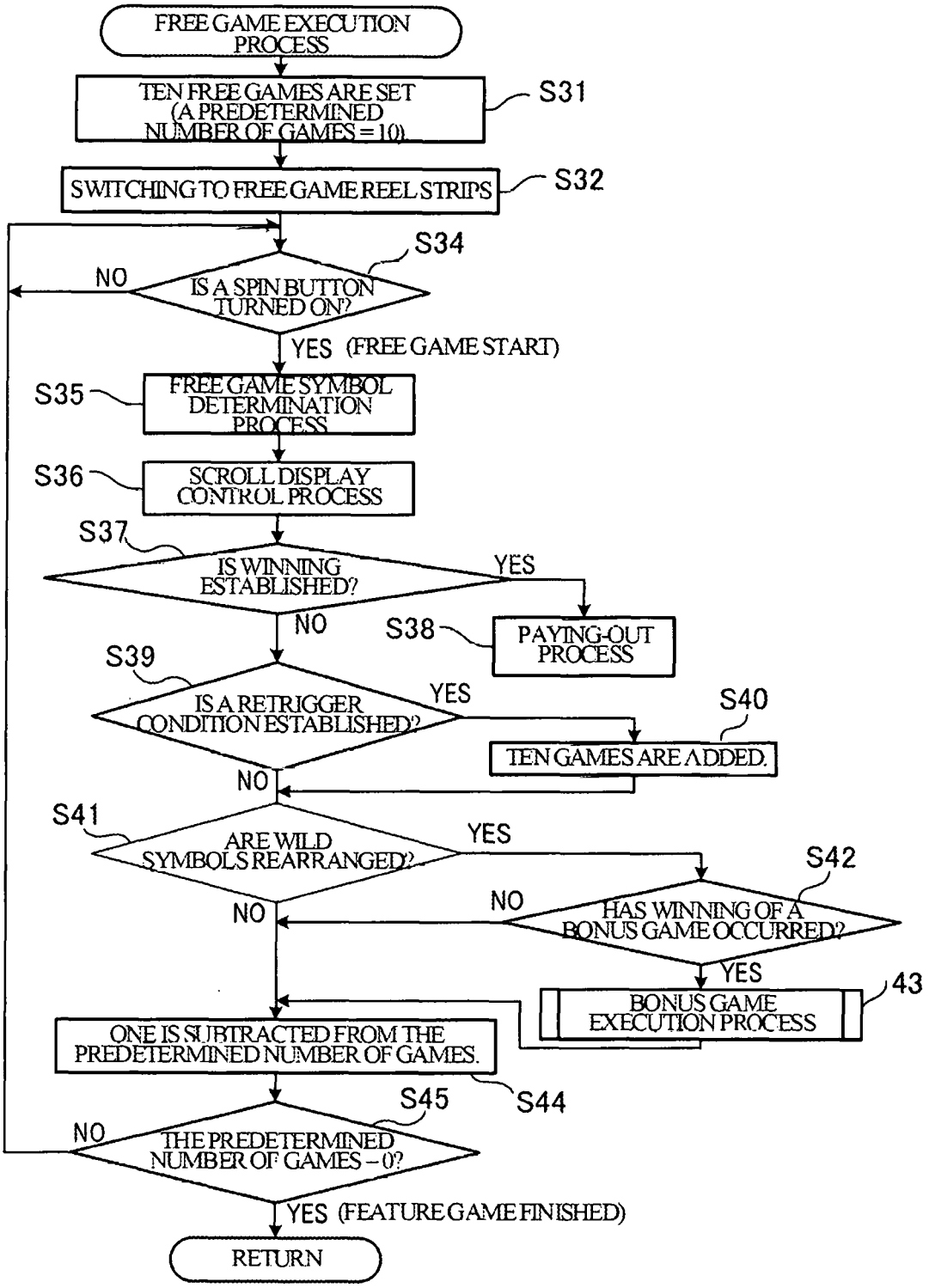
FIG. 42 is a flowchart of a free game execution process.

As shown in FIG. 42, in a free game execution process, first, 10 free games are set. In other words, a predetermined number of games=10 is set (S31). In association with said setting, switching to free game reel strips is conducted (S32). In other words, a kind of a symbol bet in a base game in which the free games have been triggered is determined, and free game symbol arrays in accordance with the kind of a symbol bet are selected.

Thereafter, it is determined whether or not a SPIN button 46 has been turned ON by a pressing operation (S34). When the SPIN button 46 has not been pressed (S34: NO), S34 is executed again. On the other hands, when the SPIN button 46 has been pressed (S34: YES), a free game symbol determination process is executed (S35) and thereafter, a scroll display control process is executed (S36). Thereafter, it is determined whether or not winning has been established (S37). When the winning has been established (S37: YES), a paying-out process is executed (S38) and thereafter, S39 is executed. On the other hand, when no winning has been established (S37: NO), S38 is executed.

It is determined whether or not a retrigger condition (free game addition condition) has been established (S39). When no retrigger condition has been established (S39: NO), one is subtracted from the predetermined number of games (S41). On the other hand, when the retrigger condition has been established (S39: YES), 10 free games are added (S40).

When the free games have not been triggered or after the addition of 10 games, it is determined whether or not a WILD symbol or WILD symbols has or have been rearranged (S41). When the WILD symbol or WILD symbols has or have been rearranged (S41: YES), in accordance with a number of the WILD symbol or WILD symbols, a bonus game drawing is conducted, and it is determined whether or not winning of a bonus game has occurred (S42). Thereafter, when the winning of the bonus game has occurred, the bonus game is executed (S43). When it is determined at step S41 that the WILD symbol or WILD symbols has or have not been rearranged (S43: NO) or after the bonus game execution process at step S43, one is subtracted from the predetermined number of games (S44).

Next, it is determined whether or not the predetermined number of games is 0 (S45). When the predetermined number of games is not 0 (S45: NO), it is determined that the free games are under way, and each of the free games is executed again from S34. On the other hand, when the predetermined number of games is 0 (S45: YES), it is determined that the feature game is finished, and this routine is finished.

(Processing Operation of Slot Machine 10: Bonus Game Execution Process)

Figure 43:
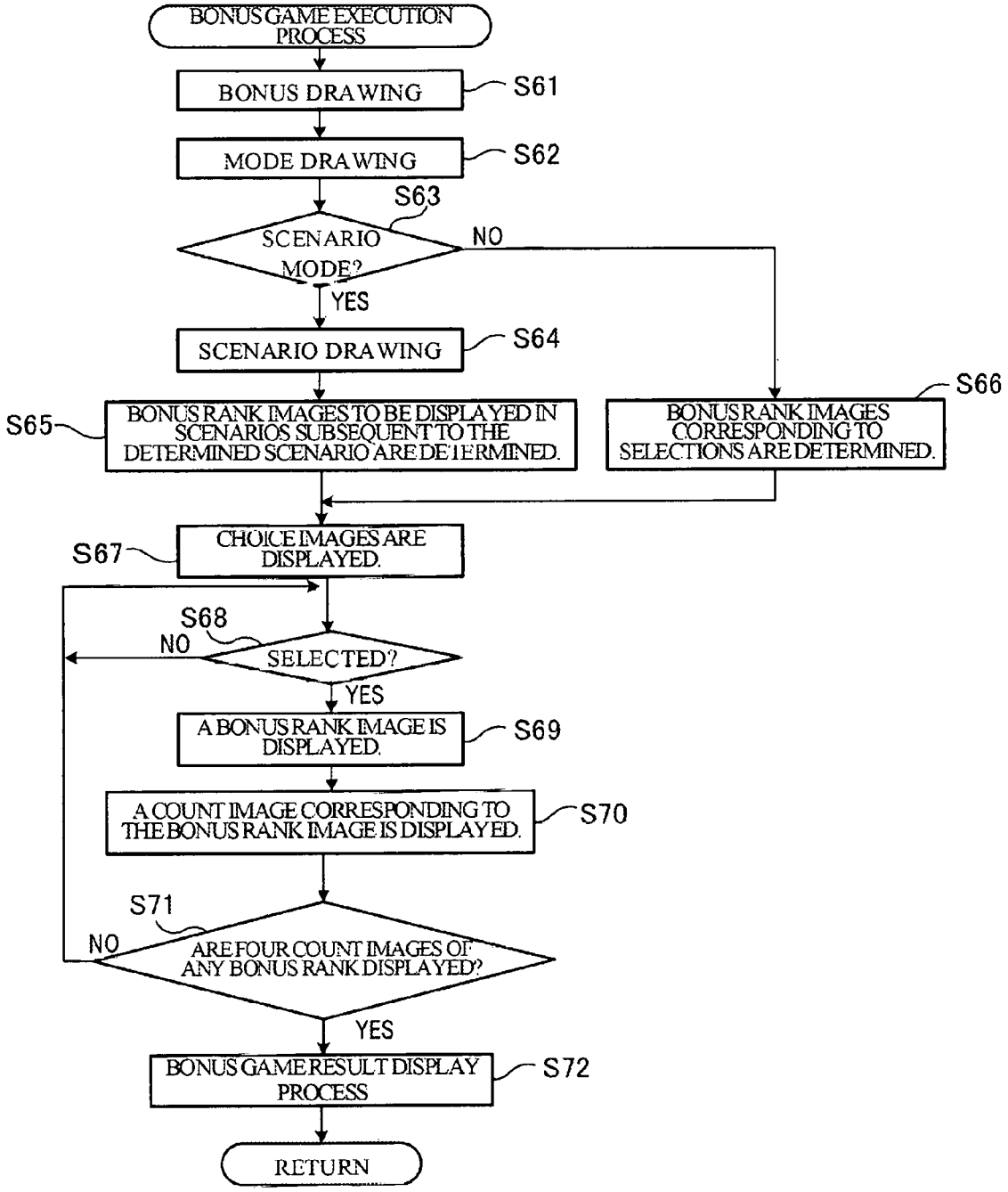
FIG. 43 is a flowchart of a bonus game execution process.

As shown in FIG. 43, in a bonus game execution process, first, a bonus drawing is executed (S61), thereby determining a kind of a bonus to be awarded. Thereafter, a mode drawing is executed (S62). In the mode drawing, it is determined whether the mode is a scenario mode or a random mode. Next, it is determined whether or not the mode determined at step S62 is the scenario mode (S63). When the mode is the scenario mode (S63: YES), a scenario drawing to select one of scenarios is executed (S64). Bonus rank images to be displayed in scenarios subsequent to the determined scenario are determined (S65). On the other hand, when the mode is not the scenario mode (S63: NO), bonus rank images 1422 corresponding to respective selections (the first to 14th selections) are determined by drawings (S66). At step S65 and S66, 14 bonus rank images 1422 (two GRAND rank images 1422*a*, two MAJOR rank images 1422*b*, four MINOR rank images 1422*c*, four MINI rank images 1422*d*, one double bonus rank image 1422*e* of a GRAND rank, and one double bonus rank image 1422*f* of a MAJOR rank) are associated with all of the first to 14th selections. At step S65, bonus rank images 1422 to be displayed in the fifth and subsequent selections except the bonus rank images 1422 in the first to fourth selections, which have already been determined by the scenario, are determined. The 14 bonus rank images 1422 are associated with the selections such that four bonus rank images of the bonus rank determined at step S61 are counted prior to counting of the other bonus ranks. Accordingly, the selections are actually made by a player at up to 10 times.

At step S65 or after step S66, the 14 choice images 1421 are displayed, and a screen is in a standby state for a selection input by a player (S67). It is determined whether or not a selection input of any of the choice images 1421 has been accepted by a control panel 30 (S68). When no input has been accepted, step S68 is executed again. When the input has been accepted, an image display, in which the selected choice image 1421 is modified to the bonus rank image 1422 determined at step S65 or step S66, is conducted (S69). A count image 1423*a* corresponding to this bonus rank image 1422 is displayed in any corresponding area of the rank count areas 1423 (S70). When the bonus rank image 1422 is the double bonus rank image 1422*e*, two count images 1423*a* are displayed. Thereafter, it is determined whether or not four count images 1423*a* of any bonus rank are displayed (S71). When the number of the count images of any of bonus ranks has not reached four, step S68 is executed again.

When all of the bonus rank images 1422 are displayed, a bonus game result display process is executed (S72). Specifically, a frame image 1423*b* is displayed for the rank count area 1423 corresponding to the won bonus, and a bonus result 1450 is displayed. Thereafter, this routine is finished.

(Display Screen: Base Game Screen)

As shown in FIG. 28, below a symbol display area 150, a CREDIT meter 400, a BET meter 401, and a WIN meter 402 are arranged. The CREDIT meter 400 and the BET meter 401 are arranged in the central portion, viewed from a player. On the other hand, the WIN meter 402 is arranged in the right end portion, viewed from a player.

The CREDIT meter 400 displays the total credit number (remaining credit number). An initial value is 0. As for an increase and a decrease in the numerical value, a WIN credit obtained by "TAKE WIN", that is, winning in a game, is added. During playing the game, a bet number is subtracted therefrom. Upon finishing "COLLECT", a bet number is subtracted therefrom.

The BET meter 401 displays a "total bet". When betting is made for each activated line, a number of bets×a number of the lines is the total bet. For each game play, a numerical value is recalculated.

The WIN meter 402 displays the total credits of obtained wins in an incremented manner. An initial value is 0. The display of the WIN meter 402 in a system font display position is as follows.

For example, when no 2× WILD symbol 505*b* or the like has appeared and a win of 3 of a Kind has singly occurred, a display in the WIN meter 402 is indicated as described below. For example, when on pseudo reels 151 to 153, GOURD symbols 503*d* are rearranged one by one, "3 PICKED_D=15" is displayed as the detail, "TOTAL WIN=15" is displayed as the total amount, and a value obtained by multiplying this total amount by a denomination is displayed.

In addition, when the 2× WILD symbol 505*b* has appeared and a win of 3 of a Kind has singly occurred, a display in the WIN meter 402 is indicated as described below. For example, when on the pseudo reels 151 to 152, the GOURD symbols 503*d* are rearranged one by one and on the pseudo reel 153, the 2× WILD symbols 505*b* is rearranged, "3 PICKED_D×2 WILD=30" is displayed as the detail, "TOTAL WIN=30" is displayed as the total amount, and a value obtained by multiplying this total amount by a denomination is displayed.

In addition, when the 2× WILD symbols 505*b* has appeared, a win of 3 of a Kind including the 2× WILD symbols 505*b* has occurred, and a win of 3 of a Kind has singly occurred, a display in the WIN meter 402 is indicated as described below. For example, when on the pseudo reels 151 to 153, FISH symbols 503*c* are rearranged one by one and on the pseudo reel 153, the 2× WILD symbols 505*b* is rearranged, "3 PICKED_C=20" and "3 PICKED_C×2 WILD=40" are alternately and repeatedly displayed, "TOTAL WIN=60" is displayed as the total amount, and a value obtained by multiplying this total amount by a denomination is displayed as the detail.

In addition, when the 2× WILD symbols 505*b* has appeared and a plurality of wins of 3 of a Kind have occurred, a display in the WIN meter 402 is indicated as described below. For example, when on the pseudo reel 151, "10", a POT symbol 503*b*, and the FISH symbol 503*c* are rearranged one by one; on the pseudo reel 152, the normal WILD symbol 505*a* and two FISH symbols 503*c* are rearranged; and on the pseudo reel 153, the 2× WILD symbol 505*b* is rearranged, "3 PICKED_B×2 WILD=50", "3 PICKED_C×3×2 WILD=120", and "3 TEN×2 WILD=10" are alternately and repeatedly displayed as the detail, "TOTAL WIN=180" is displayed as the total amount, and a value obtained by multiplying this total amount by a denomination is displayed.

In addition, when the 2× WILD symbols 505*b* has appeared and a plurality of wins of 3 of a Kind have occurred, a display in the WIN meter 402 is indicated as described below. For example, when on the pseudo reel 151, the POT symbol 503*b* and a BAT symbol 503*e* are rearranged one by one; on the pseudo reel 152, one POT symbol 503*b* and two BAT symbols 503*e* are rearranged; on the pseudo reels 153, one BAT symbol 503*e* and the 2× WILD symbol 505*b* are rearranged; and on the pseudo reel 154, one POT symbol 503*b* is rearranged, "4 PICKED_B×2 WILD=120", "3 PICKED_Ex2=20", and "3 PICKED_Ex2 WILD=40" are alternately and repeatedly displayed as the detail, "TOTAL WIN=180" is displayed as the total amount, and a value obtained by multiplying this total amount by a denomination is displayed.

Further, below the symbol display area 150, a denomination button 413, a MENU button 414, and an audio button 415 are arranged. These buttons 413, 414, and 415 are located in the order from the left to the right, viewed from a player. In addition, above a GAME RULE button 416, a TIME display 417 for indicating a current time is displayed.

The denomination button 413 displays a current denomination which is set with an AUDIT screen. The denomination button is displayed while a screen other than the audit screen is displayed. The audio button 415 is used when an audio volume outputted by a slot machine 10 is adjusted. As shown in FIG. 28, there are three stages of the audio volume, and each time the audio button 415 is touched, the audio volume is switched in the order (a minimum volume (30%) →a middle volume (70%)→a maximum volume (100%)→a minimum volume (30%)→ • • • ). It is to be noted that as a default, the audio volume is set to the minimum volume. In addition, after a game is started and when the AUDIT screen (setting screen) is set to a non-displayed state, the audio volume is reset to the default. While a HELP screen is displayed, since the audio button 415 is in the non-displayed state, the audio volume is set in a state in which the audio volume cannot be changed. However, the audio button 415 is active in other states than the above-mentioned state. An operation inactive time from when the audio button 415 is pressed is set to 0.15 second (150 msec). A default of a volume setting value on the AUDIT screen is "12". It is to be noted that when there is not a volume adjusting touch panel, the default is set to "5". A reproduction volume of a volume setting change sound on the AUDIT screen is set to the default (a volume reflecting the minimum volume (30%)) of the audio button 415. The audio button 415 is touched, whereby payout tables in HELP pages are displayed. The GAME RULE button 416 is touched, whereby the first page of the HELP pages is displayed. It is to be noted that the GAME RULE button 416 is inactive while the reels are being rotated and is displayed in a grayed-out manner.

In addition, above the denomination button, a status display area 419 is arranged. In the status display area 419, bet information and a game state of a game which is currently being executed are displayed. The bet information indicates a bet number placed. For example, when a bet number is one, "BET MUTIPLIER 1" is displayed, and when a bet number is two, "BET MUTIPLIER 2" is displayed. In addition, the game state is set to be in a non-displayed state, for example, during a game, and upon game-over, "GAME OVER" is displayed and in a GAMBLE wait state, "PLAY ON, GAMBLE or TAKE WIN" is displayed.

Specifically, in a bet information area of the status display area 419, immediately after RAM clear, "BET MUTIPLIER n" (n is a minimum value in a set BET pattern) is displayed. After pressing a button "BETx XX", "BET MUTIPLIER n" (a value of n for each bet button is modified) is displayed. For the others, the immediately previous display contents are maintained.

In addition, in the status display area 419, immediately after the RAM clear, "GAME OVER" is displayed. In addition, upon pressing down the SPIN button 46, while the reels are being rotated, the status display area 419 is set in the non-displayed state, and in the other state, "GAME OVER" is displayed therein. Immediately after stopping the reels, when GAMBLE is enabled by a win, "PLAY ON, GAMBLE or TAKE WIN" is displayed therein, and in the other state, "GAME OVER" is displayed therein. When a bonus game is triggered, the status display area 419 is set in the non-displayed state. Immediately after finishing the bonus game, when the GAMBLE is enabled by a win, "PLAY ON, GAMBLE or TAKE WIN" is displayed therein, and in the other state, "GAME OVER" is displayed therein. Immediately after finishing a jackpot, "GAME OVER" is displayed. When the HELP is pressed down and the HELP screen is thereby displayed, when the GAMBLE is enabled by a win, "PLAY ON, GAMBLE or TAKE WIN" is displayed therein, and in the other state, "GAME OVER" is displayed therein. When the HELP is pressed down and the screen is returned to a game screen, a state prior to displaying the HELP screen is displayed. After pressing the button "BETx XX" and upon "TAKE WIN", "GAME OVER" is displayed.

In addition, in portions on both right and left sides of the symbol display area 150, logos 418, each of which indicates that paylines are not limited (EVERY WAY), are displayed.

(Display Screen: HELP Screen)

Figure 44:
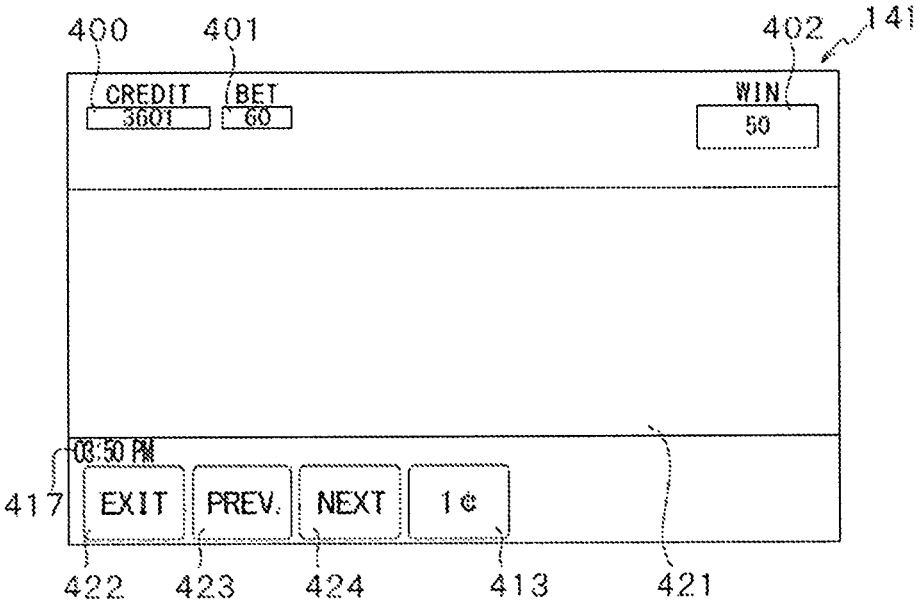
FIG. 44 is an explanatory diagram illustrating a HELP screen.

A HELP screen displayed when a MENU button 414 is touched will be described. As shown in FIG. 44, on the HELP screen, a HELP display part 421 is displayed in the central portion of a lower image display panel 141. In addition, below the HELP display part 421, an EXIT touch button 422 for causing the HELP screen to disappear and returning to a base game screen, a PREY touch button 423 for turning a current page of the HELP display part 421 to the previous page, a NEXT touch button 424 for turning a page of the HELP display part 421 to the next page, a denomination button 413 described above, and a TIME display 417 described above are displayed.

In the HELP display part 421 of the HELP screen, the below-described messages are displayed.

Displayed in the first page are messages: "●Select bet multiplier.", which prompts a player to select a multiplier; "●Select number of credits to play to start the game." which prompts a player to select a number of credits to start a game to play; "●All wins left to right in any position only." which notifies a player that all wins are determined by symbols rearranged from left to right "●Each symbol appearing on a reel is counted once per winning combination." which notifies a player that each symbol appearing on a reel is counted only once per winning combination; "●All wins shown in credits, except progressives." which notifies a player that all wins are shown with credits except progressive bonuses; "●Highest win only on each way." which notifies a player that a win by which the highest amount is likely to be obtained is targeted; "●All wins are multiplied by bet multiplier except scatters." which notifies a player that each of all of wins except scatter wins is multiplied by a bet multiplier, "●Scatter wins are multiplied by the total credits bet" which notifies a player that each of the scatter wins is multiplied by a total credit bet; "●Wins on different ways are added." which notifies a player that amounts of wins on ways which are different from one another are added; "●Scatter wins are added to EVERY WAY wins." which notifies a player that amounts of the scatter wins are added to an amount of EVER WAY wins; "●Malfunction voids all pays and plays." which notifies a player that malfunction voids all payouts and plays; and "●The player is responsible for checking that correct credit has been registered before commencing play." which notifies a player that it is required for a player to check that a correct credit has been registered before a game is started.

Displayed in the second page are messages: "INCREASED SYMBOLS PER PLAY. Different reels are used according to the selected number of credits played as displayed below." which notifies a player that reels whose kinds are different from one another are used and the selection of reels to be used is made according to a selected number of credits. "PLAY 60 CREDITS Reels have an increased number of [BAT], [GOURD], [FISH], [JAR], and [DRAGON]; PLAY 30 CREDITS Reels have an increased number of [BAT], [GOURD], [FISH], and [JAR]. PLAY 15 CREDITS Reels have an increased number of [BAT], [GOURD] and [FISH]. PLAY 5 CREDITS Reels have an increased number of [BAT] and [GOURD]. PLAY 1 CREDIT NORMAL REELS. The increase in the number of each symbol is respective to the number of each symbol on normal reels." which notifies a player that with respect to numbers of the respective kinds of symbols on the normal reels, the numbers of the respective kinds of symbols are increased.

Displayed in the third page are messages: "●EVERY WAY provides for 243 ways to win." which notifies a player that EVERY WAY provides 243 ways to win for a player; "●EVERY WAY wins are the winning combinations that appear left to right in any position." "●Only one symbol from each reel comprises each winning combination." which notifies a player that each one symbol rearranged on each of the reels constitutes each of the symbols of each of the winning combinations; "The increase in the number of each symbol is respective to the number of each symbol on normal reels." which notifies a player that with respect to numbers of the respective kinds of symbols on the normal reels, the numbers of the respective kinds of symbols are increased.

Displayed in the fourth page are messages: "FREE GAMES ●3 or more [FEATURE], [WILD] or [×2WILD] appearing left to right trigger 10 FREE GAMES." which notifies a player that when three or more symbols of [FEATURE], [WILD], or [×2WILD] have appeared, 10 free games are triggered; "●Different reels are used during the FREE GAMES." which notifies a player that during each of the free games, different reels are used; "●FREE GAMES can be triggered again during the FREE GAMES." which notifies a player that free games can be triggered again during the free games; and "●Credits bet and increased symbols played during the FREE GAMES are the same as the game that triggered the FREE GAMES." which notifies a player that as a bet placed during each of the free game, the bet which has triggered the free game is applied.

In the fifth page, a payout table shown in a first payout table 1431 in FIG. 2 is displayed. Further, displayed therein are messages: "PAYTABLE SUBSTITUTES ●[WILD] substitutes for all symbols except [×2WILD]." which notifies a player that a symbol [WILD] substitutes for each of all symbols except [×2WILD]; "●[WILD] appears on reels 2 and 4 only." which notifies a player that the symbols [WILD] appear only on reels 2 and 4; "●[×2WILD] substitutes for all symbols." which notifies a player that a symbol [×2WILD] substitutes for each of all of symbols; "●If [×2WILD] substitutes in a win the pay for that win is doubled." which notifies a player that when any WIN with the symbol [×2WILD] involved has occurred, a payout is doubled; "●[×2WILD] appears on reel 3 only." which notifies a player that the symbol [×2WILD] appears only on reel 3; "● 招財進寶 " written in combined form on [WILD] and [×2WILD] means "Bringing fortune and treasure." which notifies a player that the Chinese characters " 招財進寶 " written on [WILD] and [×2WILD] mean "bringing fortune and treasure"; and ●"SCATTER CREDIT".

In the sixth page, a payout table shown in a second payout table 1432 in FIG. 2 is displayed. Further, displayed therein are messages: "PROGRESSIVE FEATURE ●There is a chance the PROGRESSIVE FEATURE may be triggered when [WILD] or [×2WILD]appear." which notifies a player that there is a chance that the progressive feature may be triggered when the symbol [WILD] or the symbol [×2WILD] appears; "●IN the PROGRESSIVE FEATURE, 4 types of dragons are hidden behind 12 coins." which notifies a player that in the progressive feature, four types of DRAGONs are hidden behind 12 coins; "●Select a coin until 3 matching dragons corresponding to a PROGRESSIVE are revealed." which prompts a player to select the coins one by one until three matching DRAGONs whose type is the same have been revealed; "●When 3 matching dragons have been revealed, the corresponding PROGRESSIVE is won and the feature ends." which notifies a player that when the three same matching DRAGONs have been revealed, a PROGRESSIVE award corresponding thereto is won and the PROGRESSIVE FEATURE is finished; "●PROGRESSIVE award amounts for each bet condition are displayed on the top screen." which notifies a player that each PROGRESSIVE award amount which is likely to be obtained by each bet is displayed on the 2nd screen; "●The chances of revealing each dragon are not equal." which notifies a player that the chances of revealing the respective types of DRAGONs are not equal to one another; "●All wins cannot be gambled if the PROGRESSIVE is won, even if gamble game is available." which notifies a player that any wins including a PROGRESSIVE win cannot be gambled even if GAMBLE is active; and "DRAGONS/PROGRESSIVE [RED DRAGON]/GRAND PROGRESSIVE [PURPLE DRAGON]/MAJOR PROGRESSIVE [GREEN DRAGON]/MINOR PROGRESSIVE [BLUE DRAGON]/MINI PROGRESSIVE".

Displayed in the eighth page are messages: "●PLAY 0000 TO 0000 CREDITS" "●ALL WINS PAID BY MACHINE OR ATIENDANT".

As described above, on the HELP screen, the payout tables indicating all of the winning combinations, the basic rules, the win lines, the feature games (the bonus game, the free game, and the like), the ranges of the bet numbers, and the like are described. In each of the payout tables, the payouts are described in descending order of the payouts. In addition, in the basic rules, ways of playing and basic plays of the GAMBLE game are described. For the win lines, it is described that the EVERY WAY in which the paylines are not limited. For the feature games, the plurality of feature games are described in the respectively different pages. When in each of the feature games, the payout tables are different from the payout table in the base game, after the description of the rules in each of the feature game, the payout tables are described. In addition, when there are game specific features such as High POWER and Max Bet Special, rules of the features are described. For the bet numbers, ranges of the bet numbers with which betting can be made in each of the games are described.

A process related to the HELP screen will be described. When the SERVICE button 45 is pressed down with the SERVICE button 45 (GAME RULE button 33) being active, the basic screen in an idle state is kept to be displayed on the middle image display panel 142, and only on the lower image display panel 141, the HELP screen is displayed. While any error is occurring or the AUDIT screen is being displayed, the LED of the SERVICE button 45 is lit off, and the SERVICE button 45 is made inactive. On the HELP screen, the below described process is conducted. When Error/Door Open has occurred, the HELP screen is made to be non-displayed (with the game screen being displayed), and "Error/Door Open" is displayed. When bills or coins are inputted, after the HELP screen has been made to be non-displayed, the credit is accepted. When an AUDIT screen key is turned, the HELP screen is made to be non-displayed, and the AUDIT screen is displayed. Thereafter, when the AUDIT screen is made to be non-displayed, the screen is made to be in the idle state. When after turning off the power, the power is turned on, the HELP screen is not displayed and the screen is made to be in the idle state. When with the HELP screen being displayed, any inputting is not conducted for three minutes, the HELP screen is made to be non-displayed.

(Display Screen: WIN Presentation Screen)

Figure 45:
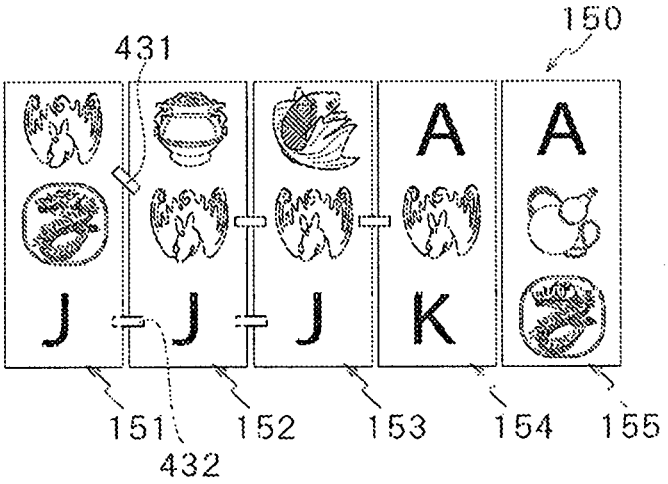
FIG. 45 is an explanatory diagram illustrating one example of a win presentation screen.
Figure 46:
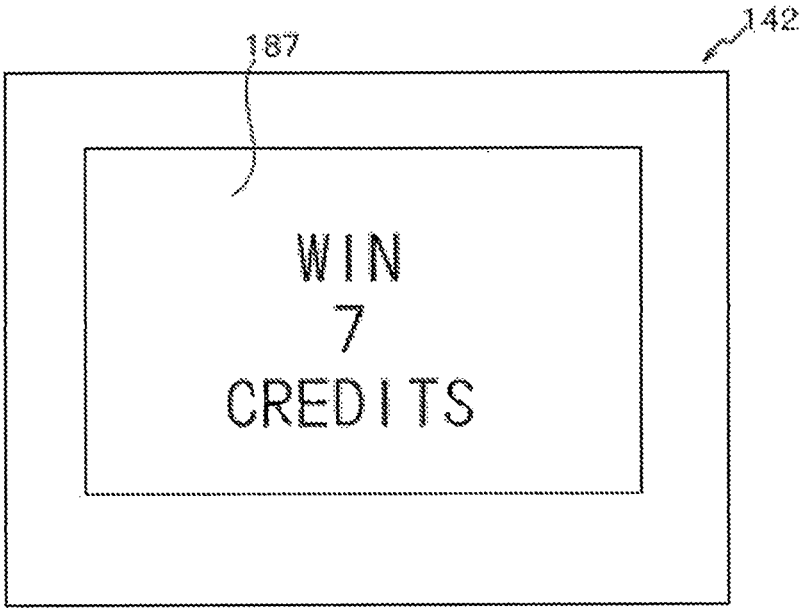
FIG. 46 is an explanatory diagram illustrating one example of the win presentation screen.

When in the base game and the free games, winning has occurred, the below-described presentation display is conducted. As shown in FIG. 45, when in a symbol display area 150 of a lower image display panel 141, two line wins have occurred, the established winning combinations are indicated by line displays 431 and 432. The line displays 431 and 432 are alternately displayed. At this time, on a middle image display panel 142, as shown in FIG. 46, a win image 187 "WIN 7 CREDITS" is displayed. In the win image 187, the obtained credit is displayed in an incremented manner (which is linked to a WIN meter 402 on the lower image display panel 141). A plurality of win images 187 may be used. For example, in respective cases where the obtained win total is less than 25 times of a bet number; where the obtained win total is 25 times or more and less than 50 times of the bet number; and where the obtained win total is 50 times or more of the bet number, the win images 187 which are respectively different from one another may be used. In addition, when the obtained win total is 20 times or more of the bet number, from when all pseudo reels 151 to 155 have stopped to when the above-describe win presentation screen is displayed, a standby state of 20 frames may be set.

In addition, there are 24 WIN ranks which are classified by amounts of obtained win credits. In accordance with the respective WIN ranks, increment speeds are properly used. In addition, WIN sounds in accordance with the increment speeds are used. Specifically, as shown in FIG. 47, the increment speeds are defined in accordance with the respective ranges of the WIN totals. In other words, for each of the WIN ranks 1 to 22, a result of dividing the obtained credit by a predetermined number of seconds is defined as a speed at which one increment is made. Thus, the incrementing is completed in the predetermined number of seconds. In addition, for each of the WIN ranks 23 to 24, up to when a credit to be incremented has reached 20 times of the bet number, the incrementing is conducted at a speed at which 1/2 of the bet number proceeds for one second. When the credit to be incremented has reached 20 times or more of the bet number, a result of dividing the remaining amount of the obtained credit by the remaining number of seconds is defined as a speed at which one increment is made. Thus, the incrementing is completed in the predetermined number of seconds.

In addition, when three or more TRIGGER symbols 504 have been rearranged, audio presentation is conducted. Specifically, after the elapse of 20 frames from when all the pseudo reels 151 to 155 have stopped, "ringing" sound is reproduced. Thereafter, the above-described WIN presentation screen is displayed.

(Details of Display Screen: WIN Meter 402)

Figure 48:
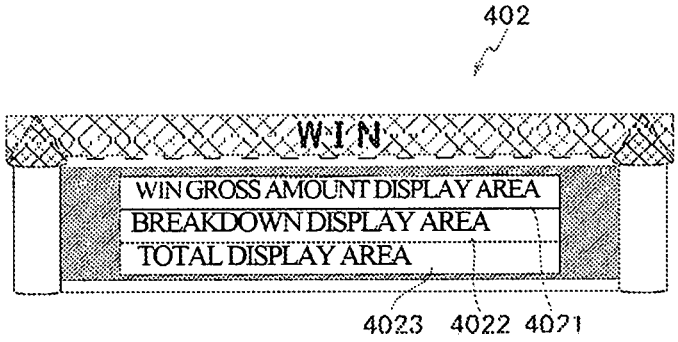
FIG. 48 is an explanatory diagram illustrating a WIN meter.

As shown in FIG. 48, a WIN meter 402 is to display a WIN credit and a breakdown in an integrated meter when winning has occurred. The WIN meter 402 has a WIN gross amount display area 4021, a breakdown display area 4022, and a total display area 4023.

(Details of Display Screen: WIN Meter 402: WIN Gross Amount Display Area 4021)

In the WIN gross amount display area 4021, a WIN credit and a money amount are displayed. The details of display specification will be described below. During idling, immediately after winning has occurred, "0" is displayed as a WIN gross amount, and also in the other states, "0" is displayed. Upon pressing down a SPIN button 46, "0" is displayed. During WIN incrementing, an increment display is conducted. Upon bonus pick triggering, "0" is displayed (no winning occurs upon this triggering).

Upon introducing free games, an immediately previous WIN gross amount is displayed therein. During the rotation of reels in each of the free games, the immediately previous WIN gross amount is displayed therein. Immediately after stopping the reels in each of the free games, if it is immediately after winning has occurred, a WIN amount is added to the immediately previous WIN gross amount, and incrementing display is conducted. On the other hand, in the other states, the immediately previous WIN gross amount is displayed therein. Upon introducing a bonus game, the immediately previous WIN gross amount is displayed therein. Immediately after finishing the bonus game, a WIN amount of a bonus or a jackpot is added to the immediately previous WIN gross amount, and incrementing display is conducted.

As a display image, a credit display such as "12345678" is displayed in an upper row, and a money amount display such as "$123,456.78" is displayed in a lower row.

(Details of Display Screen: WIN Meter 402: Breakdown Display Area 4022)

A breakdown display area 4022 is to display a WIN line No. and a WIN credit, when winning has occurred during a base game and each free game, after stopping the fifth reel. At this time, when a plurality of line payouts have been won, each of the plurality of line payouts is displayed by conducting switching with a switching time unit of 0.5 second. The line payouts are displayed in ascending order of win line Nos. After the largest win line No. has been displayed, the line payouts are displayed again in ascending order of the win line Nos. In the breakdown display area 4022, in a case of winning of a bonus and a credit payout, a "bonus win" and a WIN credit are displayed. In addition, in the breakdown display area 4022, in a case of winning upon winning a jackpot in a bonus game, a "jackpot win" and a WIN credit are displayed.

The details of display specification will be described below. During idling, immediately after winning in the base game has occurred, a breakdown of a payout is displayed, and when a plurality of payouts have been won, each of the plurality of payouts is displayed by conducting the switching with the switching time unit of 0.5 second. In the other cases, the breakdown display area 4022 is made to be non-displayed. Upon pressing down a SPIN button 46, the breakdown display area 4022 is made to be non-displayed. During WIN incrementing, a breakdown of the payout is displayed, when a plurality of payouts have been won, each of the plurality of payouts is displayed by conducting the switching with the switching time unit of 0.5 second. Upon bonus pick triggering, the breakdown display area 4022 is made to be non-displayed. Upon introducing free games, the breakdown display area 4022 is made to be non-displayed. During the rotation of reels in each of the free games, the breakdown display area 4022 is made to be non-displayed. Immediately after stopping the reels in each of the free games, if a line win has occurred, a breakdown of a payout is displayed, and when a plurality of payouts have been won, each of the plurality of payouts is displayed by conducting the switching with the switching time unit of 0.5 second. In the other cases, the breakdown display area 4022 is made to be non-displayed.

Upon introducing a bonus game, the breakdown display area 4022 is made to be non-displayed. Immediately after finishing the bonus game, in a case of a bonus (except a jackpot), a bonus win is displayed and when a jackpot has been won, a jackpot win is displayed. Immediately after winning a credit payout, a bonus win is displayed. Upon finishing the bonus game (upon returning to a game screen), the breakdown display area 4022 is made to be non-displayed.

As a display image, "each number of a Kind, a symbol name, WIN×number of WAYs in which winning has been established=12345678" is displayed. This display is conducted for the wins obtained during the base game and each of the free games. In addition, for the wins by TRIGGER symbols, as a display image, "FEATURE WIN=12345678" is displayed.

(Details of Display Screen: WIN Meter 402: Total Display Area 4023)

A display area 4023 is to display a total in the breakdown display area. The details of display specification will be described below. During idling, immediately after winning in a base game has occurred, a total win is displayed. In the other cases, the total display area 4023 is made to be non-displayed. Upon pressing down a SPIN button 46, the total display area 4023 is made to be non-displayed. During WIN incrementing, a total win is displayed therein. Upon bonus pick triggering, the total display area 4023 is made to be non-displayed. Upon introducing the free games, the total display area 4023 is made to be non-displayed. During the rotation of reels in each of the free games, the total display area 4023 is made to be non-displayed. Immediately after stopping the reels in each of the free games, if a line win has occurred, a total win is displayed, and in the other cases, the total display area 4023 is made to be non-displayed. Upon introducing a bonus game, the total display area 4023 is made to be non-displayed. Immediately after finishing the bonus game, a total win is displayed therein. Immediately after winning a credit payout, a total win is displayed therein. Upon finishing the bonus game (upon returning to a game screen), the total display area 4023 is made to be non-displayed. As a display image, "Total WIN=12345678" is displayed.

(Control Panel 30)

Below a lower image display panel 141, as shown in FIG. 49, a control panel 30 is arranged. The control panel 30 includes a variety of buttons, a coin entry 21 for accepting coins into a cabinet 11, a bill entry 22, and the like.

Specifically, on the control panel 30, a TAKE WIN/COLLECT button 32 and a SERVICE button 45 are arranged in a left area thereof, and a 1-BET button 34, a 2-BET button 35, a 3-BET button 36, a 4-BET button 37, and a 5-BET button 38 are arranged in an upper row in a central area thereof. Further, on the control panel 30, a PLAY 8 CREDITS button 40, a PLAY 18 CREDITS button 41, a PLAY 38 CREDITS button 42, a PLAY 68 CREDITS button 43, and a PLAY 88 CREDITS button 44 are arranged in a lower row in the left area thereof. On the control panel 30, a SPIN button (REPEAT BET/START FEATURE button) 46 is arranged in a right area thereof. In addition, between the TAKE WIN/COLLECT button 32 and the 1-BET button 34, a GAMBLE button 31 is arranged.

In addition, as shown in FIG. 49, the CREDITS buttons 40 to 44 are provided with name labels, respectively. Specifically, the PLAY 8 CREDITS button 40 is provided with a name label "EXTREAM LEVEL, with one star sign, PLAY 8 CREDITS". In addition, the PLAY 18 CREDITS button 41 is provided with a name label "EXTREAM LEVEL, with two star signs, PLAY 18 CREDITS". In addition, the PLAY 38 CREDITS button 42 is provided with a name label "EXTREAM LEVEL, with three star signs, PLAY 38 CREDITS". In addition, the PLAY 68 CREDITS button 43 is provided with a name label "EXTREAM LEVEL, with four star signs, PLAY 68 CREDITS". In addition, the PLAY 88 CREDITS button 44 is provided with a name label "EXTREAM LEVEL, with five star signs, PLAY 88 CREDITS". Each of these credit buttons 40 to 44 is operated, whereby an external appearance of each of these credit buttons 40 to 44 is displayed as an image on the lower image display panel 141.

Figure 50:
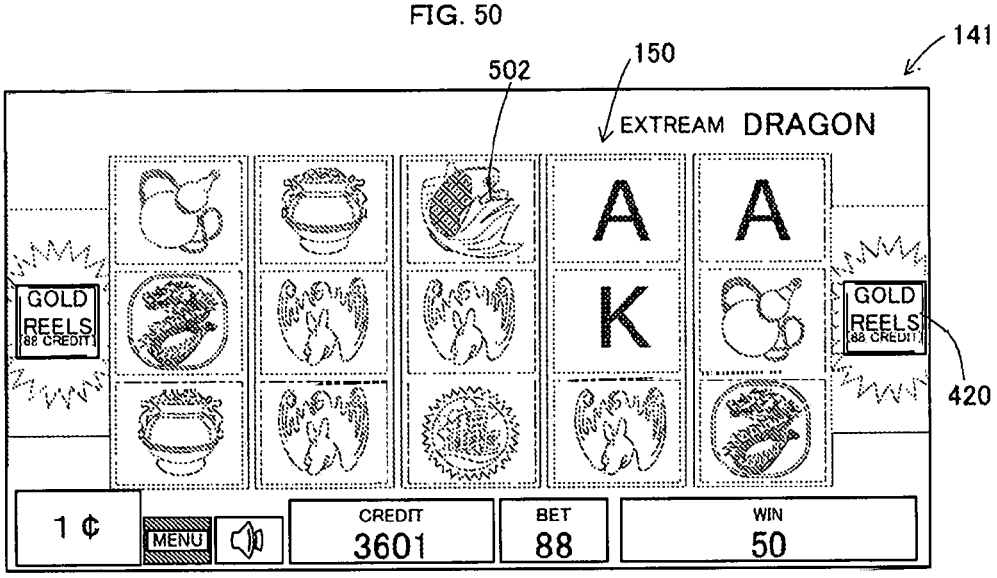
FIG. 50 is an explanatory diagram illustrating one example of a display screen on the lower image display panel.

Specifically, when as a symbol bet, any of the credit buttons 40 to 44 is selected and a game is started, as shown in FIG. 50, in areas of the lower image display panel 141, in which logos 418 (refer to FIG. 28) are arranged (areas on both sides of a symbol display area 150), button images 420 indicating the external appearances each corresponding to the selected symbol bet are displayed. In FIG. 50, an example in which as a symbol bet, the PLAY 88 CREDITS button 44 is operated and the button images 420 of "EXTREAM LEVEL, with five star signs, PLAY 88 CREDITS" are displayed is shown.

The control panel 30 allows the same selections as those conducted by using a touch panel on a variety of selection screens. For example, operating the 1-BET button 34 allows a cursor used upon the selection to move in a left direction, and operating the 5-BET button 38 allows the cursor to move in a right direction. It is preferable that upon operating each of the buttons, a light source inside each of the buttons is lit up.

Figure 51:
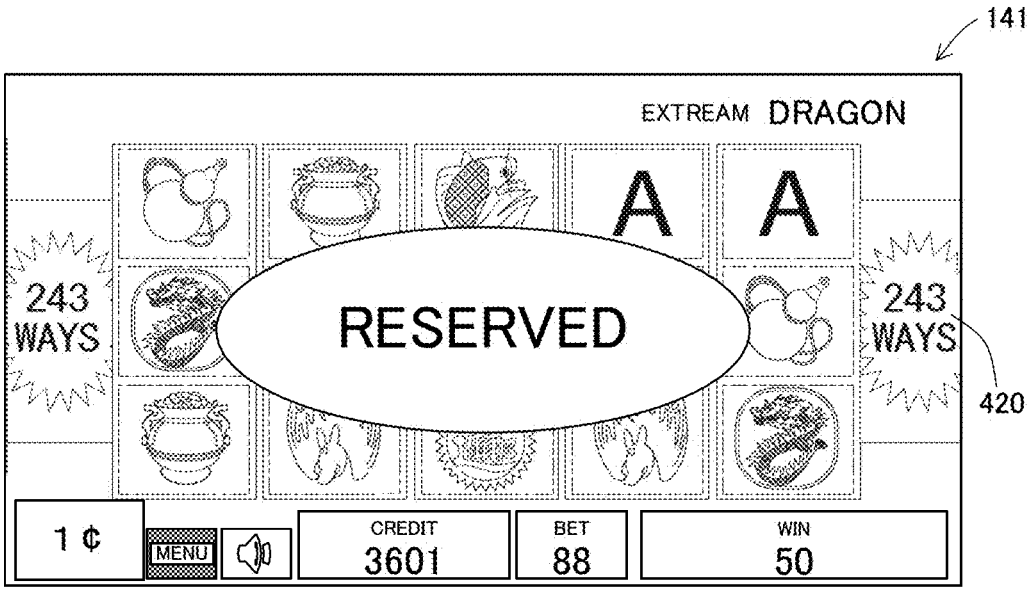
FIG. 51 is an explanatory diagram illustrating one example of a display screen on the lower image display panel.

The above-mentioned SERVICE button 45 is an operation button used upon leaving his or her seat or requesting exchange from a gaming house employee. When the SERVICE button 45 is pressed down, as shown in FIG. 51, a RESERVED symbol 1460 with which a countdown for three minutes is conducted is displayed on the lower image display panel 141, and a standby state is maintained for three minutes. It is to be noted that the SERVICE button 45 is active when a game is over. In addition, a light source inside the SERVICE button 45 is lit off and the SERVICE button 45 is made inactive during spinning of reels, during win incrementing (when the game is not over), during displaying of a HELP screen, upon the occurrence of an error, during displaying a presentation screen which can be cancelled, and during RS accounting. The RESERVED symbol 1460 is made to be non-displayed when the three minutes has passed or when the SERVICE button 45 is pressed down again during displaying of the RESERVED symbol 1460. The GAMBLE button 31 is an operation button used upon shifting to a gamble game, for example, after finishing a bonus game. Here, the gamble game is a game played by using the obtained credits. The TAKE WIN/COLLECT button 32 is the so-called settling button with which credit data related to credits obtained in a variety of games is added to credit data stored in an IC card inserted into a PTS terminal 700. The GAME RULE button 33 is a button pressed when a way of operating a game and the like are not known, and upon pressing the GAME RULE button 33, a variety of pieces of HELP information are displayed on the later-described presentation mechanism 131 and the lower image display panel 141.

The 1-BET button is a button with which each time the 1-BET button is pressed, a credit which a player currently has is bet one by one with respect to each activated line. The 2-BET button 35 is a button to start a game by placing two bets with respect to each activated line. In addition, the 3-BET button 36 is a button to start a game by placing three bets with respect to each activated line. In addition, the 4-BET button 37 is a button to start a game by placing four bets with respect to each activated line. In addition, the 5-BET button 38 is a button to start a game by placing five bets with respect to each activated line. Accordingly, by pressing each of the 1-BET button 34, the 2-BET button 35, the 3-BET button 36, the 4-BET button 37, and the 5-BET button 38, the number of bets to be placed with respect to one line of the activated lines is determined. It is to be noted that in accordance with a change in the number of bets which can be placed, the design of each of the above-mentioned buttons may be changed. For example, bet buttons with which a credit and credits of "1", "2", "5", "10", and "15" can be placed may be provided. In this case, the bet buttons may be designed to be "BETx1", "BETx2", "BETx5", "BETx10", and "BETx15". In addition, bet buttons with which a credit and credits of "1", "2", "5", "10", and "20" can be placed may be provided. In this case, the bet buttons may be designed to be "BETx1", "BETx2", "BETx5", "BETx10", and "BETx20".

The SPIN button 46 with "REPEAT BET" denoted is a button used when scrolling of the symbol arrays in which the symbols 501 are depicted is started. In other words, the SPIN button 46 is used when spinning is started with the same contents of betting as those of the previous betting. In addition, this SPIN button 46 functions also as a button for starting the bonus game and a button for adding a payout obtained in the bonus game to a credit. When the SPIN button 46 allows a game to be started with the same contents of betting (a bet amount and a number of activated lines) as those of the previous betting, as the designed thereof, the SPIN button 46 may be a button with "REPEAT BET/START FEATURE" denoted. The bill entry 22 is to identify whether or not bills are legitimate and to accept the legitimate bills into a cabinet 11.

(Process Operation of Slot Machine 10: GAMBLE Game)

Figure 52:
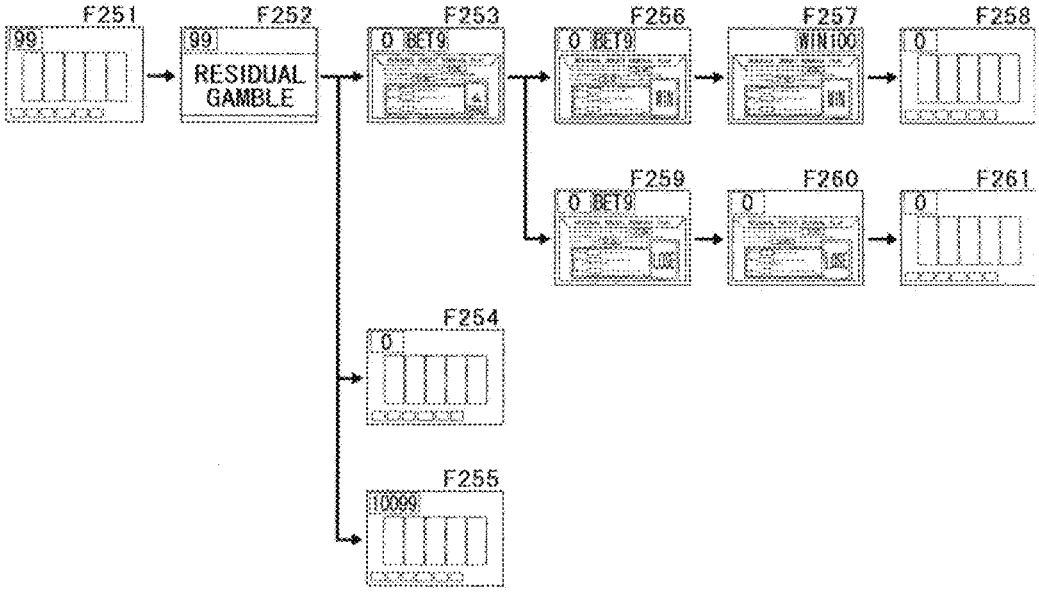
FIG. 52 is a diagram showing a display change flow in a GAMBLE game.

As shown in FIG. 52, when a GAMBLE start condition is established, for example, when a COLLECT button is pressed, in a state in which a money amount is less than a process value such as one dollar, a "RESIDUAL GAMBLE" screen is displayed (F253). When a GAMBLE button is pressed, a GAMBLE game is started. On the other hand, when the COLLECT button is pressed, a call attendant is displayed (F254). When a SPIN button 46 is pressed, the screen is returned to a screen in a base game (F255).

When "WIN" has occurred in the GAMBLE game (F256), a predetermined money amount such as one cent is won and concurrently, a token is paid out from a hopper. In addition, the addition to a CREDIT meter is conducted (F257). Thereafter, after the elapse of a predetermined time period such as two seconds, the screen is returned to the screen in the base game (F258). On the other hand, when "LOSE" has occurred in the GAMBLE game (F259), a LOSE screen is displayed (F260). Thereafter, after the elapse of a predetermined time period such as two seconds, the screen is returned to the screen in the base game (F261).

Functions of buttons in the progress of the GAMBLE game will be described. A TAKE WIN/COLLECT button 32 functions as a "TAKE WIN" (CASH OUT) button in "GAMBLE ON" and "GAMBLE OFF" states. A GAMBLE button 31 functions as a "GAMBLE START" button in the "GAMBLE ON" state and does not function in the "GAMBLE OFF" state. Each BET button is inactive in the "GAMBLE ON" state and functions as the "GAMBLE START" button in the "GAMBLE OFF" state. A SPIN button 46 functions as a button to shift "to a base game" in the "GAMBLE ON" and "GAMBLE OFF" states.

Figure 53:
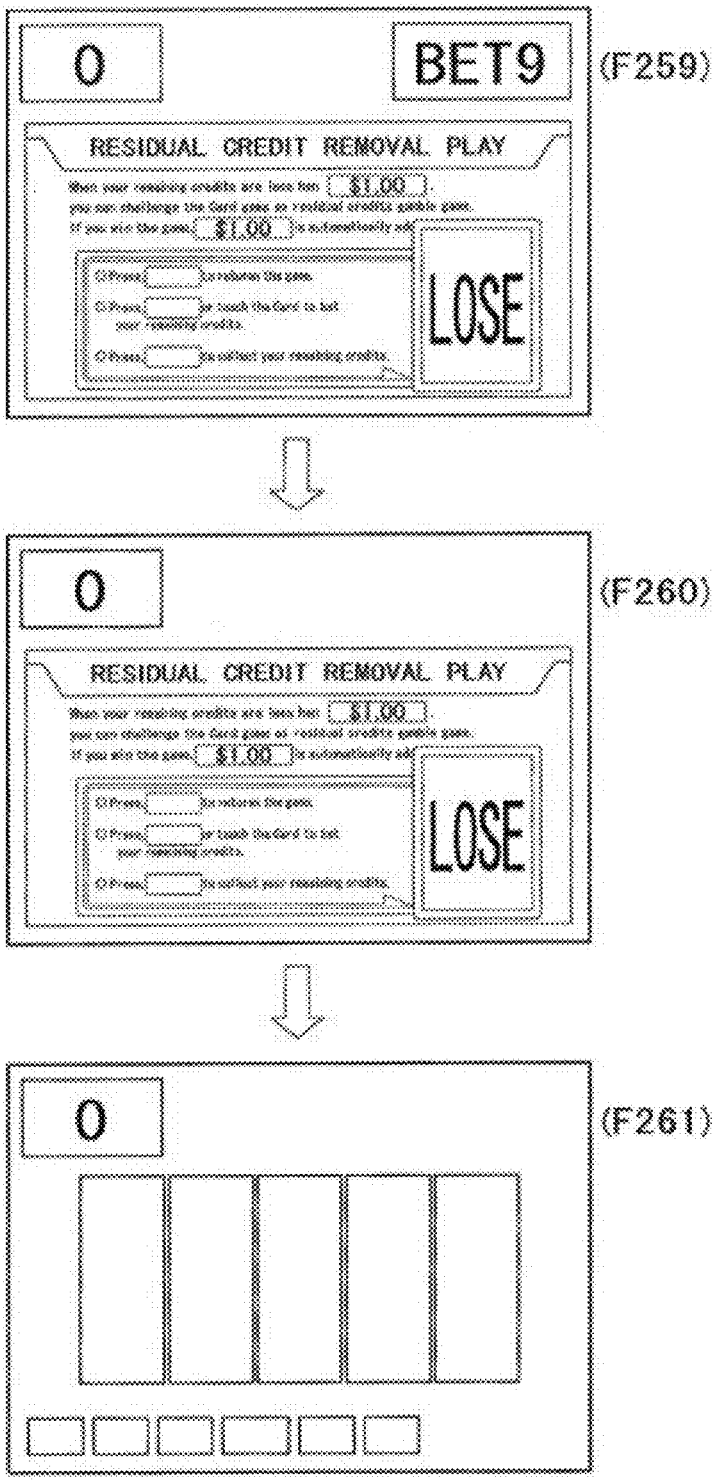
FIG. 53 is an explanatory diagram illustrating screens in the GAMBLE game.

As shown in FIG. 53, the "RESIDUAL GAMBLE" screen has a card display area, a navigation area, and a meter area. In the card display area, a card image is displayed. The whole card display area is provided with a touch sensor function. In the navigation area, a variety of navigational messages are displayed.

A limit of a value which allows winning in the GAMBLE game is set by using an audit screen. An upper limit of the number of times at which the GAMBLE game is played is also set by using the audit screen. For example, the upper limit thereof is five times, and the upper limit can be set within the upper limit. Whether a touch panel is turned on or off is selectable.

Figure 54:
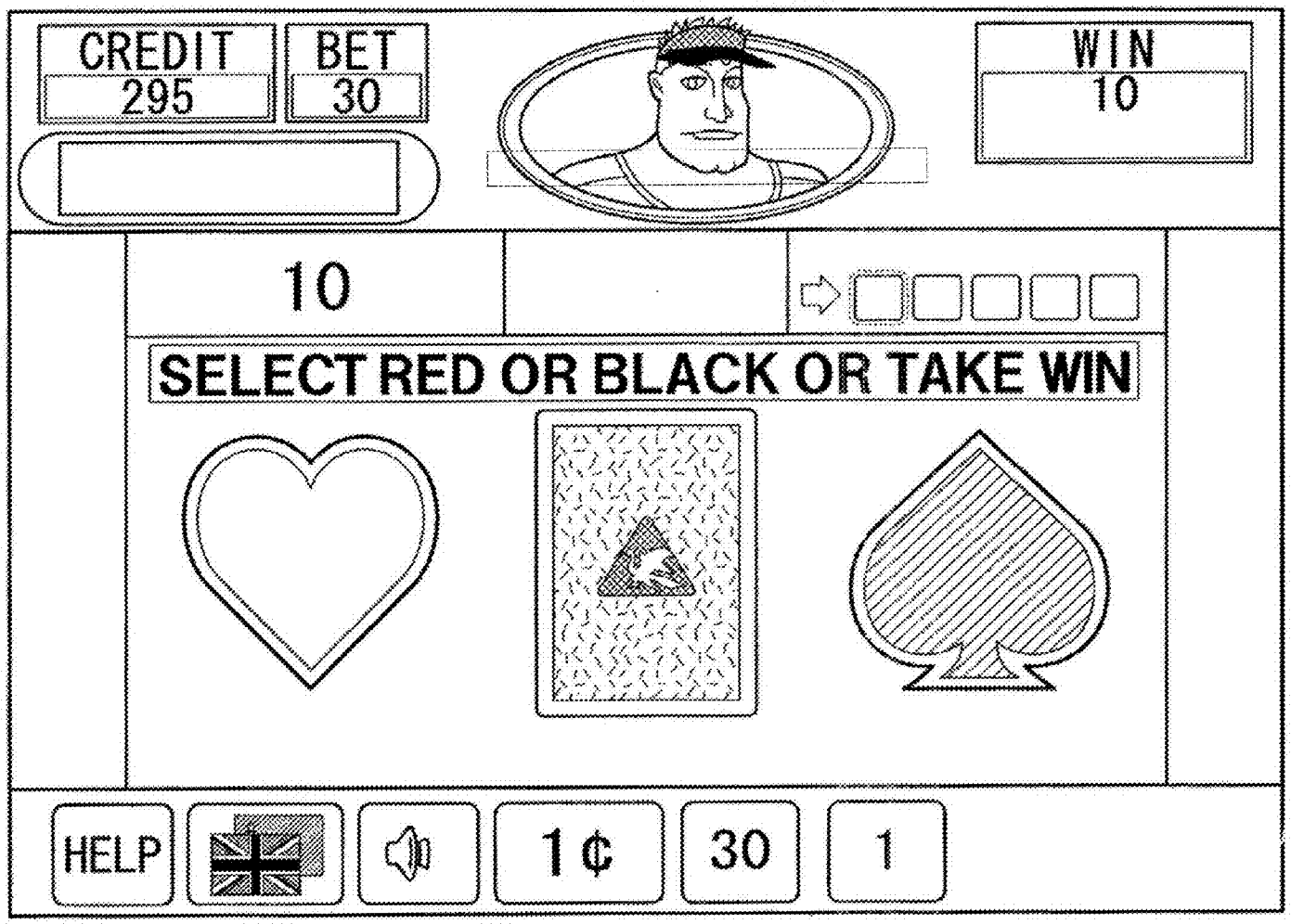
FIG. 54 is an explanatory diagram illustrating an operation course in the GAMBLE game.

As shown in FIG. 54, upon shifting to the GAMBLE game, a message "PLAY ON, GAMBLE or TAKE WIN RED" is caused to disappear. It is to be noted that immediately after RAM clear, nothing is displayed in a card history until the GAMBLE game is played. A message "SELECT RED OR BLACK OR TAKE WIN" is displayed. A heart-shaped red button and a spade-shaped black button on the GAMBLE screen are lit up and a TAKE WIN button in a central portion thereof is lit up. The other buttons are lit off.

Figure 55:
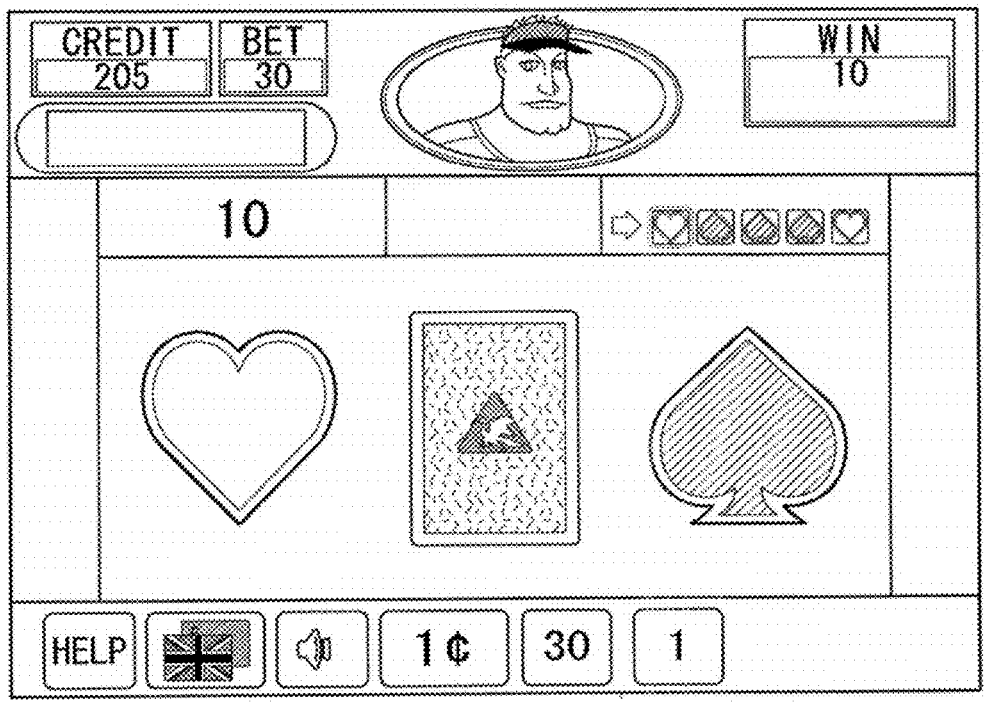
FIG. 55 is an explanatory diagram illustrating the operation course in the GAMBLE game.

Next, as shown in FIG. 55, in "GAMBLE AMOUNT", an amount to be bet is displayed. Any of the choices of the heart-shaped red button and the spade-shaped black button on the GAMBLE screen and the TAKE WIN button in the central portion is selected. When the TAKE WIN button is selected, a value of a win is added to a credit at one time, a game state is returned to an idle state.

Figure 56:
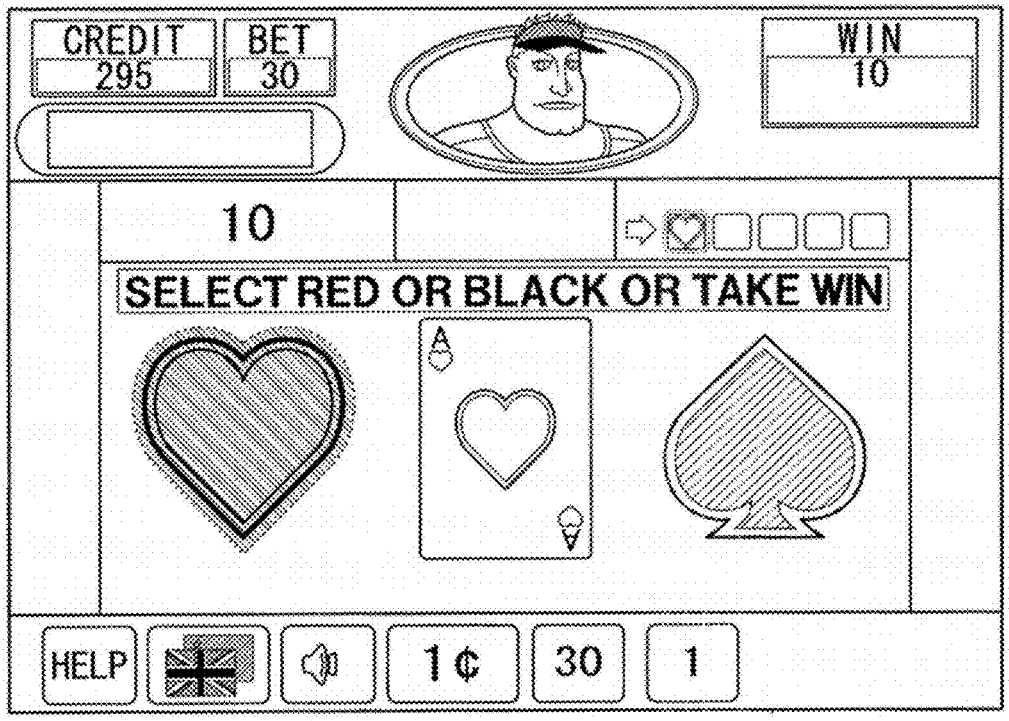
FIG. 56 is an explanatory diagram illustrating the operation course in the GAMBLE game.

In a case of a failure in the GAMBLE game, as shown in FIG. 56, the choices not selected are darkened. In a left end portion of a GAMBLE history column, the card history is displayed at one time. The previous card history shifts to right. It is to be noted that a shifting trajectory has no animation and a one-time display is conducted. A card result in the central portion is displayed at one time. At this point in time, values in the WIN meter and the GAMBLE meter are not changed. A sound indicating "unlucky" is outputted, and after several seconds, the game shifts to a base game.

Figure 57:
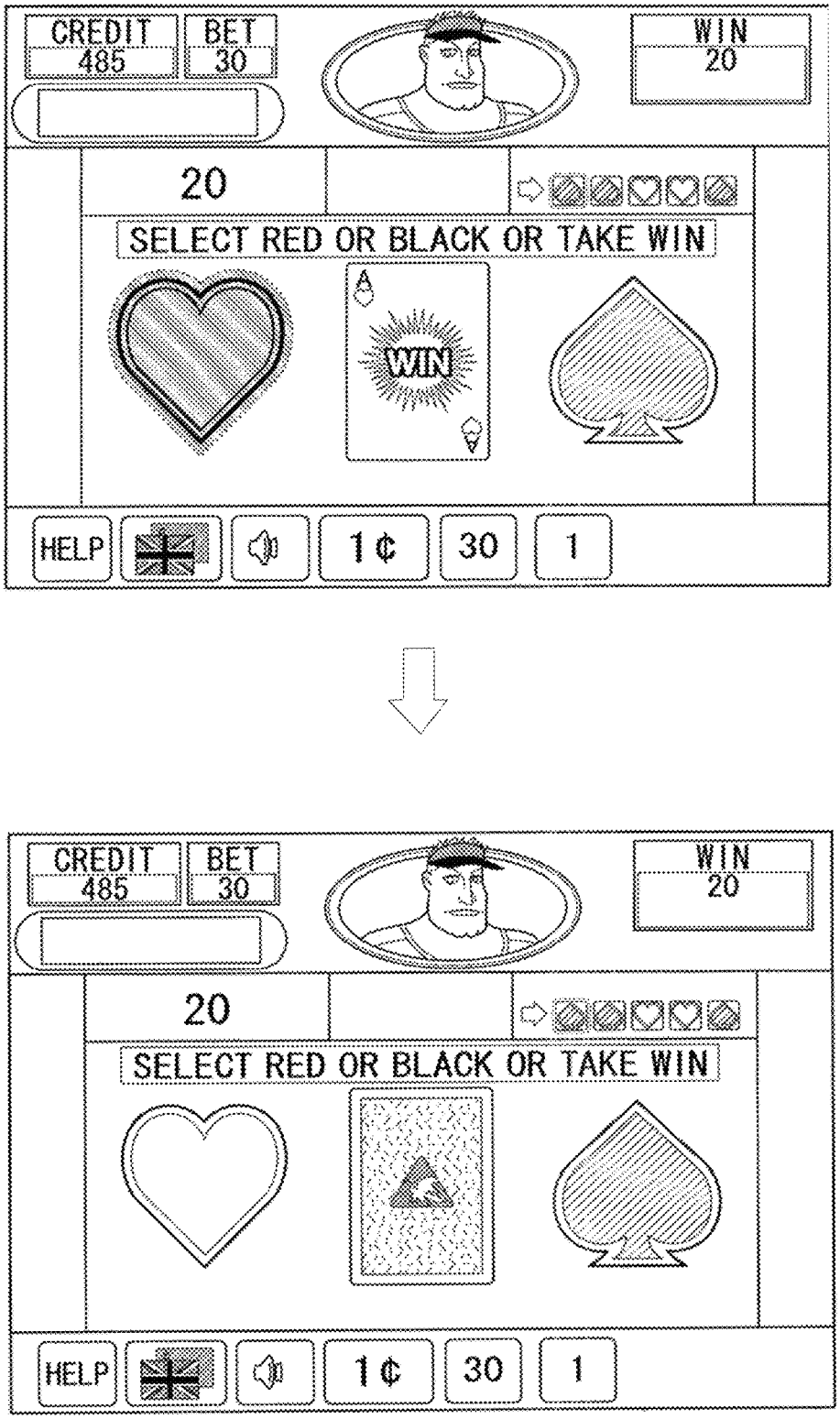
FIG. 57 is an explanatory diagram illustrating the operation course in the GAMBLE game.

In a case of a success in the GAMBLE game, as shown in FIG. 57, the choices not selected are darkened. In the left end portion of the GAMBLE history column, the card history is displayed at one time. The previous card history shifts to right. It is to be noted that a shifting trajectory has no animation and a one-time display is conducted. In the central card, a normal card and a card having a WIN message are alternately displayed in each one frame, and a success sound is outputted for a predetermined time period. In the WIN meter, a value which is increased by the GAMBLE result is added at one time. When the GAMBLE game is played at up to the upper limit of times, credits of win values are added at one time, and the game state is returned to the idle state. As shown in FIG. 57, when the GAMBLE game is not played at up to the upper limit of times, the card is flipped over, and the GAMBLE game is continued.

Hereinabove, the embodiment of the present invention is described. However, the specific example is merely exemplified, the present invention is not particularly limited thereto, and appropriate design modifications and variations of the specific configuration of the parts and the like are possible. In addition, the effects described in the embodiment of the present invention are merely the most favorable effects coming from the present invention, and the effects according to the present invention are not limited to the effects described in the embodiment of the present invention.

Next, additional functions and configuration of the slot machine 10 of the above-described embodiment will be described in details.

(Symbol Bet: Increases in Kinds and Numbers of Special Symbols for Each Bet Number)

As shown in FIG. 5, in a gaming machine according to the present embodiment, symbol arrays are displayed in a varying manner, and in association with increases in bet numbers and credits, kinds and numbers of special symbols displayed on the symbol arrays are increased. Specifically, the slot machine 10 (gaming machine 300) has a lower image display panel 141 (liquid crystal display device) as a symbol display device. On the lower image display panel 141, a plurality of symbol arrays 170 in which a plurality of symbols including base game symbols 502 and special symbols 503 which are more advantageous than said base game symbols 502 are arrayed are displayed in the varying manner, and thereafter, symbols 501 are rearranged in a symbol display area 150 composed of a plurality of cells 28 (refer to FIG. 26, also referral to as display blocks 28) in a matrix shape, thereby displaying a game result.

The slot machine 10 has a control panel 30 as a bet input device, which is operable to accept betting whose bet number is designated by a player. The control panel 30 has credit buttons 40 to 44 (a PLAY 8 CREDITS button 40, a PLAY 18 CREDITS button 41, a PLAY 38 CREDITS button 42, a PLAY 68 CREDITS button 43, and a PLAY 88 CREDITS button 44), thereby allowing gradual setting of bet numbers to be set. Hereinafter, the bet based on the credit buttons 40 to 44 are referred to as "symbol bets (SBB) 8, 18, 38, 68, and 88", respectively. On the slot machine 10, a base game in which with betting as a condition, the symbols 501 are rearranged on the lower image display panel 141 is executed. On the slot machine 10, the symbols 501 arrayed in the plurality of symbol arrays 170 are modified such that in accordance with an increase in the bet number placed by a player, a percentage of a number of the special symbols 503 to a number of all of the symbols 501 in the plurality of symbol arrays 170 is increased.

As described above, the larger the bet number is, the more increased the percentage of the number of the special symbols 503 which are more advantageous than the base game symbols 502 is. Thus, by the way of increasing the number of the special symbols 503, it is clearly shown to a player that in accordance with the increase in the bet number, a player can more advantageously play a game. As a result, the likelihood that a profit of a gaming machine administrator can be increased is enhanced.

It is to be noted that "the special symbols 503 which are more advantageous than the base game symbols 502" denotes that there is a likelihood with which a more advantageous game result can be obtained by the rearrangement of the special symbols 503 in the symbol display area 150 than by the rearrangement of the base game symbols 502 therein. The "advantageous game result" denotes that an amount of a payout awarded based on the game result is large. For example, it is denoted that when symbols 501 whose number is a predetermined number or more are rearranged and winning corresponding to said symbols 501 is determined, an amount of a payout of winning corresponding to the special symbols 503 is larger than an amount of a payout of winning corresponding to the base game symbols 502.

In addition, a bet operation in the present embodiment is conducted as described below. First, a player determines a value of a number of bets by using any of the credit buttons 40 to 44, the value used as a base of a large quantity in a bet number. By using any of bet buttons 34 to 38 (a 1-BET button 34, a 2-BET button 35, a 3-BET button 36, a 4-BET button 37, and a 5-BET button 38) provided on the control panel 30, a player selects a multiplier used upon obtaining a payout. As described above, the large quantity of the number of bets may be determined by the base value determined by using the credit buttons 40 to 44. For example, when the PLAY 88 CREDITS button 44 and the 2-BET button 35 are selected, the bet number is "88 credits× 2=176 credits" and the payout multiplier is two times. It is to be noted that which of each of the bet buttons 34 to 38 and each of the credit buttons 40 to 44 may be first operated.

The special symbols 503 include a plurality of kinds of symbols whose degrees of advantageousness are different from one another in a gradual manner. As shown in FIG. 7, the special symbols 503 include: BAT symbols **503*e***;

GOURD symbols 503*d* whose degree of advantageousness is higher than a degree of advantageousness of the BAT symbols 503*e*; FISH symbols 503*c* whose degree of advantageousness is higher than a degree of advantageousness of the GOURD symbols 503*d*; POT symbols 503*b* whose degree of advantageousness is higher than a degree of advantageousness of the FISH symbols 503*c*; and DRAGON symbols 503*a* whose degree of advantageousness is higher than a degree of advantageousness of the POT symbols 503*b*. In accordance with the increase in the number of bets placed by a player, the increase in the percentage of the special symbols 503 whose degree of advantageousness is higher is permitted.

In the present embodiment, these plurality of kinds of special symbols 503*e*, 503*d*, 503*c*, 503*b*, and 503*a* whose degrees of advantageousness are different from one another in the gradual manner are associated with the credit buttons 40 to 44, respectively. Increases in the percentages of the respective kinds of specific symbols associated with these credit buttons 40 to 44 are permitted.

In addition, it is only required for the symbol arrays 170 to be advantageously modified in accordance with the increase in the number of bets, and the way of modification is not limited. For example, the base game symbols 502 may be modified to the special symbols 503 in accordance with the increase in the number of bets. In addition, the special symbols 503 may be increased in accordance with the increase in the number of bets. In addition, the base game symbols 502 may be decreased in accordance with the increase in the number of bets. In addition, the above-mentioned modification, increase, and decrease may be combined.

In addition, in the present embodiment, when a predetermined condition is satisfied in the base game, free games, in each of which betting is not required, are executed. Also in each of the free games, the symbol arrays 170 may be modified to advantageous symbol arrays 170 in accordance with the increase in the number of bets. Specifically, in each of the free game, on the lower image display panel 141, a plurality of symbol arrays 170 which are different from the plurality of symbol arrays 170 used in the base game are displayed in the varying manner and thereafter, the symbols 501 are rearranged in the symbol display area 150. The modification of the symbols arrayed in the plurality of symbol arrays 170 may be configured such that in accordance with the increase in the number of bets placed in the base game immediately prior to shifting to the free games, in which the free games are triggered, a percentage of the special symbols 503 to all symbols 501 in the plurality of symbol arrays 170 is more increased than a percentage in the base game.

One example of the symbol arrays 170 is shown in FIG. 8 to FIG. 17. In FIG. 8 to FIG. 12, one example of symbol arrays 170 corresponding to the symbol bets 8, 18, 38, 68, and 88 in the base game is shown. In FIG. 13 to FIG. 17, one example of symbol arrays 170 corresponding to the symbol bets 8, 18, 38, 68, and 88 in the free games is shown. Reels 1 to 5 in FIG. 8 to FIG. 17 correspond to the later-described pseudo reels 151 to 155, and symbol arrays 170A to 170E to be varied respectively thereon are shown. In addition, in FIG. 18 and FIG. 19, the numbers of the respective kinds of the special symbols 503 and the percentages of the respective kinds of the special symbols 503 to all symbols in the base game and the free game are shown.

As shown in FIG. 18, in the base game, in a case of one symbol bet, symbol arrays 170 in which only the number of the BAT symbols 503*e* is large are used. In addition, in a case of five symbol bets, symbol arrays 170 in which the numbers of the BAT symbols 503*e* and the GOURD symbols 503*d* are large are used. In addition, in a case of 15 symbol bets, symbol arrays 170 in which the numbers of the BAT symbols 503*e*, the GOURD symbols 503*d*, and the FISH symbols 503*c* are large are used. In addition, in a case of 30 symbol bets, symbol arrays 170 in which the numbers of the BAT symbols 503*e*, the GOURD symbols 503*d*, the FISH symbols 503*c*, and the POT symbols 503*b* are large are used. In addition, in a case of 60 symbol bets, symbol arrays 170 in which the numbers of the BAT symbols 503*e*, the GOURD symbols 503*d*, the FISH symbols 503*c*, the POT symbols 503*b*, and the DRAGON symbols 503*a* are large are used. As described above, the special symbols 503 whose increase or increases in the number or numbers is or are permitted are associated with the number or numbers of the symbol bets.

In addition, when the symbol bets are compared with one another, in accordance with the increase in the number of the symbol bets, the numbers of all of the kinds of the special symbols 503 are increased, and further, the numbers of all of symbols are decreased. In other words, the larger the number of symbol bets is, the more increased the percentages of all kinds of the special symbols 503 are. In the present embodiment, since probabilities with which symbols 501 which the symbol arrays 170 respectively have are rearranged are the same as one another, it is understood that the larger the number of symbol bets is, the more the percentage of the special symbols 503 is increased, thereby enhancing the likelihood with which an advantageous game result is obtained. It is to be noted that the way of increasing the respective kinds of the special symbols 503 is not limited thereto, and it is only required for the way of increasing the respective kinds of the special symbols 503 to allow the advantageousness to be associated with the increase in the bet numbers.

For example, as shown in FIG. 19, in a case of the one symbol bet in the free games, the percentages of the special symbols 503 are higher than the percentages in the other symbol bets. However, there is bias in the arrangement of the respective kinds of the special symbols 503 on each of the reels, probabilities, with each of which a game result related to the special symbols 503 is obtained, are set to be low.

(Determination of One from a Plurality of Bonuses Whose Degrees of Advantageousness are Different from One Another in a Gradual Manner.)

As shown in FIG. 6, on a gaming machine according to the present embodiment, in a bonus game, one bonus is determined from among a plurality of bonuses whose degrees of advantageousness are different from one another in a gradual manner. Specifically, the slot machine 10 (gaming machine 300) has a lower image display panel 141 functioning as a display, on which a plurality of choice images 1421 are displayed in a pick-out bonus game in which one bonus is determined from among the plurality of bonuses (a GRAND bonus, a MAJOR bonus, a MINOR bonus, and a MINI bonus) whose degrees of advantageousness are set to be different from one another in the gradual manner. The slot machine 10 has a control panel 30 as a selection input device which allows one to be selected from among the plurality of choice images 1421 on the lower image display panel 141. Each time one is determined from among the plurality of choice images 1421 by using the control panel 30, each of the choice images 1421 is modified to any of bonus rank images 1422 (a GRAND rank image 1422*a*, a MAJOR rank image 1422*b*, a MINOR rank image 1422*c*, and a MINI rank image 1422*d*) corresponding to the plurality of bonuses. It is to be noted that the bonus is also referral to as a progressive, a jackpot, and a progressive jackpot.

On the slot machine 10, in the above-described bonus game, prior to performing a presentation display related to the bonus game, one bonus is previously determined from among the plurality of bonuses. The slot machine 10 controls the lower image display panel 141 such that in the presentation display, it is displayed that a number of only the bonus rank images 1422 corresponding to the determined bonus reaches a predetermined number (for example, four). In other words, a player obtains the bonus corresponding the kind of bonus rank images 1422 whose number has reached the predetermined number through the selections of the choice images 1421.

Further, in the presentation display, prior to performing the display in which the number of the bonus rank images 1422 corresponding to the previously determined bonus reaches the predetermined number, bonus rank images 1422 corresponding to bonuses among the plurality of bonuses, whose degrees of advantageousness are high in rank, are displayed.

As described above, in the presentation display, prior to performing the display in which the number of the bonus rank images 1422 corresponding to the previously determined bonus reaches the predetermined number, the bonus rank images 1422 corresponding to the bonuses among the plurality of bonuses, whose degrees of advantageousness are high in rank, are displayed. Thus, even when the rank of the determined bonus is any rank, a player playing the bonus game prior to the notification of the bonus is provided with a sense of expectation that a player is likely to obtain any bonus which is high in rank, thereby allowing new entertainment properties to be provided.

Although in the present embodiment, the "bonuses which are high in rank" are the GRAND bonus and the MAJOR bonus, the present invention is not limited thereto. For example, only the most advantageous GRAND bonus may be the bonus which is high in rank. In addition, although in the presentation display, the bonus rank images 1422 corresponding to "bonuses which are high in rank" are displayed, the present invention is not limited thereto.

For example, in the bonus game according to the present embodiment, either of a first mode (scenario mode) in which a part of all of the plurality of bonus rank images 1422 to be displayed on the lower image display panel 141 are previously determined; and a second mode (random mode) in which all of the plurality of bonus rank images 1422 to be displayed on the lower image display panel 141 are randomly determined is previously determined. In the first mode, prior to displaying the predetermined number of bonus rank images 1422 corresponding to the bonuses previously determined as a result of the bonus game, the bonus rank images 1422 corresponding to the "bonuses which are high in rank" are displayed. On the other hand, in the second mode, since all of the bonus rank images 1422 are randomly determined, there is a likelihood that the bonus rank images 1422 corresponding to the "bonuses which are high in rank" are not displayed.

In addition, in the base game, as described above, the plurality of symbols 501 are rearranged in the symbol display area 150 on the lower image display panel 141, thereby displaying a game result. Here, the plurality of symbols 501 include WILD symbols 505 (refer to FIG. 7) as specific symbols. On the slot machine 10, when the WILD symbols 505 are rearranged in the symbol display area 150, a drawing to determine whether or not any of the bonuses (any of the GRAND bonus, the MAJOR bonus, the MINOR bonus, and the MINI bonus) is triggered is conducted with a probability in accordance with the number of the rearranged WILD symbols 505. In other words, when the WILD symbols whose number is large are displayed in a stopped manner, a probability with which any of the plurality of ranks is won is gradually increased. Further, the drawing to determine whether or not any of the bonuses is triggered is influenced by the above-described bet number. In other words, on the slot machine 10, when the WILD symbols 505 are rearranged in the symbol display area 150, the drawing to determine whether or not the bonus game is triggered is conducted with a probability in accordance with the number of the rearranged WILD symbols 505.

Figure 20:
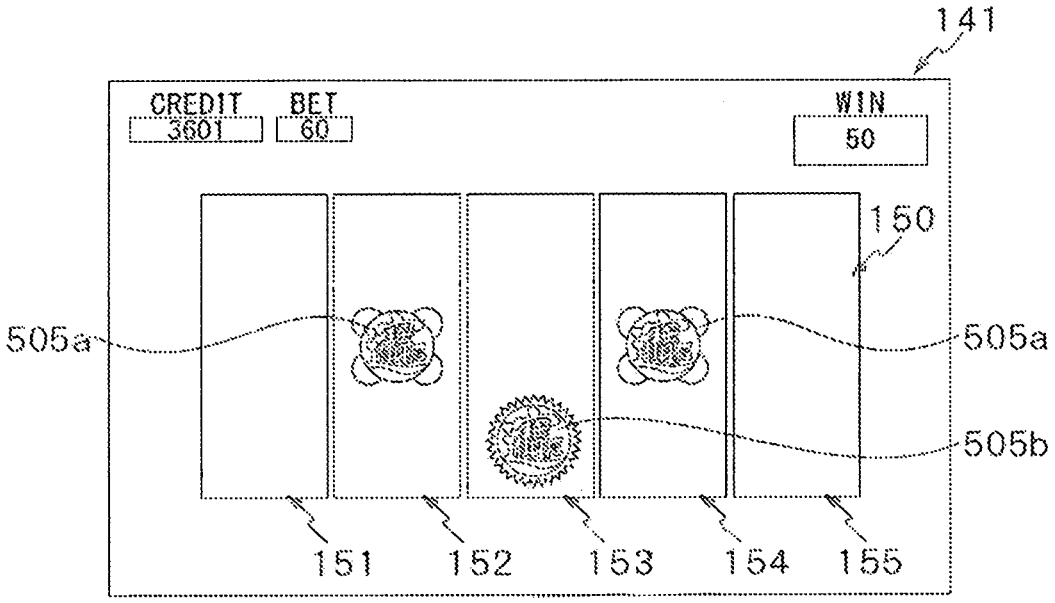
FIG. 20 is an explanatory diagram illustrating a state in which a bonus game is triggered.

Specifically, as shown in FIG. 7, the WILD symbols 505 include normal WILD symbols 505*a* (WILD) and a 2× WILD symbol 505*b* (2× WILD). As shown in FIGS. 12 to 17, the normal WILD symbols 505*a* are arranged on Reels 2 and 4 (pseudo reels 152 and 154) one by one. In addition, the 2× WILD symbol 505*b* is arranged on Reel 3 (a pseudo reel 153). In the present embodiment, as shown in FIG. 20, one or more WILD symbols 505 are rearranged in the symbol display area 150, whereby the drawing to determine whether or not the bonus game is triggered is conducted.

In addition, in accordance with the number of the rearranged WILD symbols 505, a winning probability of the bonus game is modified. Specifically, with respect to a winning probability with which the bonus game is triggered when one normal WILD symbol 505*a* is rearranged, when two normal WILD symbols 505*a* are rearranged, a winning probability with which the bonus game is triggered is doubled. In addition, a winning probability with which the bonus game is triggered when one 2×WILD symbol 505*b* is rearranged is twice (corresponding to two normal WILD symbols 505*a*) the winning probability with which the bonus game is triggered when one normal WILD symbol 505*a* is rearranged. In other words, a winning probability with which the bonus game is triggered when all of the WILD symbols 505 (two normal WILD symbols 505*a* and one 2×WILD symbol 505*b*) are rearranged is four times the winning probability with which the bonus game is triggered when one normal WILD symbol 505*a* is rearranged.

In addition, for the presentation display, the lower image display panel 141 is provided with rank count areas 1423 in which the number of the kinds of the bonus rank images 1422 are counted. In the rank count areas 1423, count images 1423*a* of the bonus rank images 1422, whose each number is a predetermined number, are provided. Each time each of the bonus rank images 1422 is displayed, the number of the displayed bonus rank images 1422 is counted for each of the kinds thereof, and the counted number is displayed in each of the rank count areas 1423. In other words, the count images 1423*a* which are counted are modified to the same images as the bonus rank images 1422.

In addition, as shown in FIG. 6, one choice image 1421 is modified to a double bonus rank image 1422*e* indicating two bonus rank images. Specifically, in FIG. 6, the double bonus rank image 1422E of the GRAND rank indicating the two bonus rank images is displayed. The double bonus rank image 1422*e* is counted as two bonus rank images 1422. Only the double bonus rank images 1422*e* which correspond to high ranks (the GRAND ranks and the MAJOR rank) are displayed.

In addition, in the present embodiment, the above-described bonus is triggered also by a drawing conducted each time the above-described base game is executed. In other words, on the slot machine 10, when the WILD symbols 505 are rearranged in the symbol display area 150, a first drawing to determine whether or not any of the bonuses is triggered, with the probability in accordance with the number of the rearranged WILD symbols 505. Further, a second drawing to determine whether or not any the bonuses is triggered is conducted each time the base game is executed, separately from the above-mentioned first drawing. The bonuses will be described later in details.

(Display Mode of Bonus/Free Counter/Message Area 399)

A bonus/free counter/message will be specifically described. It is to be noted that the description on the same configuration and the like as that of the embodiment is omitted.

Figure 62:
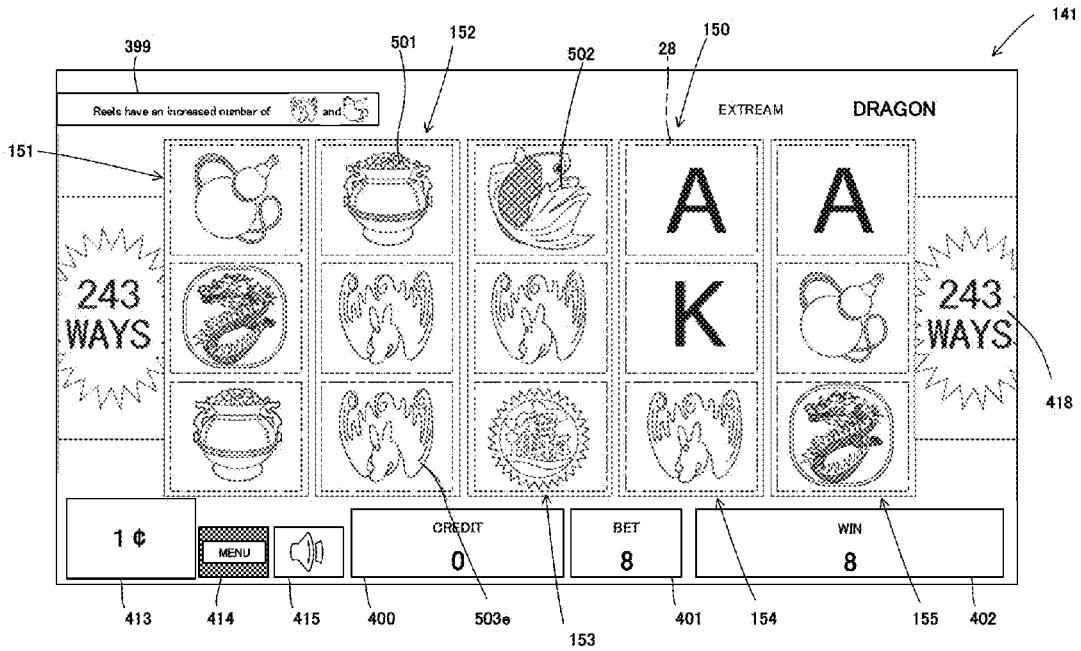
FIG. 62 is an explanatory diagram illustrating one example of a display screen on the lower image display panel in a modification example.

As shown in FIG. 62, an area 399 in which a bonus/free counter/message is displayed is provided above a symbol display area 150. Said bonus/free counter/message area 399 is located in a left end portion, viewed from a player. In the bonus/free counter/message area 399, "BOUNS REELS IN PLAY" is displayed during the free games, and thereafter, images of special symbols, whose numbers are increased in symbol arrays to which the previous symbol arrays are modified in accordance with the number of the WILD symbols, and a message are displayed. In other words, in the bonus/free counter/message area 399, a message "Reals have an increased number" is displayed and behind said message, the images of the special symbols 503 and 504 or the like, whose numbers are increased, are displayed.

(Notification of Specific Symbols Whose Percentages of Numbers are Increased.)

For example, special symbols 503 whose percentages of numbers are increased may be displayed on a lower image display panel 141, a middle image display panel 142, or the like.

FIG. 62 is an explanatory diagram illustrating a display screen on the lower image display panel 141. As described in the above embodiment, in accordance with an increase in the number of symbol bets placed by a player, a percentage of a number of each kind of special symbols 503 to a number of all of symbols 501 in a plurality of symbol arrays 170 is increased. For example, when betting is made by selecting a credit button 41, percentages of the numbers of BAT symbols 503*e* and GOURD symbols 503*d* thereto in the symbol arrays 170 are increased, as compared with betting made by selecting a credit button 40. In the present modification example, in a upper left end portion of the lower image display panel 141, a bonus/free counter/message area 399 for notifying the special symbols 503 whose percentages of the numbers thereto are increased is displayed. The bonus/free counter/message area 399 indicates with images the special symbols 503 whose percentages of the numbers thereto are increased in the symbol arrays 170 being used in a current game and indicates that the percentages of the numbers of said special symbols 503 thereto are increased in the symbol arrays 170. In the example shown in FIG. 62, it is notified that in the symbol arrays 170, the percentages of the numbers of the BAT symbols 503*e* and the GOURD symbols 503*d* thereto are increased. Specifically, upon pressing down the credit button 41, sound effects are outputted, and concurrently, a message "Reals have an increased number" indicating that the percentages of the numbers of the BAT symbols 503*e* and the GOURD symbols 503*d* thereto are increased, and the images of the BAT symbol 503*e* and the GOURD 503*d* are displayed while moving from left to right in the bonus/free counter/message area 399.

Figure 63:
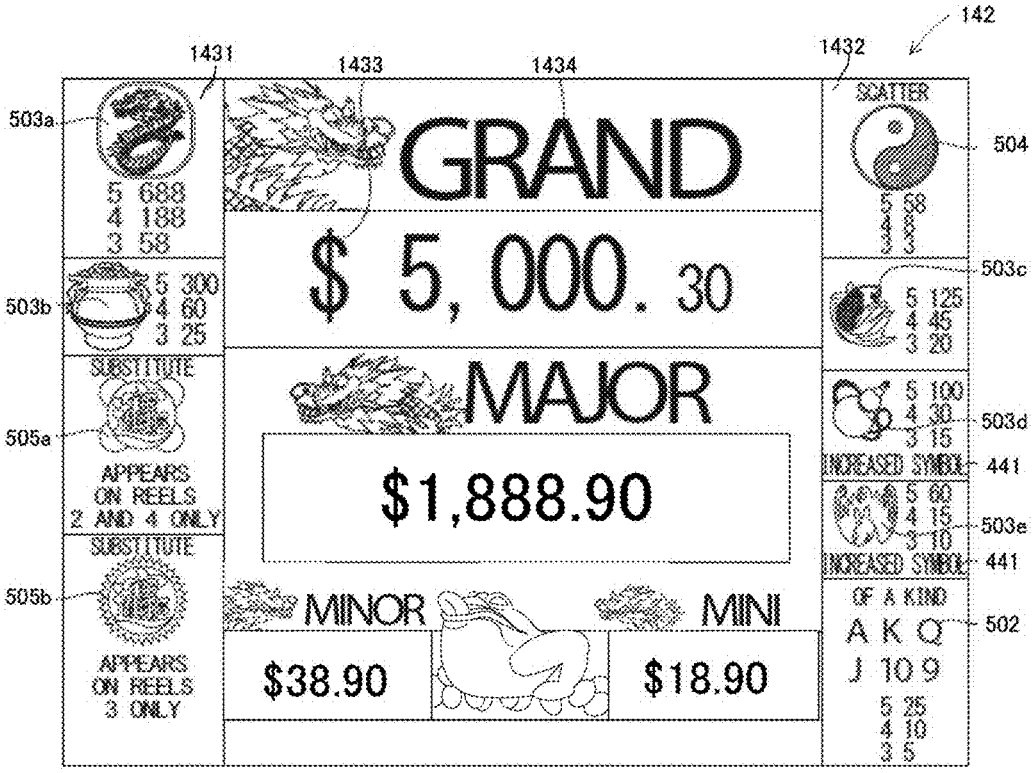
FIG. 63 is an explanatory diagram illustrating one example of a display screen on the middle image display panel in the modification example.

FIG. 63 is an explanatory diagram illustrating a display screen on the middle image display panel 142. As shown in FIG. 63, when the game in which the percentages of the numbers of the special symbols 503 thereto are increased in the symbol arrays 170 is being executed, the special symbols 503 whose percentages of the numbers of the special symbols 503 thereto are increased are notified so as to be displayed in payout tables. In the example shown in FIG. 63, in the payout tables, notification images 441 indicating that the percentages of the numbers of the BAT symbols 503*e* and the GOURD symbols 503*d* are increased are displayed, respectively.

Figure 64:
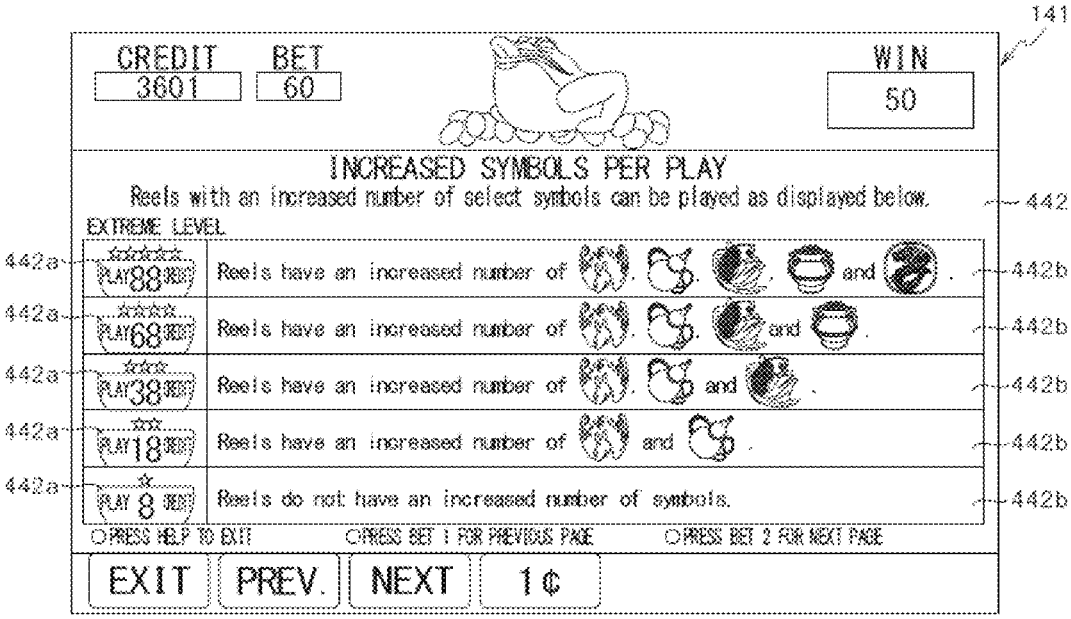
FIG. 64 is an explanatory diagram illustrating one example of a HELP screen in the modification example.

FIG. 64 is an explanatory diagram illustrating a HELP screen. In FIG. 64, as the first page of the HELP screen, shown is an increased symbol explanation page 442 in which kinds of special symbols 503 whose percentages are increased in a gradual manner for each of the bet numbers are described. Specifically, on the increased symbol explanation page 442, displayed are five symbol bet images 442*a* indicating in a gradual manner bet numbers, which can be placed, with the numbers of star signs and numerical values of the bet numbers; and corresponding increased symbol image 442*b* which respectively correspond to the symbol bet images 442*a* and in which kinds of the special symbols 503 whose percentages of the numbers thereof in the symbol arrays 170 are increased are indicated with images and text. The five symbol bet images 442*a* are associated with credit buttons 40 to 44, respectively and allow a player to clearly understand which kinds of special symbols 503 are increased upon using each of the credit buttons 40 to 44. In the present modification example, credit numbers of 8, 18, 38, 68, and 88 are bet by the credit buttons 40 to 44, respectively.

(Trigger of Bonus)

In the above-described embodiment, the first drawing to determine whether or not any the bonuses is triggered is conducted with the probability in accordance with the number of the rearranged WILD symbols 505, and further, the second drawing to determine whether or not any of the bonuses is triggered is conducted each time the base game is executed, separately from the above-mentioned first drawing. However, the present invention is not limited thereto. In the modification example, the second drawing as described above is not conducted, and a third drawing to determine whether or not any of the bonuses is triggered is conducted when there is/are a payout/payouts based on DRAGON symbols 503*a* which are special symbols 503 (top symbols) whose payouts are the highest. The payouts based on the DRAGON symbols 503*a* includes a payout obtained by the rearrangement of three or more DRAGON symbols 503*a* and a payout obtained by the rearrangement of three or more DRAGON symbols 503*a* and WILD symbols 505. As described above, in the present modification example, any of the bonuses is triggered by the first drawing and the third drawing. It is to be noted that the third drawing is executed only in the base game.

As shown in FIG. 65, in a WILD symbol drawing table, numerical values used in the first drawing are stored. As these numerical values, values which are different from one another for each of symbol bets (SBB1 to 5) are used, and these numerical values are selected in accordance with each of set values (V1 to V7) which are set by an AUDIT screen. In addition, as shown in FIG. 65, the WILD symbol drawing table is selected from five kinds of tables by set values (SC01 to SC48) which are set by the AUDIT screen.

The first drawing is conducted with a probability whose denominator is a numerical value selected from the WILD symbol drawing table and whose numerator is a value obtained by multiplying a value, obtained by multiplying the number of the WILD symbols 505 appearing in a stopped manner by 10,000,000,000,000, by a multiplier determined by any of the bet buttons 34 to 38.

In addition, as shown in FIG. 66, in a top symbol drawing table, numerical values used in the third drawing are stored. As these numerical values, values which are different from one another for each of symbol bets (SBB1 to 5) are used, and these numerical values are selected in accordance with each of set values (V1 to V7) which are set by the AUDIT screen. In addition, as shown in FIG. 70, the top symbol drawing table is selected from five kinds of tables by set values (SC01 to SC48) which are set by the AUDIT screen.

The third drawing is conducted with a probability whose denominator is a numerical value selected from the top symbol drawing table and whose numerator is a value obtained by multiplying a value, obtained by multiplying the number of the WILD symbols 505 appearing in the stopped manner by 10,000,000,000,000, by a multiplier determined by any of the bet buttons 34 to 38.

Figure 67:
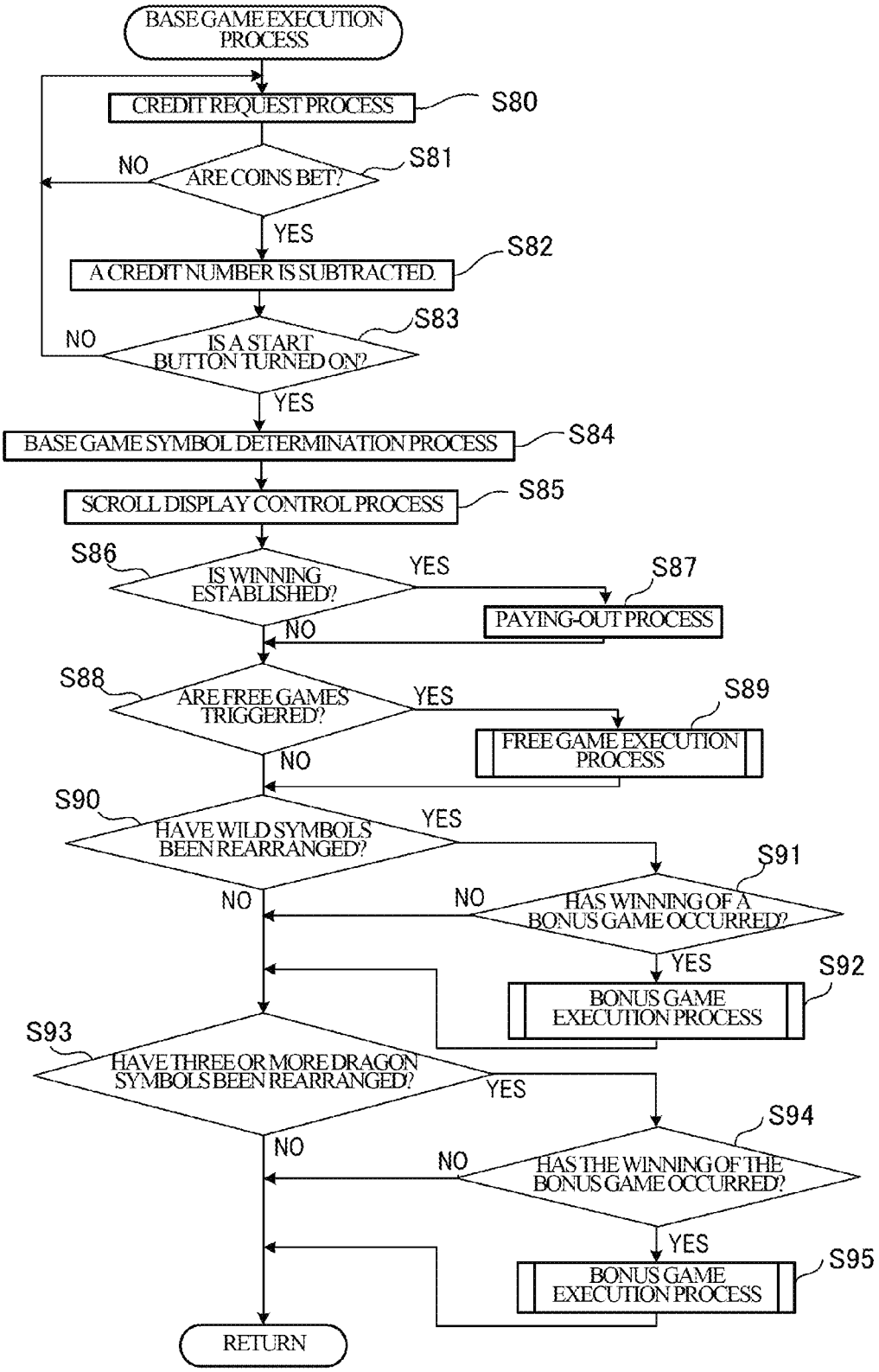
FIG. 67 is a flowchart of a base game execution process in the modification example.

FIG. 67 is a flowchart of a modification example of a base game execution process. The processes at step S80 to S92 are executed in the same manner as those at step S11 to S22 in the base game execution process shown in FIG. 41.

Next, a main CPU 71 determines whether or not three or more DRAGON symbols 503*a* have been rearranged (S93). When the three or more DRAGON symbols 503*a* have been rearranged (S93: YES), the bonus game drawing is conducted, it is determined whether or not winning has occurred in the bonus game (S94). Thereafter, when the winning has occurred in the bonus game, the bonus game is executed (S95). When the three or more DRAGON symbols 503*a* have not been rearranged (S93: NO), when the winning in the bonus game has not occurred (S94: NO), or after the execution of the bonus game triggered by the rearrangement of the three or more DRAGON symbols 503*a*, this routine is finished.

As described above, the bonus game is triggered by the first drawing and the third drawing. Accordingly, when the WILD symbols 505 have been rearranged in the symbol display area 150 and the three or more DRAGON symbols 503*a* have been rearranged, and thereafter, when winning has occurred in the first drawing and the third drawing, the bonus game is executed twice.

(Bonus Game)

Although in the above-described embodiment, the bonus game which is triggered by the base game in which any of the credit buttons 40 to 44 is selected is executed under the same condition, the present invention is not limited thereto. For example, depending on one selected from among the credit buttons 40 to 44, one bonus which can be obtained may be determined from among a plurality of bonuses (a GRAND bonus, a MAJOR bonus, a MINOR bonus, and a MINI bonus) whose degrees of advantageousness are set to be different from one another in a gradual manner.

Specifically, in the present modification example, in a bonus game (hereinafter, referred to as a first bonus game) which is triggered by a base game in which the credit button 43 or the credit button 44 is selected, the GRAND bonus, the MAJOR bonus, the MINOR bonus, and the MINI bonus are set to be obtainable. In addition, in a bonus game (hereinafter, referred to as a second bonus game) which is triggered by a base game in which any one of the credit buttons 40 to 42 is selected, the MAJOR bonus, the MINOR bonus, and the MINI bonus are set to be obtainable. The description on the first bonus game is omitted since the first bonus game is the same as in the above-described embodiment. Hereinafter, the second bonus game will be described.

Figure 68:
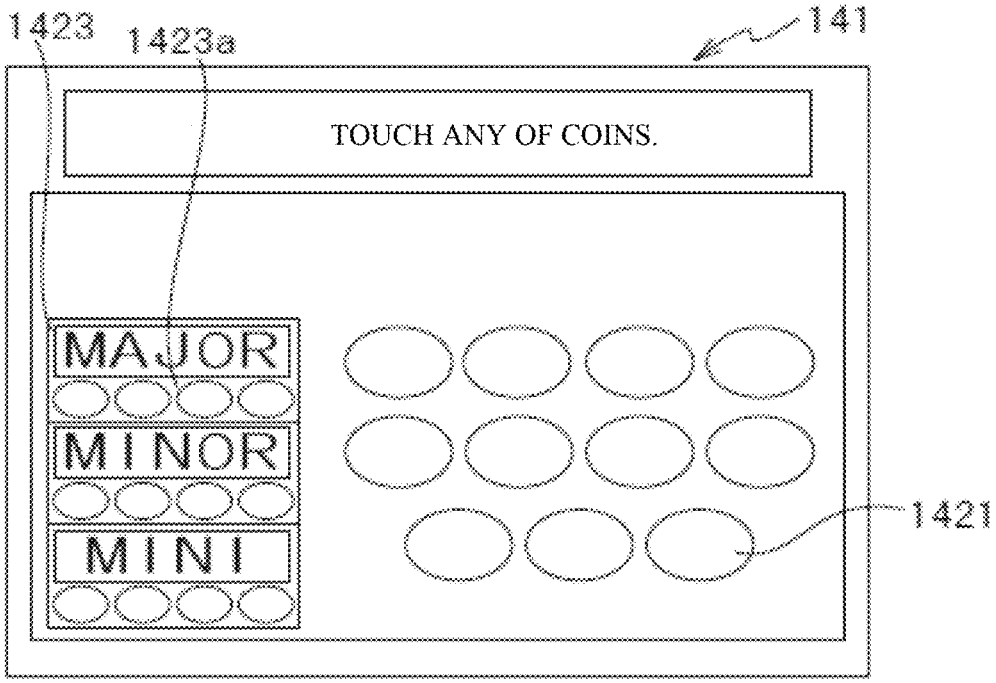
FIG. 68 is an explanatory diagram illustrating one example of a display screen on the lower image display panel in the modification example.

As shown in FIG. 68, upon starting the second bonus game, on a lower image display panel 141, a plurality of choice images 1421 are displayed. Although in the first bonus game, 14 choice images 1421 are displayed, in the second bonus game, 11 choice images 1421 are displayed. Because two bonus rank images 1422 for a GRAND bonus and one double bonus rank images 1422*e* for the GRAND bonus are omitted from the choices in the first bonus game, the number of the choice images 1421 to be displayed is reduced. Thus, in the second bonus game, any of only the MAJOR bonus, the MINOR bonus, and the MINI bonus are set to be selectable.

In addition, on the lower image display panel 141, rank count areas 1423 in which counts of kinds of the bonus rank images 1422 are displayed is provided. In the second bonus game, since the three kinds of the MAJOR bonus, the MINOR bonus, and the MINI bonus are selectable, respective the rank count areas 1423 corresponding to these three kinds of bonuses are provided. In each of the rank count area 1423, count images 1423*a* for each of the bonus rank images 1422, whose number is a predetermined number (four), are provided. Each time the bonus rank image 1422 is displayed, the number of each of the kinds of the bonus rank images 1422 is counted, and the counted number is displayed in each of the rank count areas 1423. In other words, the count images 1423*a* which are counted are modified to the same images as the bonus rank images 1422.

On the slot machine 10, in the above-described second bonus game, prior to performing a presentation display related to the second bonus game, any one of the MAJOR bonus, the MINOR bonus, and the MINI bonus is previously determined. The slot machine 10 controls the lower image display panel 141 such that in the presentation display, it is displayed that a number of only the bonus rank images 1422 corresponding to the determined bonus reaches a predetermined number (for example, four). In other words, a player obtains the bonus corresponding the kind of bonus rank images 1422 whose number has reached the predetermined number through the selections of the choice images 1421.

Figure 69:
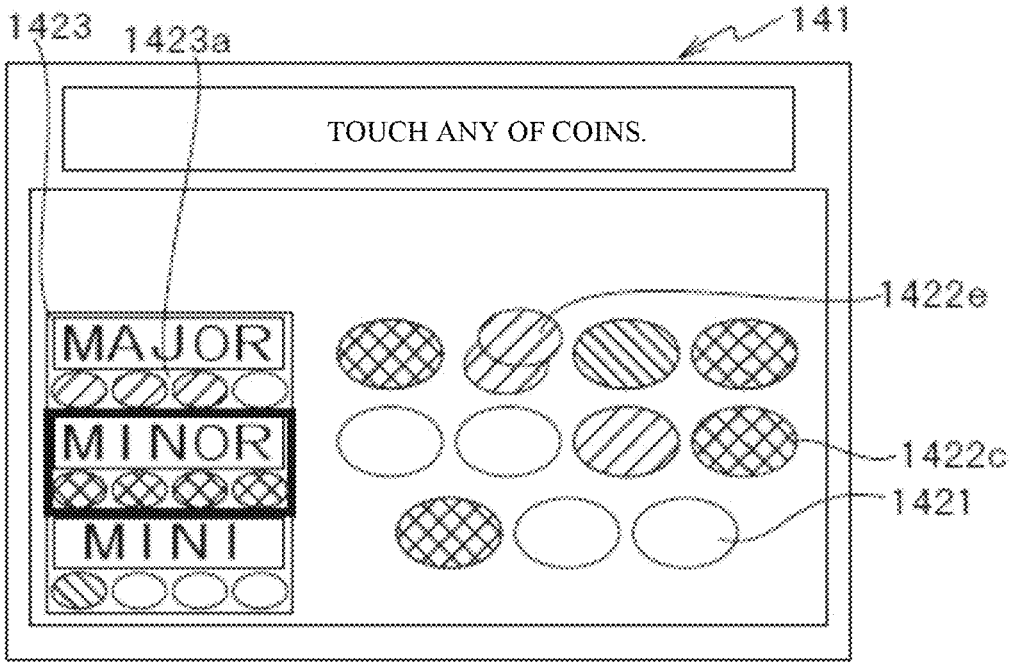
FIG. 69 is an explanatory diagram illustrating one example of a display screen on the lower image display panel in the modification example.

In FIG. 69, an example in which the MINOR bonus has been won in the second bonus game is shown. Specifically, as a result of the selections of the choice images 1421 by a player, four MINOR rank images 1422*c* are displayed, and the number thereof has reached the predetermined number (four). Only double bonus rank images 1422*e* which are counted as images corresponding to the MAJOR bonus are included in the choices.

In the first bonus game and the second bonus game, with reference to respective tables described below, drawings and the like are executed. It is to be noted that by setting set values (SC01 to SC48) by an AUDIT screen or the like, values to be referenced in each of the tables can be modified.

As shown in FIG. 70, in a progressive initial value table, initial values in the first bonus game and the second bonus game are stored. On the slot machine 10, with reference to the progressive initial value table, progressive initial values to be awarded as payouts in the bonus game are determined.

In addition, as shown in FIG. 71, in a progressive default increment rate table, default increment rates in the first bonus game and the second bonus game are stored. On the slot machine 10, with reference to the progressive default increment rate table, variation percentages of progressive values are determined.

It is to be noted that the progressive values are limited. For the GRAND bonus, the limit is set to 999,999,999.99 dollars; for the MAJOR bonus, the limit is se to 9,999,999.99 dollars; for the MINOR bonus, the limit is set to 999,999.99 dollars; and for the MINI bonus, the limit is set to 999,999.99 dollars.

In addition, as shown in FIG. 72, in a first bonus game drawing table, weights used when in the first bonus game, any one of the GRAND bonus, the MAJOR bonus, the MINOR bonus, and the MINI bonus is determined by a drawing are stored. In other words, a value whose denominator is each of these weights and whose numerator is each of these weights is a probability with which each of the bonuses is obtained in the first bonus game.

In addition, as shown in FIG. 73, in a second bonus game drawing table, weights used when in the second bonus game, any one of the MAJOR bonus, the MINOR bonus, and the MINI bonus is determined by a drawing are stored. In other words, a value whose denominator is each of these weights and whose numerator is each of these weights is a probability with which each of the bonuses is obtained in the second bonus game.

As described above, in accordance with the increase in the number of bets placed by a player, in the bonus game triggered when a result of the base game executed based on said bets satisfies the predetermined condition, the upper limit of the bonus which can be obtained is set to be high.

Figure 74:
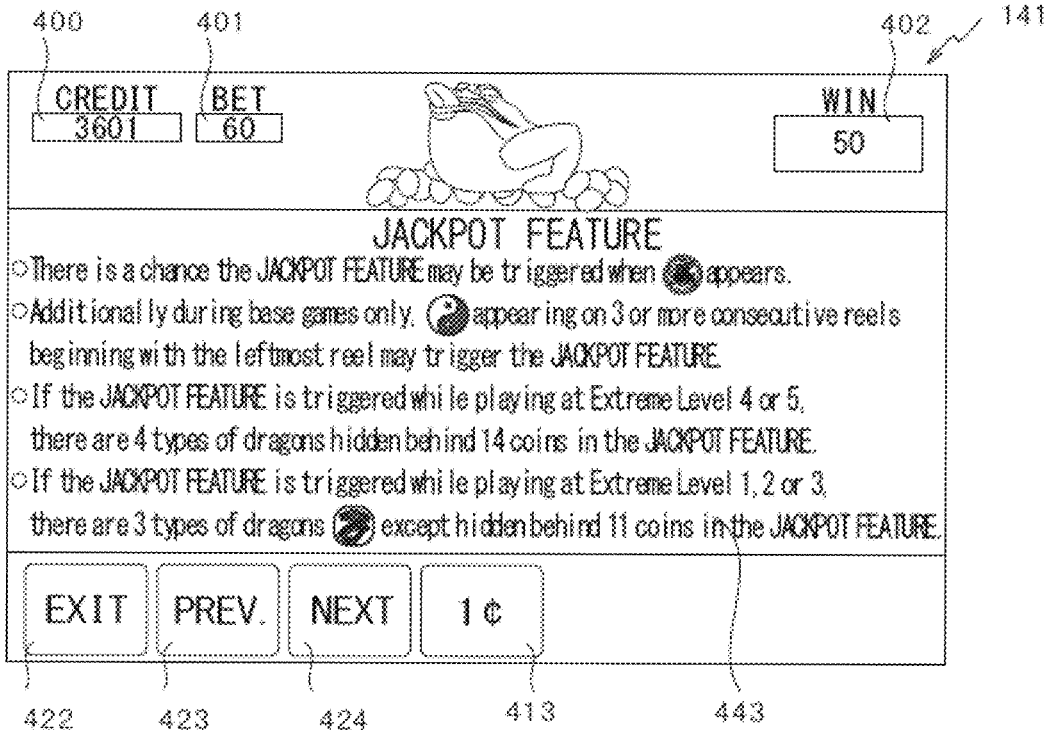
FIG. 74 is an explanatory diagram illustrating one example of a HELP screen in the modification example.

As shown in FIG. 74, on a HELP screen, displayed is a bonus explanation page 443 which explains the bonus game and in which it is described that depending on the selection of any one of the credit buttons 40 to 44, a bonus which can be obtained is determined from among the plurality of bonuses whose degrees of advantageousness are set in the gradual manner. In the present modification example, depending on any one of the credit buttons 40 to 44 to be selected, each of five levels (Extreme Level) is determined. In the bonus explanation page 443, it is indicated that in the bonus game triggered by the base game started at each of the level 4 and level 5 through the selection of each of the credit button 43 and the credit button 44, four kinds of bonuses (the GRAND bonus, the MAJOR bonus, the MINOR bonus, and the MINI bonus) can be obtained. In addition, in the bonus explanation page 443, it is indicated that in the bonus game triggered by the base game started at each of the level 1 to level 3 through the selection of each of the credit button 40 to the credit button 42, three kinds of bonuses (the MAJOR bonus, the MINOR bonus, and the MINI bonus) can be obtained.

(First Modification Example of Symbol Arrays in Base Game and Free Games)

Although in the above-described embodiment, the numbers of the WILD symbols 505 are not changed in the base game and the free game, the present invention is not limited thereto. In addition, although in the above-described embodiment, the normal WILD symbols 505*a* and the 2× WILD symbol 505*b* are used, only the normal WILD symbols 505*a* may be used.

In FIG. 75, symbol arrays in a base game with one symbol bet are shown. The WILD symbols 505 are arranged in a position of "11" on a second reel, positions of "15" and "45" on a third reel, and a position of "36" on a fourth reel. In other words, a probability with which the WILD symbols 505 are rearranged in a symbol display area 150 on the second reel is 3/68; a probability with which the WILD symbols 505 are rearranged in the symbol display area 150 on the third reel is 6/64; and a probability with which the WILD symbols 505 are rearranged in the symbol display area 150 on the fourth reel is 3/64.

In FIG. 76 and FIG. 77, symbol arrays in free games triggered by the base game with the one symbol bet are shown. The WILD symbols 505 are arranged in a position of "9" on the second reel, positions of "0", "1", and "2" on the third reel, and a position of "34" on the fourth reel. In other words, a probability with which the WILD symbols 505 are rearranged in the symbol display area 150 on the second reel is 3/96; a probability with which the WILD symbols 505 are rearranged in the symbol display area 150 on the third reel is 100%; and a probability with which the WILD symbols 505 are rearranged in the symbol display area 150 on the fourth reel is 3/61.

As described above, as compared with the base game with the one symbol bet, in the free games triggered by the base game with the one symbol bet, the WILD symbols 505 are set to be stopped on all positions on the third reel. Accordingly, each time the rearrangement in each of the free games is executed, the first drawing for a bonus game triggered by the stopping of the WILD symbols 505 is surely executed.

In FIG. 78, symbol arrays in the base game with five symbol bets are shown. The WILD symbols 505 are arranged in positions of "11", "17", and "44" on the second reel, positions of "3", "15", and "46" on the third reel, and positions of "36" and "51" on the fourth reel. In other words, a probability with which the WILD symbols 505 are rearranged in the symbol display area 150 on the second reel is 9/60; a probability with which the WILD symbols 505 are rearranged in the symbol display area 150 on the third reel is 9/60; and a probability with which the WILD symbols 505 are rearranged in the symbol display area 150 on the fourth reel is 6/60.

As described above, as compared with the base game with the one symbol bet, in the base game with the five symbol bets, the symbol arrays are modified such that the probabilities, with each of which the WILD symbols 505 are rearranged, become high.

In FIG. 79, symbol arrays in free games triggered by the base game with the five symbol bets are shown. The WILD symbols 505 are arranged in positions of "0", "10", "16" and "43" on the second reel, positions of "0", "1", and "2" on the third reel, and positions of "0", "35", and "50" on the fourth reel. In other words, a probability with which the WILD symbols 505 are rearranged in the symbol display area 150 on the second reel is 12/59; a probability with which the WILD symbols 505 are rearranged in the symbol display area 150 on the third reel is 100%; and a probability with which the WILD symbols 505 are rearranged in the symbol display area 150 on the fourth reel is 9/59.

As described above, as compared with the base game with the five symbol bets, in the free games triggered by the base game with the five symbol bets, the WILD symbols 505 are set to be stopped on all positions on the third reel. Accordingly, each time the rearrangement in each of the free games is executed, the first drawing for the bonus game triggered by the stopping of the WILD symbols 505 is surely executed. In addition, as compared with the free games triggered by the base game with the one symbol bet, in the free games triggered by the base game with the five symbol bets, the symbol arrays are modified such that the probabilities, with each of which the WILD symbols 505 are rearranged, become high.

As described above, the symbol arrays in the free games are modified such that the probabilities, with each of which the WILD symbols 505 are stopped, become higher than in the base game. In addition, in both of the base game and the free games, the symbol arrays are modified such that in accordance with the increase in the bet number to be placed, the probabilities, with each of which the WILD symbols 505 are stopped, become high. Further, in the free games, the reel including the symbol array whose all positions are constituted of the WILD symbols 505 is provided so as to allow the WILD symbols 505 to be unfailingly stopped.

(Second Modification Example of Symbol Arrays in Base Game and Free Games)

In FIG. 80, symbol arrays in a base game with one symbol bet are shown. The WILD symbols 505 are arranged in a position of "11" on a second reel, positions of "15" and "45" on a third reel, and a position of "36" on a fourth reel. In other words, a probability with which the WILD symbols 505 are rearranged in a symbol display area 150 on the second reel is 3/68; a probability with which the WILD symbols 505 are rearranged in the symbol display area 150 on the third reel is 6/64; and a probability with which the WILD symbols 505 are rearranged in the symbol display area 150 on the fourth reel is 3/64.

In FIG. 81, symbol arrays in free games triggered by the base game with the one symbol bet are shown. The WILD symbols 505 are arranged in positions of "5", "6", and "7" on the second reel, positions of "14", "15", and "16" on the third reel, and positions of "3", "4", and "5" on the fourth reel. In other words, a probability with which the WILD symbols 505 are rearranged in the symbol display area 150 on the second reel is 5/49; a probability with which the WILD symbols 505 are rearranged in the symbol display area 150 on the third reel is 5/43; and a probability with which the WILD symbols 505 are rearranged in the symbol display area 150 on the fourth reel is 5/42.

As described above, as compared with the base game with the one symbol bet, in the free games triggered by the base game with the one symbol bet, the symbol arrays are modified such that the probabilities, with each of which the WILD symbols 505 are stopped, become high. Further, because the WILD symbols 505 are consecutively arranged in the symbol arrays, there is a likelihood with which the WILD symbols 505 may be consecutively stopped on the same reel, thereby allowing a player to expect a high payout and an increase in a winning probability in the first drawing for a bonus game.

In FIG. 82, symbol arrays in a base game with five symbol bets are shown. The WILD symbols 505 are arranged in positions of "11", "17", and "44" on the second reel, positions of "3", "15", and "46" on the third reel, and positions of "36" and "51" on the fourth reel. In other words, a probability with which the WILD symbols 505 are rearranged in the symbol display area 150 on the second reel is 9/60; a probability with which the WILD symbols 505 are rearranged in the symbol display area 150 on the third reel is 9/60; and a probability with which the WILD symbols 505 are rearranged in the symbol display area 150 on the fourth reel is 6/60.

As described above, as compared with the base game with the one symbol bet, in the base game with the five symbol bets, the symbol arrays are modified such that the probabilities, with each of which the WILD symbols 505 are rearranged, become high.

In FIG. 83, symbol arrays in free games triggered by the base game with the five symbol bets are shown. The WILD symbols 505 are arranged in position of "4", "5", "17", "18", "19", "46", and "47" on the second reel, positions of "3", "4", "28", "29", "30", "53", and "54" on the third reel, and positions of "32", "33", "34", "51", and "52" on the fourth reel. In other words, a probability with which the WILD symbols 505 are rearranged in the symbol display area 150 on the second reel is 13/60; a probability with which the WILD symbols 505 are rearranged in the symbol display area 150 on the third reel is 13/60; and a probability with which the WILD symbols 505 are rearranged in the symbol display area 150 on the fourth reel is 9/60.

As described above, as compared with the base game with the five symbol bets, in the free games triggered by the base game with the five symbol bets, the symbol arrays are modified such that the probabilities, with each of which the WILD symbols 505 are stopped, become high. Further, because there are the plurality of positions in which the WILD symbols 505 are consecutively arranged in the symbol arrays, there is a likelihood with which the WILD symbols 505 may be consecutively stopped on the same reel, thereby allowing a player to expect a high payout and an increase in a winning probability in the first drawing for the bonus game. In addition, as compared with the free games triggered by the base game with the one symbol bet, in the free games triggered by the base game with the five symbol bets, the symbol arrays are modified such that the probabilities, with each of which the WILD symbols 505 are rearranged, become high.

As described above, the symbol arrays in the free games are modified such that the probabilities, with each of which the WILD symbols 505 are stopped, become higher than in the base game. In addition, in both of the base game and the free games, the symbol arrays are modified such that in accordance with the increase in the bet number to be placed, the probabilities, with each of which the WILD symbols 505 are stopped, become high. Further, in the free games, in order to provide the likelihood with which the plurality of WILD symbols 505 are stopped on the same reel, the WILD symbols 505 are consecutively arranged in the symbol arrays.

(Coin Presentation)

Figure 84:
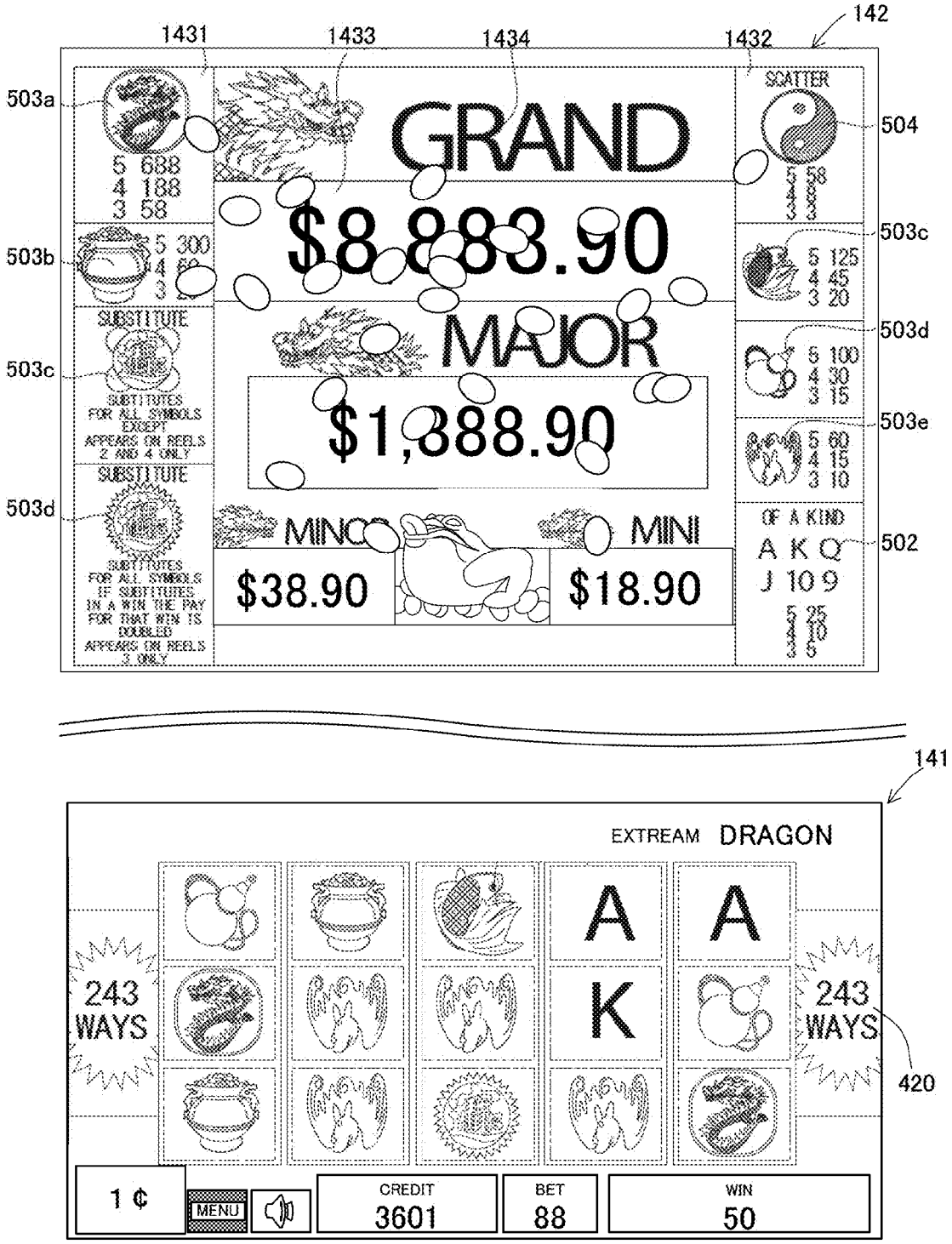
FIG. 84 is an explanatory diagram illustrating one example of display screens on the lower image display panel and the middle image display panel.

As shown in FIG. 84, there is a case where coin presentation in which after the rearrangement on all pseudo reels 151 to 155, coins 444 are falling down from above and an amount of the coins 444 accumulated in a lower portion is changed is performed. The coin presentation is performed at four times, and the display on a screen is changed in five stages. Specifically, an initial display in the first stage is changed to a display in the second stage, the display in the second stage is changed to a display in the third display, the display in the third display is changed to a display in the fourth stage, the display in the fourth stage is changed to a display in the fifth stage, and after passing through the changes at four times, the final screen is displayed.

FIG. 85 is a coin presentation assignment table. Each of the changes is executed when a number of games which have been played has reached a number of games which is previously determined based on the coin presentation assignment table and a winning probability in a bonus game. Specifically, a method of calculating the number of games to determine timing at which the coin presentation using the coin presentation assignment table is performed will be described. First, any one is selected from (A) to (C) in the coin presentation assignment table. The selection of each of (A) to (C) is conducted by a drawing with an equal probability. In the coin presentation assignment table, in each column X, percentages at which the coin presentation is executed are stored. For example, in a case of (A), with the whole being 100%, each time 25% has passed, the coin presentation is executed. Here, as the whole being 100%, a theoretical number of games, which is calculated from a winning probability in the bonus game, is assumed. For example, when a winning probability in the bonus game is 1/400, a number of games to reach the bonus game is assumed to be 400.

In the coin presentation assignment table, in each column Y, each value obtained by dividing the total of the values in the each X column (that is, 100) by each value in the each X column is stored. A value obtained by dividing the number of games by this value in the column Y is a number of games to reach a game in which the next coin presentation is performed. For example, in the case of (A), in the 100th game from triggering of the bonus game, the coin presentation is executed. In each of the 200th game, the 300th game, and the 400th game, the coin presentation is executed. In other words, each count of the number of games, which is reset by the triggering of the bonus game is stored in a memory.

It is to be noted that when after the execution of the coin presentation in the fifth stage, the bonus game is not triggered, a drawing may be conducted each time the WILD symbols 505 are stopped, and further, the coin presentation may be executed. For example, a drawing to determine whether or not the coin presentation is won may conducted with a probability of 20%. It is to be noted that no increase and decrease in the amount of the coins 444 accumulated in the lower portion may be made. As described above, the coin presentation is repeatedly conducted up to when the bonus game is triggered, thereby allowing a player to have a sense of expectation to the bonus game.

(Presentation Upon Concurrent Winning)

As described above, the bonus game is triggered by each of the WILD symbol drawing and the top symbol drawing. Since in the base game, both of the WILD symbol drawing and the top symbol drawing are executed, there is a likelihood with which concurrent winning in the WILD symbol drawing and the top symbol drawing occurs. Upon the concurrent winning, two bonus games are executed, and between the first bonus game and the second bonus game, concurrent winning presentation is conducted. This concurrent winning presentation will be described.

First, the first bonus game is executed, and a result is displayed. Thereafter, on a lower image display panel 141, the screen is returned to a screen in which symbols 501, in a base game in which the bonus game has been triggered, have been rearranged in a symbol display area 150. At this time, the amount of coins 444 accumulated in the above-described coin presentation is reset to an initial amount in the first stage.

Figure 86:
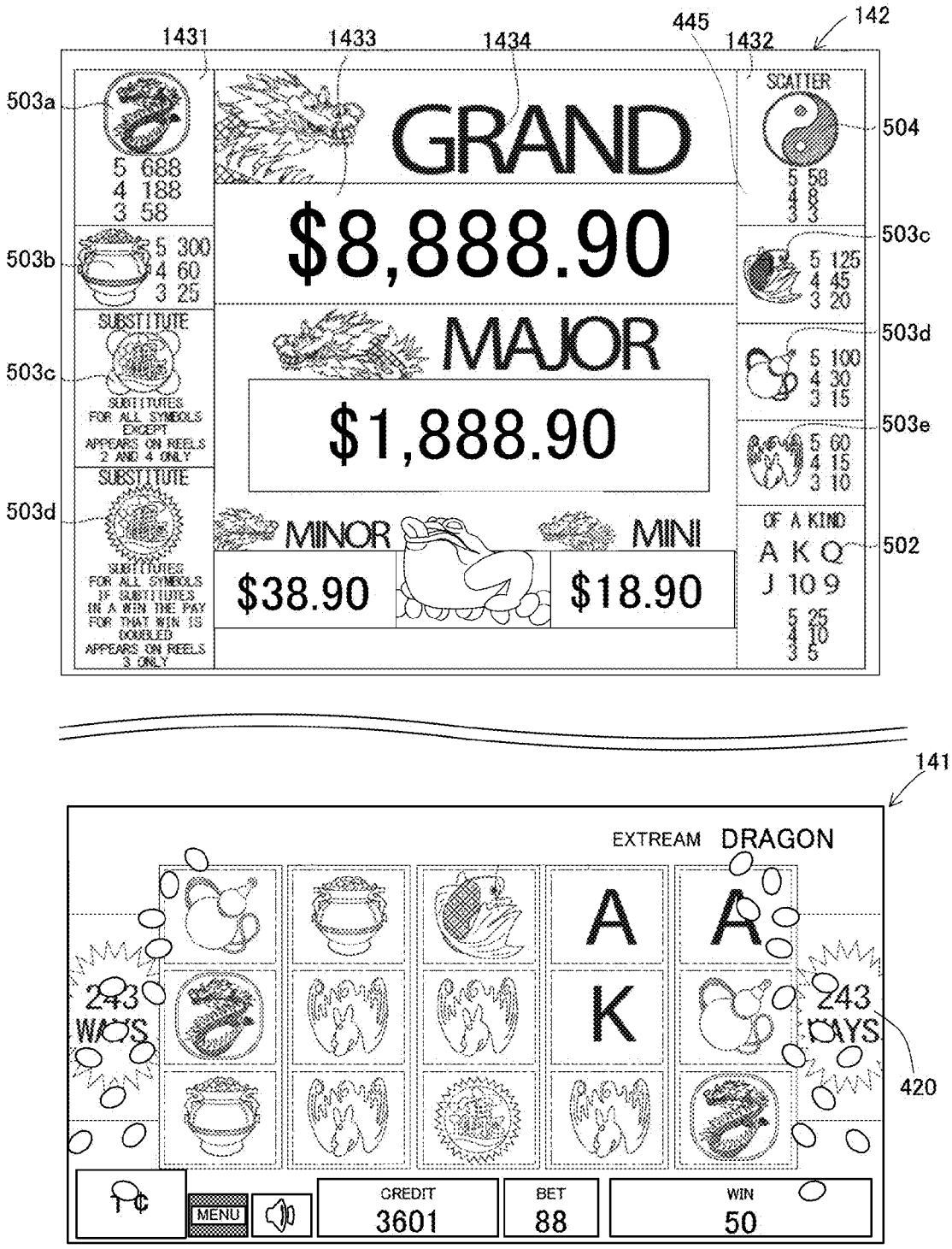
FIG. 86 is an explanatory diagram illustrating one example of display screens on the lower image display panel and the middle image display panel.

As shown in FIG. 86, thereafter, an animation in which coins 445 are falling down from an upper portion of the symbol display area 150 on the lower image display panel 141 toward right and left is reproduced.

Figure 87:
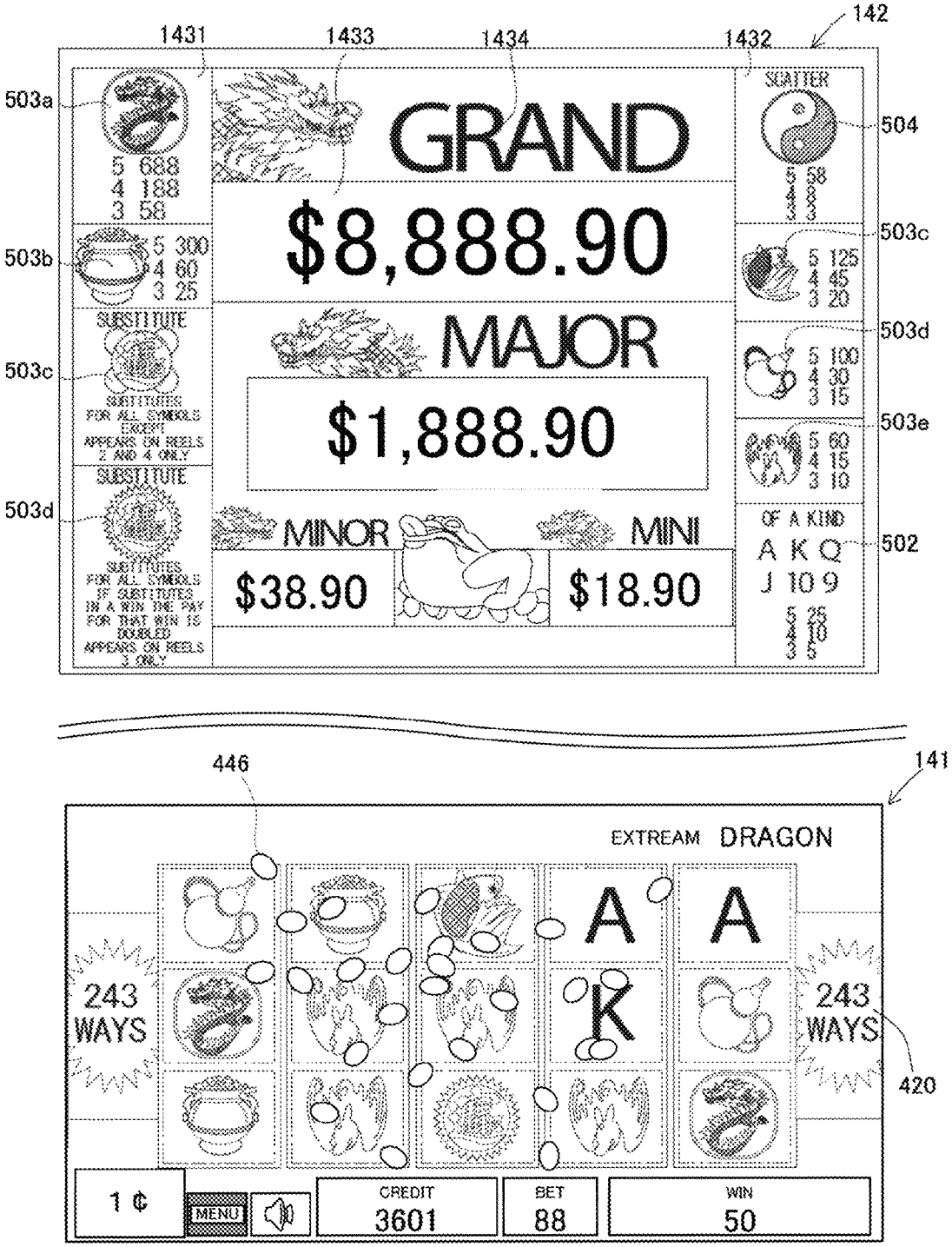
FIG. 87 is an explanatory diagram illustrating one example of display screens on the lower image display panel and the middle image display panel.

Further, as shown in FIG. 87, an animation in which coins 446 are falling down from the upper portion of the symbol display area 150 on the lower image display panel 141 toward a central portion thereof is reproduced. Then, the second bonus game is executed.

(Bet/Start-Check Process)

Figure 88:
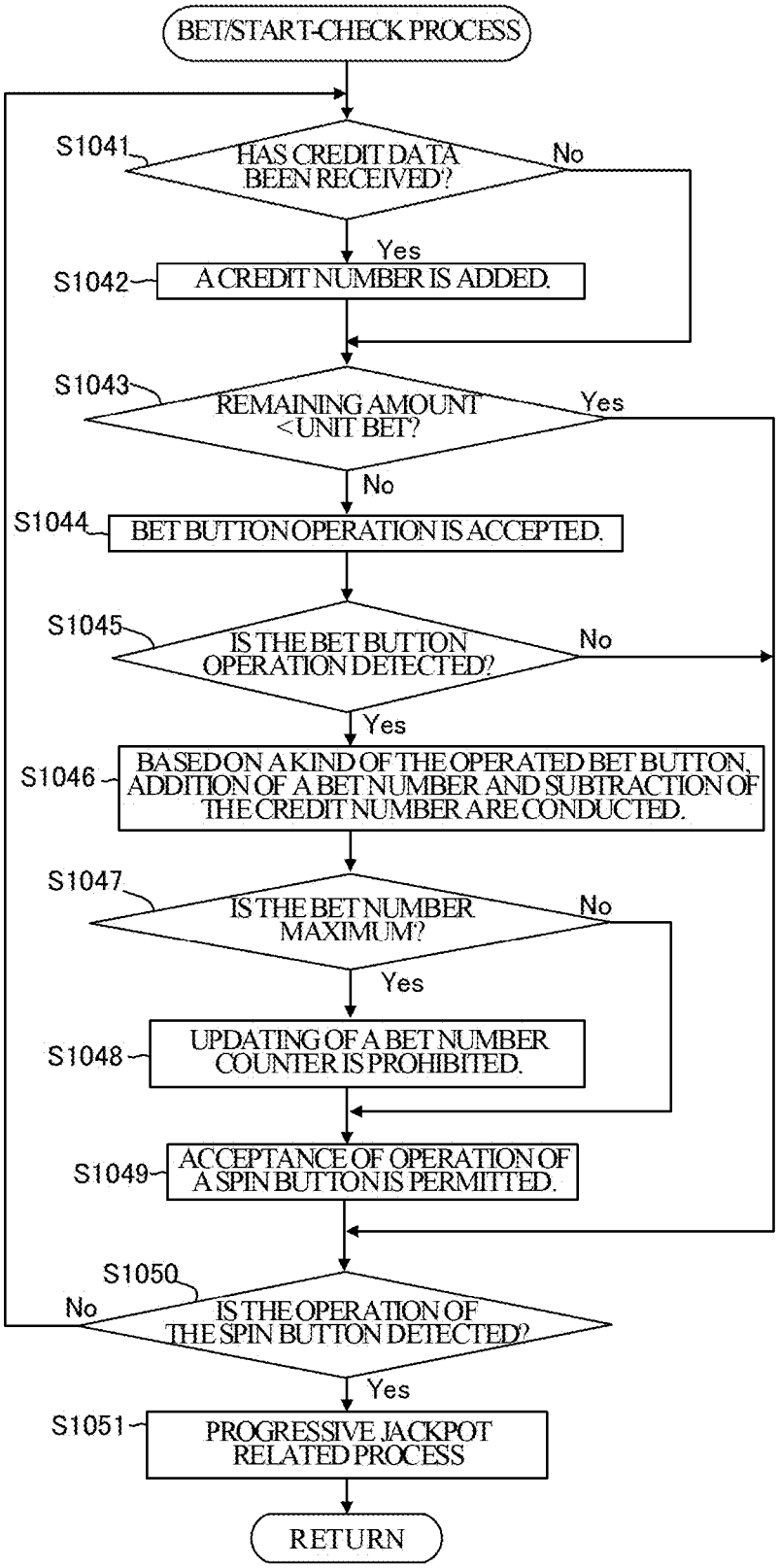
FIG. 88 is a flowchart of a bet/start-check process.

With reference to FIG. 88, a bet process will be described.

A CPU 71 determines whether or not credit data has been received from a PTS terminal 700 (S1041). The transmission of the credit data from the PTS terminal 700 to the CPU 71 is conducted when an IC card is inserted into a card insertion slot and when a bill entry 22 has accepted legitimate bills.

When the CPU 71 determines that the credit data has been received (S1041: YES), an amount indicated by the credit data is added to a value stored in a credit number storage region of a RAM 73 (S1042).

After S1042 or when the CPU 71 determined that the credit data has not been received at S1041 (S1041: NO), the CPU 71 determines whether or not a value stored in the credit number storage region is less than a unit bet including 0 (S1043). When the CPU 71 determines that the value stored in the credit number storage region is not less than the unit bet (S1043: NO), the CPU 71 permits the acceptance of operation of any of BET buttons (a 1-BET button 34, a 2-BET button 35, a 3-BET button 36, a 4-BET button 37, and a 5-BET button 38) (S1044).

Next, the CPU 71 determines whether or not the operation of any of the BET buttons has been detected (S1045). When the pressing-down of any of the BET buttons by a player has been detected by any of BET switches (a 1-BET switch 34S, a 2-BET switch 35S, a 3-BET switch 36S, a 4-BET switch 37S, and a 5-BET switch 38S), based on the kind of the pressed BET button, the CPU 71 performs addition to a value stored in a BET number storage region provided in the RAM 73 and subtracts the consumed credit number from the value stored in the credit number storage region (S1046).

When the CPU 71 determines that a value stored in the BET number storage region is a maximum (S1047: YES), the CPU 71 prohibits updating of the value stored in the BET number storage region (S1048). After S1048 or when the CPU 71 determines that the value stored in the BET number storage region is not the maximum at S1047 (S1047: NO), the CPU 71 permits the acceptance of operation of a SPIN button 46 (S1049).

After S1049, when the CPU 71 determines at S1045 that the operation of any of the BET buttons has not been detected (S1045), or when the CPU 71 determines at S1043 that the value stored in the credit number storage region is not less than the unit bet (S1043: YES), the CPU 71 determines whether or not the operation of the SPIN button 46 has been detected (S1050). When the CPU 71 determines that the operation of the SPIN button 46 has not been detected (S1050: NO), the CPU 71 returns to the process at S1041.

On the other hand, when the CPU 71 determines that the operation of the SPIN button 46 has been detected (S1050: YES), the CPU 71 executes a progressive-jackpot-related process which is the above-described bonus-game-related process (S1051). In this process, a part of the bet amount bet in the base game is calculated as a value to be incremented for each of the four kinds of progressive jackpot payouts (bonus ranks: GRAND, MAJOR, MINOR, and MINI) and is used to update each of the four kinds of progressive jackpots stored in a progressive payout storage region provided in the RAM 73. One round of the bet process is finished as described above, and thereafter, the processes at S1041 to S1051 are repeatedly executed.

It is to be noted that the progressive-jackpot-related process at S1051 includes the display control process of the bonuses, the free game execution process, and the bonus game execution process described in the present embodiment.

(Display Presentation of Bonus Game)

On a slot machine 10 according to the above-described embodiment, for example, display presentation as described below is executed on a lower image display panel 141 and a middle image display panel 142.

Rank images of bonuses, each of which is likely to be obtained in accordance with a bet amount are displayed on a display part of the middle image display panel 142. In other words, as shown in FIG. 3, images of GRAND, MAJOR, MINOR, and MINI and payout amounts thereof are displayed. However, only a display area in which a name and a payout amount of GRAND are displayed is displayed in gray by effects. In other words, the GRAND rank as one of the ranks is made to be deactivated and the payout (a jackpot amount: $8,888.90) cannot be obtained, and the MAJOR, MINOR, and MINT ranks as the other ranks are made to be activated, and each of the payouts (jackpot amounts: $1,888.90, $38.90, and $18.90) is likely to be obtained.

Figure 89:
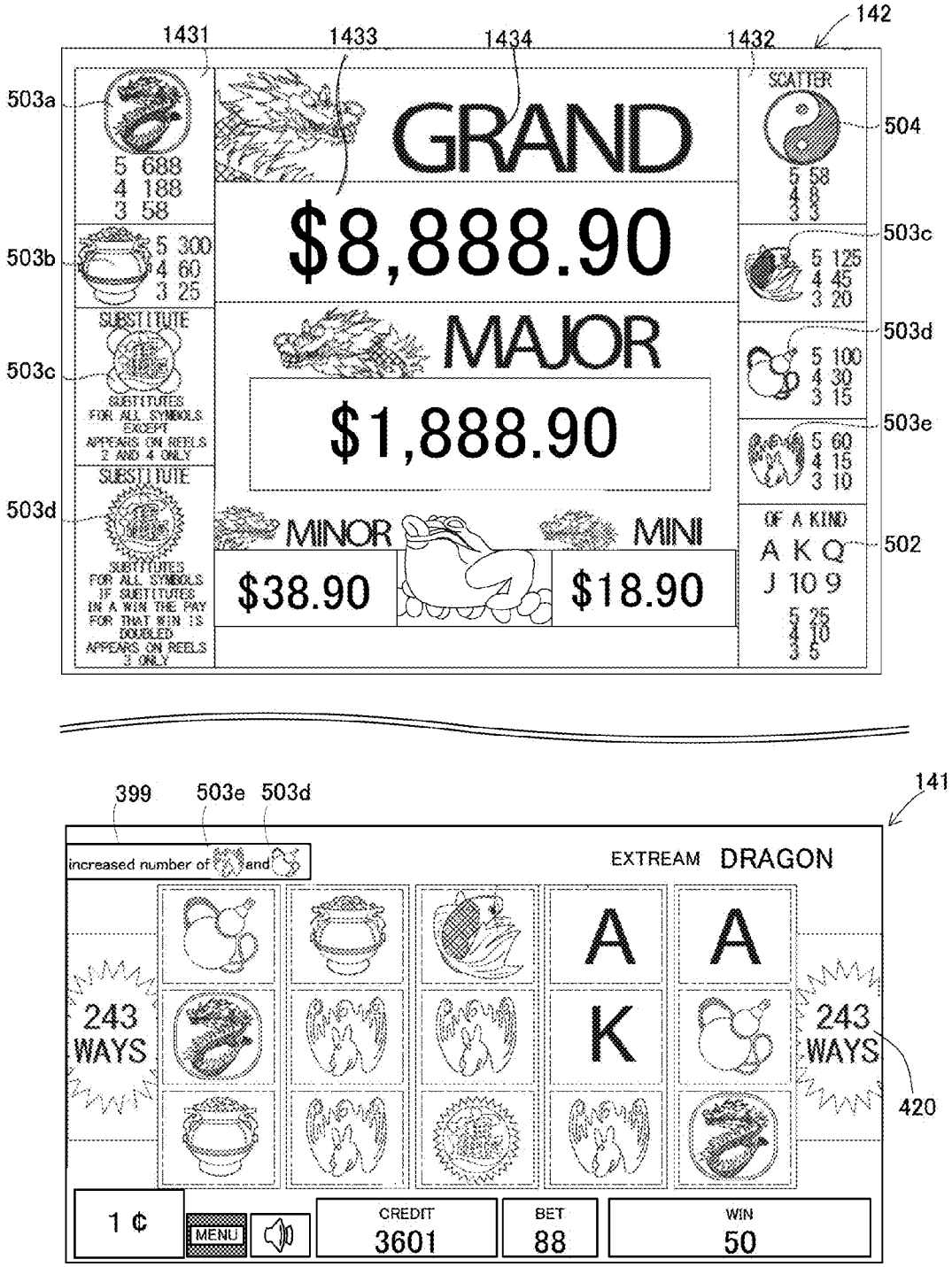
FIG. 89 is an explanatory diagram illustrating one example of display screens on the lower image display panel and the middle image display panel.

Here, when a player presses two buttons in combination, one of which is a PLAY 68 CREDITS button 43 or a PLAY 88 CREDITS button 44 selected from among five kinds of credit buttons 40 to 44, with which credits are bet and the credits are used as a base of a large quantity in a bet number, and the other of which is any of a 1-BET button 34, a 2-BET button 35, a 3-BET button 36, a 4-BET button 37, and a 5-BET button 38, as shown in FIG. 89, the display area of the GRAND rank which is displayed in gray, indicating that the GRAND rank is deactivated, is modified to be in an activated state which is a normal state (first state).

Immediately after pressing any of the BET buttons, in a bonus/free counter/message area 399 of the lower image display panel 141, display presentation is executed.

Figure 90:
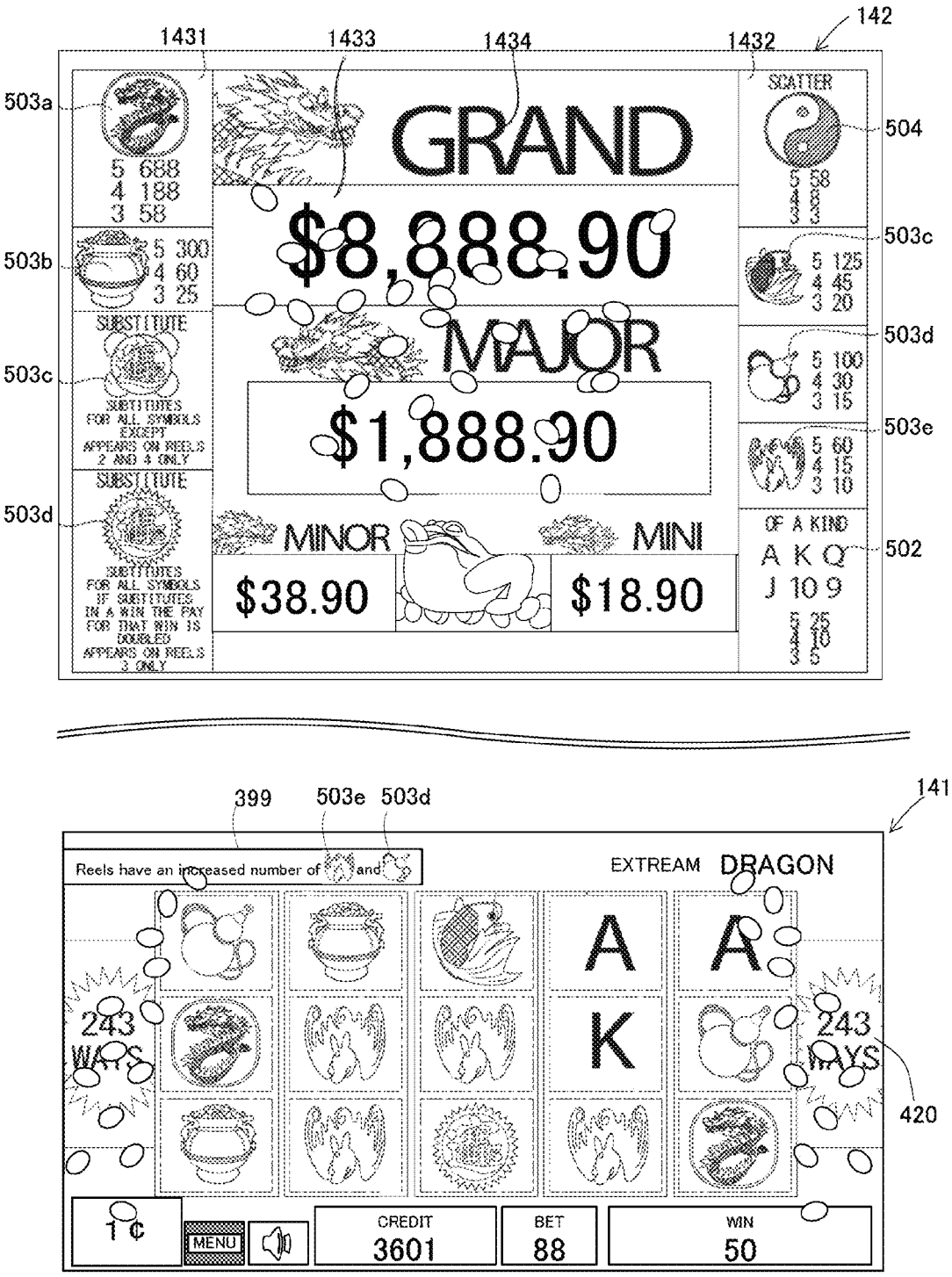
FIG. 90 is an explanatory diagram illustrating one example of display screens on the lower image display panel and the middle image display panel.
Figure 91:
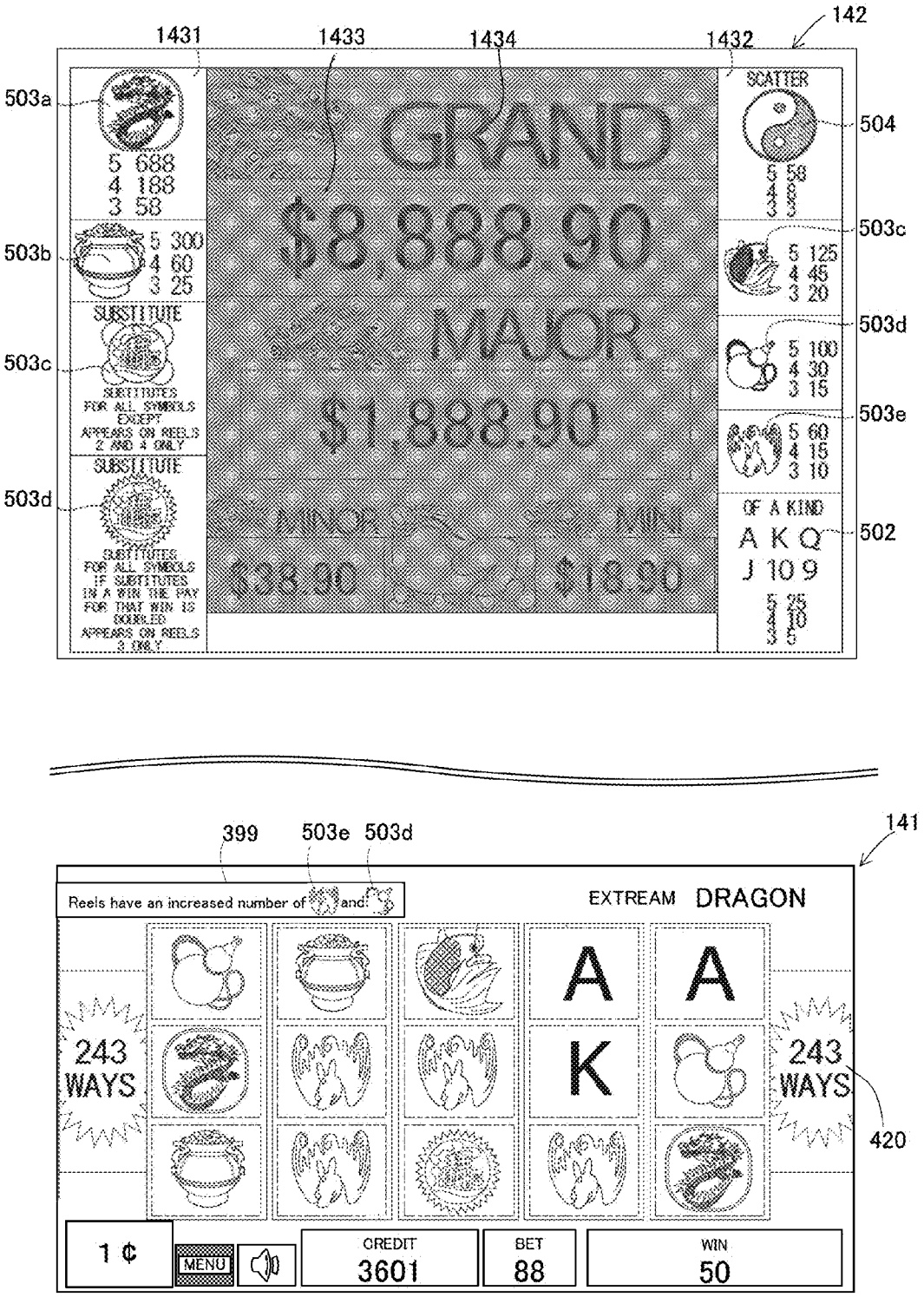
FIG. 91 is an explanatory diagram illustrating one example of display screens on the lower image display panel and the middle image display panel.

For example, in the bonus/free counter/message area 399, a message "Reals have an increased number" and a BAT symbol 503*e* and a GOURD symbol 503*d* whose numbers are increased are moving together from left to right and as shown in FIG. 90, all of the message and symbols are stopped after the displaying and are displayed in a blinking manner.

Thereafter, display presentation in association with the addition of the special symbols is executed. Executed is the display presentation in which a frog displayed on a lower side of a central portion of the middle image display panel 142 croaks at several times while opening and closing the mouth. The croaking sound is outputted from a speaker device. Concurrently, symbol arrays 170 in a symbol display area 150 of the lower image display panel 141 are displayed in a varying manner and thereafter, symbols 501 to 504 are rearranged in the symbol display area 150 of the lower image display panel 141. At this time, in association with the increase in the bet number, which is made by selecting either of the above-mentioned two credit buttons 43 and 44, percentages of the numbers of special symbols 503 and 504 to the number of all symbols 501 in the plurality of symbol arrays 170 are increased, as compared with percentages thereof in a base game. In the present embodiment, the numbers of BAT symbols 503*e* and GOURD symbols 503*d* are increased as indicated in the bonus/free counter/message area 399.

Upon the rearrangement of the symbols 501 to 504 in the symbol display area 150 of the lower image display panel 141, as shown in FIG. 90, executed is display presentation in which a plurality of coins 446 are falling down from an upper portion of the middle image display panel 142 together with outputting of sound effects and a plurality of coins 445 are falling down from an upper portion of the lower image display panel 141 toward portions on both right and left sides thereof together with the outputting of sound effects, with the symbol arrays sandwiched between the falling down coins 445 on the right and left sides. Further, in the payout tables, among the plurality of kinds of payout tables displayed in the first payout table 1431 and the second payout table 1432, the payout tables of the BAT symbols 503*e* and the GOURD symbols 503*d* as the special symbols whose numbers are increased are blinking. Accordingly, the cells 28 of the symbol display area 150, which include the BAT symbols 503*e* and the GOURD symbols 503*d* whose numbers are increased in accordance with the bet number, the bonus/free counter/message area 399, and the payout tables are concurrently blinking.

(Modification Example of Display Control Process in Bonus Game)

(1) Although in the above-described embodiment, the gray layer is superimposed on the whole of the display part 142 at S1070 in the flowchart shown in FIG. 1, the present invention may be embodied as described below. For example, the gray layer superimposed on character areas (rank names and payout amounts) of the bonus ranks to indicate the deactivation with which the payouts cannot be obtained is removed, and all of the bonus ranks displayed in the display part 142 may be set to be in a normal state (first display state) which is a lighting-up state (activated state).

In this configuration, all of the bonus ranks displayed in the display part 142 are activated, and a player is likely to obtain each of the payouts of all of the bonus ranks. Accordingly, a player playing a game or other player deems that a high amount of a bonus payout is likely to be obtained on said gaming machine and continues to play the game or newly starts a game. Accordingly, an operation rate of said gaming machine is enhanced.

However, the present invention does not exclude that in the standby state which is a non-play state, all of the bonus ranks displayed in the display part 142 are displayed in the state in which it is difficult to visually recognize all of the bonus ranks.

(2) The display modification in the display part 142 at S1070 in the flowchart shown in FIG. 1 in the above-described embodiment may be configured as described below. For example, the total area of the display area or display areas in the first state, which are activated so as to indicate that each of the payouts is likely to be obtained, and the total area of the display area or display areas in the second state, which are deactivated so as not to indicate that each of the payouts cannot be obtained, are compared, and in consideration of faster rendering processing and a smaller processing load, the superimposition of the gray layer may be conducted for the display area or display areas in either of the first state and the second state.

For example, when among the four kinds of bonus ranks, only MINI whose payout amount is minimum is displayed in the first state and is activated, the total area displaying MINI is smaller than the total area of the display areas of the other bonus ranks which are deactivated. Therefore, the gray layer is superimposed in the display area of said MINI. Alternatively, when only GRAND whose payout amount is maximum is displayed in the second state and is deactivated, the total area of the display area of said GRAND is smaller than the total area of the display area of the three kinds of the other bonus ranks. Therefore, the gray layer superimposed in the display area of said GRAND may be removed.

In addition, as another embodiment, an illuminance surrounding said slot machine 10 is detected by an illuminance sensor, the detected illuminance is compared with a reference value of a predetermined illuminance, all of the display areas of the bonus ranks on the display part 142 are modified to be in either of the first state or the second state such that the illuminance surrounding said slot machine 10 approaches the reference value, and in addition thereto, a luminance is adjusted. Here, the reference value of the illuminance is appropriately set, for example, to a degree that staff and customers in a hall in which the slot machines 10 are installed easily recognize the surrounding situation.

By employing the above-described configuration, since an intensity of light irradiated from the whole apparatus by LEDs used for decoration and the like is heightened, luminances of liquid crystal display devices are appropriately reduced and the illuminance surrounding the slot machine 10 is thereby adjusted, thus allowing a power consumption of the slot machine 10 to be reduced. Accordingly, the power consumption of the slot machine 10 is reduced, thereby a profit of an administrator of the slot machines 10 to be enhanced.

It is to be noted that this specification also discloses the invention of a gaming machine as described below.

(Outline of Configuration of Gaming Machine)

Although in the above-described embodiment, as the gaming machine, the slot machine 10 is exemplified, the present invention is not limited thereto. For example, the gaming machine according to the present invention may be a communication terminal such as a personal computer, a smartphone, and a tablet in which a game program (application) of the slot machine 10 is installed, thereby allowing a game to be played.

Figure 92:
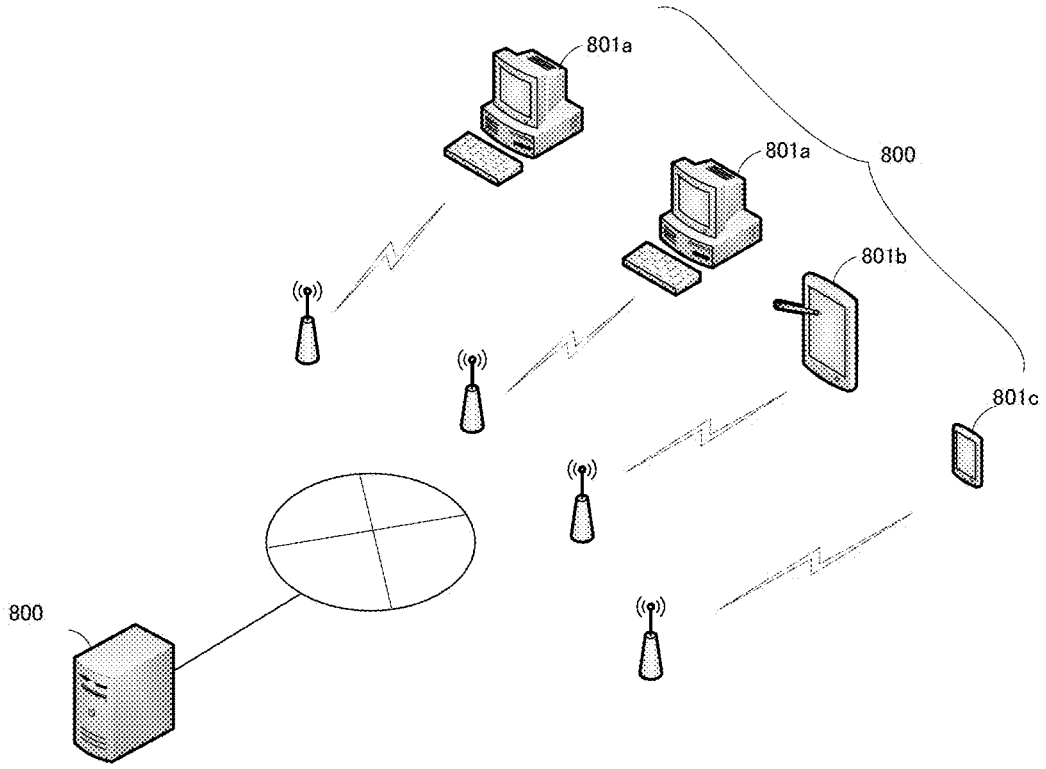
FIG. 92 is an outline configuration diagram illustrating a gaming machine system in a modification example.

In addition, as shown in FIG. 92, the present invention may be a gaming system constructed by connecting communication terminals 801 such as a plurality of personal computers 801*a*, a tablet 801*b*, and a smartphone 801*c* via a network to a server apparatus 800. Hereinafter, a configuration of the gaming system will be described (Configuration of Communication Terminal)

Figure 93:
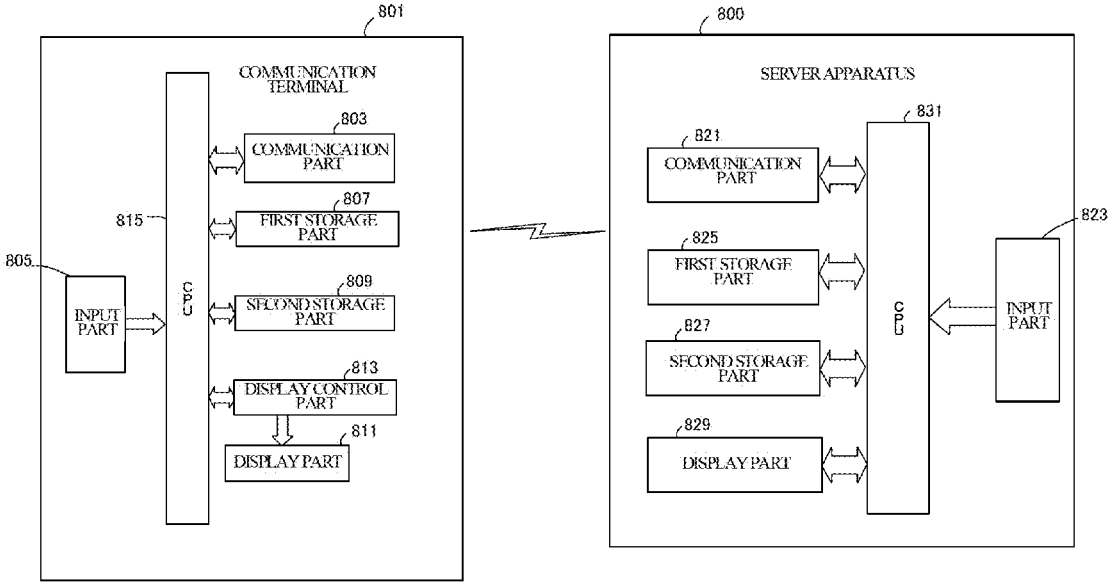
FIG. 93 is a block diagram illustrating the gaming machine system in the modification example.

As shown in FIG. 93, each of the communication terminals 801 includes a communication part 803, an input part 805, a first storage part 807, a second storage part 809, a display part 811, a display control part 813, a control part 815, and the like.

The communication part 803 is a part for communicating with a base station within the network and is constituted of a communication apparatus (for example, a communication module or the like for a wired LAN, a wireless LAN, and a mobile phone communication) for a wired communication and a wireless communication, or the like.

The input part 805 varies depending on a kind of the communication terminal 801. For example, an input part 805 of the personal computer 801*a* is mainly a physical keyboard and a mouse. Since a main body of each of the smartphone 801*c* and the tablet 801*b* has no physical keyboard, a user interface displayed on a liquid crystal touch panel which is the display part 811 functions as an input part. As the input part 805 of the smartphone 801*c* or the like which does not has any keyboard externally connected, a keyboard part displayed in a liquid crystal screen may be uplifted and be formed as a physical keyboard.

The first storage part 807 is constituted of a silicon disk, a hard disk, or the like. In said first storage part 807, an operating system of each of the communication terminals 801, applications of games and the like, pieces of management information required to use the system and the applications such as an ID, a password, and a mail address of an owner of said communication terminal 801 are stored.

In the second storage part 809, the pieces of information (the ID, the password, and the like) inputted from the input part 805 are temporarily stored and the pieces of information read out from the first storage part 807 are also stored.

Figure 94:
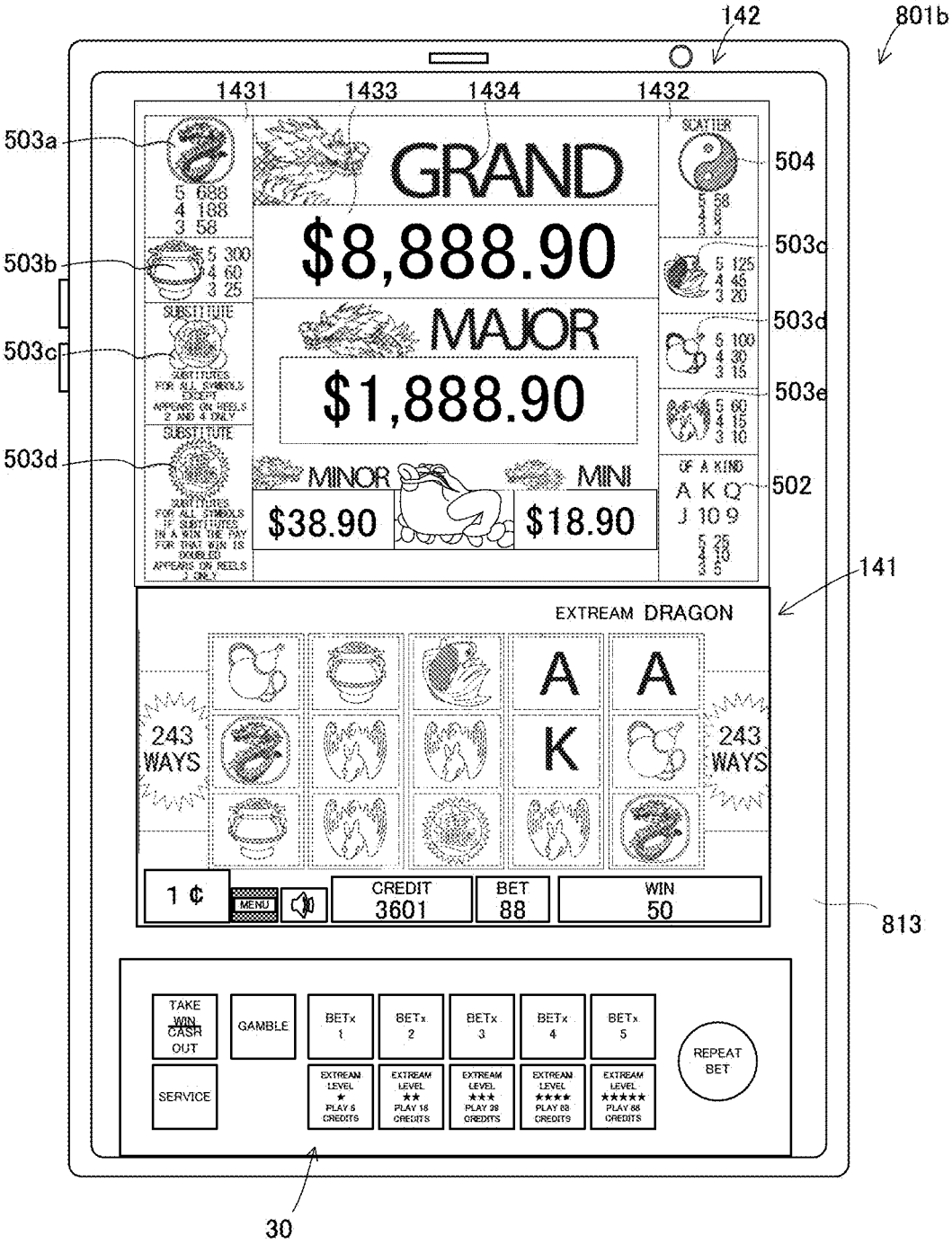
FIG. 94 is an explanatory diagram illustrating one example of display images on a communication terminal in the modification example.
Figure 95:
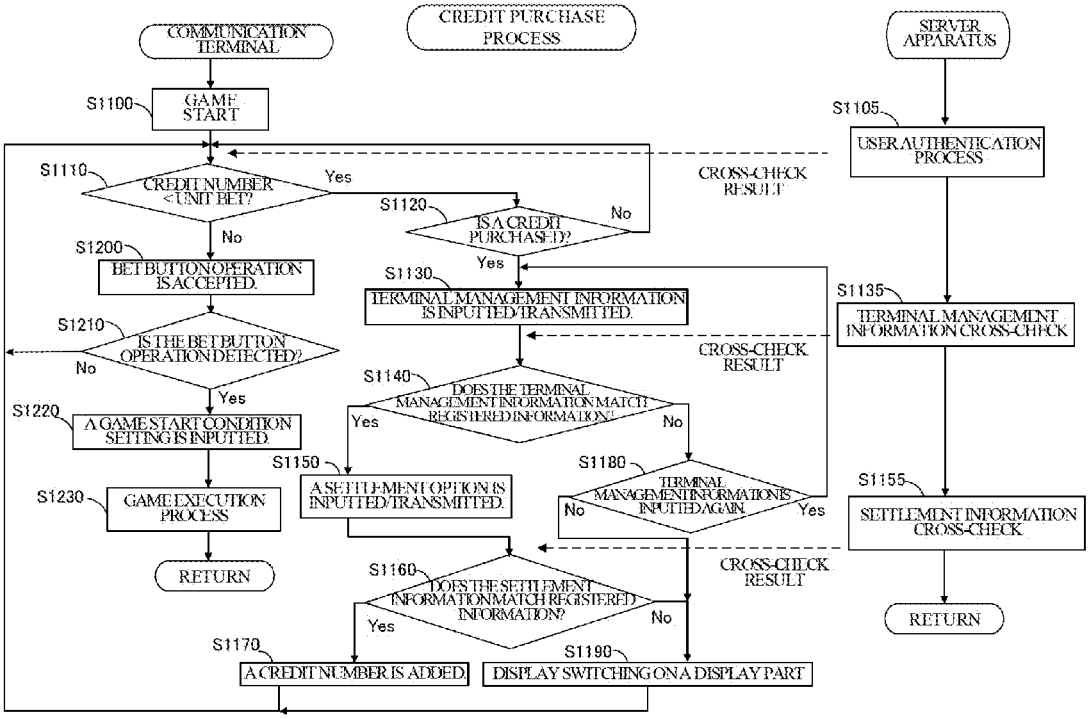
FIG. 95 is a flowchart of a credit purchase process in the modification example.

The display part 811 is constituted of a liquid crystal touch panel, a CRT, or the like. In addition, on the liquid crystal touch panel, as shown in FIG. 94, bonus ranks, symbol arrays, and a control panel 30 are displayed in upper, middle, and lower rows. The bonus ranks in the upper row has the same configuration of display images as the configuration of display images displayed on a middle image display panel 142 of a slot machine 10. In addition, the symbol arrays in the middle row has the same configuration of a display image as the configuration of the display image displayed on a lower image display panel 141 of the slot machine 10. Further, in the lower row, a user interface which has the same configuration of shapes and arrangement of BET buttons, credit buttons, and a SPIN button as the configuration of the slot machine 10 and allows touch-operation is displayed.

The display control part 813 controls image displays on the display 811, display presentation, and the like in accordance with instructions of a CPU which is the control part 815.

The control part 815 comprehensively controls the communication terminal 801 and conducts a variety of processes based on pieces of information transmitted to and received from the server apparatus 800 which is connected via the network through the communication therewith. The specific processes by said control part 815 will be described later.

(Configuration of Server Apparatus)

The server apparatus 800 includes, a communication part 821, an input part 823, a first storage part 825, a second storage part 827, a display part 829, a control part 831, and the like.

The communication part 821 is a part for communicating with a base station within a network and is mainly constituted of a wired LAN which allows large-capacity communication.

The input part 823 is a keyboard externally connected to the server apparatus. It is to be noted that a liquid crystal touch panel may be used as the display part 831, and a user interface displayed on said liquid crystal touch panel may be caused to function as the input part.

The first storage part 825 is constituted of a silicon disk, a hard disk, or the like. In said first storage part 825, an operating system, applications of a plurality of kinds of games and the like for downloading, an ID and a password of an administrator, personal information (management information) of a user who has permitted communication connection with said server apparatus 800 such as an ID, a password, a mail address, a registered name, and the like are stored in a storage table for database.

In the second storage part 827, pieces of information inputted from the input part 823 and an ID and a password of a user connected through the communication are temporarily stored and a variety of pieces of information read out from the first storage part 825 are also stored.

The display part 829 appropriately displays pieces of information such as operating states and maintenance of the server apparatus.

The control part 831 comprehensively controls the server apparatus 800 and conducts a variety of processes based on pieces of information transmitted to and received from each of the communication terminals 801 which is connected via the network through interactive communication. The processes by said control part 831 will be described later.

(Credit Purchase Process)

In the present embodiment, a case where a game application for a slot machine, which allows the same game (including a base game and a bonus game) as that played on the slot machine 10 described in details in the above-described embodiment, is previously installed in a communication terminal 801 will be described as an example. Accordingly, a credit (a virtual currency such as points) purchase process in a case where a credit is less than a unit bet upon determining a condition "credit<unit bet?" in a base game execution process shown in FIG. 41 and a bonus game execution process shown in FIG. 1 will be described.

It is to be noted that in said game application, a credit which is equivalent to a bet amount which can be bet at a predetermined number of times per day is automatically provided. In other words, a free game can be played at up to a predetermined number of times. In addition, upon downloading and installing the game application, by accessing a store on the Internet uploading said application or a home page of a game management company, personal information required to download said application (terminal management information such as an ID, a password, and a mail address for the registration in the communication terminal) is inputted from an input part 805 of the communication terminal 801 and is thereby previously registered.

By clicking an icon of a game displayed on a display part 811 of the communication terminal 801, a game is started (S1100). In association with the start of said game, the management information such as the ID of the communication terminal 801 is automatically transmitted to a server apparatus 800. The server apparatus 800 conducts a cross-check process between the terminal management information transmitted from the communication terminal 801 and terminal management information stored in a first storage part 825 (S1105). The server apparatus 800 transmits a result of the cross-check to the communication terminal 801. When the communication terminal 801 is authenticated, a CPU which is a control part 815 determines whether or not a credit number is less than a unit bet (S1110).

When the credit number is less than the unit bet (S1110: YES), the control part 815 of the communication terminal 801 causes the display part 811 to display a message on whether or not a credit (points) is purchased (S1120). When said credit is purchased (S1120: YES), the previously registered terminal management information such as an ID and a password of an owner of the communication terminal 801 is inputted onto an input screen displayed on the display part 811, and said inputted information is transmitted from said communication terminal 801 to the server apparatus 800 of the game management company (S1130). A control part 831 of said server apparatus 800 executes a cross-check process for the registered information of the owner (S1135).

Based on a result of the cross-check from the server apparatus 800, the control part 815 of the communication terminal 801 executes the next determination process (S1140). When the terminal management information and the registered information match each other (S1140: YES), the communication terminal 801 receives an instruction signal, from the server apparatus 800, which causes an input screen for displaying settlement options and a money amount to be displayed on the communication terminal 801.

When the terminal management information and the registered information do not match each other (S1140: NO), the communication terminal 801 receives an instruction signal, from the server apparatus 800, which causes the display part 811 to display a message on whether the terminal information is inputted again (S1180: YES) or the process is finished (S1180: NO) (S1180).

When the terminal management information and the registered information match each other, on the communication terminal 801, one of the settlement options and a money amount are inputted onto the input screen displayed on the display part 811 and are transmitted therefrom to the server apparatus 800 (S1150). Also upon inputting one of the settlement options, the server apparatus 800 inputs management information such as an ID and a password of a credit card, transmitted from the communication terminal 801, or a pass code of a prepaid card and executes a cross-check process therefor (S1155).

When the information inputted from the input screen of the communication terminal 801 does not match the previously registered information stored in the first storage part 825 of the server apparatus 800 (S1160: NO), in order to reject the acceptance of the credit purchase, the communication terminal 801 receives an instruction signal, from the server apparatus 800, which displays a message of an input error for the inputted information or displays a message on whether or not the purchase process is finished, and a selection button. A user arbitrarily selects said selection button from the display part 811 of the communication terminal 801, whereby the control part 815 switches the display part 811 to either of an initial screen displayed upon staring the game or a credit purchase screen to be displayed (S1190).

When the credit purchase is authorized by the server apparatus 800 (S1160: YES), a credit is added to a value stored in a second storage part 809 of the communication terminal 801 (S1170), processes for executing a base game or a bonus game at S1200 to S1230 is executed. It is to be noted that as the processes at S1200 to S1230, the process at S12 and the subsequent steps shown in FIG. 41 and the process at S1062 and the subsequent steps shown in FIG. 1 are appropriately executed. It is to be noted that results occurring during the game are consecutively transmitted from the communication terminal 801 to the server apparatus 800, and the control part 831 of the server apparatus 800 is monitoring the states of the communication terminal 801 during the game.

(Display Control Process of Bonus Ranks in Gaming System)

Figure 96:
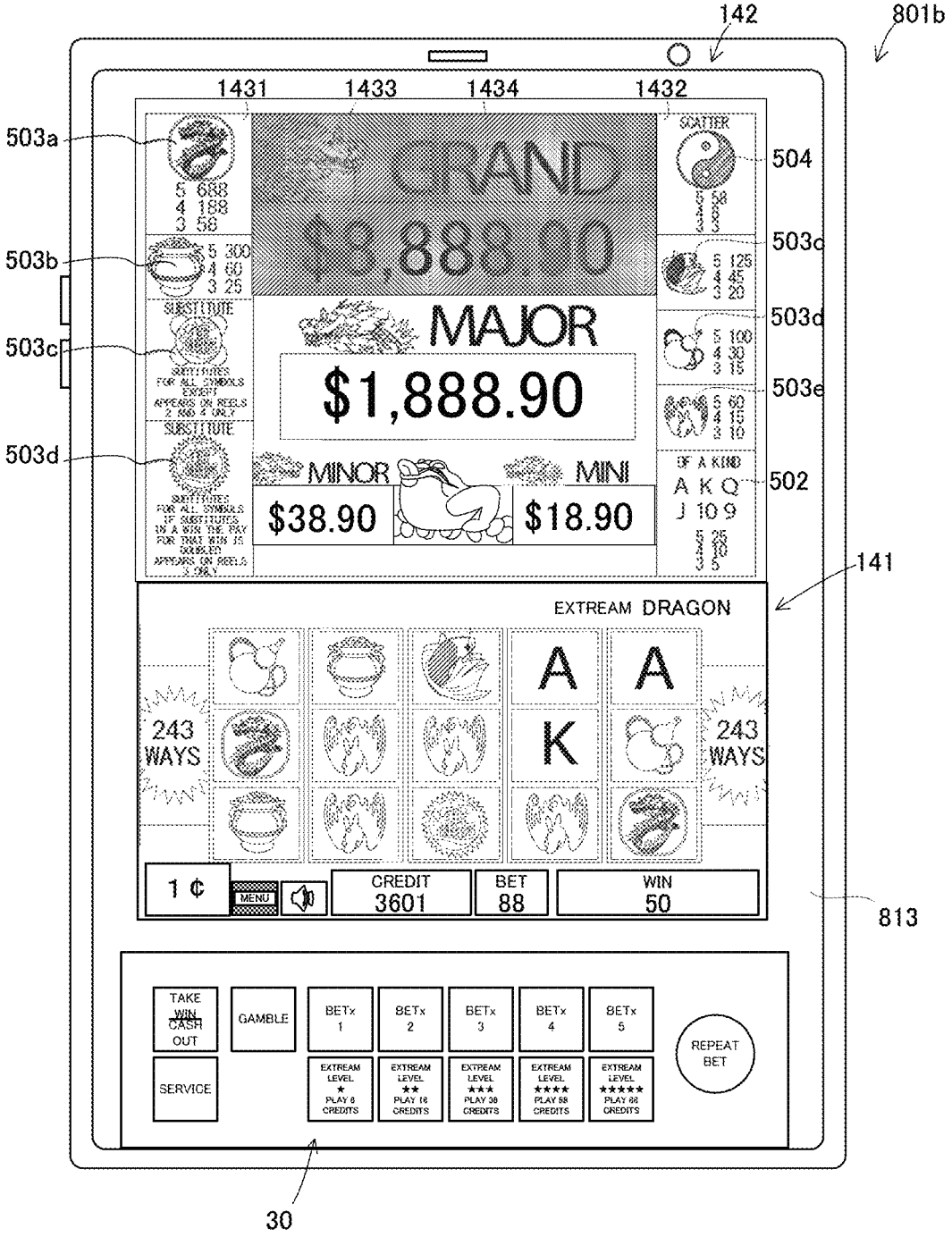
FIG. 96 is an explanatory diagram illustrating one example of display images on the communication terminal in the modification example.

Display control in said communication terminal 801 is the same as that in the above-described slot machine 10. For example, as shown in FIG. 96, in a base game, a rank/ranks which is/are activated and whose payout/payouts is/are likely to be obtained is/are displayed in a normal display (lighting-up display) state which is a first state and a rank/ranks which is/are deactivated and whose payout/payouts cannot be obtained is/are displayed in a second state in which a gray layer is superimposed on the deactivated rank/ranks.

Figure 97:
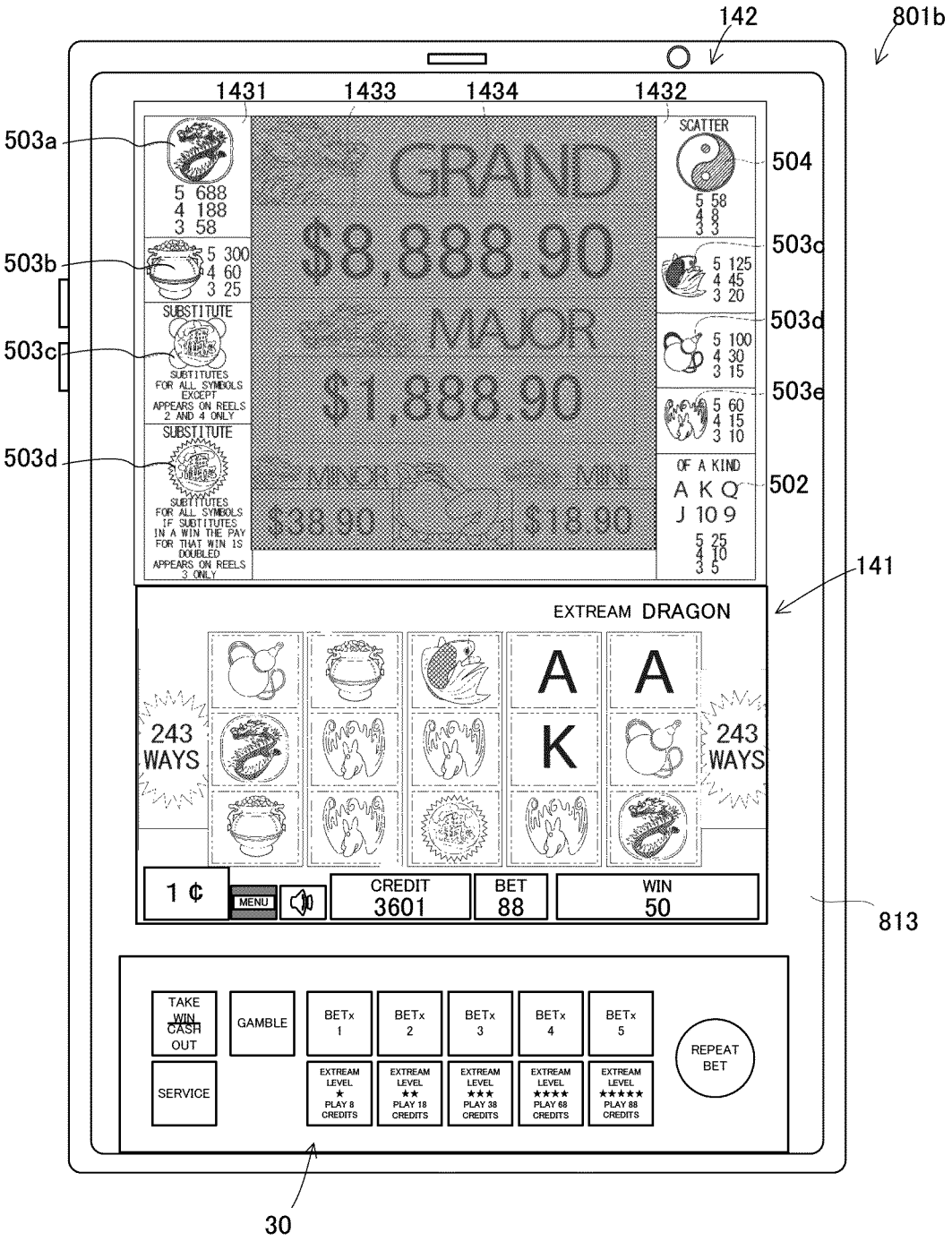
FIG. 97 is an explanatory diagram illustrating one example of display images on the communication terminal in the modification example.

In addition, when a credit number becomes less than a unit bet number and a credit is not purchased within a predetermined time period, as shown in FIG. 97, the gray layer is superimposed on all of the bonus ranks. This configuration is opposite to the above-described configuration of the display control in the slot machine. However, in particular, as in this gaming system, when a game is played by using a mobile terminal 801 which a player has, a standby state display has little effect for inducing the next player. Therefore, this configuration is made opposite to the above-described configuration of the display control in the slot machine. In addition, when the credit number becomes less than the unit bet, the display may be controlled by a CPU 815 as a control part of the gaming system such that all of the bonus ranks are activated and the gray layer is not superimposed.

In the above-described gaming system, no game program may be installed in the communication terminal 801 and the game program may be downloaded from a server apparatus 800 to the communication terminal 801 each time a game is started after authenticating the ID and the like. The game is played and drawing results during playing the game and display presentation data may be appropriately transmitted from the server apparatus 800 to the communication terminal.

In addition, in the above-description in details, in order to facilitate understanding of the present invention, the features are mainly described. The present invention is not limited to the embodiments described above in details and is applicable to other embodiment, and a scope of application thereof is diverse. In addition, the terms and wording used in the present specification are used to accurately describe the present invention and are not used to limit the interpretation of the present invention. In addition, from the concept of the invention described in the present specification, it is considered to be easy for a person skilled in the art to arrive at other configuration, a system, a method, and the like embraced within the concept of the present invention. Accordingly, in the description in the appended claims, an equivalent constitution must be taken to be embraced within the scope not departing from the scope of a technical idea of the present invention. In addition, the purpose of the abstract is to make it possible that the Patent Office, general public institutions, and technical personnel and the like who do not have a thorough knowledge of patents, legal terms, or technical terms and are involved in the technical field that the present invention pertains can make prompt determination by conducting a simple search on the technical contents and essence of the present application. Accordingly, it is not intended that the abstract limits the scope of the invention which should be evaluated by the description in the scope of claims. In addition, in order to sufficiently understand the object of the present invention and the particular effects of the present invention, it is desirable that the present invention is interpreted by sufficiently taking into consideration the documents and the like which have already been disclosed.

In the above description in details, processes executed by a computer are included. The above description and expressions are given for the purpose of allowing a person skilled in the art to most efficiently understand the prevent invention. In the present specification, each step used to derive one result should be understood as a process which is not self contradictory. In addition, at each step, transmission and reception of an electrical or magnetic signal and recoding thereof are conducted. In a process at each step, such a signal is represented by bits, a value, a symbol, characters, a term, a numeral, and the like. However, it should be kept in mind that these are used simply because they are convenient to facilitate understanding. In addition, there may be a case when a process at each step is described with expressions which are common to those describing human behavior. In principle, however, each process described in the present specification is executed by a variety of devices. In addition, other configuration required to execute each step is made obvious by the above description.

REFERENCE SIGNS LIST

10 slot machine
30 control panel
69 touch panel
141 lower image display panel
142 middle image display panel
200 center controller
300 gaming machine
501 symbols

What is claimed is:

1. A gaming machine comprising:

a display part for displaying a plurality of awards in a first state and a second state, payouts of the plurality of awards being different from one another;

a storage part for storing a deposited bet amount, the deposited bet amount being allowed to be bet in accordance with a previously inputted game value; and a controller for subtracting a bet amount placed for a unit game from the deposited bet amount stored in the storage part and for displaying the awards having the different payouts in the first state and in the second state in accordance with the placed bet amount, the first state indicating activation that makes any of the awards obtainable, the second state indicating deactivation that makes the awards unobtainable, the controller determining that a game state is a non-play state when with reference to the storage part, the deposited bet amount stored in the storage part has reached an amount being less than a unit bet amount being required for a play, the controller comparing display states of all the awards and causing all the awards to be displayed in either of the first state or the second state.

2. The gaming machine according to claim 1, wherein when the game state is determined to be the non-play state, the controller controls the display part to display the awards displayed on the display part in the first state.

3. The gaming machine according to claim 1, wherein when the game state is determined to be the non-play state, the controller controls the display part to display the awards displayed on the display part in the second state.

4. The gaming machine according to claim 1, comprising a game value acceptance part for accepting the game value, wherein when the game value acceptance part has accepted the game value, the controller returns the display part to be in a display mode at a point in time when the game state is determined to be the non-play state.

* * * * *